US010926852B2

(12) United States Patent
Kramer

(10) Patent No.: US 10,926,852 B2
(45) Date of Patent: Feb. 23, 2021

(54) PERSONAL WATERCRAFT

(71) Applicant: James F. Kramer, Foster City, CA (US)

(72) Inventor: James F. Kramer, Foster City, CA (US)

( * ) Notice: Subject to any disclaimer, the term of this patent is extended or adjusted under 35 U.S.C. 154(b) by 0 days.

(21) Appl. No.: 16/185,005

(22) Filed: Nov. 8, 2018

(65) Prior Publication Data

US 2019/0308709 A1 Oct. 10, 2019

Related U.S. Application Data

(60) Provisional application No. 62/582,948, filed on Nov. 8, 2017.

(51) Int. Cl.

| | |
|---|---|
| ***B63H 16/18*** | (2006.01) |
| ***B63H 1/36*** | (2006.01) |
| ***B63H 25/44*** | (2006.01) |
| ***B63H 25/06*** | (2006.01) |
| ***B63B 32/00*** | (2020.01) |

(52) U.S. Cl.

CPC ..... *B63H 16/18* (2013.01); *B63B 32/00* (2020.02); *B63H 1/36* (2013.01); *B63H 25/06* (2013.01); *B63H 25/44* (2013.01)

(58) Field of Classification Search

CPC ..... B63H 16/18; B63H 16/16; B63H 1/36; B63H 25/06; B63H 25/44; B63B 32/00

See application file for complete search history.

(56) References Cited

U.S. PATENT DOCUMENTS

| | | | | |
|---|---|---|---|---|
| 9,051,038 | B1 * | 6/2015 | Herber | B63H 16/20 |
| 10,556,656 | B2 * | 2/2020 | Kuntz | B63H 1/32 |
| 2015/0072576 | A1 * | 3/2015 | Malakiman | B63H 1/36 440/21 |

OTHER PUBLICATIONS

"Pelican Lounger Replacement Parts," PelicanPaddleBoat.com, Aug. 2016.
"DryLin TK-04-assembly," Igus.com, Aug. 2016.
"Rail Guideway System, Flanged Square Slide Unit Linear Motion," VXB (on Amazon.com), Aug. 2016.
"HG Series-Heavy Load Ball Type Linear Guideway," Hiwin, Aug. 2016.
"Bearing Ball Carriage," Thomson, Aug. 2016.
"Hobie Eclipse Parts & Accessories," Hobie Cat Company, Aug. 2016.

* cited by examiner

*Primary Examiner* — Stephen P Avila

(57) ABSTRACT

A personal watercraft includes a floatation member, a thrust assembly, a steering assembly, and a braking assembly. The assemblies may be actuated either mechanically or electrically. The thrust assembly is human powered, solar powered, or electric powered. The thrust, steering, and braking assemblies can be added after-market to an existing stand-up paddle board (SUP), or built into one or a plurality of SUPs during initial manufacturing. When the thrust assembly is human powered, it is leg or arm powered. When the thrust assembly is leg powered, the legs can move backward and forward in a sliding motion, up and down in a stomping fashion, or move in a loop trajectory. When the thrust assembly is arm powered, the arms can move forward/backward together or separately. The thrust assembly includes one or a plurality of paddles or flippers that are positioned to the side or under the SUP.

20 Claims, 77 Drawing Sheets

1402
1400
1401
1408
1407
1404
1406
1405
1403
1409
1417
1416
1415
1414
1412
1411
1410
1413

1423
1424
1422
1421
1420
1419
1418
1414
1415
1413

1502
1504
1503
1506
1507
1505
1510
1511
1518
1513
1514
1500
1501
1519
1520
1517
1516
1509
1508
1515
1512

1631
1620
1621
1603
1605
1615
1614
1600
1601
1632
1622
1633
1623
1624
1634
1625
1627
1630
1604
1613
1606
1607
1608
1618
1616
1617
1609
1610
1602
1612
1611
1619
1626
1629
1628

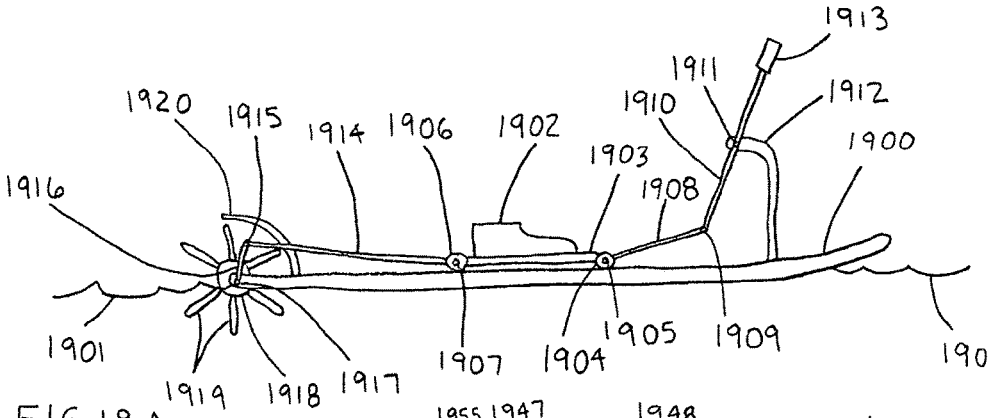
FIG. 19 A
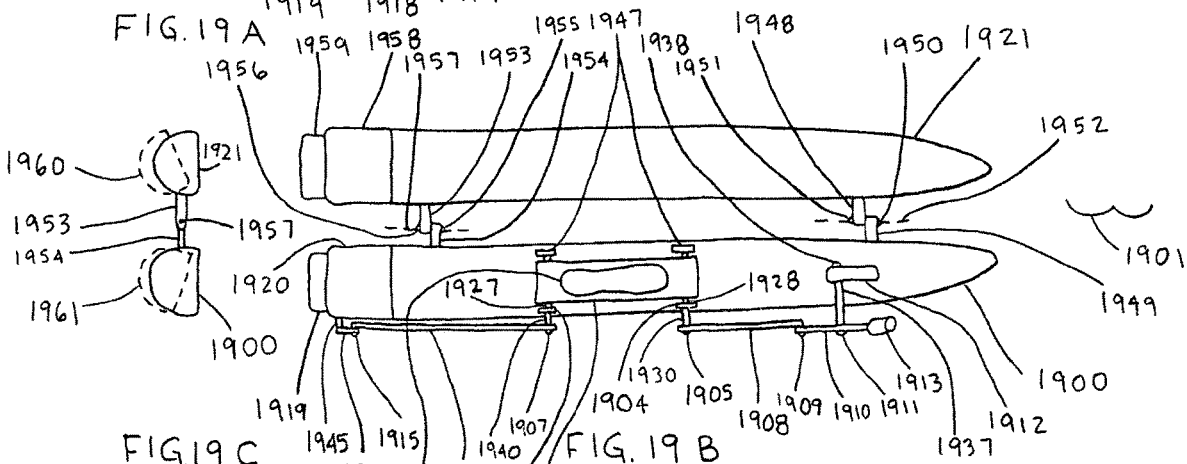
FIG. 19 C
FIG. 19 B
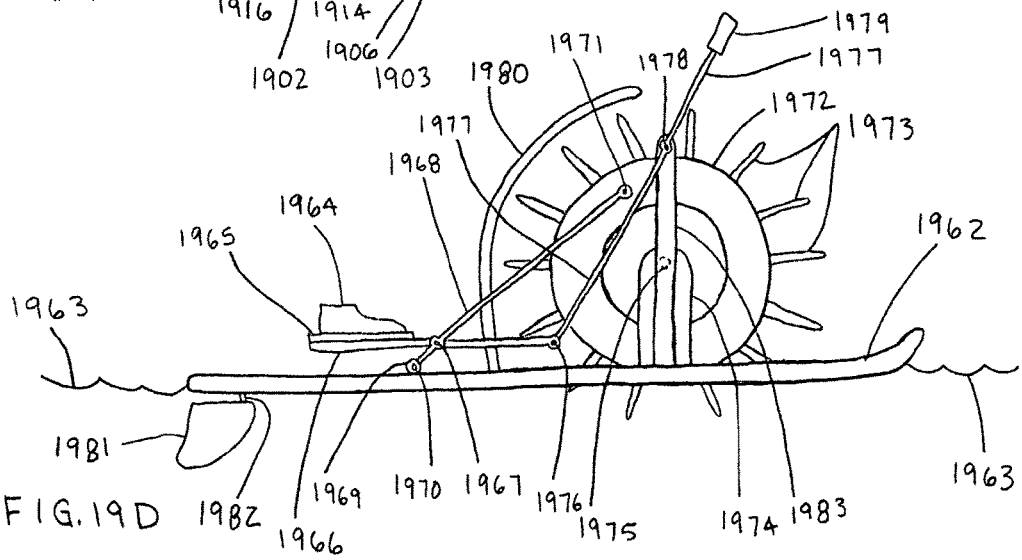
FIG. 19 D

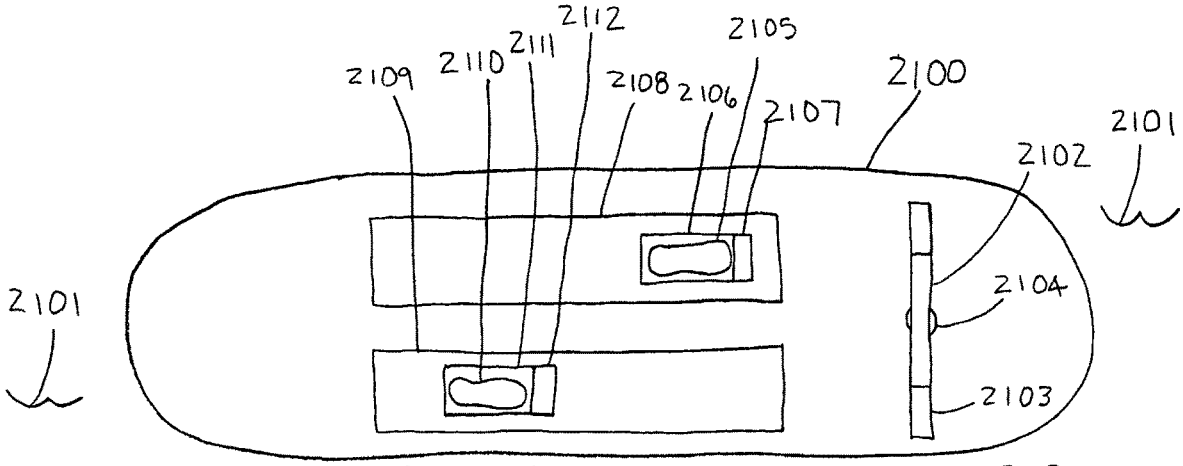
FIG. 21A
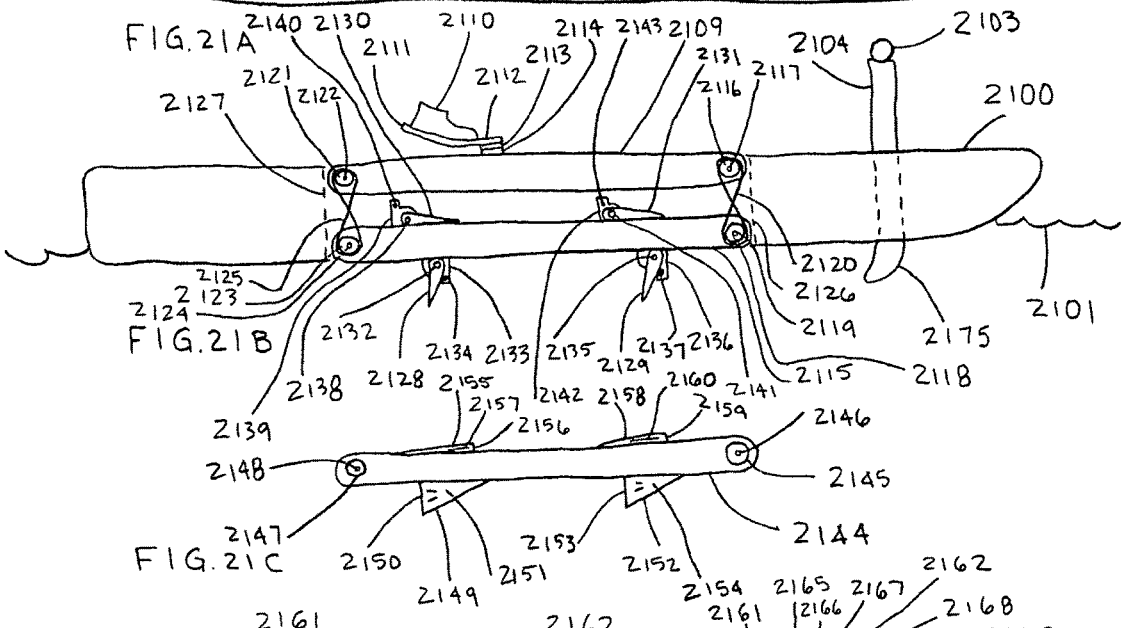
FIG. 21B
FIG. 21C
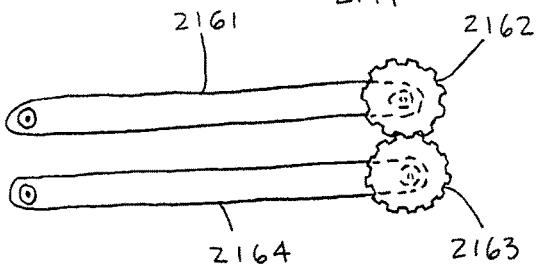
FIG. 21D
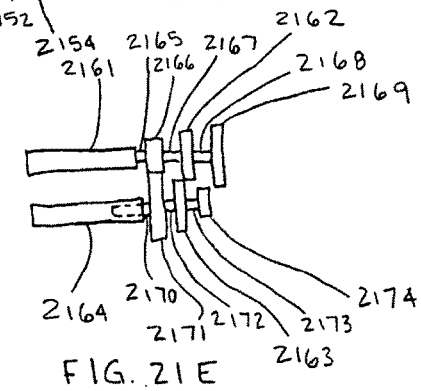
FIG. 21E

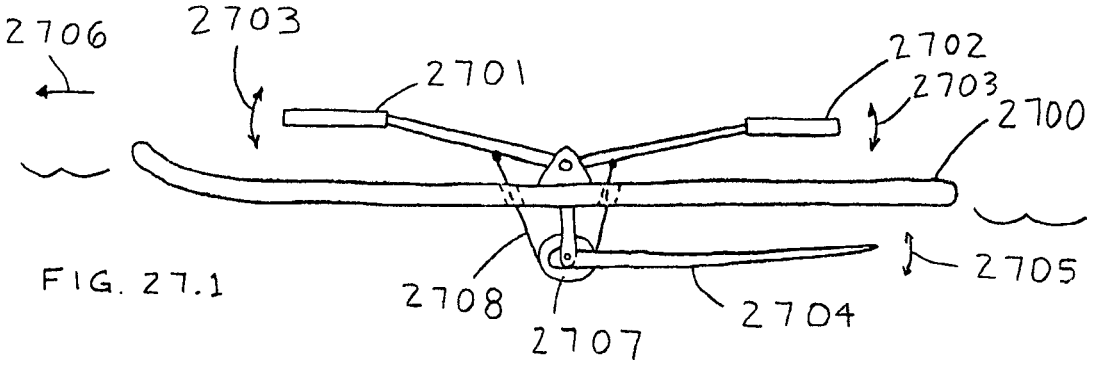
FIG. 27.1
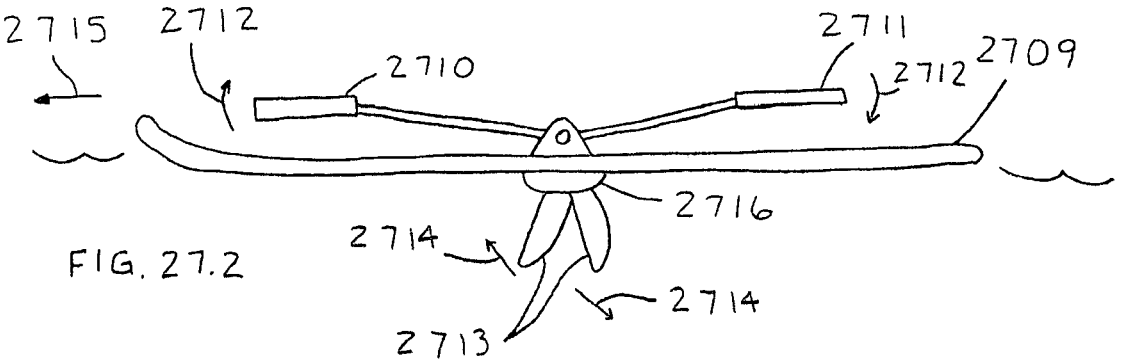
FIG. 27.2
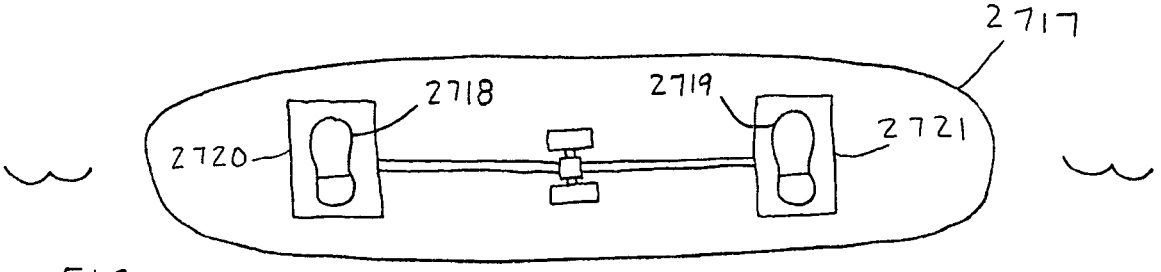
FIG. 27.3a
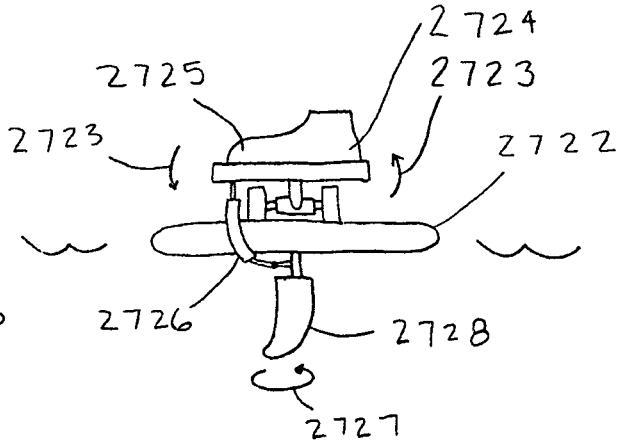
FIG. 27.3b

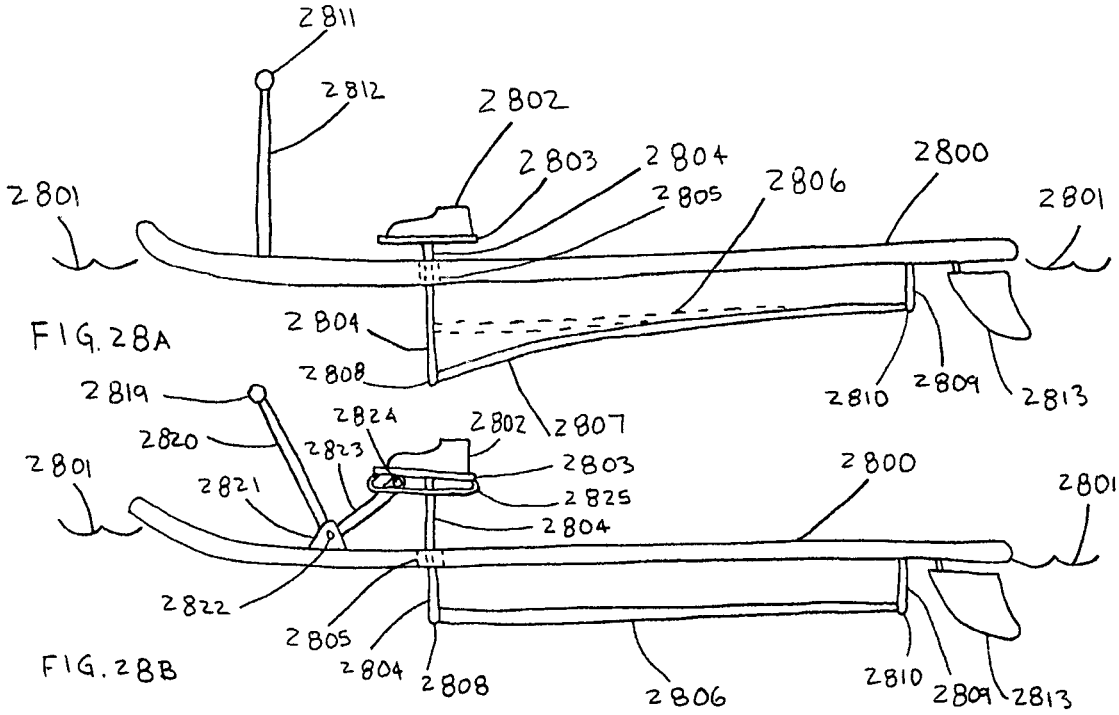
FIG. 28A
FIG. 28B
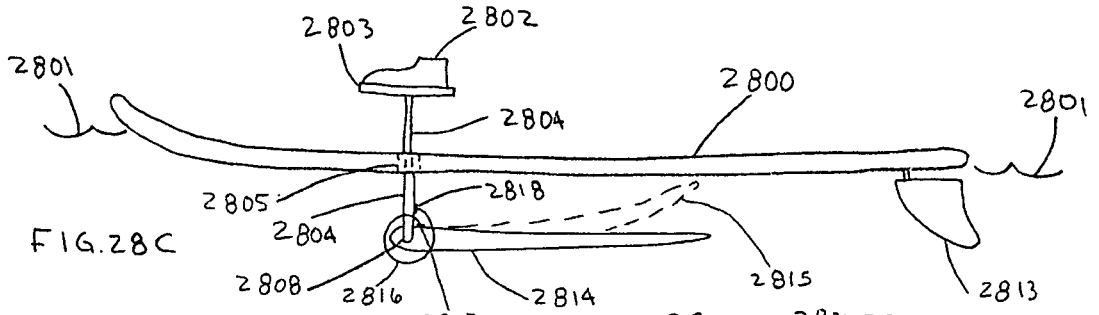
FIG. 28C
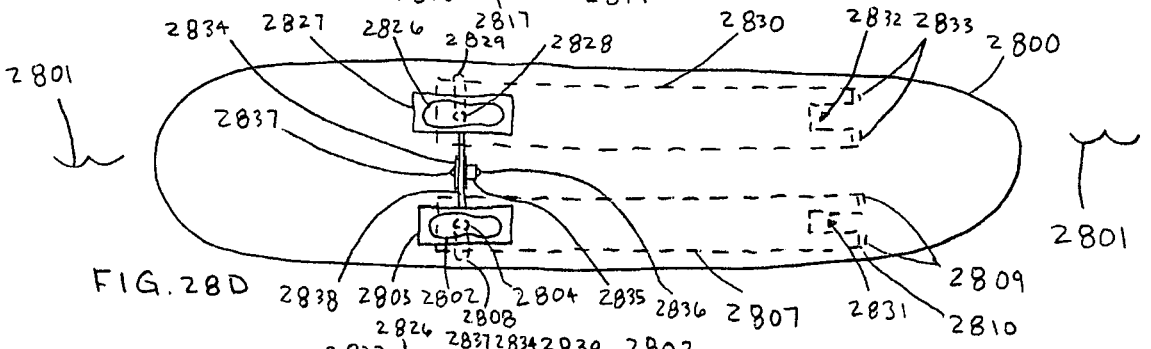
FIG. 28D
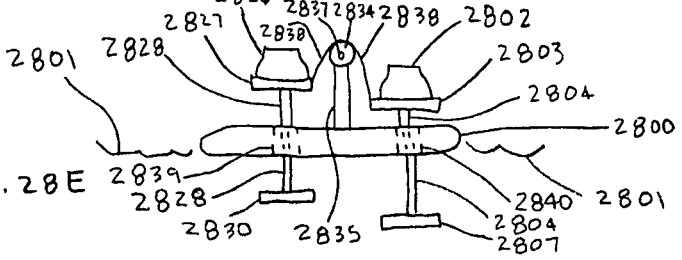
FIG. 28E

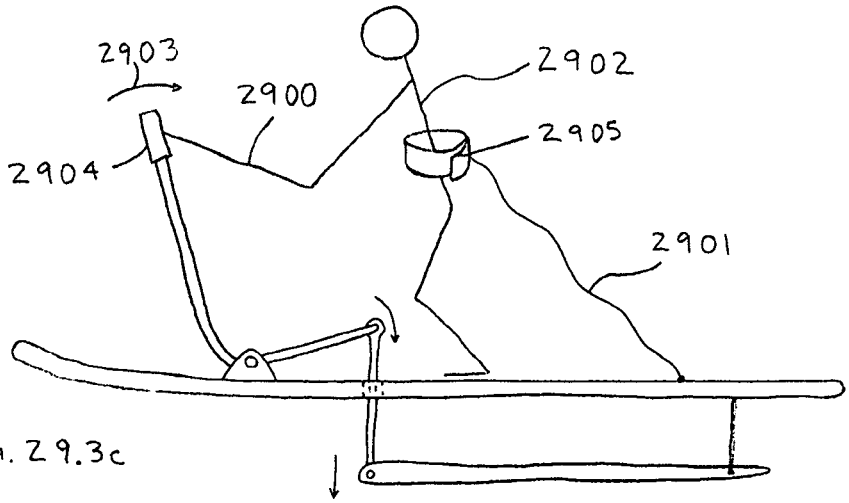
FIG. 29.3c
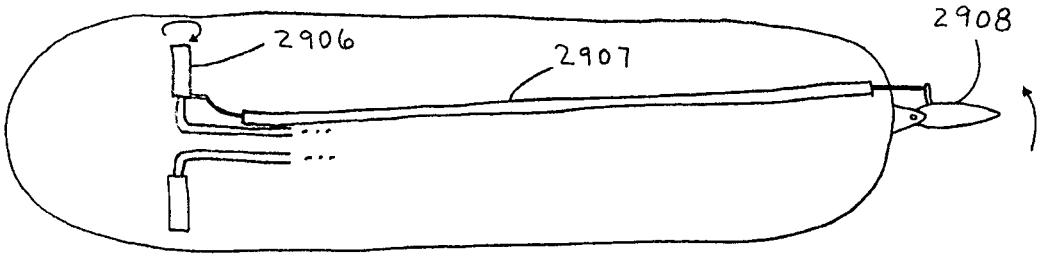
FIG. 29.3d
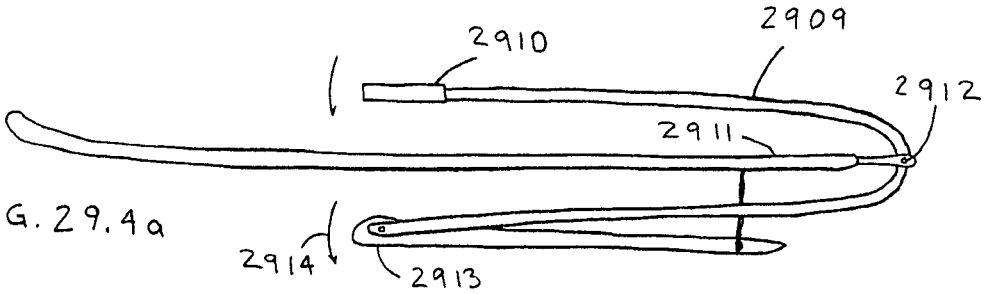
FIG. 29.4a
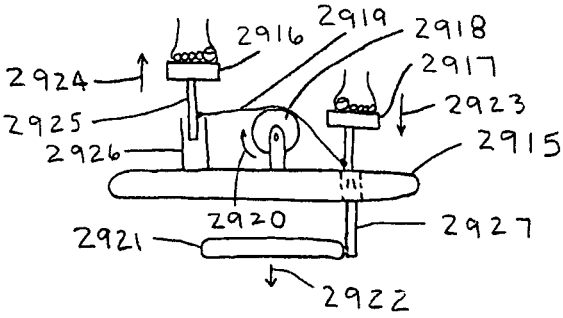
FIG. 29.4b

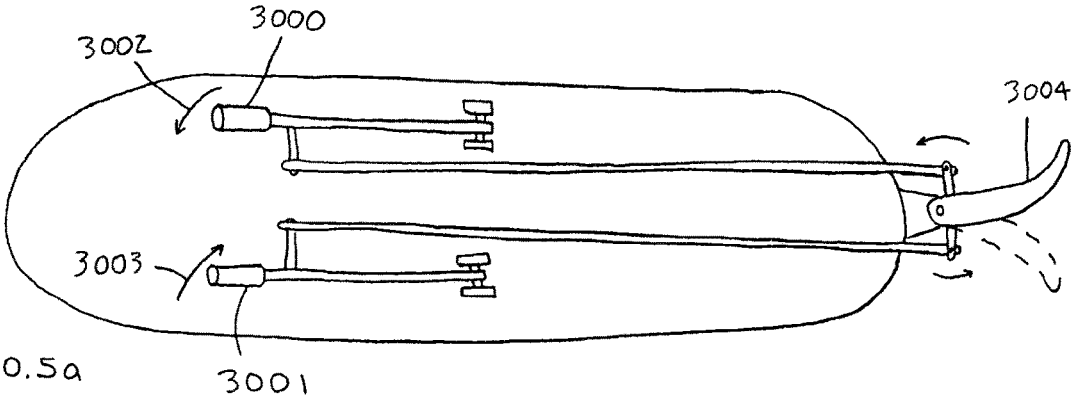
FIG. 30.5a
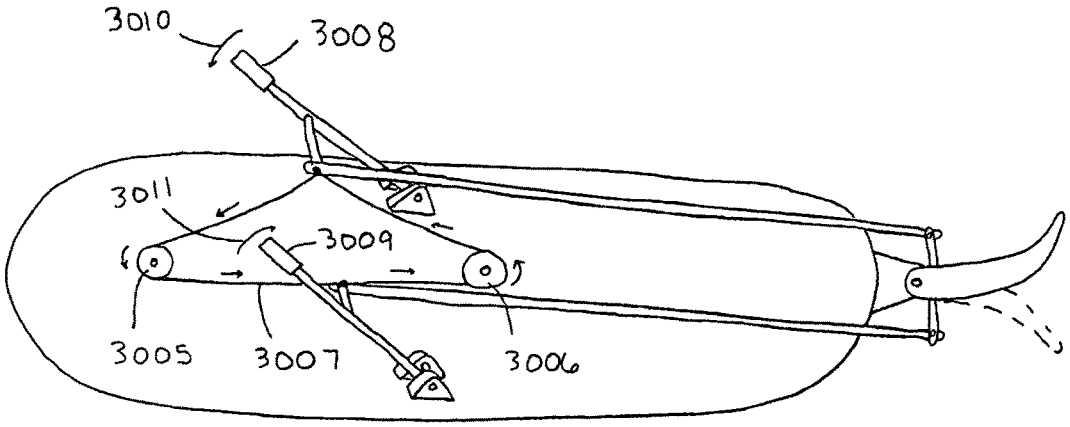
FIG. 30.5b

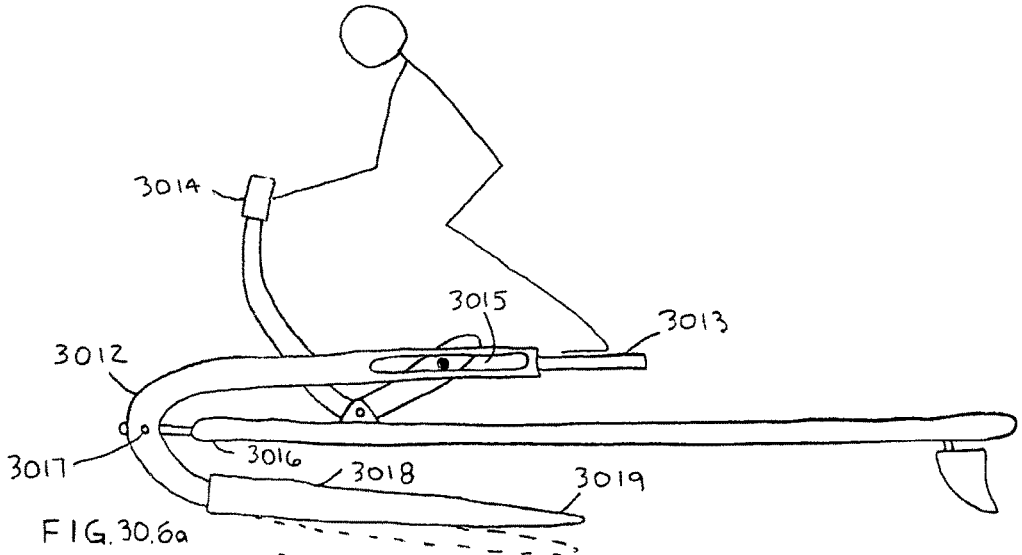
FIG. 30.6a
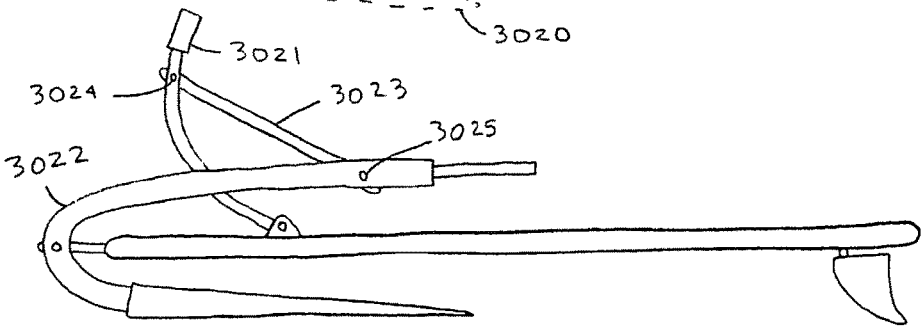
FIG. 30.6b
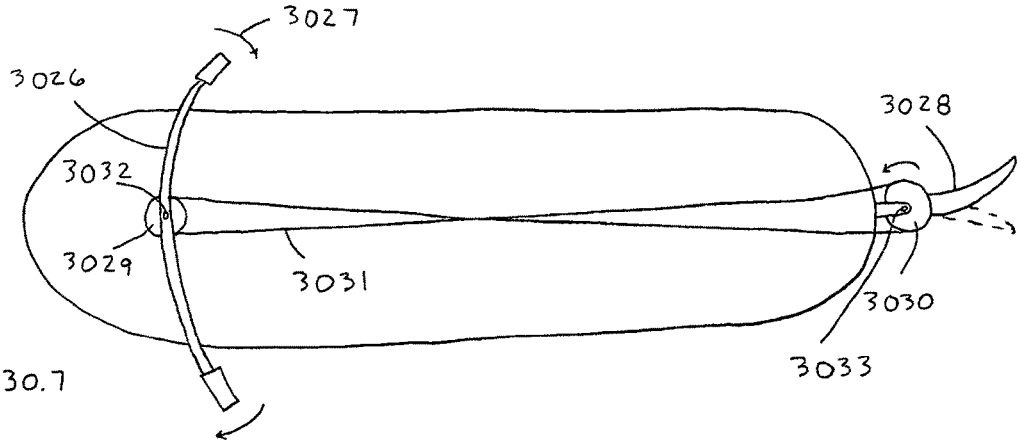
FIG. 30.7

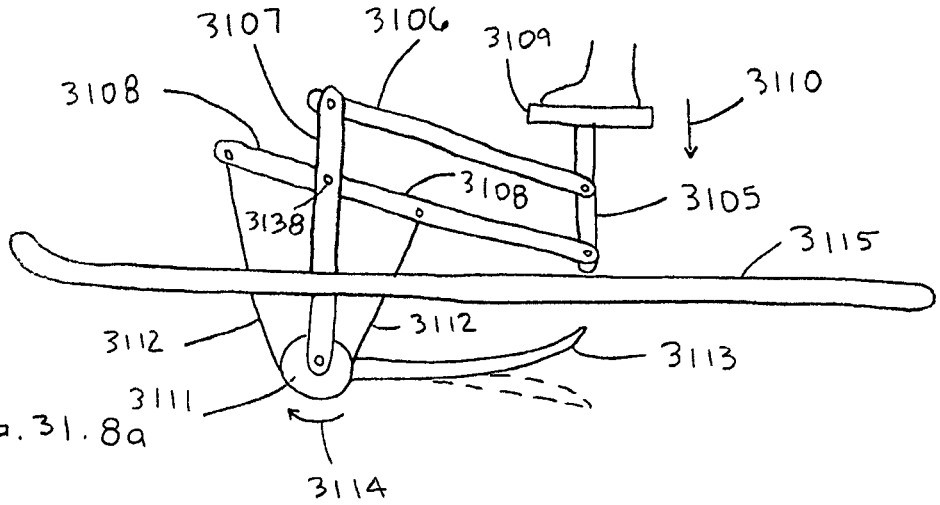
FIG. 31.8a
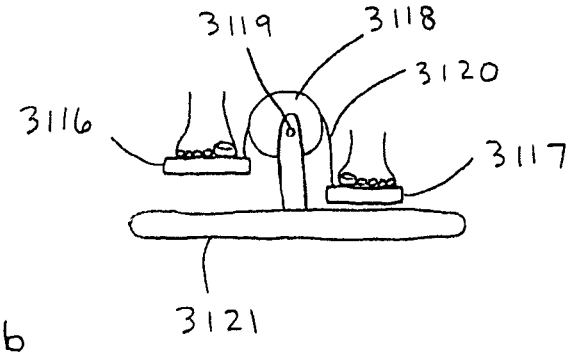
FIG. 31.8b
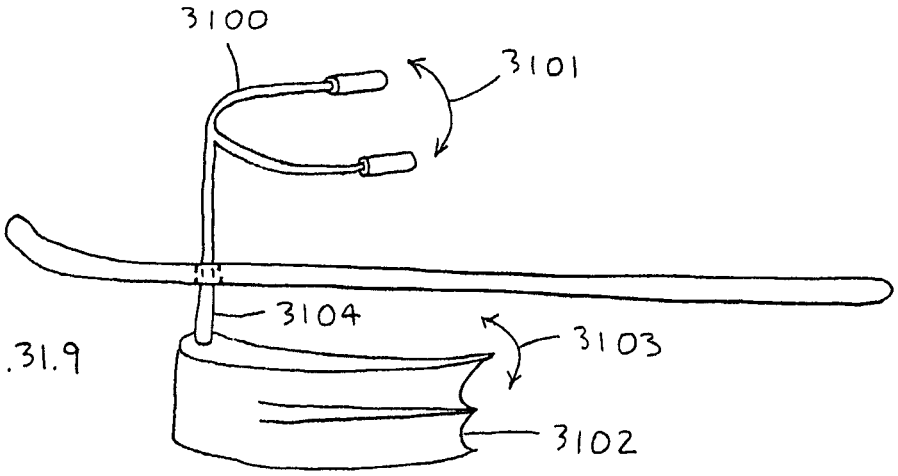
FIG. 31.9

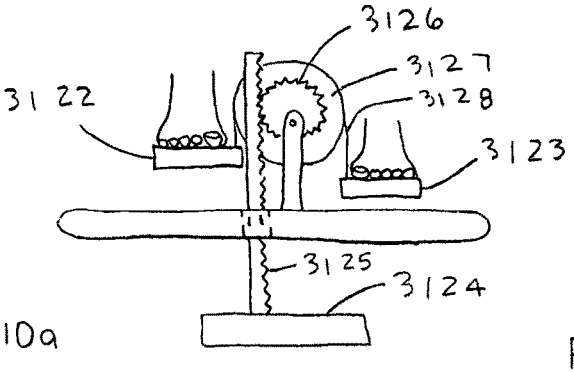
FIG. 31.10a
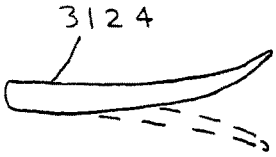
FIG. 31.10b
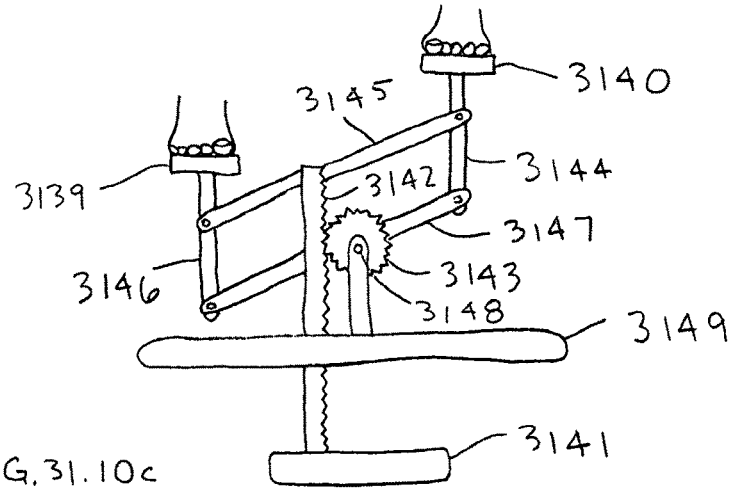
FIG. 31.10c
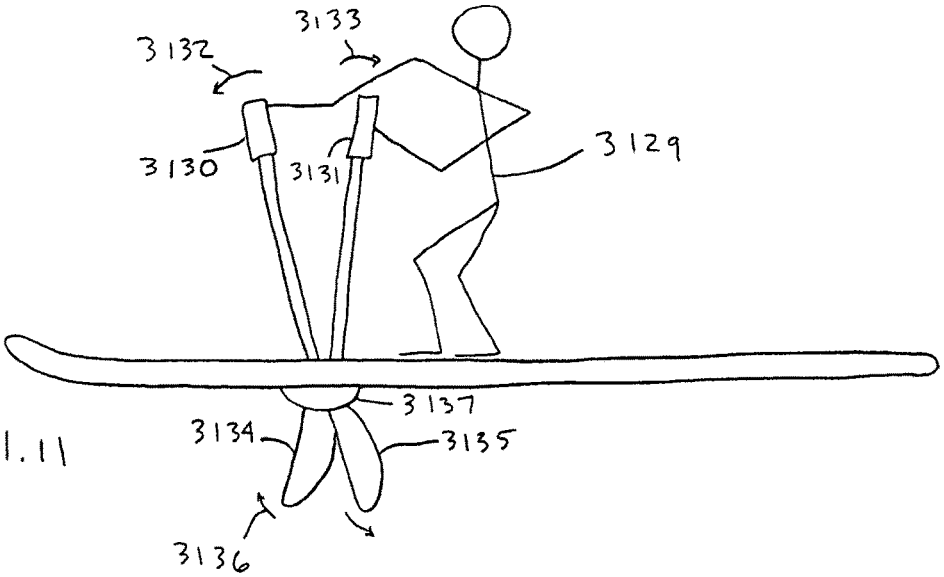
FIG. 31.11

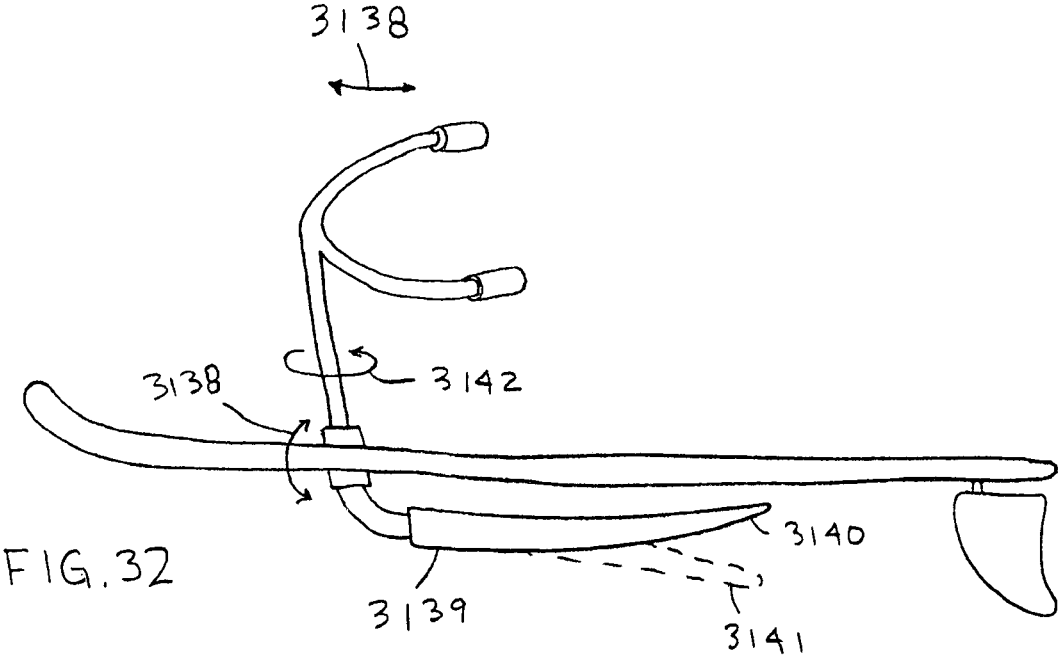
FIG. 32
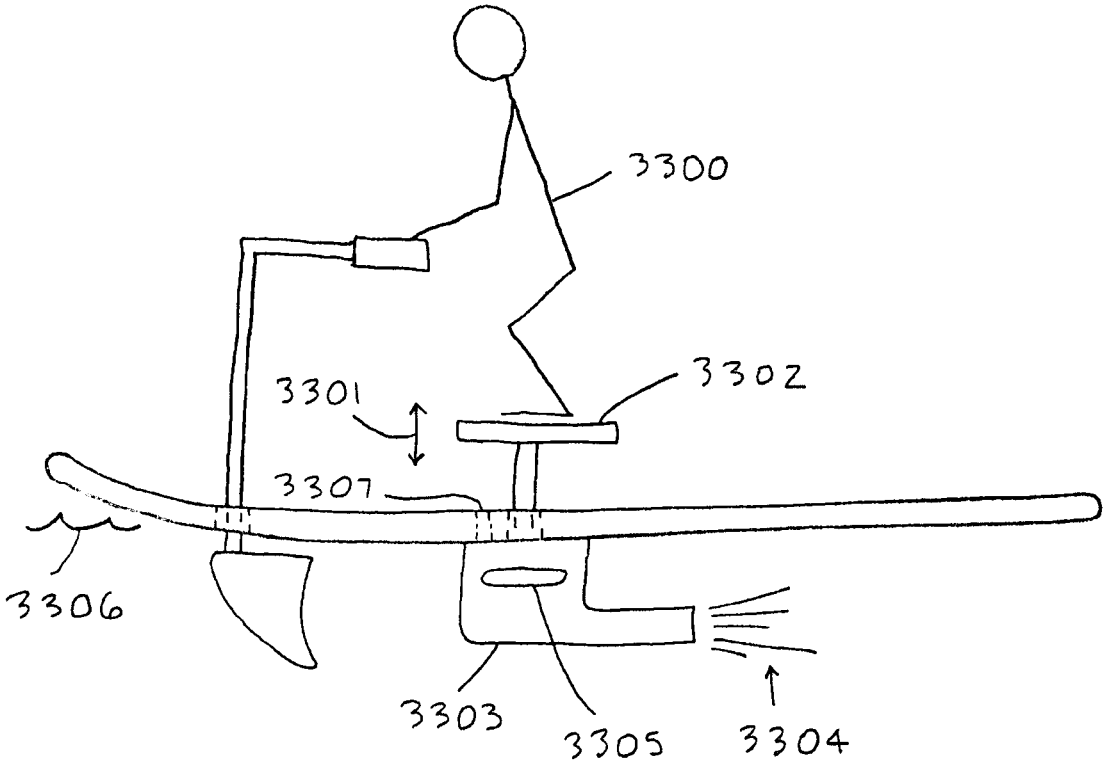
FIG. 33.1

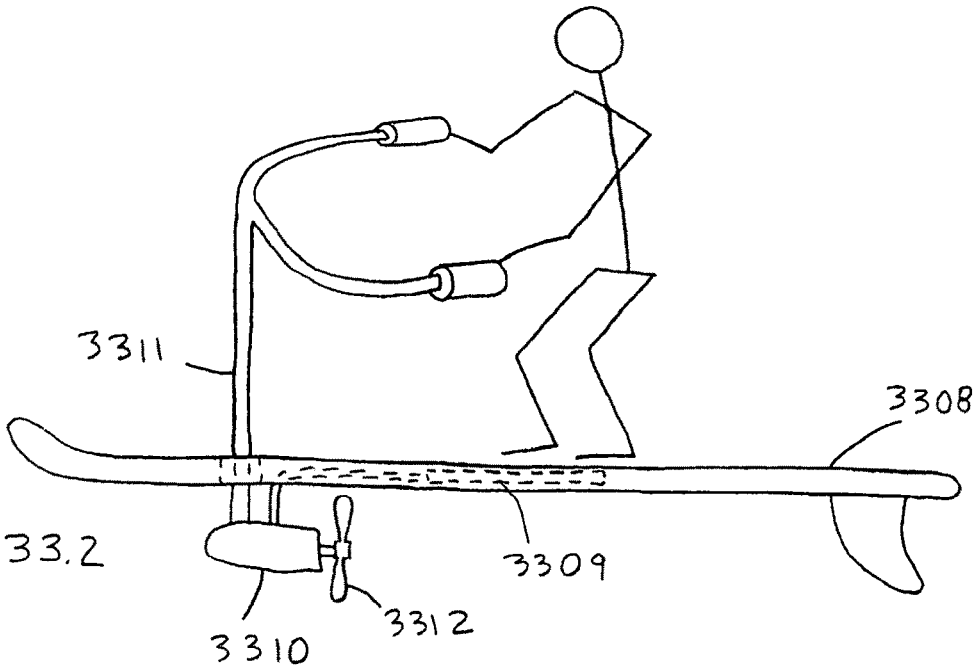
FIG. 33.2
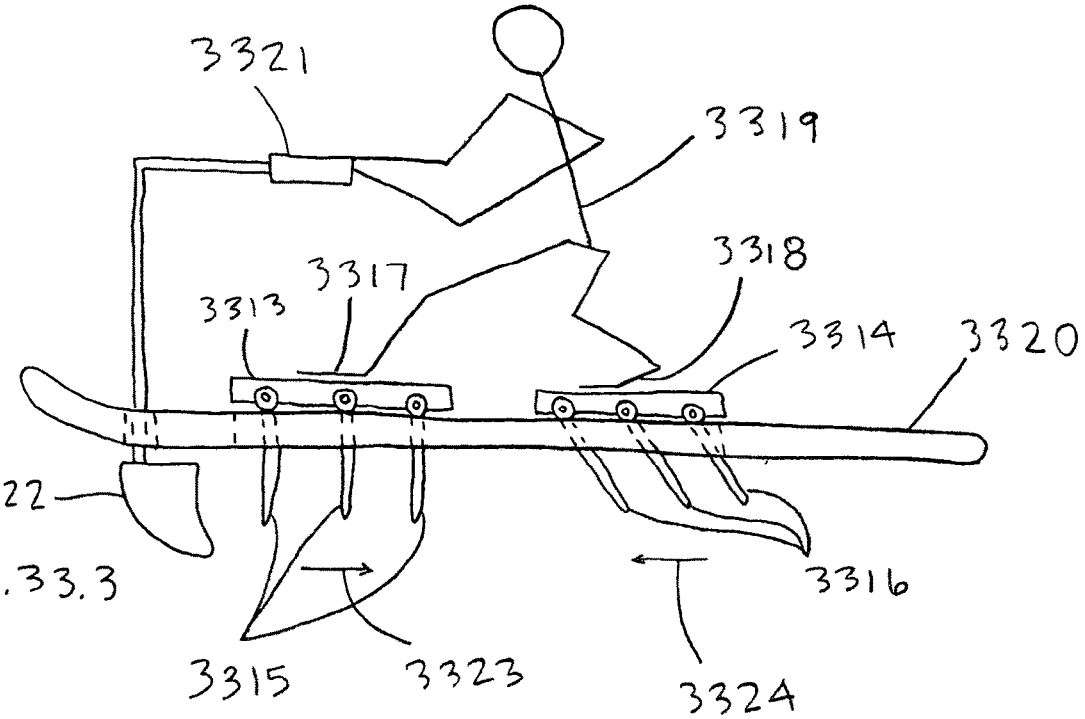
FIG. 33.3

PERSONAL WATERCRAFT

TECHNICAL FIELD

The field of this invention generally relates to personal watercraft.

BACKGROUND

Pelican International Inc. manufactures paddle boats. Companies which provide linear guides include Igus, Hiwin, VBX and Thomson. Neither a standard stand-up paddle board nor a Hobie® Eclipse board with MirageDrive® allows a rider to generate thrust by sliding their feet forward and rearward. The Hobie Eclipse does not provide separate flotation devices for each foot. The MirageDrive does not attach to a standard stand up paddle board.

SUMMARY OF THE INVENTION

The subject invention provides a personal watercraft which typically includes a floatation member for supporting a rider, typically supported entirely out of the water; although a portion of the rider may be supported in the water. Throughout this patent application, reference will be made to water, typically fresh or salt water; however, the provided watercraft is not intended to be limited to use in water, since it will work as described within many different fluids. The watercraft typically also includes a thrust assembly, and may include a steering assembly and a braking assembly. The assemblies may be actuated either mechanically or electrically. The thrust assembly is typically human powered; although, it may also be solar powered, electric powered, or wind powered. The thrust, steering, and braking assemblies may be added after-market to an existing stand-up paddle board (SUP), i.e., retrofit, or built into one or a plurality of SUPs during initial manufacturing. Throughout this application, the thrust, steering, or braking controlling and actuating assemblies provided by one embodiment may be readily combined with, used with, or substituted for, another embodiment. For example, for clarity of the drawings, a simplified embodiment might show a thrust control and actuation assembly, but not show a steering or braking control or actuation assembly; however, any steering or braking control or actuation assembly provided by another embodiment may be combined with, used with, or substituted for, such simplified embodiment as if the braking control or actuation assembly were explicitly provided in the simplified embodiment. Throughout this application, the term SUP includes, but is not limited to, a stand-up paddle board, surf board, kayak, canoe, pontoon, or any of a variety of buoyant objects, boards, boats, inflatable devices, and the like, or any other functionally similar floatation or buoyant apparatus, where the apparatus may comprise a plurality of floatation or buoyant members, and where the apparatus is capable of providing buoyancy support for at least one user or rider in a fluid, which may be water. When a plurality of SUPs are used by a single rider, each SUP is typically more narrow than usual, so the rider's feet are not unreasonably far apart. When the thrust assembly is human powered, it is typically leg or arm powered. When the thrust assembly is leg powered, typically the legs can move backward and forward in a sliding motion (like cross-country skiing), up and down in a stomping fashion (like marching in place), or move in a loop trajectory (such as on an Elliptical machine). When the thrust assembly is arm powered, typically the rider's arms may move forward and backward, and move either together or separately. The thrust assembly may combine leg and arm powered assemblies. The thrust assembly may include one or a plurality of paddles or flippers that typically are positioned to the side of the SUP or under the SUP. In some cases the terms thrust fin and thrust paddles are used interchangeably. In some cases, the terms foot support, foot holder, carriage, platform, pedal, and pad are used interchangeably. In some drawings to aid understanding, part of the drawing is provided in a perspective view while the rest is provided in a non-perspective view.

Although the watercraft is designed for use in fresh water or salt water, the watercraft may be used in any convenient fluid.

When the thrust assembly is leg powered, the thrust assembly may include one or more guides, such as linear guides that have carriages for sliding on them. Typically the carriages may have supports, which may removably secure a rider's feet. Typically two linear guides are positioned to a SUP, one linear guide on the right side, and one linear guide on the left side, and each linear guide having a carriage, one carriage for each of the rider's feet. Typically handlebars are attached to the SUP, where the rider may push against the handlebars in order to translate one or both of the carriages rearward. Movement of a carriage rearward typically causes a paddle, such as a paddle blade, to move rearward to generate forward thrust of the SUP. Movement of a carriage may also cause a flexible or rotatable flipper to move up and down to generate forward thrust of the SUP. Typically, forward movement of a carriage is substantially resistance free for a "recovery phase," for instance where the paddle may recover out of the water, or turn relative to the water and direction of motion so that resistance is reduced while the paddle moves through the water.

A benefit of a rider sliding their feet on carriages which may be associated with linear guides is that certain muscles may be targeted for exercise. For instance, when a rider slides their foot rearward to generate forward thrust of their watercraft, such as an SUP, they might exercise their gluteus maximus, their hamstrings, their lower back muscles, and other core muscles. Such muscles might not receive the same level of exercise as when other movement of the feet are used to generate thrust, such as when the feet use a stomping motion, such as up and down. That is, a cross-country skier which slides on their skis uses different muscles than a walker and a bicycle rider.

Another benefit of a rider sliding their feet on carriages which may be associated with linear guides is the gliding feeling they perceive, which is related to the gliding feeling a cross-country skier feels. Cross-country skiers may prefer cross-country skiing over running due to the enjoyable gliding sensation.

Other movements of the rider's feet may be substantially resistance free, such as when lifting a foot that is controlling a flipper, the flipper may rotate to reduce resistance.

A first useful embodiment provides a thrust assembly having a guide for attachment to a buoyant member, such as an SUP, the guide having a support for supporting a human foot and for guiding movement of a human foot forward and rearward. The embodiment has a paddle for propelling the buoyant member forward when the rider uses their foot to force the support rearward relative to said buoyant member.

The first useful embodiment may also have two sub-assemblies each having the support, the guide, and the paddle, wherein one of the sub-assemblies is for positioning on the left side and one of the sub-assemblies is for positioning on the right side of the buoyant member.

A second useful embodiment may also have two thrust assemblies each having a support and a thrust member for applying force against water, wherein one of the thrust assemblies is for positioning on a left buoyant member and one of said thrust assemblies is for positioning on a right buoyant member, wherein a rider is capable of placing their left foot on the support on the left buoyant member and placing their right foot on the support on the right buoyant member and moving their right and left feet forward and rearward relative to each other, whereby each of the buoyant members moves forward in water.

A guide of the second useful embodiment may comprise a linear guide, and each of the supports may comprise an attachment for releasably securing a human foot to the support.

A third useful embodiment of the subject invention is a personal watercraft comprising a buoyant member, a guide attached to the buoyant member, the guide having a support for supporting a human foot and for guiding movement of a human foot forward and rearward, and a paddle for propelling the buoyant member forward when the support moves rearward relative to the buoyant member.

The third useful embodiment may comprise a buoyant member, two guides attached to the buoyant member, each of the guides having a support for supporting a human foot and for guiding movement of a human foot forward and rearward, and a paddle associated with each the supports for propelling the buoyant member forward when one of the supports moves rearward relative to the buoyant member.

A fourth useful embodiment includes solar cells to power an electric thrust system, such as an electric motor with a propeller, a paddle, a paddle wheel, a flipper, and the like.

Each of the guides of an embodiment may comprise a linear guide, and each of the supports may comprise an attachment for releasably securing a human foot to the support.

A first useful technique provided by the subject invention comprises a guide attached to a buoyant member, the guide having a support for supporting a human foot and for guiding movement of a human foot forward and rearward, and a paddle for propelling the buoyant member forward when the support moves rearward relative to the buoyant member, where the technique includes sliding a foot rearward propelling the buoyant member forward, and sliding the foot forward to move the paddle forward.

A second useful technique provided by the subject invention comprises a support for supporting a human foot, and a flipper for propelling the buoyant member forward when the support moves toward the buoyant member. The technique includes pushing a foot downward toward the buoyant member, and the flipper moving away from the buoyant member to deeper water propelling the buoyant member forward.

The second useful technique may include lifting a foot upward away from the buoyant member, and the flipper moving toward the buoyant member to shallower water propelling the buoyant member forward.

The second useful technique may include pushing a foot downward toward the buoyant member causing a second foot to lift upward away from the buoyant member.

Handlebars on an SUP may be released to slide through a hole in the SUP to lower the center of gravity to make the SUP more stable and less prone to turning over if a rider wants to get onto the SUP from the water. For instance, there may be a knob on or near the handlebars to release it so it may slide down.

When an electric motor is used, such as a trolling motor, handlebars may have a battery gauge indicating the amount of electrical power being used and how much is left in a battery. Alternatively, LEDs may be used, such as green, yellow, and red LEDs, to indicate battery level.

When a trolling motor is used, the trolling motor may be attached to the water side of the handlebars, and it may be retractable all the way up into the body of the SUP so the SUP may be dragged on sand and dirt without damaging the trolling motor. An extensible paddle may be slid into and out of a storage slot on the SUP, or in the handlebars, in case the battery dies.

The SUP may have a kick stand with retractable wheels so the rider may conveniently roll the SUP to the water's edge. Once the SUP is placed in the water, the wheels may be removed, or retracted into the body of the SUP to prevent drag. Alternatively, the wheels may be rotated up and above the surface of the water, and may remain to the side of the SUP.

BRIEF DESCRIPTION OF THE DRAWINGS

FIGS. 1-62 provide embodiments of various personal watercraft, associated assemblies, sub-assemblies, members, elements, and components.

FIG. 19A is a side view of a useful embodiment of another thrust assembly. FIG. 19B is a plan view of two SUPs according to FIG. 19A. FIG. 19C is a rear-end view of the SUPs shown as connected in FIG. 19B. FIG. 19D is a side view of a useful embodiment of another thrust assembly.

FIG. 21A is a plan view of a useful embodiment of another thrust assembly. FIG. 21B is a side view of the thrust assembly of FIG. 21A. FIG. 21C is a side view, where the thrust paddles on the circulatory belt in FIG. 21B are substituted with collapsible thrust actuators. FIG. 21D is a side view, where the pulleys and belt of FIG. 21A that mechanically connects the treadmill control input with the circulatory belt output is replaced by fixed gears. FIG. 21E is an end view, where the fixed gears of FIG. 21D are replaced by a gear box.

FIG. 27.1 is a side view of a useful embodiment of another thrust assembly where the rider may stand sideways on the SUP. FIG. 27.2 is a side view of a useful embodiment of another thrust assembly where the rider may stand sideways on the SUP. The foot support may be connected to flippers by a Mirage Drive, such as is part of a Hobie Mirage Eclipse. FIG. 27.3*a* is a plan view of the useful embodiment of another thrust assembly where the rider may stand sideways on the SUP. FIG. 27.3*b* is a front-end view of the useful embodiment of another thrust assembly where the rider may stand sideways on the SUP.

FIGS. 28A-28C are a side views of useful embodiments of other thrust assemblies. FIG. 28D is a plan view, and FIG. 28E is a front-end view, of the useful embodiment of FIG. 28A.

FIG. 29.3*c* is a side view of a useful embodiment of another thrust assembly. FIG. 29.3*d* is a plan view of a useful embodiment where a throttle grip comprises a Bowden cable to control the rudder. FIG. 29.4*a* is a side view of a useful embodiment of another thrust assembly. FIG. 29.4*b* is a front-end view of a useful embodiment where the two foot supports are kept 180 degrees out of phase using a pulley and pulley cable.

FIG. 30.5*a* is a perspective view of a useful embodiment of another thrust assembly. FIG. 30.5*b* provides an assembly comprising pulleys and a pulley belt to keep the two handles 180 degrees out of phase. FIG. 30.6*a* is a side view of a useful embodiment of another thrust assembly. FIG. 30.6*b* is similar to 30.6*a*, except the hand lever is connected to the curved rod using a tie rod with rotary joints on each end. FIG. 30.7 is a plan view of a useful embodiment of another thrust assembly.

FIG. 31.8*a* is a side view of a useful embodiment of another thrust assembly, where the up and down motion of the foot support is constrained by a four-bar mechanism. FIG. 31.8*b* is a front-end view of a useful embodiment, such as a portion of the embodiment of FIG. 31.8*a*. FIG. 31.9 is a side view of a useful embodiment of another thrust assembly. FIG. 31.10*a* is a front view of a useful embodiment for keeping the right and left foot supports moving 180 degrees out of phase. FIG. 31.10*b* is a side view of the flexible flipper of FIG. 31.10*a*. FIG. 31.10*c* is a front view of a useful embodiment for keeping the right and left foot supports moving 180 degrees out of phase. FIG. 31.11 is a side view of a useful embodiment of another thrust assembly, where handle levers may be connected to the flippers by a Mirage Drive, such as is part of a Hobie Mirage Eclipse.

FIG. 32 is a side view of a useful embodiment of another thrust assembly.

FIG. 33.1 is a side view of a useful embodiment of another thrust assembly. FIG. 33.2 is a side view of a useful embodiment of another thrust assembly. FIG. 33.3 is a side view of a useful embodiment of another thrust assembly.

FIGS. 53E-35F are side views of useful embodiments of portions of thrust assemblies guided by linear bearings.

DETAILED DESCRIPTION OF THE INVENTION

Figures 1A, 1B, 1C, 1D:
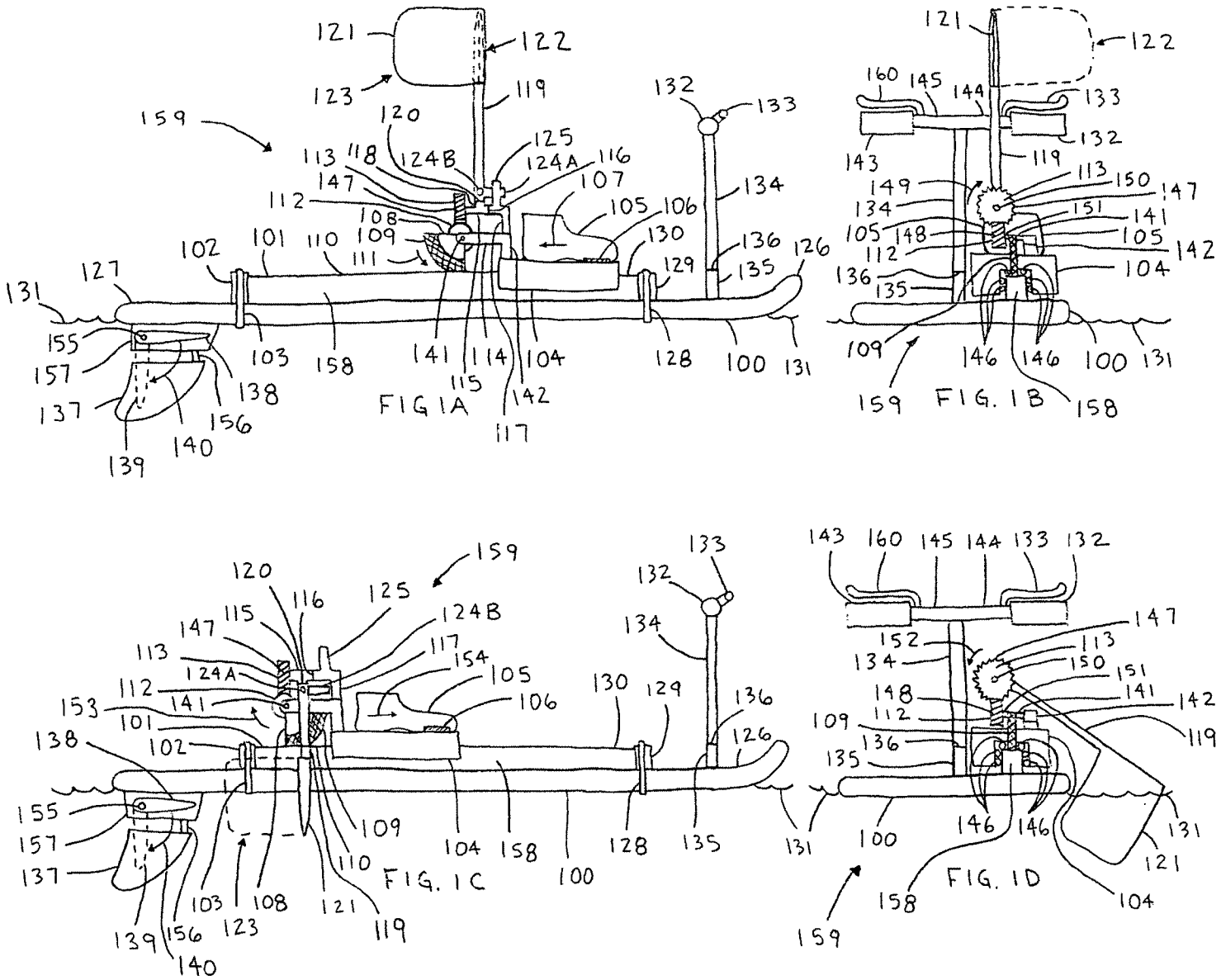
FIG. 1A is a side view of a first useful embodiment of the subject invention comprising a linear sliding assembly in a forward position and attached to a standup paddle board (SUP).
FIG. 1B is a rear end view of the embodiment of FIG. 1A, where the linear rail of the linear sliding assembly is shown as part of the SUP.
FIG. 1C is a side view of the embodiment of FIG. 1A, where the linear sliding assembly in a rear position.
FIG. 1D is a rear end view of the embodiment of FIG. 1C, where the linear rail of the linear sliding assembly is shown as part of the SUP.

The subject invention is further described in detail hereunder referring to the embodiments provided in the drawings. The following descriptions exemplify only some of the types of movements, mechanisms, and electronics that provide thrust, braking, and turning of a buoyant member, and other desired effects. Mechanisms provided may be substituted with electronic sensors and actuators, and gears provided may be substituted with pulleys and cables, and vice versa. In many cases, gears, pulleys, and cables are shown to provide a simple example of the functional relationship and relative movement between a plurality of members, but typically, any functionally equivalent apparatus to the provided gears, pulleys, and cables may be substituted. Additionally, throughout this application, the thrust, steering, or braking controlling and actuating assemblies provided by one embodiment may be readily combined with, used with, or substituted for, another embodiment. For example, for clarity of the drawings, a simplified embodiment might show a thrust control and actuation assembly, but not show a steering or braking control or actuation assembly; however, any steering or braking control or actuation assembly provided by another embodiment may be combined with, used with, or substituted for, such simplified embodiment as if the braking control or actuation assembly were explicitly provided in the simplified embodiment. Additionally, throughout this application, the term SUP includes, but is not limited to, a stand-up paddle board, surf board, kayak, canoe, pontoon, or any of a variety of buoyant objects, boards, boats, inflatable devices, and the like, or any other functionally similar floatation or buoyant apparatus, where the apparatus may comprise a plurality of floatation or buoyant members, and where the apparatus is capable of providing buoyancy support for at least one user or rider in a fluid, which may be water. An outline of a shoe shown on an SUP or foot support exemplifies where the rider typically puts their feet on the SUP or foot support, and there need not be an actual shoe or other special foot holder.

FIG. 1A is a side view of a first useful embodiment of the subject invention. It comprises a translation assembly in a forward position and attached to a standup paddle board (SUP) 100 having a front portion 126 and a rear portion 127. Although the profile of a generic SUP 100 is shown, as mentioned in the previous paragraph, any of a variety of buoyant objects, boards, boats, inflatable devices, and the like may be used in place of SUP 100. In FIGS. 1A-1D, some ripples of the water 131 are shown below and not contacting the SUP 100; although, in typical operation, the bottom surface of the SUP 100 is substantially in contact with the water 131 and supported by the water 131 due to the buoyancy of the SUP 100, so the average level of the water 131 is typically somewhere between the bottom surface and top surface of the SUP 100.

FIGS. 1A-1D provide the case where the translation assembly comprises a linear guide assembly, where the linear guide assembly comprises a carriage 104 for linearly moving with low friction along the length of the rail 158. The rail 158 is affixed to the SUP 100, and the rider of the watercraft 159 typically places one foot on or in a foot support 105, such as a boot, foot cradle, or sock, that is affixed to the carriage 104. Such foot support 105 is typically affixed to the carriage 104 near the toe portion of the foot support 105 using toe fastener 106, where the toe fastener typically comprises a hinge, Velcro, pin, axel, clip, or other fastening technique permitting the toe region of the foot support 105 to pivot relative to the carriage 104. The foot support 105 is typically flexible near the ball of the food for permitting the heel region of the foot support 105 to move out of contact with the carriage 104, such as up and off the carriage 104, similar to how a Nordic ski boot flexes with a Nordic ski binding, such as a cross-country ski binding, where the skier's toe region is affixed to the ski and the skier's heel region remains relatively free to move.

For better balance, and to allow the rider to use and exercise both legs, and to provide a gliding sensation for the rider that is similar to the gliding sensation perceived by a cross-country skier, there are typically two carriage/rail assemblies, one for each foot, arranged parallel to each other and each affixed parallel to the SUP 100; however, only one carriage/rail assembly is required.

As shown in FIGS. 1A-1D, the linear guide assembly comprises a linear guide rail 158 with a rear portion 101, a forward portion 130, and a top surface 110. A carriage 104 is guides along rail 158 with bearings 146. The carriage 104 for the rail 158 may comprise ball bearings, roller bearing such as cylindrical roller bearings, bushings, and the like to support up/down motion, side-side motion, or both. The bearings and bushings may comprise steel, stainless steel, aluminum, plastic, fabric, or other materials depending on the design, stability and wear requirements.

Companies that provide useful linear guides, linear rails, linear bearings, and the associated carriages, blocks, and the like include: Igus (www.igus.com), and in particular their DryLin® T Low-Profile Linear Guides, Drylin SWUM/EWUM supported steel shaft with Drylin QJUI-11-xxTW straight bearing open twin pillow block; Hiwin HG Series such as their HGW15 Flange Block Linear Guides; VBX and their rail guideway system with flanged square slide unit linear motion, such as part number Kit17821; Thomson bearing ball carriage, such as part number 511H25A1; and various Chinese suppliers provide SBR10 fully supported linear rail shaft rod with SBR10UU open linear slide bearing (or bushing) blocks (or carriages), such as might be used for CNC (computer numerical control) equipment.

FIGS. 1A (side view) and 1B (rear end view) show the translation assembly in a typical starting position for the "thrust phase" of the watercraft 159; whereas, FIGS. 1C (side view) and 1D (rear end view) show the translation assembly at a typical starting position for the "recovery phase" of the watercraft 159. In the thrust phase, the rider's foot is secured relative to the foot support 105, and the rider pushes their foot backward in the direction of the arrow 107. The rider may put their hands on handlebar grips 132 and 143, and use the handlebar grips to provide leverage to push against to drive each of their feet backwards, one at a time, or together, similar to pushing a sled. Similarly, the rider may put their hands on handlebar grips 132 and 143, and use the handlebar grips to provide leverage to pull against to drive each of their feet forward, one at a time, or together.

As the rider's foot presses against the foot support 105, the carriage 104 slides in the direction of the arrow 107 toward the rear portion 101 of the rail 158. As the carriage 104 moves backward, the engaging portion 109 of sector 108 engages with the top 110 of the rail 158, causing it to rotate counter clockwise (CCW) in FIG. 1A in the direction of the arrow 111. Any convenient means may be used to engage the engaging portion 109 of the sector 108 with the top 110 of the rail 158. For instance, the engaging portion 109 may comprise gear teeth that engage with mating gear teeth in the top 110 of the rail 158. Alternatively, the engaging portion 109 may include an elastic coating, such as rubber, that grips with the top 110 of the rail 158, causing the sector 108 to rotate CCW in FIG. 1A when the carriage 104 moves backward.

Sector 108 rotates around the axis 141, and is affixed to the carriage 104 by the positioning member 114, which is affixed to the positioning member 142, which is affixed to the carriage 104. In practice, positioning members 114 and 142 may be largely different in actual structure, but are shown here as discrete members to illustrate their positioning function.

The worm gear 112 is affixed to the sector 108, either explicitly, or affixed to the same rotary shaft 151 with axis 141, such that as the sector 108 rotates CCW in FIG. 1A, the worm gear 112 also rotates CCW with the sector 108. The spiral teeth 148 of the worm gear 112 mesh with the straight teeth 147 of the worm wheel 113, where their axes of rotation are perpendicular. As the worm gear 112 rotates CCW in FIG. 1A, the worm wheel 113 rotates clockwise (CW) in FIG. 1B, as indicated by the arrow 149 in FIG. 1B. The gear ratio is selected to provide the desired mechanical advantage.

When the carriage 104 moves backward, the worm wheel 113 rotates CW in FIG. 1B around axis 150, which is supported by positioning member 115 in FIG. 1A. The positioning member 115 is rotatably connected to the positioning member 117 at the rotation joint 116, and positioning member 115 is able to rotate relative to the positioning member 117 about the axis 150. The positioning member 117 is affixed to the positioning member 142, which is affixed to the carriage 104. The positioning member 115 is affixed to the positioning member 118, which is rotatably connected to the paddle arm 119 at the rotation joint 120 about a vertical axis in FIG. 1A.

As the rider's foot moves backward, the foot support 105 causes the carriage 104 to slide backward on the rail 158, causing the sector 108 and the worm gear 112 to rotate CCW in FIG. 1A, causing the worm wheel 113 to rotate CW in FIG. 1B, causing the positioning members 115 and 118 to rotate CW in FIG. 1B, causing the paddle arm 119 to rotate CW in FIG. 1B, and ultimate causing the paddle blade 121 that is firmly affixed to the paddle arm 119 also to rotate CW in FIG. 1B.

As the paddle arm 119 rotates CW in FIG. 1B, the rotation member 124A that is firmly affixed to the paddle arm 119 comes into contact with the rotator member 125 that is firmly affixed to the positioning member 117. This contact causes the paddle arm 119 and the paddle blade 121 to rotate about the rotation joint 120, such that the paddle blade 121 rotates from the back position 123 to the side position 122. A typical rotation amount is 90 degrees. Associated with rotation joint 120, but not shown in any of FIGS. 1A-1D, is a first paddle limit stop that prevents the paddle blade 121 from rotating past the side position 122 when rotating from the back position 123. The first paddle limit stop may take the form of a protrusion from the positioning member 115 that contacts the rotation member 124A and prevents the paddle arm 119 from continuing to rotate about the rotation joint 120. As the rider's foot continues to move the carriage 104 backward, the paddle arm 119 and paddle blade 121 rotate CW in FIG. 1B and at least a portion of the paddle blade 121 enters the water 131 in a functional orientation that uses the first paddle limit stop to help apply pressure against the water 131 as the rider continues to push the carriage 104 backward.

As the rider's food continues to press the carriage 104 backward, the paddle blade 121 that is now at least partially extended into the water 131 continues to press against the water, providing forward thrust and moving the SUP 100 forward relative to the water 131. Typically the farther backward the carriage 104 travels, the more the heel of the rider will rise up, whereas the rider's toes and ball of their foot typically remains pressing against the carriage 104 through foot support 105 where the foot support 105 is affixed by toe fastener 106 to carriage 104.

The arc length of the sector 108 may be selected such that as the paddle blade 121 is extended to the desired position in the water 131, the engaging portion 109 exits engagement with the mating top portion 110 of rail 158, so the paddle blade 121 is not lowered farther into the water 130. Another way to control the maximum distance that the paddle blade 121 is lowered into the water 130 is to alter the engagement structure of the engaging portion 109 such that it no longer engages the top portion 110 of rail 158. Another way to control the maximum distance that the paddle blade 121 is lowered into the water 130 is to alter the worm gear 112 or worm wheel 113 so they no longer rigidly engage each other and instead slip relative to each other when the paddle blade 121 reaches its desired extension into the water 130. A clutch or other convenient technique that is set to slip when the paddle blade 121 reaches the desired position may also be used.

After the rider has pushed their foot backward while propelling the SUP 100 forward, the "recovery phase" can begin, as shown in FIGS. 1C and 1D. In FIG. 1C, the carriage 104 is shown positioned near the rear portion 101 of the rail 158. The carriage 104 may remain in this position indefinitely; although, the associated paddle blade 121 will no longer provide forward thrust for the SUP 100 in this position. In this position near the rear portion 101 of the rail 158, the paddle blade 121 is at least partially extended into the water 131. When the carriage 104 stops moving relative to the rail 158, if the SUP 100 continues to glide forward relative to the water 131, the water 131 can cause the paddle blade 121 and paddle arm 119 to rotate about the rotation joint 120 away from the first paddle limit stop, so while at least a portion of the paddle blade 121 is still extended into the water 131, the paddle blade 121 won't cause drag due to the relative movement of the water 131 or the air as the SUP 100 continues to glide forward.

To start the recovery phase, the rider moves their foot forward causing the foot support 105 to move forward in the direction of the arrow 154 toward the front portion 130 of the rail 158. As the foot support 105 moves forward, the carriage 104 also moves forward.

As the carriage 104 moves forward, the engaging portion 109 of sector 108 again engages with the top 110 of the rail 158, and this time causing it to rotate clockwise (CW) in FIG. 1C in the direction of the arrow 153.

The worm gear 112 is affixed to the sector 108, either explicitly, or affixed to the same rotary shaft, such that as the sector 108 rotates CW in FIG. 1C, the worm gear 112 also rotates CW with the sector 108. The spiral teeth of the worm gear 112 mesh with the straight teeth of the worm wheel 113, where their axes of rotation are perpendicular. As the worm gear 112 rotates CW in FIG. 1C, the worm wheel 113 rotates counter clockwise (CCW) in FIG. 1D as indicated by the arrow 152 in FIG. 1D. The gear ratio is selected to provide the desired mechanical advantage for raising the paddle blade 121 at the desired rate and with the desired torque.

As the rider's foot moves forward, the foot support 105 causes the carriage 104 to slide forward on the rail 158, causing the sector 108 and the worm gear 112 to rotate CW in FIG. 1C, causing the worm wheel 113 to rotate CCW in FIG. 1D, causing the positioning members 115 and 118 to rotate CCW in FIG. 1D, causing the paddle arm 119 to rotate CCW in FIG. 1D, and ultimate causing the paddle blade 121 that is firmly affixed to the paddle arm 119 also to rotate CCW in FIG. 1D.

As the paddle arm 119 rotates CCW in FIG. 1D, the rotation member 124B that is firmly affixed to the paddle arm 119 comes into contact with the rotator member 125 that is firmly affixed to the positioning member 117. This contact causes the paddle arm 119 and the paddle blade 121 to rotate about the rotation joint 120, such that the paddle blade 121 rotates from perpendicular to the SUP 100 to being in the line of the long direction of the SUP 100. A typical rotation amount is 90 degrees. Associated with rotation joint 120, but not shown in any of FIGS. 1A-1D, is a second paddle limit stop that prevents the paddle blade 121 from rotating past the back position 123 shown in FIG. 1A. The second paddle limit stop may take the form of a protrusion from the positioning member 115 that contacts the rotation member 124B and prevents the paddle arm 119 from continuing to rotate about the rotation joint 120. As the rider's foot continues to move the carriage 104 forward, the paddle arm 119 and paddle blade 121 rotate CCW in FIG. 1D typically until mostly vertical, or a little past vertical to rest against a resting member (not shown); although, the paddle arm 119 and paddle blade 121 may be rotate to any desired position.

As the rider's food continues to press the carriage 104 forward, the more the heel of the rider will lower toward the carriage 104, and typically eventually coming into contact.

In FIGS. 1A and 1C, the rail 158 is shown strapped onto the SUP 100 using straps 103. In these figures, the rail 158 is shown to have a front-end support 129 and a rear-end support 102 that are secured to the SUP 100 using front strap 128 and rear strap 103. The straps 128 and 103 may extend all the way around the bottom of the SUP 100 to each form a complete loop around the SUP 100, or the straps may be anchored to an anchor on the surface of the SUP 100. Such an anchor is typically on the top surface of the SUP 100. Front-end support 129 and rear-end support 102 may also be fastened to the SUP 100 by other effective means, including but not limited to screwing them to the top surface of the SUP 100, or by fastening each to a bracket that is attached to the SUP 100. Such a bracket may be attached to the SUP 100 by any effective means, typically to the top surface, and typically using screws, glue, Velcro, tape, and the like. Front-end support 129 and rear-end support 102 may also be glued, Velcroed, or taped to the SUP 100.

Steering of the watercraft 159 may be controlled by the rider in one of a variety of ways. A first way to steer the watercraft 159 is using a handlebar. The handlebar comprises a right handlebar portion 144 with right handlebar grip 132, and a left handlebar portion 145 with left handlebar grip 143. The right and left handlebar portions, 144 and 145, are connected to the handlebar neck 134. The handlebar neck 134 is connected by rotary hinge 136 to handlebar support 135, which is then connected to the SUP 100, and typically connected to the front portion 126 of the SUP 100. In FIGS. 1B and 1D, for convenience of the drawing, the handlebar neck 134 is not necessarily shown centered equidistant from the right and left edges of the SUP 100; however, in practice, the handlebar neck 134 is typically centered equidistant from the left and right edges of the SUP 100. The rotary hinge 136 may be any means to allow the handlebar neck 134 to rotate relative to the SUP 100. The rotary hinge 136 may simply be comprised of a hole in the SUP that the handlebar neck 134 fits into that allows rotation. The handlebar support 135 may comprise a bracket that is attached to the SUP 100, where such a bracket is typically attached to the top surface of the SUP 100.

When handlebars are used to steer the watercraft 159, turning the handlebar neck 134 may control one or more rudders, such as the rudder 137. The rudder 137 is connected to the rudder base 157 by rudder connector 156. Typically, the rudder connector 156 is a rotary hinge, but it may comprise any means that allows the rudder 137 to move relative to the rudder base 157. The rudder base 157 is typically attached to the bottom side (that is, the water side) of the rear portion 127 of the SUP 100. A typical attachment may include inserting the rudder base 157 into a slot in the SUP 100 intended for non-rotating rudders. The rudder base 157 may also be affixed directly to the bottom side of the rear portion 127 of the SUP 100, such as by screwing, snapping, clipping, or any other convenient connection means.

Although not shown in FIGS. 1A-1D for clarity, the handlebar neck 134 may mechanically or electrically control the position of the rudder 137. When the handlebar neck 134 is mechanically connected to the rudder 137, the connection may comprise one or more rigid links, or may comprise one or more flexible links. A useful flexible link comprises a Bowden cable, similar to a bicycle brake cable, where a flexible cable is positioned inside a flexible outer sheath. Another useful flexible link comprise a flexible cable routed from the handlebar neck 134 to the rudder 137, where the flexible cable routed such that it is always in tension, similar to a bicycle shift cable. Such routing of the flexible cable may route the cable in a straight line, or around one or more cams, rollers, pins, sliders, and the like that redirect the cable to a new direction while maintaining the cable tension. Another useful flexible link comprises two opposing flexible cables. When two opposing flexible cables are used without the flexible sheath of a Bowden cable, typically a first flexible cable from a first portion of the handlebar neck 134 pulls the rudder 137 in a first direction, and a second flexible cable from a second portion of the handlebar neck 134 pulls the rudder 137 in a second direction that is opposite to the first direction. Another useful flexible link comprises a single flexible cable that is typically used in opposition with a return spring. When the single flexible cable is pulled due to the turning of the handlebar neck 134 to turn the rudder 137, the return spring provides tension that opposes the pulling. When the handlebar neck 134 is returned to its original unturned position such that the single flexible cable is no longer pulled, the return spring continues to apply a tension until the single flexible cable returns to the position it was in before it was initially pulled by the turning of the handlebar neck 134.

Although not shown in FIGS. 1A-1D, the handlebar neck 134 may electrically control the position of the rudder 137. When the handlebar neck 134 electrically controls the position of the rudder 137, typically the position of the handlebar neck 134 is sensed by a rotary position sensor, such as a rotary encoder, an optical encoder, a magnetic rotary encoder, a potentiometer, and the like. The rotary position that is sensed is then transmitted as a position signal, either using wires or transmitted wirelessly, to a rudder actuator that receives the position signal and actuates the rudder 137 to a position corresponding to the position signal. Such a rudder actuator may include an electric rotary motor or an electric linear actuator.

A second way to steer the watercraft 159 is using a plurality of paddle blades, such as paddle blade 121. When a paddle blade, such as paddle blade 121 is positioned on both the left and right sides of the rider when standing on the SUP 100, where a right paddle blade is controlled by the rider's right foot, and a left paddle blade is controlled by the riders left foot, if the rider slides their right foot forward and backward more than they slide their left foot forward and backward, they will impart more forward thrust to the right side of the SUP 100, causing the SUP 100 to turn left. Similarly, if the rider slides their left foot forward and backward more than they slide their right foot forward and backward, they will impart more forward thrust to the left side of the SUP 100, causing the SUP 100 to turn right. This turning technique employing relative velocity of two sides is similar to how a bulldozer turns.

A third way to steer the watercraft 159 is using selective braking of right and left braking fins. The right handlebar grip 132 has an associated right handbrake lever 133, and left handlebar grip 143 has an associated left handbrake lever 160. The right handbrake lever 133 controls the position of the right brake fin 138. When right handbrake lever 133 is pulled toward the right handlebar grip 132, the right brake fin 138 extends down, rotating about an axis 155 through an arc 140, to a braking position 139. The right handbrake lever 133 may communicate position information with the right brake fin 138 using any convenient method, including but not limited to a flexible linkage, such as a Bowden cable, a flexible cable supported by cable supports, a plurality of rigid articulated links, a wireless signal, such as an electromagnetic or optical signal, and the like.

Similarly, the left handbrake lever 160 controls the position of a left brake fin (not shown). When left handbrake lever 160 is pulled toward the left handlebar grip 143, the left brake fin extends down, rotating about an axis typically coincident with the axis 155, through an arc, to a braking position. The left handbrake lever 160 may communicate position information with the left brake fin using any convenient method, including but not limited to a flexible linkage, such as a Bowden cable, a flexible cable supported by cable supports, a plurality of rigid articulated links, a wireless signal, such as an electromagnetic or optical signal, and the like.

A brake fin, such as the brake fin 138, is positioned on both the left and right sides of the rider when standing on the SUP 100, where the right brake fin 138 is controlled by the right handbrake lever 133, and a left brake fin is controlled by the left handbrake lever 160. When the rider engages the right handbrake lever 133 and moves it toward the right handlebar grip 132, the right brake fin 138 extends down, rotating about the axis 155 through the arc 140, to the braking position 139, which applies a drag force to the right side of the SUP 100, causing the SUP 100 to turn right. Similarly, when the rider engages the left handbrake lever 160 and moves it toward the left handlebar grip 143, the left brake fin (not shown) extends down, rotating about an axis typically coincident with the axis 155, through an arc to the braking position which applies a drag force to the left side of the SUP 100, causing the SUP 100 to turn left. This turning technique employing relative velocity of two sides is similar to how a bulldozer turns.

Another description of FIGS. 1A-1D follows:

Recovery Phase (FIGS. 1C and 1D): The partial sector 108 (of a disk) has a compressible frictional surface 109 that will grip the linear rail 158. When the boot 105 slides the platform 104 forward 154 (i.e., the Recovery Phase), the partial sector 108 of a disk rotates clockwise 153 (CW) in the side view (of FIG. 1C), causing the worm gear 112 to rotate, causing the worm wheel 113 to rotate and raise the paddle arm 119 and paddle blade 121. The paddle blade 121 may have already rotated from side 121 to back position 123 due to water pressure, but if not, during raising, the rotation pin 124B on the paddle arm 119 hits the rotator pin 125 on the platform 104, causing the paddle arm 119 to rotate the paddle blade 121 back 123 (in line with the SUP) to reduce wind resistance. Since the partial sector 108 is not a complete disk, when the trailing edge of the sector 108 leaves contact with the linear rail 158, the paddle arm 119 no longer moves, and the trailing edge of the partial sector 108 drags along the top 110 of the linear rail 158.

Thrust Phase (FIGS. 1A and 1B): The operation is largely the opposite of the Recovery Phase. At any point while the boot 105 is moving forward, if it begins to slide backward 107, the dragging trailing edge of the partial sector 108 grips the linear rail 158 and begins to rotate counter clockwise 111 (CCW) in the side view (of FIG. 1A). The rubber, or any convenient compressible, frictional material, will compress and grip the linear rail 158 enough that the partial sector 108 will rotate from the leading edge (which had been the dragging trailing edge during the Recovery Phase) to the trailing edge. During rotation CCW 111, the worm gear 112 rotates, rotating the worm wheel 113 CW 149 in the end view (of FIG. 1B), and thus lowering the paddle arm 119, and lowering the paddle blade 121 into the water 131. While the paddle arm 119 is lowering, the rotation pin 124A hits the rotator pin 125 which rotates the paddle blade 121 from rotated back to rotated side 122 for entry. The rotation may actually rotate the blade to a point slightly forward to the direction of SUP (standup paddle board) 100 travel, to account for the relative speed of the SUP 100 to the water 131. Once the boot 105 has moved backward 107 a little, the paddle blade 122 will be in the water and thrusting backward. Additional apparatus (not shown) may change the angle of the paddle blade 122 during thrust motion to optimize thrust. After the paddle blade 122 has entered the water 131 to the desired depth, the partial sector 108 will have rotated from its leading edge to its trailing edge, and will then drag its trailing edge along the linear rail 158 until the boot 105 moves forward 154, causing a transition back to the Recovery Phase operation. When the boot 105 stops moving backward 107, water pressure against the paddle blade will cause the blade 121 to rotate CW in the side view (of FIG. 1C). Typically, the paddle blade will rotate no more than 90 degrees to point straight back 123 (in FIG. 1C), before hitting a rotational limit stop. If the SUP 100 motion ceases, the paddle blade will then rotate back down 121 (in FIG. 1C) into the water 131 due to gravity. Either way, when the boot 105 slides forward 154 during the beginning of the Recovery Phase (FIG. 1C), the rotation pin 124B on the paddle arm 119 will rotate the blade to point backwards 123 (in FIG. 1C) when the rotation pin 124B comes into contact with the rotator pin 125.

Figure 2C:
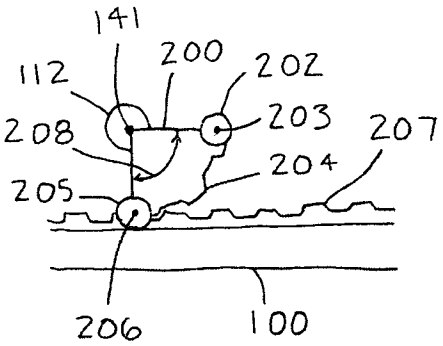
FIGS. 2A-2C provide alternative embodiments of the sector 108 that rotates the worm gear 112 in FIGS. 1A-1D.
Figure 2B:
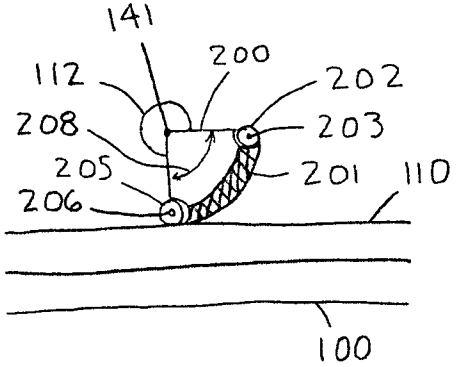
Figure 2A:
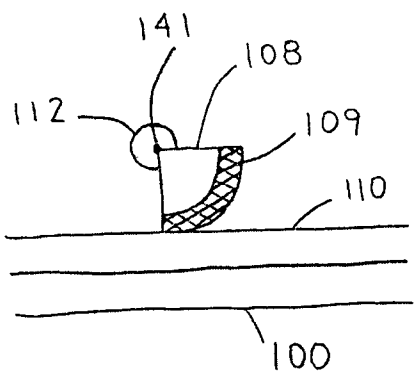

FIGS. 2A-2C provide alternative embodiments of the sector 108 that rotates the worm gear 112 in FIGS. 1A-1D. FIG. 2A provides an embodiment similar to that shown in FIGS. 1A-1D, where a sector 108 is capable of rotating about the axis 141 as the axis 141 translates parallel to the rail 110. The axis 141 is supported by a carriage (not shown in FIG. 2A) that is supported by the rail 110, where the carriage is capable of translating relative to the rail 110. The sector 108 comprises an engaging portion 109 for engaging with the top portion 110 of the rail 158. Any convenient means may be used to engage the engaging portion 109 of the sector 108 with the top 110 of the rail 158. For instance, the engaging portion 109 may include an elastic region, such as rubber, that grips with the top 110 of the rail 158 as the axis 141 translates parallel to the rail 110.

FIG. 2B provides a second embodiment for the sector, where a sector 200 is capable of rotating about the axis 141 as the axis 141 translates parallel to the rail 110. The axis 141 is supported by a carriage (not shown in FIG. 2B) that is supported by the rail 110, where the carriage is capable of translating relative to the rail 110. The sector 200 comprises an engaging portion 201 for engaging with the top portion 110 of the rail 158. Any convenient means may be used to engage the engaging portion 201 of the sector 200 with the top 110 of the rail 158. For instance, the engaging portion 201 may include an elastic region, such as rubber, that grips with the top 110 of the rail 158 as the axis 141 translates parallel to the rail 110.

As shown in FIG. 2B, sector 200 comprises rotary members on each end, such as wheels, cylinders, and the like, that rotate when in contact with the rail 110 or a shoulder of the rail 110. A first rotary member 202 rotates relative to the sector 200 about axis 203, which may comprise a bearing, bushing, and the like to reduce rotary friction. The first rotary member 202 rotates freely about the axis 203 in a clockwise (CW) sense in FIG. 2B, but rotation is prevented, i.e., it "locks," in the counterclockwise (CCW) sense in FIG. 2B. A second rotary member 205 rotates relative to the sector 200 about axis 206, which may comprise a bearing, bushing, and the like to reduce rotary friction. The second rotary member 205 rotates freely about the axis 206 in a CCW direction in FIG. 2B, but rotation is prevented, i.e., it "locks," in the CW direction in FIG. 2B.

When the carriage translates to the left in FIG. 2B, axis 141 also translates to the left, and the second rotary member 201 freely rotates about the axis 206, and so the sector 200 does not rotate about the axis 141 in FIG. 2B.

When the carriage translates to the right in FIG. 2B, axis 141 also translates to the right. When the axis 141 translates to the right, the second rotary member 205 locks and is unable to rotate about the axis 206, so the entire sector 200 rotates CW about the axis 141 in FIG. 2B. As the carriage continues to translate to the right, the engaging portion 201 engages with the rail 110, and causes the sector to continue to rotate CW about the axis 141 until the first rotary member 202 contacts the rail 110 or a shoulder of the rail 110.

As the carriage continues to translate to the right after the first rotary member 202 contacts the rail 110, the engaging portion 201 rotates CW until it is no longer in engaged with the rail 110, and only the first rotary member 202 remains in contact with the rail 110 or the shoulder of the rail 110. As the carriage continues to translate to the right from this point, the first rotary member 202 rotates freely with minimal friction in a CW sense about the axis 203, and the sector 200 no longer rotates CW about the axis 141.

When the carriage changes direction and translates to the left in FIG. 2B, the first rotary member 202 will lock, causing the sector 200 to rotate CCW until the engaging portion 201 engages with the rail 110, causing the sector 200 to continue to rotate CCW after the first rotary member 202 rotates out of engagement with the rail 110 or the shoulder of the rail 110, until the second rotary member 205 contacts the rail 110 or the shoulder of the rail 110, and rotates freely with minimal friction in a CCW sense.

Accordingly, the sector 200 only rotates the worm gear 112 back and forth through a limited angle, equal to the angle 208 circumscribed by the sector 200, even as the carriage continues to translate further to the left or to the right.

FIG. 2C provides a third embodiment for the sector, where sector 200 is capable of rotating about the axis 141 as the axis 141 translates parallel to the rail 110. The axis 141 is supported by a carriage (not shown in FIG. 2C) that is supported by the rail 110, where the carriage is capable of translating relative to the rail 110. The sector 200 comprises an engaging portion 204 for engaging with the top portion 207 of the SUP 100. In this embodiment, the engaging portion 204 may include a region with pinion teeth on the sector 200 that engages with the top rack 207 on the SUP 100 as the axis 141 translates parallel to the SUP 100.

Engagement comprising a rack and pinion is representative of a family of engaging surfaces. Such engaging surfaces may comprise any convenient engaging surfaces that allow little or no slip between them. Exemplary surfaces may also comprise interlaced protrusions, such as the illustrated rack and pinion, but may also comprise surfaces that engage using friction, such as provided by rubber, plastic, knurled surfaces, rough surfaces, sand paper, and the like.

As shown in FIG. 2C, and similar to FIG. 2B, the sector 200 comprises rotary members on each end, such as wheels, cylinders, and the like, that rotate when in contact with a shoulder of the rack 207. A first rotary member 202 rotates relative to the sector 200 about axis 203, which may comprise a bearing, bushing, and the like to reduce rotary friction. The first rotary member 202 rotates freely about the axis 203 in a clockwise (CW) sense in FIG. 2C, but rotation is prevented, i.e., it "locks," in the counterclockwise (CCW) sense in FIG. 2C. A second rotary member 205 rotates relative to the sector 200 about axis 206, which may comprise a bearing, bushing, and the like to reduce rotary friction. The second rotary member 205 rotates freely about the axis 206 in a CCW direction in FIG. 2C, but rotation is prevented, i.e., it "locks," in the CW direction in FIG. 2C.

When the carriage translates to the left in FIG. 2C, axis 141 also translates to the left, and the second rotary member 201 freely rotates about the axis 206, and so the sector 200 does not rotate about the axis 141 in FIG. 2C.

When the carriage translates to the right in FIG. 2C, axis 141 also translates to the right. When the axis 141 translates to the right, the second rotary member 205 locks and is unable to rotate about the axis 206, so the entire sector 200 rotates CW about the axis 141 in FIG. 2C. As the carriage continues to translate to the right, the engaging portion 204 engages with the rack 207, and causes the sector to continue to rotate CW about the axis 141 until the first rotary member 202 contacts the shoulder of the rack 207.

As the carriage continues to translate to the right after the first rotary member 202 contacts the shoulder of the rack 207, the engaging portion 204 rotates CW until it is no longer in engaged with the shoulder of the rack 207, and only the first rotary member 202 remains in contact with the shoulder of the rack 207. As the carriage continues to translate to the right from this point, the first rotary member 202 rotates freely with minimal friction in a CW sense about the axis 203, and the sector 200 no longer rotates CW about the axis 141.

When the carriage changes direction and translates to the left in FIG. 2C, the first rotary member 202 will lock, causing the sector 200 to rotate CCW until the engaging portion 204 engages with the rack 207, causing the sector 200 to continue to rotate CCW after the first rotary member 202 rotates out of engagement with the shoulder of the rack 207, until the second rotary member 205 contacts the shoulder of the rack 207, and rotates freely with minimal friction in a CCW sense.

Accordingly, the sector 200 only rotates the worm gear 112 back and forth through a limited angle, equal to the angle 208 circumscribed by the sector 200, even as the carriage continues to translate further to the left or to the right.

Figure 3B:
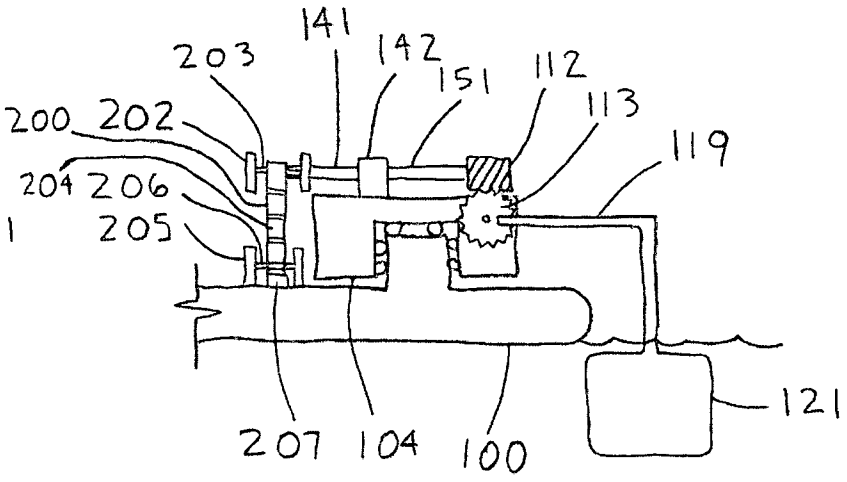
FIGS. 3A-3C provide rear-end cross-sections of carriage-paddle assemblies.
Figure 3A:
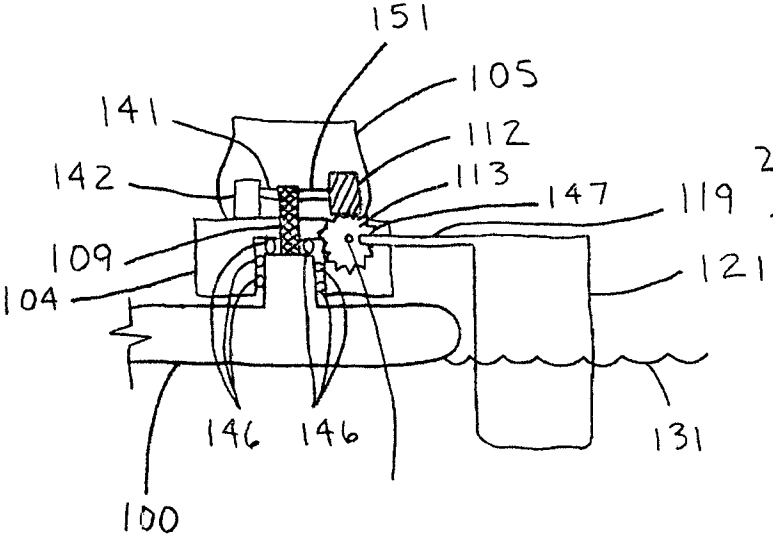
Figure 3C:
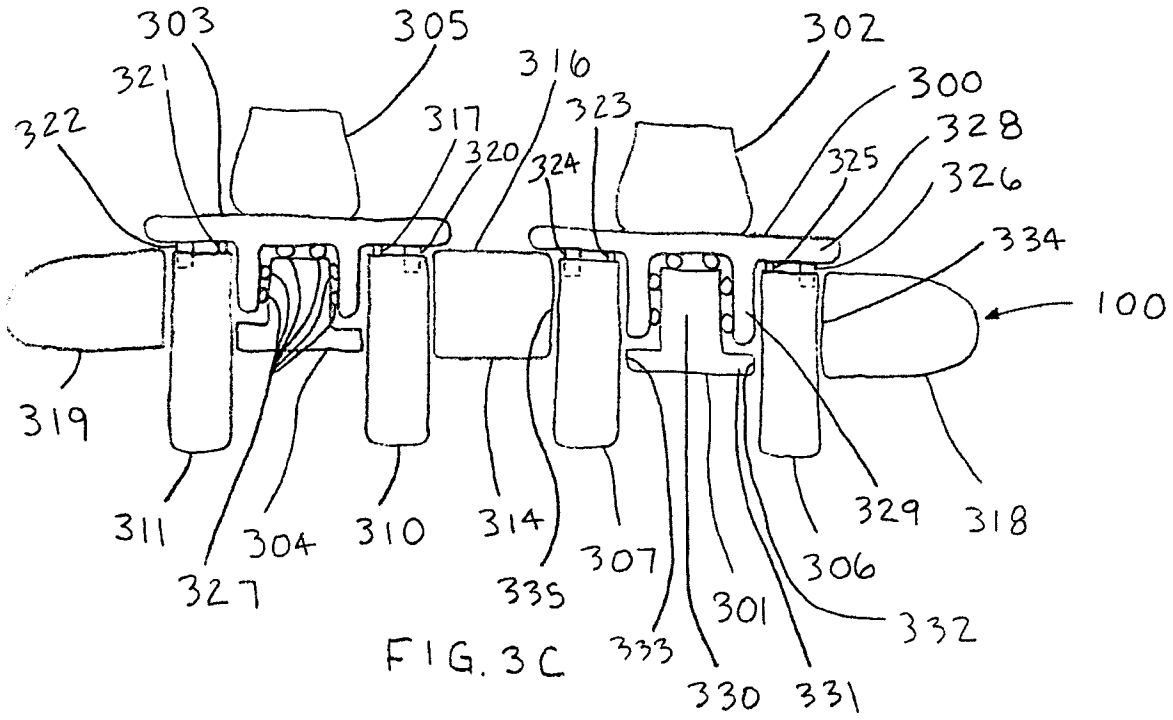

FIGS. 3A-3C provide rear-end cross-sections of carriage-paddle assemblies. FIG. 3A is similar to the carriage-paddle assembly provided by FIGS. 1A-1D, but where the worm wheel 113 in FIG. 3A is positioned below the worm gear 112.

FIG. 3B is similar to FIG. 3A, but the partial sector shown in FIG. 3A, which comprises the partial sector of FIG. 2A or 2B, is replaced by the partial sector 200 of FIG. 2C. The rack 207 of FIG. 2C is shown to the left of the carriage 104, and supported by the positioning member 142, and rotates with the worm gear 112 around axis 141, which is connected to co-axial axis 151, about which the worm gear 112 rotates. FIG. 3B also provides an alternative profile for the paddle blade 121.

Although some figures only provide a single carriage-paddle assembly for the right foot of a rider, all physical implementations, whether shown so in the drawings or not, typically also comprise a mirror-imaged carriage-paddle assembly for the left foot of the rider.

FIG. 3C provides a rear-end cross-section of an SUP showing both the right 300 and left 303 carriages for right and left feet of the rider. The paddle blades of FIG. 3C are also provided extending from each carriage, through an opening in the SUP 100, rather than to the side of the SUP 100.

The right carriage 300 is guided by the right guide 301. As shown, a portion of the right carriage 300 is recessed in the SUP 100 below the top surface 316 of the SUP 100. The right foot support 302 is attached to the right carriage 300, typically removably attached near the front portion of the right foot support 302. In this illustrative embodiment, two right paddle blades 306 and 307 extend into the water below the right carriage 300, and their orientation is determined by the force of the water as the right carriage 300 moves forward 340 and backward 336.

Figures 3D, 3E, 3F, 3G, 3H:
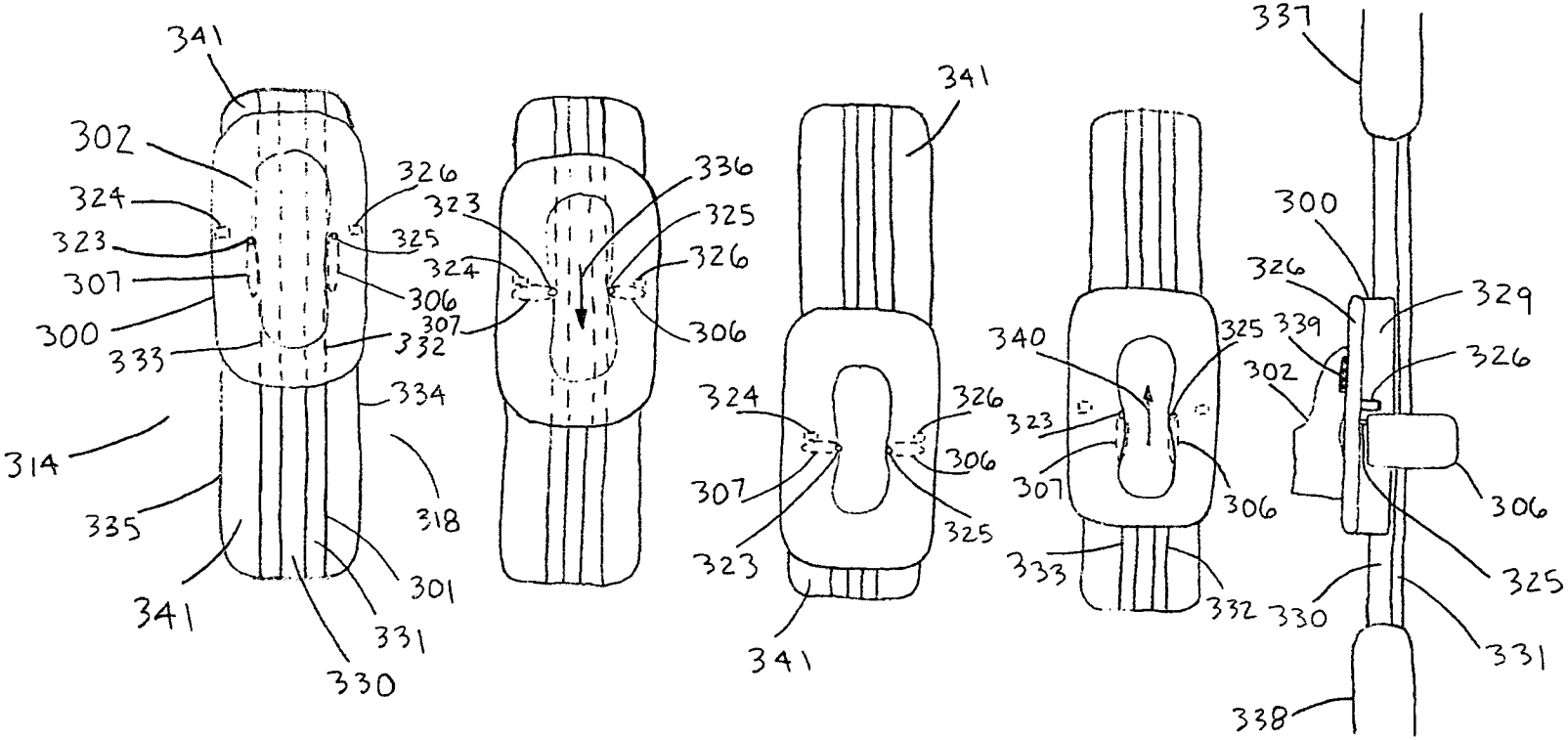
FIGS. 3D-3G are plan views of the right carriage 300 of FIG. 3C in different positions along a linear guide 301.
FIG. 3H is a side view of the right carriage 300 in the position shown in FIG. 3G.

FIGS. 3D-3G are plan views of the right carriage 300 of FIG. 3C in different positions along a linear guide 301, and FIG. 3H is a side view of the right carriage 300 in the position shown in FIG. 3G. The linear guide 301 has a bearing portion 330 and a base portion 331 with a right edge 332 and a left edge 333. Bearings allow the right carriage 300 with base portion 328 and bearing portion 329 to move along the linear guide 301 bearing portion 330. The right carriage 300 and left carriage 303 each have similar bearings, shown in FIG. 3C as ball bearings, and labeled as elements 327 in the left carriage 303.

The paddle blade 306 rotates relative to the right carriage 300 about the vertical axis 325, and the paddle blade 307 rotates relative to the right carriage 300 about the vertical axis 323. The paddle blade 306 has a rotation limit stop 326, and the paddle blade 307 has a rotation limit stop 324. In FIGS. 3C, 3E, and 3F, the paddle blades 306 and 307 are shown to be rotated about their vertical axes and resting against their respective limit stops. The right carriage 300, paddle blades 306 and 307, and the linear guide 301, are positioned in an opening 341 in the SUP 100, where the opening 341 has a right opening edge 334 in the SUP portion 318, and the opening 341 has a left opening edge 335 in the SUP center portion 314.

FIG. 3D shows the right carriage 300 in a forward position relative to the opening 341 in the SUP 100, where the paddle blades 306 and 307 have been rotated by the water away from their limit stops 326 and 324, respectively. FIG. 3E shows the right carriage 300 slid rearward 336 by the rider's foot. When the right carriage 300 is slid rearward 336, movement of the paddle blade 306 relative to the water causes the paddle blade 306 to rotate counterclockwise until it reaches the limit stop 326. Likewise, the paddle blade 307 rotates clockwise until it reaches the limit stop 324. When the paddle blades 306 and 307 reach their limit stops, they are able to apply forward thrust against the water as the rider's foot continues to slide the carriage 300 rearward 336. FIG. 3F shows the right carriage 300 moved to a farther rearward position relative to the opening 341 in the SUP 100.

FIG. 3G shows the right carriage 300 slid forward 340 by the rider's foot. When the right carriage 300 is slid forward 340, movement of the paddle blade 306 relative to the water causes the paddle blade 306 to rotate clockwise away from the limit stop 326. Likewise, the paddle blade 307 rotates counterclockwise away from the limit stop 324. When the paddle blades 306 and 307 move away from their limit stops as shown, they minimize their resistance against the water as the rider's foot continues to slide the carriage 300 forward 340.

FIG. 3H is a side view of FIG. 3G which shows the right carriage 300 being slid forward 340 by the rider. The right foot support 302 is shown removably attached 339 to the right carriage 300, typically removably attached near the front portion of the right foot support 302. The opening 341 in the SUP 100 is bounded in the front of the SUP 100 by a front SUP portion 337, and is bounded in the rear of the SUP 100 by a rear SUP portion 338.

Similarly to the right carriage 300, the left carriage 303 is guided by the left guide 304. As shown, a portion of the left carriage 303 is recessed in the SUP 100 below the top surface 316 of the SUP 100. The left foot support 305 is attached to the left carriage 303, typically removably attached near the front portion of the left foot support 305. In this illustrative embodiment, two left paddle blades 310 and 311 extend into the water below the left carriage 303, and their orientation is determined by the force of the water as the left carriage 303 moves forward and backward.

The paddle blade 310 rotates relative to the left carriage 303 about the vertical axis 317, and the paddle blade 311 rotates relative to the left carriage 303 about the vertical axis 321. The paddle blade 310 has a rotation limit stop 320, and the paddle blade 311 has a rotation limit stop 322. The left carriage 303, paddle blades 310 and 311, and the linear guide 304, are positioned in an opening in the SUP 100, where the opening has a right opening edge in the SUP center portion 314, and the opening has a left opening edge in the SUP portion 319.

In place of mechanical structure that relies on movement of a carriage to alter the position mechanically of paddle blades, an electrical system may be used. An electrical system may sense the position of the rider's foot or an associated carriage and may send a signal, which may be an electrical control signal, to an output actuator, such as a paddle blade actuator, where the signal may indicate the desired position and orientation of the paddle blade. Sensing of the position of the rider's foot or an associated carriage may employ an electrical or mechanical sensor, including but not limited to an optical encoder, a linear encoder, a rotary encoder, a potentiometer, one or more cables, an LVDT, electromagnetics, a Hall Effect sensor, a laser, and an interferometer, and the like. An output actuator, such as a paddle blade actuator, may include a rotary motor, a linear motor, an electric motor, a solenoid, and the like. The paddle blade actuator may be a radio-controlled (RC) electric motor. The signal may be sent from the carriage position sensor to the paddle blade actuator using wires, or may be sent wirelessly. When sent wirelessly, the signal may be sent using electromagnetic waves, Bluetooth, RF, light, sound, and the like.

Figure 4A:
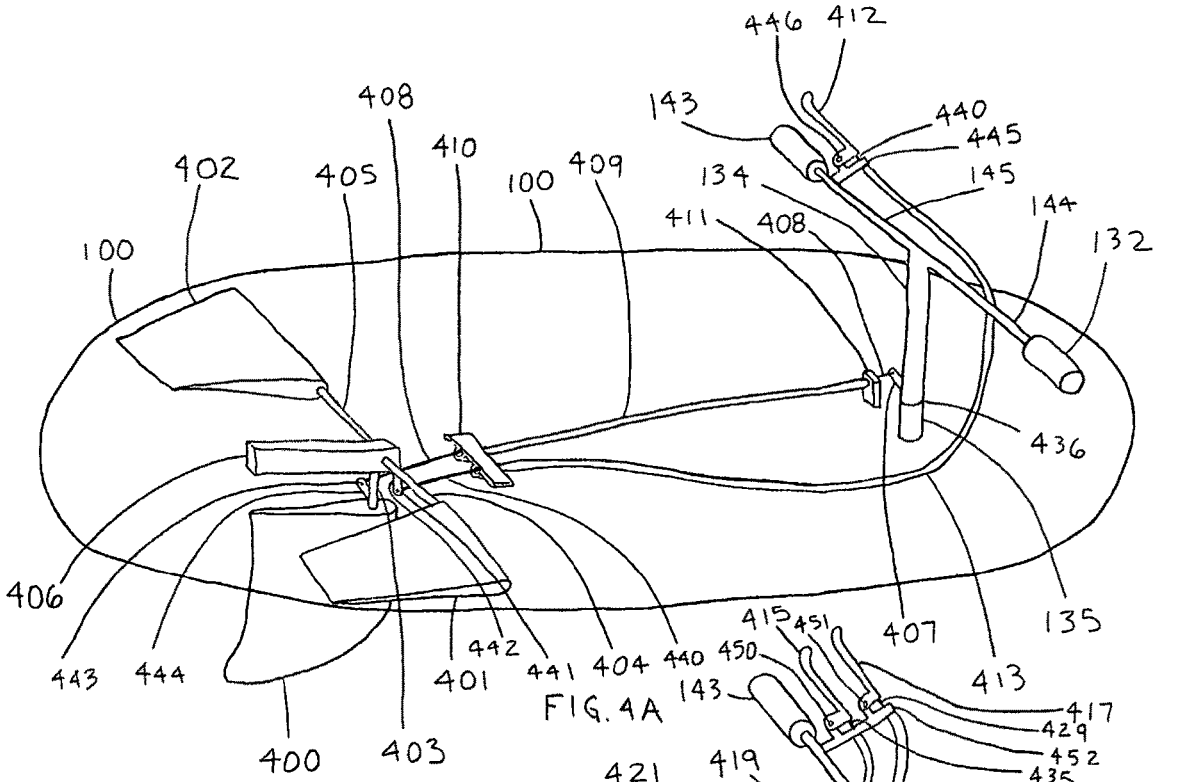
FIGS. 4A-4D provide steering and braking assemblies.

FIGS. 4A-4D provide steering and braking assemblies. FIG. 4A is a perspective view of an embodiment illustrating useful steering and braking assemblies associated with the SUP 100 of FIGS. 1A-1D. FIG. 4A provides a handlebar for steering that comprises the right handlebar portion 144 with right handlebar grip 132, and the left handlebar portion 145 with left handlebar grip 143. The right and left handlebar portions, 144 and 145, are connected to the handlebar neck 134. The handlebar neck 134 is connected by the rotary hinge 136 to the handlebar support 135, which is then connected to the SUP 100, and typically connected to the front portion of the SUP 100.

In FIG. 4A, when the handlebar neck 134 is turned to the right relative to the handlebar support 135, the lever 407 pulls on the cable tendon 408 in the sheath 409, where the cable 408 and sheath 409 comprise a Bowden cable. When the handlebar neck 134 is turned to the left relative to the handlebar support 135, the lever 407 pushes on the cable tendon 408 in the sheath 409. One end of the sheath 409 is attached to the bracket 411, and the other end of the sheath 409 is attached to the bracket 410, where both brackets 411 and 410 are attached to the SUP 100. One end of the cable tendon 408 is attached to the handlebar neck lever 407, and the other end of the cable tendon 408 is attached at the location 443 on the rudder lever 444, that is attached to the rudder rotary joint 403. Pulling and pushing the cable tendon 408 causes the rudder 400 to turn to the desired angle. The cable tendon 408 of FIG. 4A may control a cable tendon such as the cable tendon 434 in FIG. 4C which is inside the sheath 418 attached to the rudder bracket 433, so that when the cable tendon 408 is pulled due to turning the handlebars to the right, the cable tendon 434 that is attached to the cam 436 at the point 437 also pulls on the cam 436 that is attached to the rudder 423, causing the cam 436 and rudder 423 in FIG. 4C to rotate CCW about the rotary joint 426, causing the SUP 100 to turn to the right. When the cable tendon 408 is pushed due to turning the handlebars to the left, the cable tendon 434 that is attached to the cam 436 at the point 437 also pushes on the cam 436 that is attached to the rudder 423, causing the cam 436 and rudder 423 in FIG. 4C to rotate CW about the rotary joint 426, causing the SUP 100 to turn to the left. In the description above, the rudder 423 in FIG. 4C corresponds to the rudder 400 in FIG. 4A, the rotary joint 426 in FIG. 4C corresponds to the rudder rotary joint 403 in FIG. 4A, and the rudder bracket 433 in FIG. 4C corresponds to the rudder bracket 406 in FIG. 4A. The rudder bracket is attached to the SUP 100, typically being attached to the rear of the SUP and equidistant from the right and left edges of the SUP 100. It may be attached to the location that typically is manufactured to receive a fin on an SUP.

In FIG. 4A, the brake lever 412 is attached to the Bowden cable 413 that controls the position of the right brake fin 401 and left brake fin 402. The brake lever 412 can be rotated relative to the handlebar bracket 445 about the revolute joint 446. The brake fin 401 is capable of rotating about the rotary joint 404 relative to the rudder bracket 406. The brake fin 402 is capable of rotating about the rotary joint 405 relative to the rudder bracket 406. One end of the cable tendon 440 is attached to the brake lever 412, and the other end is attached to the location 441 on the brake fin lever 442 that is attached to the brake rotary joint 404. When the brake lever 412 is pulled, the cable tendon 440 causes at least one of the brake fins 401 and 402 to rotate, creating water drag to oppose the forward motion of the SUP 100.

Figure 4B:
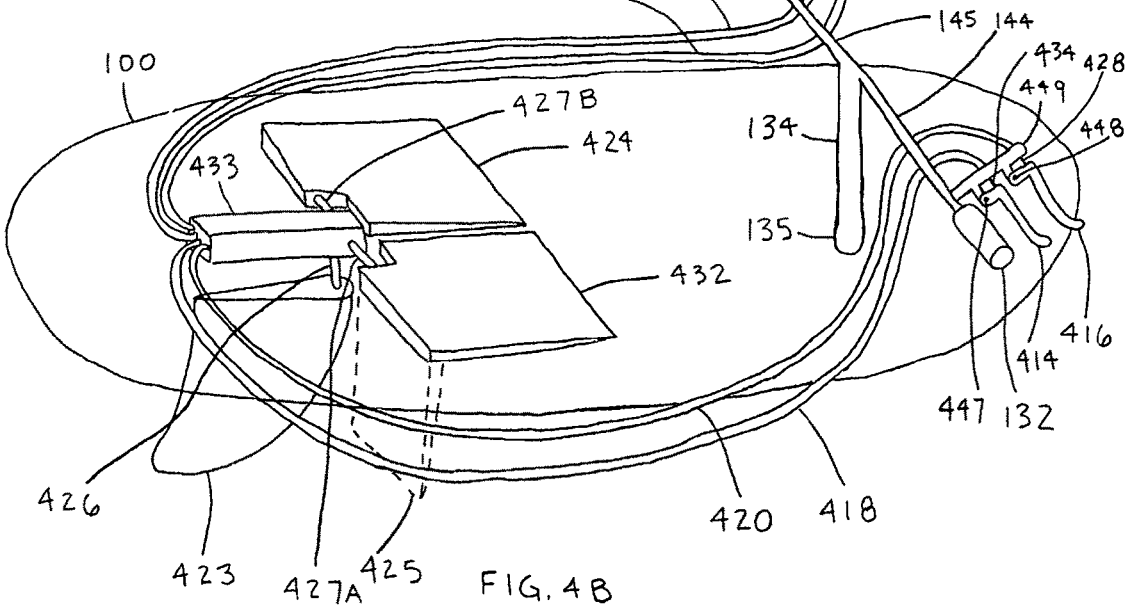
Figure 4C:
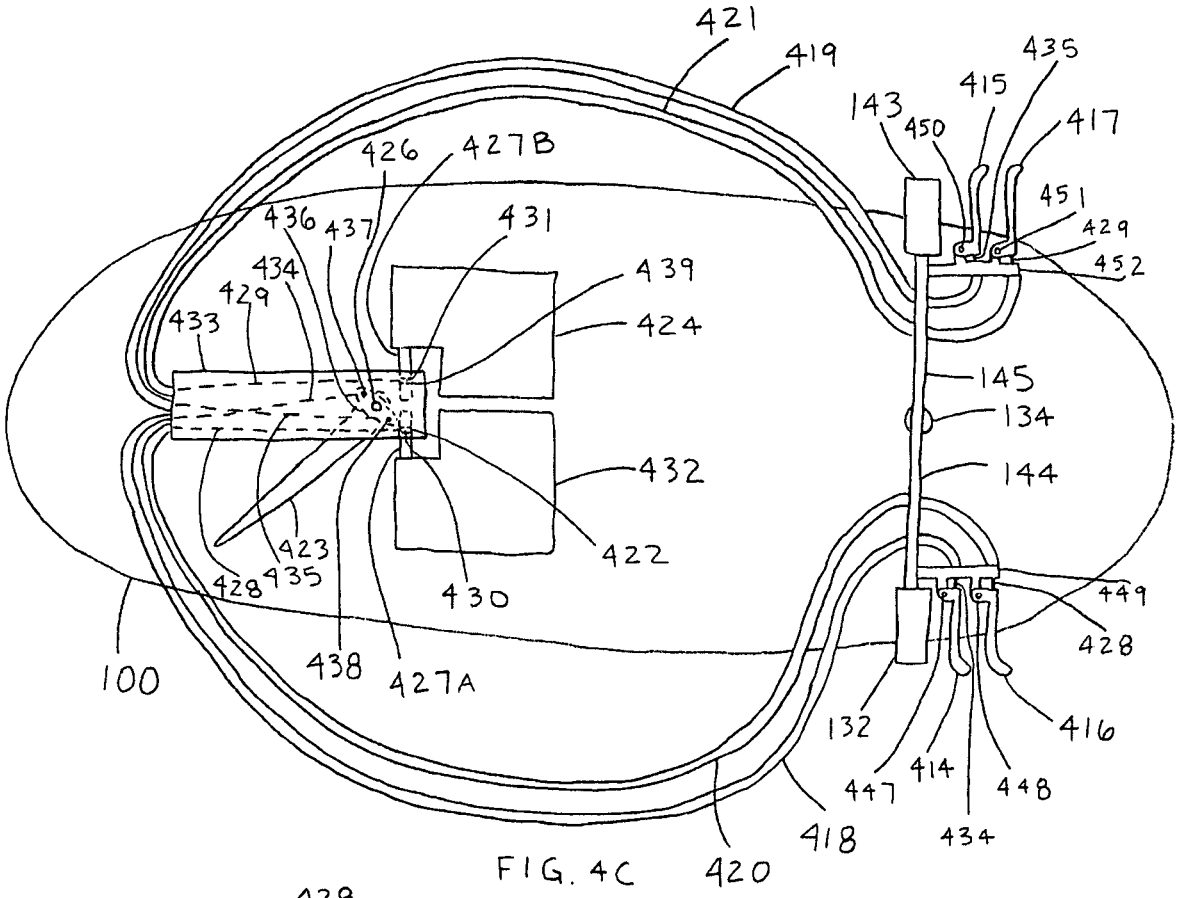
Figure 4D:
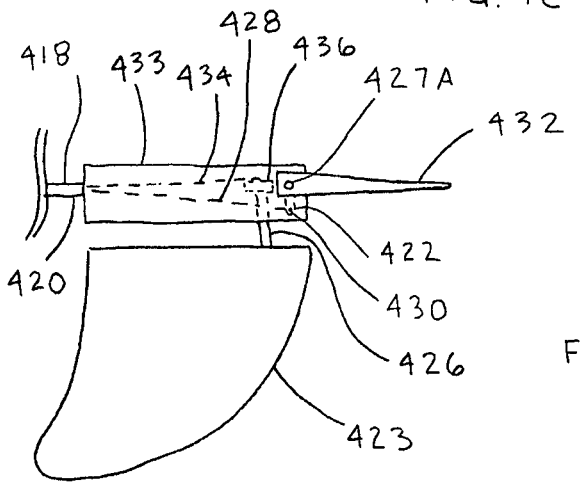

FIG. 4B is a perspective view of another embodiment illustrating useful steering and a braking assemblies associated with SUP 100; FIG. 4C is a top view of the embodiment of FIG. 4B; and FIG. 4D is a side view of the right brake fin of the embodiment of FIG. 4C. FIGS. 4B and 4C provide a handlebar for balance and pressing against when generating thrust. The handlebar comprises a right handlebar portion 144 with right handlebar grip 132, and a left handlebar portion 145 with left handlebar grip 143. The right and left handlebar portions, 144 and 145, are connected to the handlebar neck 134. The handlebar neck 134 is connected to handlebar support 135, which is then connected to the SUP 100, and typically connected to the front portion of the SUP 100.

The right rudder lever 414 and right brake lever 416 each rotate about revolute joints 447 and 448, respectively, relative to the right handlebar bracket 449. The sheaths of the Bowden cables 418 and 420 are supported by the right handlebar bracket 449, and have cable tendons 434 and 428, respectively, inside the sheaths, that are attached to the right rudder lever 414 and right brake lever 416, respectively. When the right rudder lever 414 and the right brake lever 416 are pulled, the cable tendons 434 and 428, respectively, are translated relative to the sheaths of the Bowden cables 418 and 420, respectively.

Similarly, the left rudder lever 415 and left brake lever 417 each rotate about revolute joints 450 and 451, respectively, relative to the left handlebar bracket 452. The sheaths of the Bowden cables 419 and 421 are supported by the left handlebar bracket 452, and have cable tendons 435 and 429, respectively, inside the sheaths, that are attached to the left rudder lever 415 and right brake lever 417, respectively. When the left rudder lever 415 and the left brake lever 417 are pulled, the cable tendons 435 and 429, respectively, are translated relative to the sheaths of the Bowden cables 419 and 421, respectively.

In FIGS. 4B-4C, the right rudder lever 414 is attached to the Bowden cable 418 that controls the position of the rudder 423. The rudder 423 is capable of rotating about the rotary joint 426 relative to the rudder bracket 433. The sheath of the Bowden cable 418 is attached to the rudder bracket 433 and has the cable tendon 434 inside the sheath. When the right rudder lever 414 is pulled, the cable tendon 434 that is attached to the cam 436 at the point 437 also pulls on the cam 436 that is attached to the rudder 423, causing the cam 436 and the rudder 423 in FIG. 4C to rotate CCW about the rotary joint 426, causing the SUP 100 to turn to the right.

The sheath of the Bowden cable 419 is attached to the rudder bracket 433 and has the cable tendon 435 inside the sheath. When the left rudder lever 415 is pulled, the cable tendon 435 that is attached to the cam 436 at the point 438 also pulls on the cam 436 that is attached to the rudder 423, causing the cam 436 and the rudder 423 in FIG. 4C to rotate CW about the rotary joint 426, causing the SUP 100 to turn to the left.

In FIGS. 4B-4D, the right brake lever 416 is attached to the Bowden cable 420 that controls the position of the right brake fin 432. The sheath of the Bowden cable 420 is attached to the rudder bracket 433, and the cable tendon 428 is attached to the right brake fin 432 at location 430 on the lever 422. The right brake fin 432 is capable of rotating about the rotary joint 427A relative to the rudder bracket 433. When the right brake lever 416 is pulled, the Bowden cable 420 causes the right brake fin 432 to rotate down creating water drag on the right side of the SUP 100 to oppose the forward motion of the SUP 100. If only the right brake lever 416 is pulled, the unbalanced drag on the right side of the SUP 100 will also cause the SUP 100 to turn to the right.

In FIGS. 4B and 4C, the left brake lever 417 is attached to the Bowden cable 421 that controls the position of the left brake fin 424. The sheath of the Bowden cable 421 is attached to the rudder bracket 433, and the cable tendon 429 is attached to the left brake fin 424 at location 431 on the lever 439. The left brake fin 424 is capable of rotating about the rotary joint 427B relative to the rudder bracket 433. When the left brake lever 417 is pulled, the Bowden cable 421 causes the left brake fin 424 to rotate down creating water drag on the left side of the SUP 100 to oppose the forward motion of the SUP 100. If only the left brake lever 417 is pulled, the unbalanced drag on the left side of the SUP 100 will also cause the SUP 100 to turn to the left.

Together with, or in place of, any mechanical structure described in this specification that provides movement of a cable or linkage to alter the position mechanically of a turnable rudder or a braking fin, an electrical system may be used. An electrical system may sense the position of an input controller, such as a handlebar, handlebar grip, lever, pedal, carriage, and the like, and may send a signal, which may be an electrical control signal, to an output actuator, such as a rudder, breaking fin, or paddle actuator, where the signal may indicate the desired position and orientation of the rudder, breaking fin, or paddle actuator. Sensing of the position of an input controller may employ an electrical or mechanical sensor, including but not limited to an optical encoder, a linear encoder, a rotary encoder, a potentiometer, one or more cables, an LVDT, electromagnetics, a Hall Effect sensor, a laser, and an interferometer, and the like. A rudder, braking fin, or paddle actuator may include a rotary motor, a linear motor, an electric motor, a solenoid, and the like. The rudder, braking fin, or paddle actuator may be a radio-controlled (RC) electric motor. The signal may be sent from the input controller sensor to the rudder, braking fin, or paddle actuator using wires, or may be sent wirelessly. When sent wirelessly, the signal may be sent using electromagnetic waves, Bluetooth, RF, light, sound, and the like.

Figure 5A:
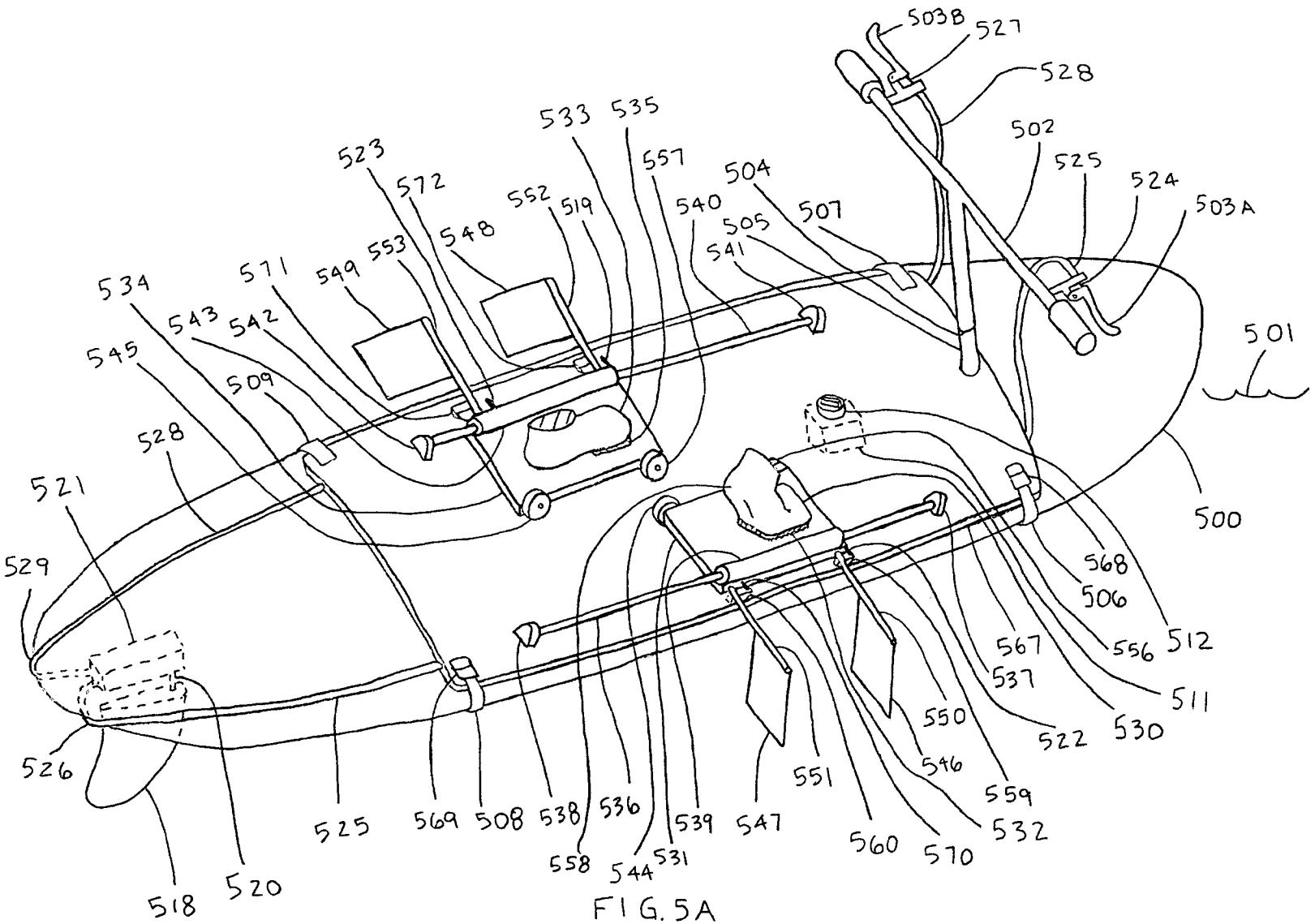
FIG. 5A is a perspective view of a useful embodiment of the invention.

FIG. 5A is a perspective view of a useful embodiment of the invention. The SUP 500 is shown on water 501. The handlebar 502 has right and left levers 503A and 503B, respectively, that may control turning, braking, and the like. The handlebar 502 may not swivel, or it may swivel around rotary joint 504 relative to the handlebar base 505 that is attached to the SUP 500 or to a mounting structure 567. The mounting structure 567 provides a rigid structure to which other elements may be attached to position such elements relative to each other and relative to the SUP 500.

Figure 5C:
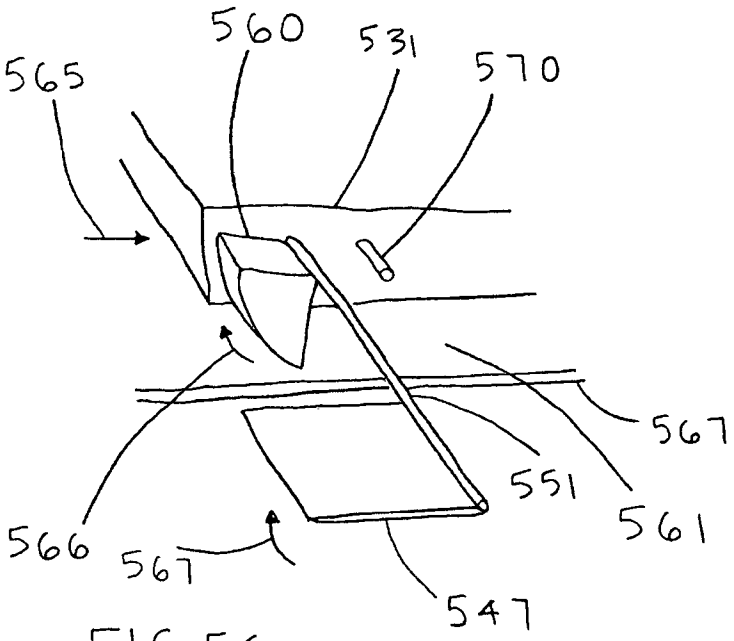
FIG. 5C provides a perspective view of the exemplary embodiment of FIG. 5B in a second state.
Figure 5E:
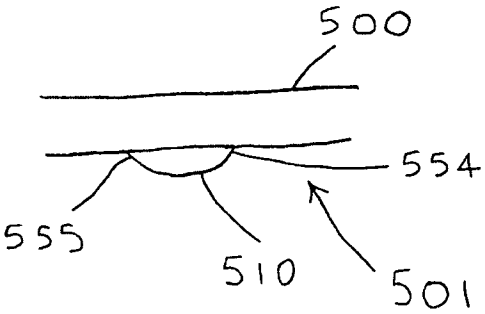
FIG. 5E provides a side view of a low-profile strap positioned against the surface of the SUP in the water.

The mounting structure 567 may be permanently or removably attached to the SUP 500. When the mounting structure 567 is removably attached to the SUP 500, it allows a standard SUP 500 to be retrofit to comprise elements of the subject invention. The mounting structure 567 may fasten to a cavity 511 in the SUP 500. Such a cavity 511 may also be used for hand carrying the SUP 500. FIG. 5D shows details of one embodiment of a protruding member that extends into to the cavity 511 for positioning and fastening. In particular, as shown in FIGS. 5A and 5D, the protruding member may comprise a control 512 that the rider may activate to secure the mounting structure 567 to the SUP 500. The rider may turn a portion of the control 512 to activate it.

In FIG. 5A, the mounting structure 567 is also shown strapped to the SUP 500. Any convenient strap and strap termination method may be used. In FIG. 5A, a front strap 506 is fastened to the front-left portion of the mounting structure 567 by the strap end 507. The front strap 506 is then fastened to the front-right portion of the mounting structure 567 with a termination 568. The termination 568 may comprise any convenient termination and tightening means, including but not limited to a buckle, a loop, Velcro®, and the like. Similarly, a rear strap 508 is fastened to the rear-left portion of the mounting structure 567 by the strap end 509. The rear strap 508 is then fastened to the rear-right portion of the mounting structure 567 with a termination 569. The termination 569 may comprise any convenient termination and tightening means, including but not limited to a buckle, a loop, Velcro, and the like.

In FIG. 5A, the mounting structure 567 has guides on the right and left portions. The guides may comprise linear guides or comprise linear bearings. The right guide 536 is fastened to the mounting structure 567 with a front fastener 537 and a rear fastener 538. The right guide 536 comprises a right bearing 539. The right bearing 539 is attached to a right carriage 531 on which the rider's right foot may be placed. The right bearing 539 may comprise a rotary member, a wheel, roller bearing, ball bearing, a bushing, and the like, which allows the right bearing 539 to move in the direction of the right guide 536 and with low friction. The right carriage 531 may comprise an optional left rear support 544 and an optional left front support 556, which may comprise a rotary member, a wheel, roller bearing, ball bearing, a bushing, and the like. The right bearing 539 and the optional left rear support 544 and optional left front support 556 help to support the force of the rider's right foot on the right carriage 531.

The rider's right foot may be supported on the right carriage 531 with a right foot support 530. The right foot support 530 may cover all or a portion of the rider's right foot. The rider's right foot may be attached to the right carriage 531 or to the right foot support 530 with straps, clips, Velcro, raised surfaces, molded surfaces, and the like. In the illustrative embodiment of FIG. 5A, the right foot support 530 comprises a boot or sock, where the front portion of the boot or sock near the ball of the foot and toes is affixed 532 to the right carriage 531. The right foot support 530 may be removably attached to the right carriage 531. The rear portion 558 of the boot or sock near the heel of the foot may be unaffixed. The right foot support 530 may be removably attached to the right carriage 531 using Velcro, or any other convenient means that resists tangential forces, and can be easily removed if the rider needs to quickly remove his foot, such as if the SUP capsizes.

Forward translation of the right carriage 531 by the rider's right foot causes a right paddle blade to translate forward. FIG. 5A provides two right paddle blades, a forward right paddle blade 546 and a rear right paddle blade 547; although, there may be only one right paddle blade, there may be more than two right paddle blades, or there may be a right rotating wheel comprising a plurality of right paddle blades.

In FIG. 5A, the forward right paddle blade 546 is able to rotate relative to the right carriage 531 about the edge 550. The rear right paddle blade 547 is able to rotate relative to the right carriage 531 about the edge 551. The right paddle blades 546 and 547 may rotate freely in a clockwise sense about the edges 550 and 551, respectively, when the right carriage 531 translates forward in a recovery phase and the water 501 pushes backward against the right paddle blades 546 and 547. The right paddle blades 546 and 547 may rotate freely in a counter-clockwise sense about the edges 550 and 551, respectively, when the right carriage 531 translates backward in a thrust phase and the water 501 pushes forward against the right paddle blades 546 and 547. However, once the right paddle blades 546 and 547 rotate CCW to a mostly downward orientation, as they are shown in FIG. 5A, the right paddle blades typically are prevented from rotating further, for example employing a detent, such that further backward translation of the right carriage 531 causes the right paddle blades 546 and 547 to create forward thrust pushing against the water 501.

A paddle-activating member, such as the left rear support 544 or left front support 556, attached to the right carriage 531, may cause one or both the right paddle blades 546 and 547 to rotate. For example, the left rear support 544 may be a paddle-activating member, and may comprise a wheel or a sector of a wheel, that when it rotates, it turns an axle that is attached to the edge 551 of the right rear paddle blade 547, causing the right rear paddle blade 547 also to rotate. The paddle-activating member may also be a different wheel or sector of a wheel that is not shown, that causes one or more of the right paddle blades 546 and 547 to rotate when the right carriage 531 translates relative to the mounting structure 567. Between the paddle-activating member and the right paddle blades 546 and 547 there may also be gears, cables, a transmission, and the like that give mechanical advantage to the paddle-activating member, or that changes the rate or direction that the right paddle blades 546 and 547 rotate as the right carriage 531 translates.

In FIG. 5A, the left guide 540 is fastened to the mounting structure 567 with a front fastener 541 and a rear fastener 542. The left guide 540 comprises a left bearing 543. The left bearing 543 is attached to a left carriage 534 on which the rider's left foot may be placed. The left bearing 543 may comprise a rotary member, a wheel, roller bearing, ball bearing, a bushing, and the like, which allows the left bearing 543 to move in the direction of the left guide 540 and with low friction. The left carriage 534 may comprise an optional right rear support 545 and an optional right front support 557, which may comprise a rotary member, a wheel, roller bearing, ball bearing, a bushing, and the like. The left bearing 543 and the optional right rear support 545 and optional right front support 557 help to support the force of the rider's left foot on the left carriage 534.

The rider's left foot may be supported on the left carriage 534 with a left foot support 533. The left foot support 533 may cover all or a portion of the rider's left foot. The rider's left foot may be attached to the left carriage 534 or to the left foot support 533 with straps, clips, Velcro, raised surfaces, molded surfaces, and the like. In the illustrative embodiment of FIG. 5A, the left foot support 533 comprises a boot or sock, where the front portion of the boot or sock near the ball of the foot and toes is affixed 535 to the left carriage 534. Similar to the right side, the rear portion of the boot or sock near the heel of the foot may be unaffixed. The left foot support 533 may be removably attached to the left carriage 534. The left foot support 533 may be removably attached to the left carriage 534 using Velcro, or any other convenient means that resists tangential forces, and can be easily removed if the rider needs to quickly remove his foot, such as if the SUP capsizes.

Forward translation of the left carriage 534 by the rider's left foot causes a paddle blade to translate forward. FIG. 5A provides two left paddle blades, a forward left paddle blade 548 and a rear left paddle blade 549; although, there may be only one left paddle blade, there may be more than two left paddle blades, or there may be a left rotating wheel comprising a plurality of left paddle blades.

In FIG. 5A, the forward left paddle blade 548 is able to rotate relative to the left carriage 534 about the edge 552. The rear left paddle blade 549 is able to rotate relative to the left carriage 534 about the edge 553. The left paddle blades 548 and 549 may rotate freely in a clockwise sense about the edges 552 and 553, respectively, until they are mostly aligned with the surface of the SUP 500, as they are shown in FIG. 5A, when the left carriage 534 translates forward in a recovery phase and the water 501 pushes backward against the left paddle blades 548 and 549. The left paddle blades 548 and 549 may rotate freely in a counter-clockwise sense about the edges 552 and 553, respectively, when the left carriage 534 translates backward in a thrust phase and the water 501 pushes forward against the left paddle blades 548 and 549. However, once the left paddle blades 548 and 549 rotate CCW to a mostly downward orientation, the left paddle blades typically are prevented from rotating further, for example employing a detent, such that further backward translation of the left carriage 534 causes the left paddle blades 548 and 549 to create forward thrust pushing against the water 501.

A paddle-activating member, such as the right rear support 545 or right front support 556, attached to the left carriage 534, may cause one or both left paddle blades 548 and 549 to rotate. For example, the right rear support 545 may be a paddle-activating member, and may comprise a wheel or a sector of a wheel, that when it rotates, it turns an axel that is attached to the edge 553 of left rear paddle blade 549, causing the left rear paddle blade 549 also to rotate. The paddle-activating member may also be a different wheel or sector of a wheel that is not shown, that causes one or more of the left paddle blades 548 and 549 to rotate when the left carriage 534 translates relative to the mounting structure 567. Between the paddle-activating member and the left paddle blades 548 and 549 there may also be gears, cables, a transmission, and the like that give mechanical advantage to the paddle-activating member, or that changes the rate or direction that the left paddle blades 548 and 549 rotate as the left carriage 534 translates.

The turning of the handlebar 502 with the shaft 559 about the rotary joint 504 may cause the rudder 518 to turn the SUP 500. Moving the right 503A or left 503B levers may also cause the rudder 518 to turn the SUP 500. To cause the rudder 518 to turn, the handlebar 502 or the levers 503A and 503B are mechanically or electrically connected to the rudder 518. Typical mechanical connections include a wire, cable, Bowden cable, flexible or rigid linkage, and the like, such as described for FIG. 1A. Typical electrical connections include a rotary or linear sensor that senses a control signal and sends the control signal to an actuator, such as a rudder, brake, or paddle actuator. The control signal may be sent using wires or wirelessly, such as by Blue Tooth, RF, and the like. As described previously, an electrical system may be used in place of any mechanical structure described in this specification that provides movement of a cable or linkage to alter the position mechanically of a turnable rudder, a braking fin, or paddle blade.

In FIG. 5A, Bowden cables are shown controlling the turning of the rudder 518. The Bowden cable 525 is shown positioned along the top right portion of the SUP 500, and then wraps around the rear portion of the SUP 500 as shown by the Bowden cable portion 526. The Bowden cable tendon 524 is attached to a fin lever (similar to the cam 436 of FIG. 4C). When the Bowden cable tendon 524 is translated, typically by turning the handlebars 502 or by moving the handlebar lever 503A, the fin lever provides a connection point and mechanical advantage to help rotate the fin 518 about the rotary fin joint with the axis 520 relative to the fin mount 521 (similar to the rotary joint 426 of the rudder 423 and rudder bracket 433 of FIG. 4C). Similarly, the Bowden cable 528 is shown positioned along the top left portion of the SUP 500, and then wraps around the rear portion of the SUP 500 as shown by the Bowden cable portion 529. The Bowden cable tendon 527 is attached to a fin lever (similar to the cam 436 of FIG. 4C). When the Bowden cable tendon 527 is translated, typically by turning the handlebars 502 or by moving the handlebar lever 503B, the fin lever provides a connection point and mechanical advantage to help rotate the fin 518 about the rotary fin joint with the axis 520 relative to the fin mount 521 (similar to the rotary joint 426 of the rudder 423 and rudder bracket 433 of FIG. 4C).

Figure 5B:
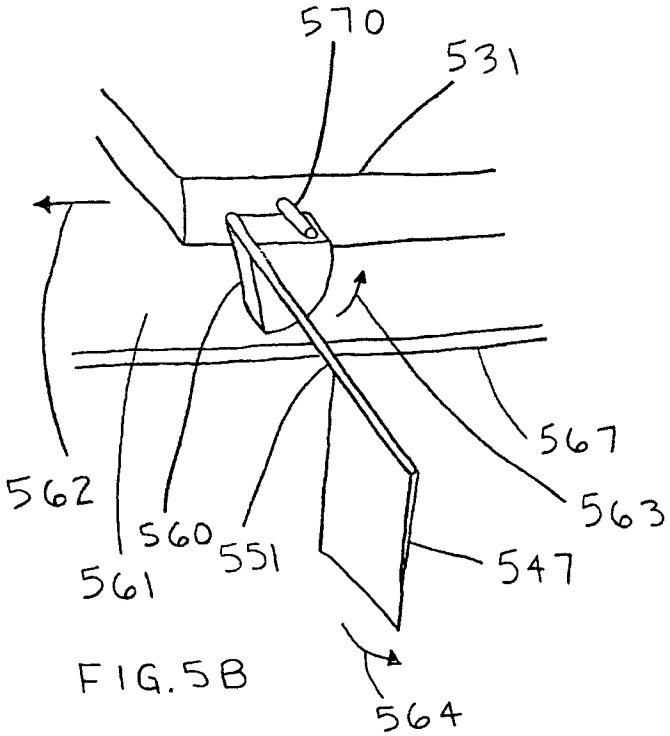
FIG. 5B is a perspective view that provides exemplary embodiments for cams, gears, or wheels that control the position of paddle blades.
Figure 5D:
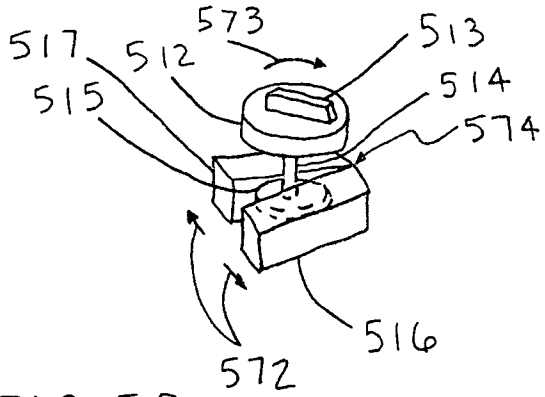
FIG. 5D provides an illustrative embodiment of a fastener assembly for securing the removable mounting structure into a cavity in the SUP.

FIG. 5B is a perspective view that provides exemplary embodiments for cams, gears, or wheels that control the position of paddle blades. A cam 560 may be associated with a wheel 544, such that when the wheel 544 moves toward the rear of the SUP 500, the cam 560 translates to the rear of the SUP 500. Translation of the cam 560 to the rear of the SUP 500 causes it to rotate CCW 563 relative to a stationary element 561 with which it is rotationally engaged. The stationary element 561 may be a portion of the mounting structure 567 or a portion of the SUP 500, such as the top surface. The cam 560 may rotationally engage with the stationary element 561 due to friction, gear teeth, cables, and the like. For illustrative purposes, the cam 560 is shown to be a sector of a disc, where the angle of the sector is selected based on the desired engagement properties. The larger the sector angle, the longer the cam 560 will remain engaged with the stationary element 561 during translation. The cam may also be a worm gear or other engagement system that remains engaged for a desired angle of rotation and then disengages, slips, rotates freely, and the like. As illustrated, after the cam 560 rotates a desired amount, further translation of the cam 560 to the rear of the SUP 500 will not cause it to additionally rotate CCW, since it is no longer rotationally engaged. Rather, the corner of the cam 560 will just drag along the stationary element 561.

The cam 560 is shown attached to the rotation coupler 551, which is attached to the paddle blade 547. The rotation coupler 551 may comprise a rigid or flexible axle, may comprise one or more linkages, one or more gears, one or more cables, a transmission system, and the like. In FIG. 5B, the rotation coupler 551 is shown for illustration purposes as a rigid axle. For clarity of the figure, the associated support structure for the cam 560, the rotation coupler 551, and the paddle blade 547 are not shown. When the cam 560 rotates CCW 563, the paddle blade 547 also rotates CCW 564 due to the rotation coupler 551. It is intended that when the right carriage 531 is translated backward 562 by the rider's right foot, i.e., the thrust phase, the cam 560 will cause the paddle blade 547 to enter the water 501 and remain in an activated position which is typically a substantially vertical orientation, even when there is further backward translation of the right carriage 531. A rotation limiter 570 may be used to physically prevent the cam 560 from rotating further CCW. Alternatively, the rotation coupler 551 or the paddle blade 547 may include limiters that prevent the paddle blade 547 from rotating CCW substantially past the activated position. Accordingly, further translation backward of the right carriage 531 causes the paddle blade 547 to apply pressure against the water 501, providing forward thrust to the SUP 500.

FIG. 5C provides a perspective view of the exemplary embodiment of FIG. 5B in a second state. The cam 560 may be associated with the wheel 544, such that when the wheel 544 moves toward the front of the SUP 500, the cam 560 translates toward the front of the SUP 500. Translation of the cam 560 toward the front of the SUP 500 causes it to rotate CW 566 relative to the stationary element 561 with which it is rotationally engaged. As illustrated, after the cam 560 rotates a desired amount, further translation of the cam 560 toward the front of the SUP 500 will not cause it to additionally rotate CW, since it is no longer rotationally engaged. Rather, the corner of the cam 560 will just drag along the stationary element 561 without causing further rotation.

When the cam 560 rotates CW 566, the paddle blade 547 also rotates CW 567 due to the rotation coupler 551. It is intended that when the right carriage 531 is translated forward 565 by the rider's right foot, i.e., the recovery phase, the cam 560 will cause the paddle blade 547 to exit the water 501 and remain in an inactivated position which is typically a substantially horizontal orientation, even when there is further forward translation of the right carriage 531. Accordingly, further translation forward of the right carriage 531 does not cause the paddle blade 547 to apply pressure against the water 501, so no reverse thrust or resistance to movement along the water 501 is provided to the SUP 500.

Although FIGS. 5B and 5C have been described for the right rear paddle blade 547, the right front paddle blade 546, left rear paddle blade 549, and left front paddle blade 548 may also have similar cams (559, 571, 572, respectively) and detents (552, 523, 519, respectively).

The useful embodiment of FIG. 5A may employ the illustrative embodiment of the braking system employing a Bowden cable 413. The tendon 440 of the Bowden cable 413 is attached to the brake fin lever 442 of the brake fin 401 at the location 441. One of the handlebar levers 503 (or the brake lever 412 of FIG. 4A), or another mechanical or electrical control, may cause the tendon 440 to retract in the direction toward the sheath of the Bowden cable 413. Retracting the tendon 440 in that direction causes the brake fin 401 to rotate CCW around the rotary joint 404 that is attached to the SUP 500 (or to the SUP 100 of FIG. 4A), typically to the underside of the rear portion of the SUP 500, and extending the brake fin 401 farther down into the water, generating a resistive force.

FIG. 5D provides an illustrative embodiment of a fastener assembly for securing the removable mounting structure 567 into a cavity 511 in the SUP 500. FIG. 5D shows details of one illustrative embodiment of the fastener assembly connected to the mounting structure 567 and comprising one or more protruding members 516 and 517, which may be hinged together at one end 574. The protruding member may be a single piece with one or more sides that extend to apply pressure. When the mounting structure 567 is functionally positioned with the SUP 500, the protruding members 516 and 517 of the fastener assembly extend into the cavity 511 of the SUP 500 for further positioning and fastening. In particular, the fastener assembly may comprise a control knob 512 with a ridge 513 for easily grasping that the rider may activate to secure the mounting structure 567 to the SUP 500. For example, the rider may push or turn a portion of the control knob 512 to activate it for securing. In the figure, the control knob 512 is connected by a connecting member 514 to a cam 515. The connecting member 514 may comprise a single shaft, multiple shafts, gears, cables, pulleys, a transmission, one or more links, and the like. In this illustrative embodiment, turning 573 the control knob 512 causes the cam 515 also to turn, which causes the protruding members 516 and 517 to be forced apart in the direction 572, applying pressure to the sides of the cavity 511, and securing the mounting structure 567 to the SUP 500. The cam 515 may be any eccentric member that when rotated moves a portion of the cam 515 to a larger distance from the axis of rotation. The cam 515 may be circular, elliptical, oblong, or egg-shaped. In place of a cam 515 and protruding member 516 and 517, the connecting member 514 may be threaded and screw into a threaded receiving member in the cavity 511.

FIG. 5E provides a side view of a low-profile strap 510 positioned against the surface of the SUP 500 in the water 501. The strap 510 has streamlined leading 554 and trailing 555 edges to minimize water resistance. The low-profile strap may be used for any of straps 506-509.

Figure 6:
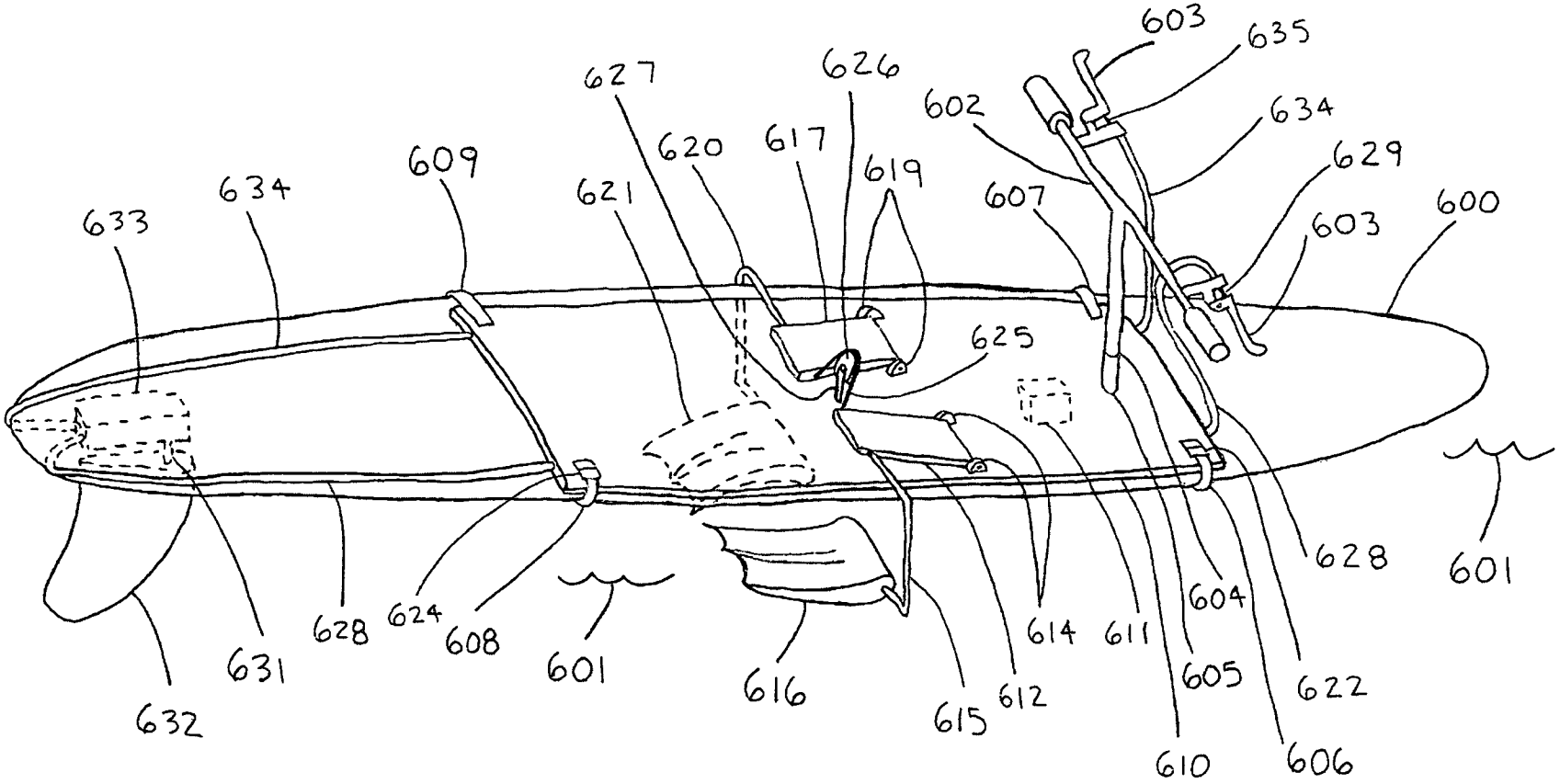
FIG. 6 is a perspective view of a useful embodiment of the invention.

FIG. 6 is a perspective view of a useful embodiment of the invention. The SUP 600 is shown on water 601. The handlebar 602 has right and left levers 603 that may control turning, braking, and the like. The handlebar 602 may not swivel, or it may swivel around rotary joint 604 relative to the handlebar base 605 that is attached to the SUP 600 or to a mounting structure 610. The mounting structure 610 provides a rigid structure to which other elements may be attached to position such elements relative to each other and relative to the SUP 600.

The mounting structure 610 may be permanently or removably attached to the SUP 600. When the mounting structure 610 is removably attached to the SUP 600, it allows a standard SUP 600 to be retrofit to comprise elements of the subject invention. The mounting structure 610 may fasten to a cavity 611 in the SUP 600. Such a cavity 611 may also be used for hand carrying the SUP 600. FIG. 5D shows details of one embodiment of a protruding member that extends into to the cavity 611 for positioning and fastening. In particular, as shown in FIGS. 6 and 5D, the protruding member may comprise a control 512 that the rider may activate to secure the mounting structure 610 to the SUP 600. The rider may turn a portion of the control 512 to activate it.

In FIG. 6, the mounting structure 610 is also shown strapped to the SUP 600. Any convenient strap and strap termination method may be used. In FIG. 6, a forward strap 606 is fastened to the front-left portion of the mounting structure 610 by the strap end 607. The forward strap 606 is then fastened to the front-right portion of the mounting structure 610 with a termination 622. The termination 622 may comprise any convenient termination and tightening means, including but not limited to a buckle, a loop, Velcro®, and the like. Similarly, a rear strap 608 is fastened to the rear-left portion of the mounting structure 610 by the strap end 609. The rear strap 608 is then fastened to the rear-right portion of the mounting structure 610 with a termination 624. The termination 624 may comprise any convenient termination and tightening means, including but not limited to a buckle, a loop, Velcro®, and the like.

In FIG. 6, the mounting structure 610 has a right platform 612. The rider may place their right foot on the right platform 612 and apply pressure using their weight. The right platform 612 may be mechanically connected to the mounting structure 610. When it is connected, the right platform 612 may be rotatably connected to the mounting structure 610 with rotary joints 614 that cause the right platform 612 to rotate along the edge 613.

The right platform 612 is connected to a right flipper 616 by a flipper-connecting member 615. The right flipper 616 may comprise flipper structure similar to a common snorkeling or SCUBA-diving flipper. The flipper-connecting member 615 may be a rigid or flexible structure. In the illustrative embodiment of FIG. 6, the flipper-connecting member 615 is shown comprising a U-shaped connecting member that extends around the right side of the SUP 600, so the right platform 612 may be above the SUP 600 and the right flipper may be below the SUP 600, yet still remain connected.

When the rider steps down on the right platform 612, the downward movement is translated by the flipper-connecting member 615 to the right flipper 616, causing the right flipper 616 to translate downward through the water 601. The physical structure of the right flipper 616 typically comprises a thicker, less flexible end, extending as it gradually narrows to a thin edge. The flipper-connecting member 615 connects near the thicker end of the right flipper 616. So, when the thicker end of the right flipper 616 is translated downward, the right flipper 616 flexes as water 601 presses against it. As the right flipper 616 flexes, the portion of the right flipper 616 nearest the thin edge provides forward thrust, and propels the SUP 600 forward. In FIG. 6, the right flipper 616 is shown as it is starting a downward translation, where the right flipper 616 is curving upward near the thin edge.

In FIG. 6, the mounting structure 610 also has a left platform 617. The rider may place their left foot on the left platform 617 and apply pressure using their weight. The left platform 617 may be mechanically connected to the mounting structure 610. When it is connected, the left platform 617 may be rotatably connected to the mounting structure 610 with rotary joints 619 that cause the left platform 617 to rotate along the edge 618.

The left platform 617 is connected to a left flipper 621 by a flipper-connecting member 620. The left flipper 621 may comprise flipper structure similar to a common snorkeling or SCUBA-diving flipper. The flipper-connecting member 620 may be a rigid or flexible structure. In the illustrative embodiment of FIG. 6, the flipper-connecting member 620 is shown comprising a U-shaped connecting member that extends around the left side of the SUP 600, so the left platform 617 may be above the SUP 600 and the left flipper may be below the SUP 600, yet still remain connected.

When the rider steps down on the left platform 617, the downward movement is translated by the flipper-connecting member 620 to the left flipper 621, causing the left flipper 621 to translate downward through the water 601. The physical structure of the left flipper 621 typically comprises a thicker, less flexible end, extending as it gradually narrows to a thin edge. The flipper-connecting member 620 connects near the thicker end of the left flipper 621. So, when the thicker end of the left flipper 621 is translated downward, the flipper 621 flexes as water 601 presses against it. As the left flipper 621 flexes, the portion of the left flipper 621 nearest the thin edge provides forward thrust, and propels the SUP 600 forward. In FIG. 6, the left flipper 621 is shown as it is starting an upward translation, where the flipper 616 is curving downward near the thin edge.

The right platform 612 may be connected to a left platform 617 with a platform-connecting system, such that when the rider translates the right platform 612 downward, the platform-connecting system causes the left platform 617 to translate upward. One example of a platform-connecting system comprises a pulley 626 supported 627 relative to the SUP 600, where a cable 625 is connected to the right platform 612 and the left platform 617 and passes around a portion of the pulley 626. Using this platform-connecting system, when the right platform 612 is all the way down, the left platform 617 will be as far as it can go up, and vice versa. The intention is that the rider may stand with their right foot on the right platform 612, and their left foot on the left platform 617, and using a walking motion of transferring their weight from one foot to the other, the platforms 612 and 617 will go up and down in an alternating fashion, where movement of each platform 612 and 617 generates forward thrust.

In FIG. 6, Bowden cables are shown controlling the turning of the rudder 632. The Bowden cable 628 is shown positioned along the top right portion of the SUP 600, and then wraps around the rear portion of the SUP 600. The Bowden cable tendon 629 is attached to a fin lever 630. When the Bowden cable tendon 629 is translated, typically by turning the handlebars 602 or by moving one of the handlebar levers 603, the fin lever 630 provides a connection point and mechanical advantage to help rotate the fin 632 about the rotary fin joint 631 relative to the fin mount 633. Similarly, the Bowden cable 634 is shown positioned along the top left portion of the SUP 600, and then wraps around the rear portion of the SUP 600. The Bowden cable tendon 635 is attached to a fin lever 636. When the Bowden cable tendon 635 is translated, typically by turning the handlebars 602 or by moving one of the handlebar levers 603, the fin lever 636 provides a connection point and mechanical advantage to help rotate the fin 632 about the rotary fin joint 631 relative to the fin mount 633.

Figure 7A:
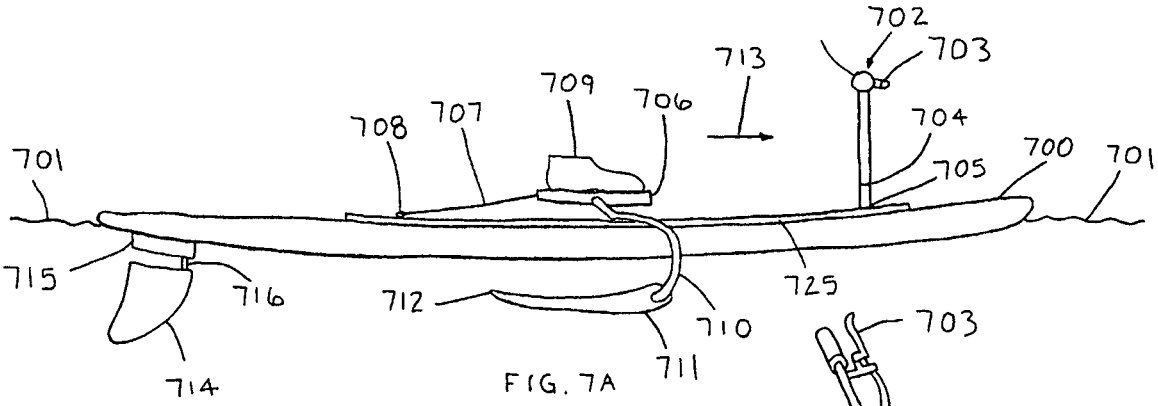
FIGS. 7A, 7B, and 7C provide a side view, perspective view, and top view, respectively, of an illustrative embodiment of an SUP comprising one or more flippers to provide forward thrust.
Figure 7B:
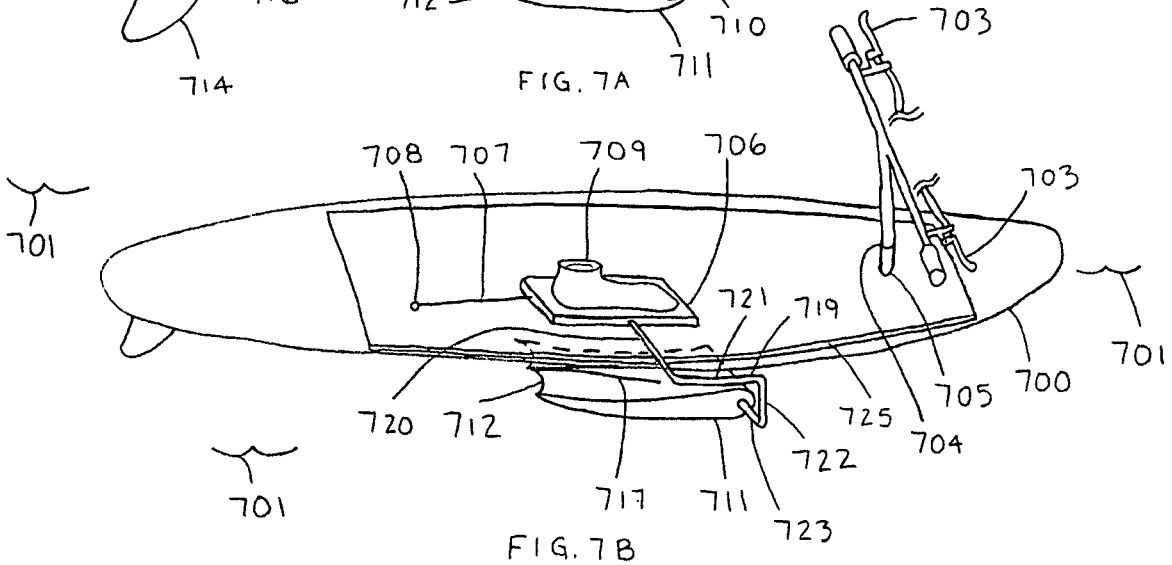
Figure 7C:
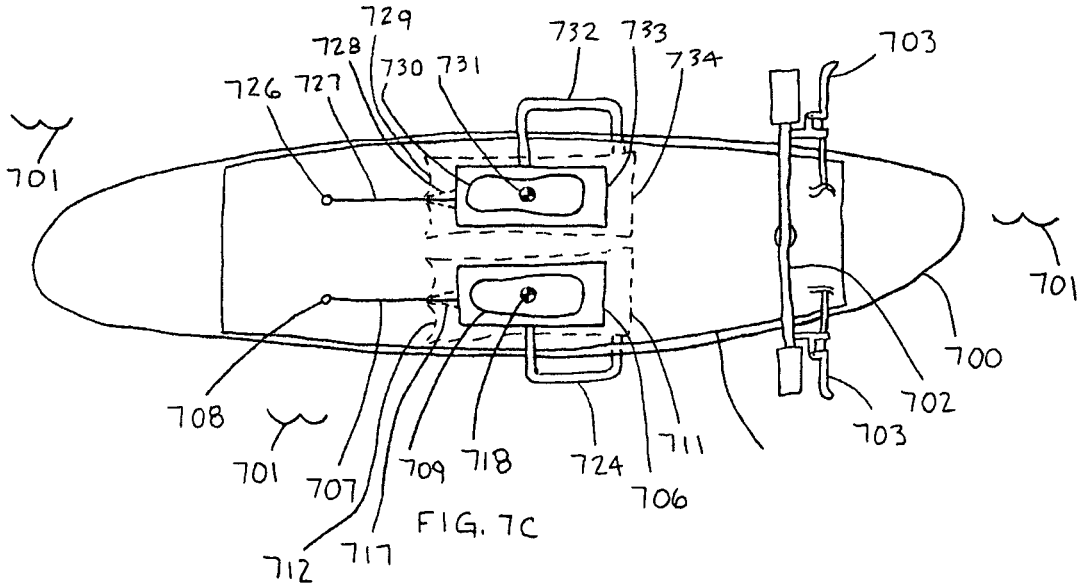

FIGS. 7A, 7B, and 7C provide a side view, perspective view, and top view, respectively, of an illustrative embodiment of an SUP 700 comprising one or more flippers 711 to provide forward thrust. FIGS. 7A-7C are similar to FIG. 6 in that a flipper provides thrust; however, instead of showing the foot platform connected to a mounting structure with a rotary joint, as shown in FIG. 6, here the connection is shown as a flexible cable or articulated link. Additionally, in FIG. 7, no mounting structure is shown; although, a mounting structure may be conveniently used. Instead, steering and thrust members are shown connected directly to the SUP 700.

FIG. 7A is a side view of a useful embodiment of the invention. The SUP 700 is shown on water 701. The handlebar 702 has right and left levers 703 that may control turning, braking, and the like. The handlebar 702 may not swivel, or it may swivel around rotary joint 704 relative to the handlebar base 705 that is attached to the SUP 700.

FIG. 7A provides a foot platform 706, however a plurality of platforms may be used. There may be a right and a left platform. There may be platforms for a plurality of riders, such as a right and left front platform, and a right and left rear platform.

The rider may place their foot on the foot platform 706 and apply pressure using their weight. The foot platform 706 may be mechanically connected to the SUP 700. When it is connected, the platform 706 may be connected to the SUP 700 with a thrust-connecting member 707 attached to the SUP 700 by the attachment member 708. The thrust-connecting member 707 may be a flexible cable, a flexible tendon, a flexible rod, a rigid rod that is articulated, a rigid rod that is pinned at at least one end, and the like.

The foot platform 706 is connected to a flipper 711 by a flipper-connecting member 710. The flipper 711 may comprise flipper structure similar to a common snorkeling or SCUBA-diving flipper. The flipper-connecting member 710 may be a rigid or flexible structure. In the illustrative embodiment of FIG. 7, the flipper-connecting member 710 is shown comprising a U-shaped flipper-connecting member that extends around the right side of the SUP 700, so the foot platform 706 may be above the SUP 700 and the right flipper may be below the SUP 700, yet still remain connected.

When the rider steps down on the foot platform 706, the downward movement is transferred by the flipper-connecting member 710 to the flipper 711, causing the flipper 711 to translate downward through the water 701. The physical structure of the flipper 711 typically comprises a thicker, less flexible end, extending as it gradually narrows to a thin edge 712. The flipper-connecting member 710 connects near the thicker end of the flipper 711. So, when the thicker end of the flipper 711 is translated downward, the flipper 711 flexes as water 701 presses against it. As the flipper 711 flexes, the portion of the flipper 711 nearest the thin edge 712 provides forward thrust 713, and propels the SUP 700 forward. In FIG. 7, the flipper 711 is shown as it is starting a downward translation, where the flipper 711 is curving upward near the thin edge 712.

A foot support 709 is attached to the foot platform 706. The foot support 709 is used to secure the rider's foot to the foot platform 706. The foot support 709 may include a cavity like the boot portion of a snorkeling or SCUBA-diving flipper. The foot support 709 may include a Velcro strap to help secure the rider's foot. The foot support 709 may include a shoe or boot, which may include a Velcro strap to help secure the rider's foot in the shoe or boot, or which may secure the shoe or boot to the foot platform 706. The foot support 709 may include an adjustable clam-like structure that is adjusted with a ratcheting mechanism to provide a snug support of the rider's foot. The foot support 709 may include a boot similar to a snow ski boot, which may have adjustable buckles or straps. The shoe or boot may have snap release that disengages from the foot platform 706, such as if the rider where to tip over the SUP 700 and need to separate from the SUP 700.

The thrust-connecting member 707 allows the rider to move their foot up and down. When the thrust-connecting member 707 is a flexible cable, the rider can also move their foot rearward, and forward until the cable is fully extended. When the thrust-connecting member 707 is a flexible cable, the intention is that the rider may more freely walk around on the SUP and direct the flipper 711 attached to the foot platform 706 to provide thrust in a variety of directions, where the thrust is transferred from the flipper 711 to the SUP 700 at the attachment member 708 when the cable is fully extended. The cable may also provide the function of a leash connecting the rider to the SUP 700. When the rider's foot is firmly secured to the foot platform 706, and the cable is fully extended, both lifting up and pressing down of the rider's foot may generate thrust in the direction the rider's foot is pointing.

FIG. 7B provides a perspective view of the embodiment of FIG. 7A. However, in FIG. 7B, the flipper-connecting member 719 is shown comprising a plurality of link portions. The number of link portions may vary, as may the angles connecting them. The link portions may be straight or curved. In the illustrative embodiment of FIG. 7B, the flipper-connecting member 719 comprises four link portions arranged to position the foot platform 706 at a desired location relative to the flipper 711. In the illustrative embodiment of FIG. 7B, the foot platform 706 is connected to a first link portion 720 that extends to the side of the foot platform 706 and extends out past the right edge of the SUP 700. The first link portion 720 is connected at substantially 90 degrees to the second link portion 721 which extends substantially forward or backward. The second link portion 721 is connected at substantially 90 degrees to the third link portion 722 that extends downward toward the water. The third link portion 722 is connected at substantially 90 degrees to the fourth link portion 723 that extends back under the SUP and connects to the flipper 711.

The flipper 711 is also shown with an optional ridge 717 that may be used to provide bending reinforcement to the flipper 711. The dimensions, design, and material of the ridge 717 may be selected to provide a desire curvature versus speed of up and down translation of the flipper 711. Such a ridge may be used on any of the other flippers, paddles and fins of the illustrative embodiments.

The flipper 621 of FIG. 6, the flipper 711 of FIGS. 7A-7C, and the flipper 800 of FIG. 8 may be made of rubber, plastic, composite, common flipper materials, or any convenient material that is compatible with water. Typically, the flippers are made from a flexible material and/or the flippers are allowed to rotate about one end.

FIG. 7C provides a top view of the embodiment of FIG. 7A. However, in FIG. 7C, the flipper-connecting member 724 is shown comprising a U-shaped link. The dimensions of the flipper-connecting member 724 are selected to place the center of force 718 from the foot platform 706 at the desired location relative to the flipper 711. For instance, the center of force 718 may be positioned over the flipper 711 so the rider does not perceive an uncomfortable force on their ankle. As the center of force 718 is moved rearward, more of the force is perceived by the rider to be exerted by their heel. Similarly, as the center of force 718 is moved forward, more of the force is perceived by the rider to be exerted by their toe.

In FIGS. 7B and 7C, the outline of the SUP 700 is not intended to limit the placement of the foot platform 706, the thrust-connecting members, the flipper-connecting members, and the flippers, and the like.

Figure 8B:
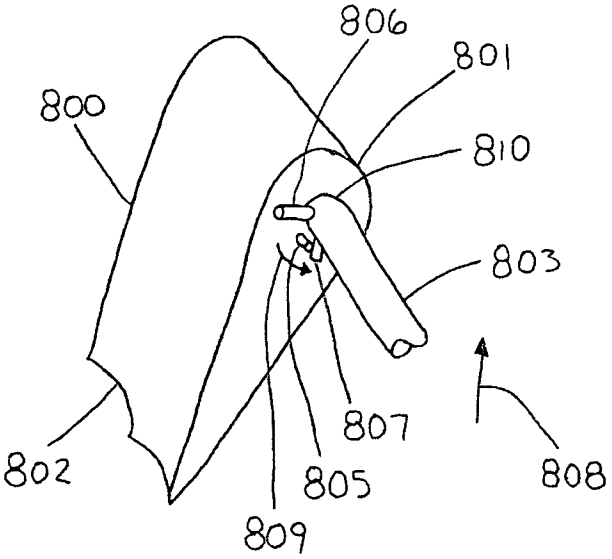
FIGS. 8A and 8B provide perspective views of a flipper with a connected end and a free end.
Figure 8A:
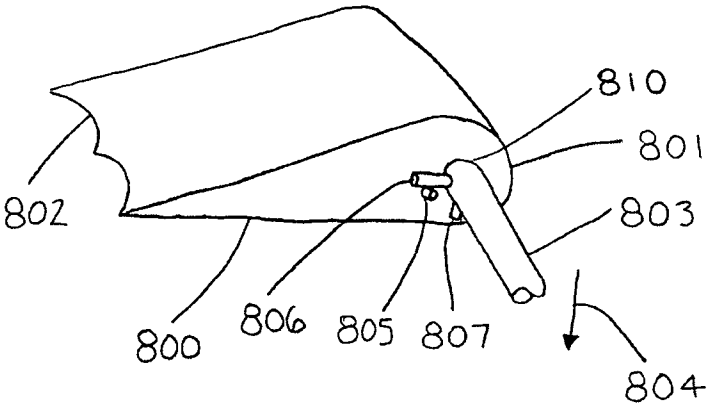

FIGS. 8A and 8B provide perspective views of a flipper 800 with a connected end 801 and a free end 802. FIG. 8A provides the flipper 800 in a first orientation relative to a flipper-connecting member 803. FIG. 8B provides the flipper 800 in a second orientation relative to the flipper-connecting member 803. The flipper 800 may be flexible or substantially inflexible. The assembly of FIGS. 8A and 8B provides that thrust is primarily generated when the rider presses down on a foot platform connected to the flipper-connecting member 803; but when the rider lifts their foot, they feel relatively little resistance. The flipper-connecting member 803 of FIGS. 8A and 8B may conveniently replace the flipper 616 and be connected to the flipper-connecting member 615 of FIG. 6, replace the flipper 621 and be connected to the flipper-connecting member 615 of FIG. 6, or replace the flipper 711 and be connected to the flipper-connecting member 710 of FIG. 7A, the flipper-connecting member 719 of FIG. 7B, or the flipper-connecting member 724 of FIG. 7C.

In FIG. 8A, when the rider causes the flipper-connecting member 803 to translate downward 804, such as when the rider puts weight on an associated foot platform, water applies a force against the bottom surface of the flipper 800, causing it to rotate CW relative to the flipper-connecting member 803 and about the rotary joint 810 near the connected end 801, until the rotation stopper 805 on the flipper 800 contacts the detent 806 on the flipper-connecting member 803, preventing further rotation. During CW rotation, the rotation may be free without resistance, or rotary resistance may be added, but typically resistance is added only when the flipper 800 is flexible. When further rotation is prevented, further downward translation 804 of the flipper-connecting member 803 provides forward thrust generated from the flipper 800 and transmitted to the SUP via the flipper-connecting member 803.

FIG. 8B provides the case where the flipper-connecting member 803 is lifted. In this case, the flipper 800 rotates CCW 809 about the rotary joint 810, unless the rotation stopper 805 on the flipper 800 contacts the detent 807 on the flipper-connecting member 803, preventing further rotation. During CCW rotation, typically the rotation is free without resistance; although, rotary resistance may be added. When the rotation is free and without resistance, it allows the rider to easily lift their foot, so they don't need to work their quadriceps much during the recovery phase.

After the flipper 800 is lifted and there is little or no vertical movement of the flipper-connecting member 803 as the SUP is gliding, the flipper 800 will freely rotate CW to a substantially horizontal orientation due to the force of the water. It may be desirable to make the flipper 800 from a buoyant material to cause the flipper 800 to more quickly rotate to a substantially horizontal orientation to reduce drag. Otherwise, once the SUP slows its glide, the flipper 800 may start rotating CCW towards a more vertical orientation due to its weight and provide more drag, in addition to not being in a good orientation to initiate the next downward thrust phase.

Further general discussion of the embodiments of FIGS. 7A-7C and FIGS. 8A-8B follows:

1. The flipper is typically positioned under the foot so the center of force from the flipper passes through the center of the foot, so there is no twisting of the foot.

2. The connecting member from the shoe platform to the flipper is streamlined to pass through water. The connecting member may have some springiness to it.

3A. The side bar that rotates relative to the flipper is prevented by a detent (1) from rotating substantially past horizontal when pushing down with the foot. When lifting the foot, the flipper may rotate downward freely, or there may be torsional resistance, or there may be another detent (2) that prevents the flipper from angling down too far. That is, the rider may feel some resistance upon raising their foot, which exercises the quad.

3B. Alternately, the side bar may not rotate relative to the flipper, and the flipper flexes to provide thrust.

3C. Alternately, the side bar may deflect torsionally when lifting the foot or/and pressing down.

4A. The side bar may detach from the shoe/foot platform.

4B. The shoe platform may detach from the shoe. For example, clips, straps, Velcro, and the like, may be used.

5. Right and left SUP flippers are best used together.

Figure 9A:
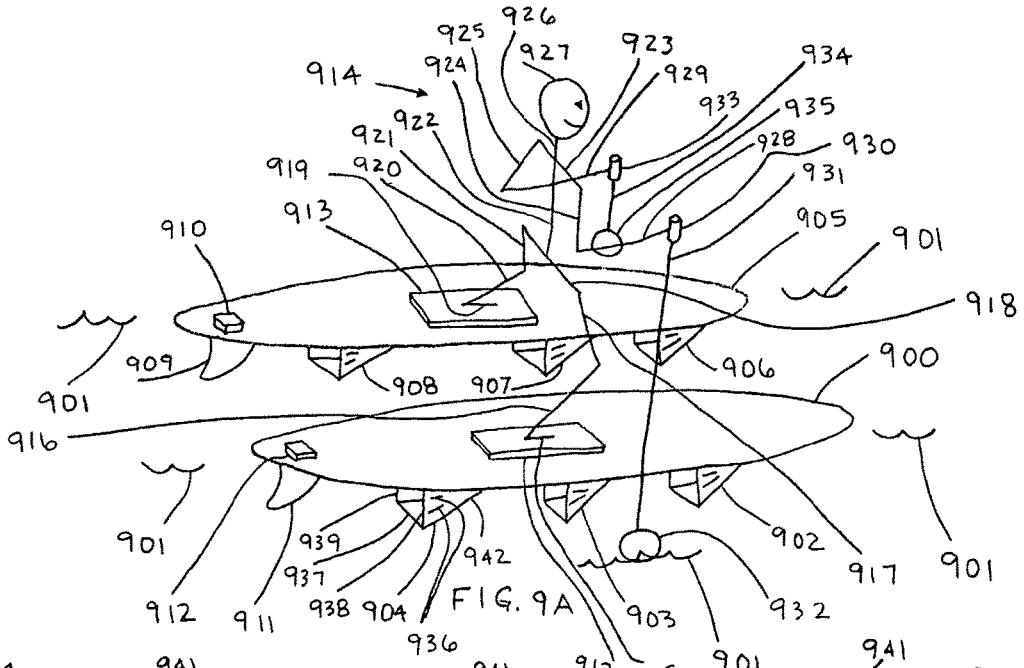
FIG. 9A is a perspective view of an illustrative embodiment of a plurality of SUP members, each comprising one or more thrust actuators for providing forward thrust.

FIG. 9A is a perspective view of an illustrative embodiment of a plurality of SUP members 900 and 905, each comprising one or more thrust actuators 902, 903, 904, 906, 907, and 908 for providing forward thrust. In FIG. 9A, no mounting structure or breaking assembly is shown; although, a mounting structure and breaking assembly may be conveniently used. Instead of an optional mounting structure, foot supports 912 and 913, as well as thrust actuators 902, 903, 904, 906, 907, and 908, are shown connected directly to the SUPs 900 and 905.

The SUP 900 is shown floating on water 901. The rider/user 914 shown for simplicity as a stick figure is representative of a mammal, such as a human, having head 927, neck 926, shoulders 923, right humerus 924, right forearm 928, with their right hand holding the right handle 930, and further having left humerus 925, left forearm 929, with their left hand holding left handle 933, and further having torso 922, hips 918, right thigh 917, right shin 916, and right foot 915 on right foot support 912, and further having left thigh 921, left thin 920, and left foot 919 on left foot support 913.

Attached to the bottom of right SUP 900 is at least one thrust actuator. Three thrust actuators are shown, including a front thrust actuator 902, a middle thrust actuator 903, and a rear thrust actuator 904. Similarly, attached to the bottom of left SUP 905 is at least one thrust actuator. Three thrust actuators are shown, including a front thrust actuator 906, a middle thrust actuator 907, and a rear thrust actuator 908. An example suitable thrust actuator is further provided in FIGS. 9B-9D.

The extension structure 931 connects the right handle 930 to right balance float 932. Similarly, the extension structure 934 connects the left handle 933 to left balance float 935. The rider 914 may hold the handles 930 and 932 to help remain balanced by applying force on the handles 930 and 932 in the direction of the balance floats 932 and 935. The balance floats 932 and 935 may be hollow members, low-density members such as foam members, inflatable member such as inflatable balls, or any other suitable buoyant object to help the rider 914 remain balanced.

One or both of the handles 930 and 932 may comprise steering and/or braking controls (not shown). Such controls may include a rotary control, a squeeze control, a tilt control, a button control, a pressure control, a twist control, a lever, a controller such as found on a video game control input, and the like. The steering and/or breaking controls may wirelessly communicate with, or otherwise affect, an associated steering and/or braking actuator. A single steering and/or braking control may control the steering and/or braking actuator for either or both SUPs 900 and 905. A wireless right steering/braking actuator 912 is provided for SUP 900, and a wireless left steering/braking actuator 910 is provided for SUP 905. The wireless right steering/braking actuator 912 may control the right steering fin 911 and/or the left steering fin 909. Similarly, the wireless left steering/braking actuator 910 may control the left steering fin 909 and/or the right steering fin 911. A braking actuator is not explicitly shown, but may take any form, including a braking fin actuator assembly such as provided by FIGS. 4A-4D.

Figure 9B:
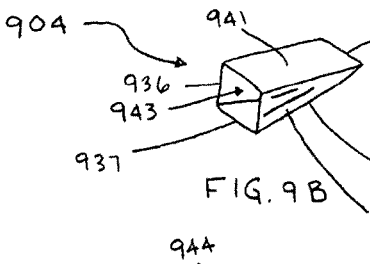
FIG. 9B is a perspective view of a thrust actuator, such as may be used in FIG. 9A.

FIG. 9B is a perspective view of the thrust actuator 942, such as may be used in FIG. 9A. The thrust actuator 942 is collapsible. The thrust actuator 942 typically has two rigid surfaces connected by two flexible surfaces. In FIG. 9B, the thrust actuator 942 is fastened to the bottom surface of an SUP by a first rigid surface 941. The rigid surface 941 is connected to a second rigid surface 937 by flexible sides 936. The first rigid surface 941 may also be connected to the second rigid surface 937 by a hinge 940. The flexible sides may include bellow folds or other structure to facilitate easy, complete, and repeatable collapsing of the second rigid surface 937 against the first rigid surface 941. If the thrust actuator is substantially wedge shaped, then when the SUP 900 is traveling through a fluid, such as water, in the direction of the hinged end 940 of the thrust actuator 942, the second rigid surface 937 will collapse on its own against the first rigid surface 941, such that the thrust actuator provides little resistance to travel. Conversely, if the SUP 900 is traveling in the other direction, i.e., toward the cavity opening 943 and away from the hinged end 940, then the opening 943 will remain open and capture fluid, providing a resistive force to travel in that direction. Accordingly, as the rider 914 slides their foot 915 forward and their foot 919 backward (or vice versa), the SUP 900 will also slide forward and SUP 905 backward; however, due to the difference in forward/backward sliding resistances, SUP 900 will slide forward more than SUP 905 will slide backward, where SUP 900 is essentially pushing forward against the resistive force provided by SUP 905. Thus, as the rider 914 repeatedly slides their feet forward and backward, but 180 degrees out of phase, the rider 914 will achieve net forward travel, i.e., in the direction of the hinges 940 and away from the cavities 943.

Figure 9C:
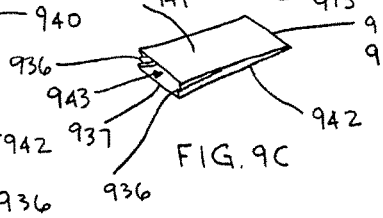
FIG. 9C is a perspective view of the collapsed thrust actuator of FIG. 9B.

FIG. 9C is a perspective view of the collapsed thrust actuator of FIG. 9B.

Figure 9D:
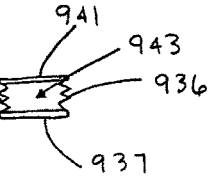
FIG. 9D is an end view of a partially collapsed thrust actuator.

FIG. 9D is an end view of a partially collapsed thrust actuator. Although not required, FIG. 9D provides that the right and left flexible sides 936 comprise a bellows fold. The bellows fold may comprise somewhat rigid slats connected by flexible material, much like an accordion. The flexible material may be plastic, vinyl, fabric, polypropylene, nylon, polyurethane laminate (PUL), and the like. Typically, the material will fold without much force required, so the thrust actuator easily collapses, and the material should provide some resistance to fluid flowing through it to generate a resistive force when the SUP, to which the thrust actuator is attached, is pushed backwards.

Figure 9E:
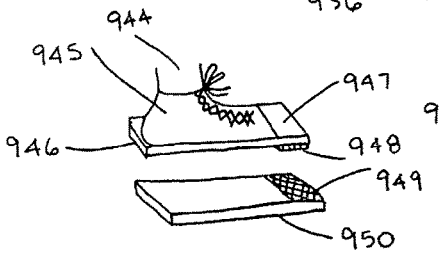
FIG. 9E is a perspective view of means for securing a foot to a foot support.

FIG. 9E is a perspective view of means for securing a foot to a foot support. A foot attached to leg portion 944 is inserted into a foot holder 945. The foot holder 945 may have structure similar to a laced show, a slip-on shoe, a waterski boot, which may be adjustable, a water sock, a sandal, and the like. The foot holder 945 comprises a holder base 946 that may be removably fastened to the foot support 950. In FIG. 9E, the holder base 946 is flexible about to be removably fastened by the fastening surface 948 near the toe end 947 to a mating fastening surface 949 on the foot support 950. One suitable fastening surface 948 is loop Velcro®, and a suitable mating fastening surface 949 is hook Velcro. The loop and hook Velcro surfaces may be swapped. In FIG. 9E, the toe end 947 of the holder base 946 may comprise loop Velcro 948, and it may be removably mated to hook Velcro 949 on the foot support 950. The holder base 946 may be any flexible material, such as rubber, neoprene, fabric, and the like. The holder base 946 may be attached to the foot support 950 at any point, but is typically fastened near the ball of the foot or toe end of the holder base to make it easy for the rider 914 to lift their heel, like a Nordic snow skier. The holder base 946 may be removably attached to the foot support 950 using any convenient means, including Velcro, a snow-ski binding, a snap, and the like. The removable attachment should provide transfer of tangential forces, but easily separate when vertical forces are applied, such as if the rider falls from the SUP.

Figure 9F:
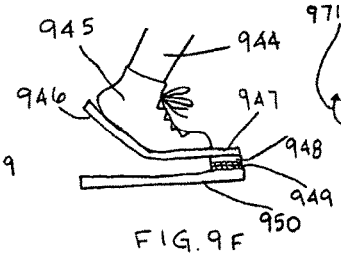
FIG. 9F is a side view of the apparatus of FIG. 9E, where the rider has lifted their heel, such as when pushing rearward.

FIG. 9F is a side view of the apparatus of FIG. 9E, where the rider 914 has lifted their heel, such as when pushing rearward. FIG. 9F also provides the holder base 946 already removably fastened by fastening surface 948 to the fastening surface 949 of the foot support 950.

Figure 9G:
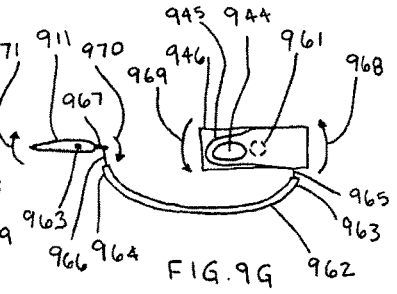
FIG. 9G is a top view of a steering control and actuator assembly.

FIG. 9G is a top view of a steering control and actuator assembly. A foot at the end of the leg 944 is held by the foot holder 945 to the holder base 946. The holder base 946 may rotate or pivot around the rotary joint 961. When the holder base 946 rotates counter clockwise, as shown by the arrows 968 and 969, the holder base pulls on one end 965 of a tendon of a Bowden cable with sheath 962. One end 963 of the sheath 962 of the Bowden cable is attached to the SUP near the holder base 946, and the other end 964 of the sheath 962 is attached to the SUP near the steering rudder 911. The other end 966 of the tendon of the Bowden cable exits the end 964 of the sheath and is attached to a rudder attachment 967. Accordingly, when the holder base rotates counter clockwise, the steering rudder 911 rotates clockwise about the rotary joint 963, as shown by the arrows 970 and 971. So, the rider 914 may slide an SUP forward and backward, and may also turn their foot to cause the SUP also to turn. FIG. 9G is a mechanical steering controller and actuator; however, the Bowden cable may be replaced by a rotation sensor wirelessly communicating a rotation signal to a rotation actuator functionally related to a steering rudder, such as described in FIG. 9A.

Figure 9H:
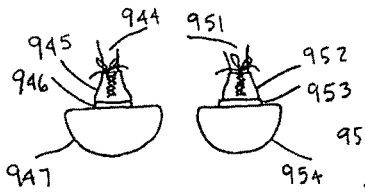
FIG. 9H is a front end view of one embodiment of SUPs, where the curvature of the bottoms of the SUPs are substantially symmetrically curved.

FIG. 9H is a front end view of one embodiment of SUPs 900 and 905, where the curvature of the bottoms of the SUPs 900 and 905 are substantially symmetrically curved. Legs 944 and 951 are held by foot holders 945 and 952, respectively, which are supported by holder bases 946 and 953, respectively, which are removably attached to SUPs 900 and 905 with cross sections 947 and 954, respectively.

Figure 9I:
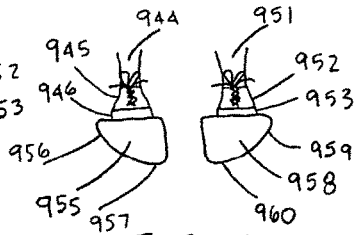
FIG. 9I is a front end view of another embodiment of SUPs, where the curvature of the bottoms of the SUPs are not symmetrically curved.

FIG. 9I is a front end view of another embodiment of SUPs 900 and 905, where the curvature of the bottoms of the SUPs 900 and 905 are not symmetrically curved. Instead, the depth of the SUPs 900 and 905 are deeper in one area. Legs 944 and 951 are held by foot holders 945 and 952, respectively, which are supported by holder bases 946 and 953, respectively, which are removably attached to SUPs 900 and 905 with cross sections 955 and 958, respectively. Cross section 955 has a deeper portion 957 and a shallower portion 956, while cross section 958 has a deeper portion 960 and a shallower portion 959. Having deeper and shallower portions can improve overall balance by providing more buoyant force where there is more weight load.

Figure 9J:
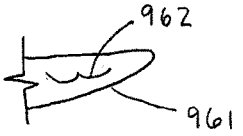
FIG. 9J is a side view of one exemplary front end of the SUPs, showing an exemplary fluid/water level.

FIG. 9J is a side view of one exemplary front end 961 of the SUPs 900 and 905, showing an exemplary fluid/water level 962.

Figure 10A:
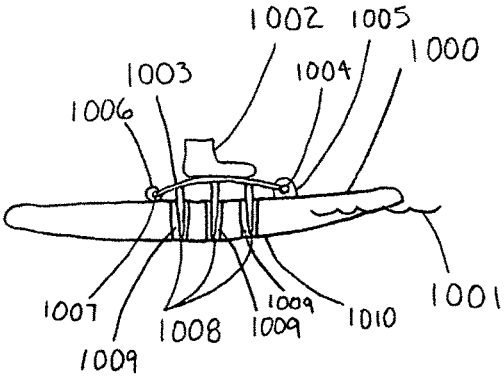
FIGS. 10A-10B are a side view of a useful embodiment of a thrust assembly.
Figure 10B:
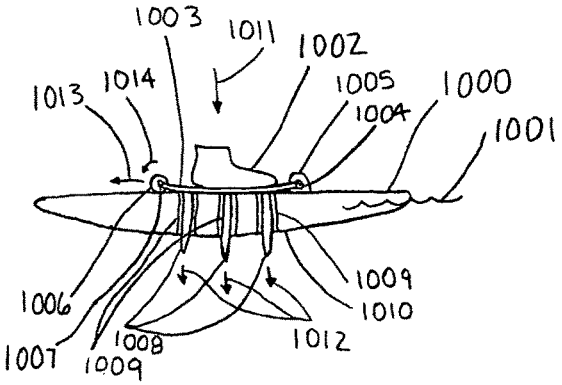

FIG. 10A is a side view of a useful embodiment of a thrust assembly. Such a thrust assembly may be substituted or combined with other thrust assemblies or actuators, such as the thrust actuators 902, 903, 904, 906, 907, and 908, of the SUPs 900 and 905 of FIG. 9A. In the thrust assembly of FIG. 10A, the rider's foot 1002 is resting on the foot support 1003. Alternately, a foot holder 1002 is removably secured to the foot support 1003, and the rider's foot is held by the foot holder 1002. The foot support 1003 is flexible and may be attached to the SUP 1000 in a variety of ways. In FIG. 10A, the foot support 1003 is attached at a first end to a rotary joint 1004, which rotates relative to the mount 1005 which is firmly affixed to the SUP 1000 floating in fluid 1001, such as fresh or salt water. The second end of the foot support 1003 is able to move relative to the SUP 1000. In FIG. 10A, in one example, the second end of the foot support 1003 is attached to a roller joint with axis 1007 and roller wheel 1006 that rolls relative to the SUP 1000. Alternatively, the roller wheel may be replaced by a linear bearing or other convenient sliding joint. As shown in FIG. 10B, when the rider stands on, or applies sufficient weight to, the foot support 1003, it flexes down in the direction of the arrow 1011, and one or more thrust paddles 1008 extend in the direction of the arrows 1012 through the paddle slots 1009 into the water past the bottom surface 1010 of the SUP 1000. Typically, two SUPs are used by a rider: one SUP for each foot of the rider, where each SUP is configured according to FIG. 10A. When the rider shifts their weight from one SUP to the other, they may apply a forward thrust force with the SUP supporting their weight, since the thrust paddles 1008 will be capable of applying a forward or rearward force against the water. When the rider applies a rearward force with one SUP, the other SUP that is not supporting the rider's weight will have thrust paddles 1008 retracted to the position provided by FIG. 10A, and not providing a resistive force to forward gliding motion. The result is that the rider may, in effect, skate on the surface of the water, using a weight-shifting sliding technique similar to a Nordic snow skier.

Figure 10C:
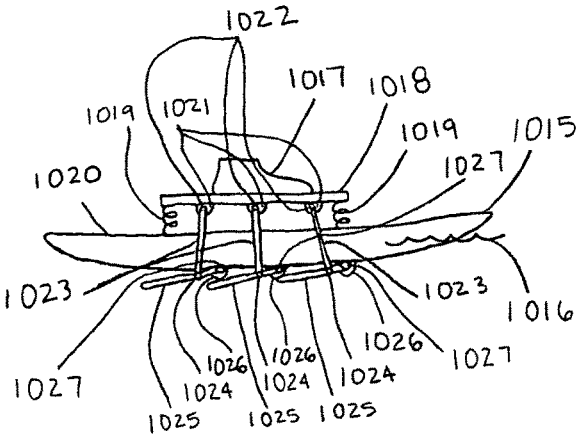
FIGS. 10C-10D are a side view of a useful embodiment of another thrust assembly.
Figure 10D:
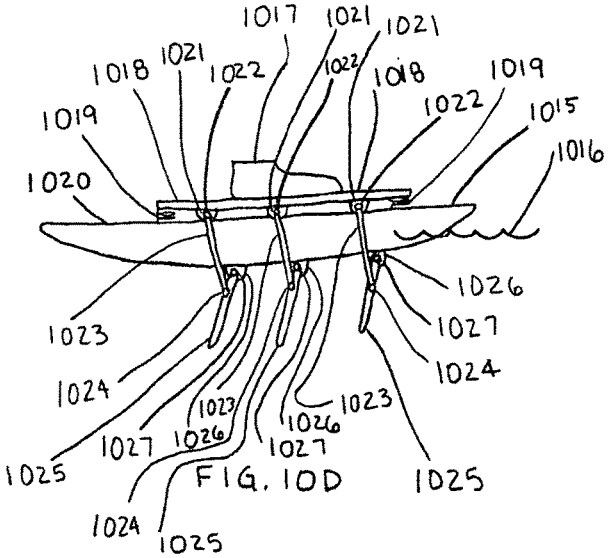

FIG. 10C is a side view of a useful embodiment of another thrust assembly. Such a thrust assembly may be substituted or combined with other thrust assemblies or actuators, such as the thrust actuators 902, 903, 904, 906, 907, and 908, of the SUPs 900 and 905 of FIG. 9A, or the thrust assembly of FIGS. 10A and 10B. In the thrust assembly of FIG. 10C, the rider's foot 1017 is resting on the foot support 1018. Alternately, a foot holder 1017 is removably secured to the foot support 1018, and the rider's foot is held by the foot holder 1017. The foot support 1018 may be attached to the SUP 1015 in a variety of ways. In FIG. 10C, the foot support 1018 is supported relative to the surface of the SUP 1015 using springs 1019. The SUP 1015 is floating in fluid 1016, such as fresh or salt water. There is at least one thrust paddle 1025 with a rotary joint 1027 at one end capable of rotating relative to a mount 1026 which is firmly affixed to the SUP 1015. Corresponding to each thrust paddle 1025 is a push rod 1023. Each push rod 1023 has a rotary joint 1024 at one end capable of rotating relative to an associated thrust paddle 1025, and another rotary joint 1022 at the other end of the push rod 1023 capable of rotating relative to an associated mount 1021 which is firmly affixed to the foot support 1018. FIG. 10C shows the thrust paddles 1025 in their retracted position, which produces very little resistance to water flow past the SUP 1015. As shown in FIG. 10D, when the rider stands on, or applies sufficient weight to, the foot support 1018, it translates down and compresses the springs 1019, and one or more thrust paddles 1025 are forced by the push rods 1023 to rotate counter clockwise to an extended position, extending downward deeper into the water. In the extended position, a thrust paddle is capable of applying a force against the water supporting the SUP 1015 to direct the SUP 1015 forward or rearward. Typically, two SUPs are used by a rider: one SUP for each foot of the rider, where each SUP is configured according to FIG. 10C. When the rider shifts their weight from one SUP to the other, they may apply a forward thrust force with the SUP supporting their weight, since the thrust paddles 1025 will be capable of applying a forward or rearward force against the water. When the rider applies a rearward force with one SUP, the other SUP that is not supporting the rider's weight will have thrust paddles 1025 retracted to the position provided by FIG. 10C, and not providing a resistive force to forward gliding motion. The result is that the rider may, in effect, skate on the surface of the water, using a weight-shifting sliding technique similar to a Nordic snow skier.

Figure 11A:
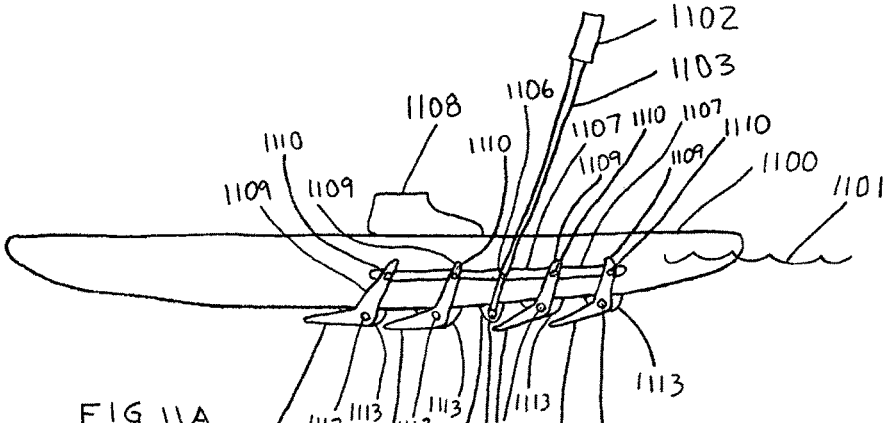
FIGS. 11A-11B are a side view of a useful embodiment of another thrust assembly.
Figure 11B:
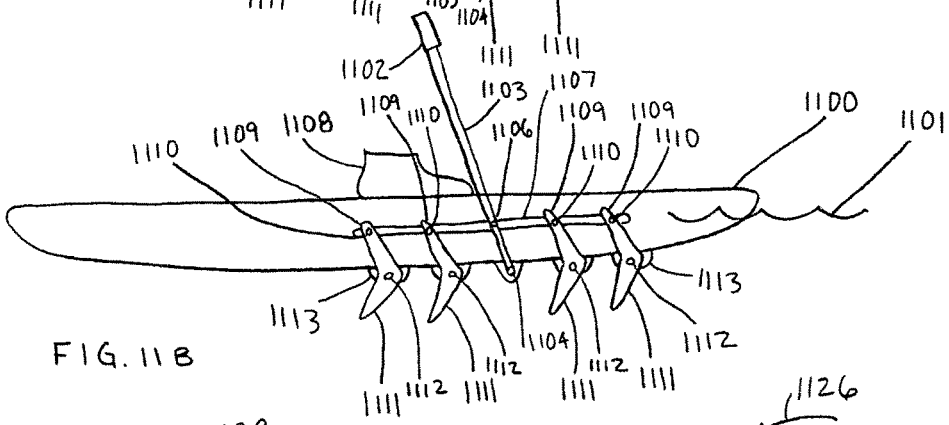

FIG. 11A is a side view of a useful embodiment of another thrust assembly. Such a thrust assembly may be substituted or combined with other thrust assemblies or actuators, such as the thrust actuators 902, 903, 904, 906, 907, and 908, of the SUPs 900 and 905 of FIG. 9A, or the thrust assemblies of FIGS. 10A-10D. In the thrust assembly of FIG. 11A, the rider's foot 1108 is resting on the SUP 1100. Alternately, a foot holder 1108 is removably secured to the SUP 1100, and the rider's foot is held by the foot holder 1108. The foot holder 1108 may be attached to the SUP 1100 in a variety of ways. The SUP 1100 is floating in fluid 1101, such as fresh or salt water. There is at least one thrust paddle 1111 with a rotary joint 1112 capable of rotating relative to a mount 1113 which is firmly affixed to the SUP 1100. Extending from each thrust paddle 1111 is a rocker arm 1109. Each rocker arm 1109 has a rotary joint 1110 at one end capable of rotating relative to a tie rod 1107. If there is more than one thrust paddle 1111, the rocker arm 1109 of each thrust paddle 1111 will be forced to rotate in unison by the connecting tie rod 1107. FIG. 11A shows the thrust paddles 1111 in their retracted position, which produces very little resistance to water flow past the SUP 1100. FIG. 11A also provides a lever arm 1103 with handle 1102. The lever arm 1103 has a rotary joint 1104 capable of rotating relative to a mount 1105 which is firmly affixed to the SUP 1100. The lever arm 1103 also has a rotary joint 1106 capable of rotating relative to the tie rod 1107. As shown in FIG. 11B, when the rider pulls the lever arm 1103 toward them, the thrust paddles 1111 are forced by the tie rod 1107 to rotate counter clockwise to an extended position, extending downward deeper into the water. In the extended position, a thrust paddle is capable of applying a force against the water supporting the SUP 1100 to direct the SUP 1100 forward or rearward. Typically, two SUPs are used by a rider: one SUP for each foot of the rider, where each SUP is configured according to FIG. 11A. When the rider shifts their weight from one SUP to the other, they may apply a forward thrust force with the SUP supporting their weight, since the thrust paddles 1111 will be capable of applying a forward or rearward force against the water.

When the rider applies a rearward force with one SUP, the other SUP that is not supporting the rider's weight will have thrust paddles 1111 retracted to the position provided by FIG. 11A, and not providing a resistive force to forward gliding motion. The result is that the rider may, in effect, skate on the surface of the water, using a weight-shifting sliding technique similar to a Nordic snow skier.

Figure 11C:
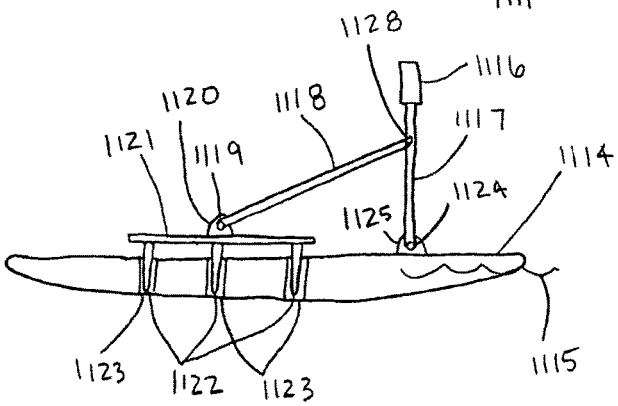
FIGS. 11C-11D are a side view of a useful embodiment of another thrust assembly.
Figure 11D:
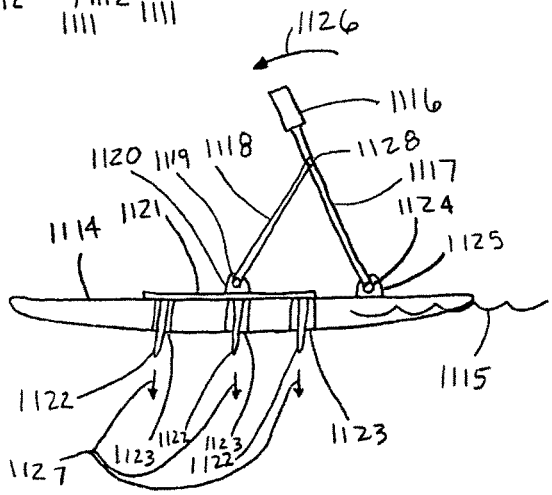

FIG. 11C is a side view of a useful embodiment of another thrust assembly. Such a thrust assembly may be substituted or combined with other thrust assemblies or actuators, such as the thrust actuators 902, 903, 904, 906, 907, and 908, of the SUPs 900 and 905 of FIG. 9A, or the thrust assemblies of FIGS. 10A-10D and FIGS. 11A-11B. In the thrust assembly of FIG. 11C, the rider's foot (not shown) may rest on top of the SUP 1114. Alternately, a foot holder may be removably secured to the SUP 1114, and the rider's foot may be held by the foot holder. The SUP 1114 is floating in fluid 1115, such as fresh or salt water. There is at least one thrust paddle 1122 affixed to the paddle support 1121. FIG. 11C also provides a lever arm 1117 with handle 1116. The lever arm 1117 has a rotary joint 1124 capable of rotating relative to a mount 1125 which is firmly affixed to the SUP 1114. The lever arm 1117 also has a rotary joint 1128 capable of allowing a tie rod 1118 to rotate relative to the lever arm 1117. The tie rod 1118 has a rotary joint 1119 capable of rotating relative to a mount 1120 which is firmly affixed to the paddle support 1121. FIG. 11C shows the thrust paddles 1122 in their retracted position, which produces very little resistance to water flow past the SUP 1114. As shown in FIG. 11D, when the rider pulls the lever arm 1117 toward them in the direction of the arrow 1126, the tie rod 1118 forces the paddle support 1121 to force the thrust paddles 1122 to extend downward through the paddle slots 1123 in the direction of the arrows 1127 deeper into the water. In the extended position, a thrust paddle 1122 is capable of applying a force against the water supporting the SUP 1114 to direct the SUP 1114 forward or rearward. Typically, two SUPs are used by a rider: one SUP for each foot of the rider, where each SUP is configured according to FIG. 11C. When the rider shifts their weight from one SUP to the other, they may apply a forward thrust force with the SUP supporting their weight, since the thrust paddles 1122 will be capable of applying a forward or rearward force against the water. When the rider applies a rearward force with one SUP, the other SUP that is not supporting the rider's weight will have thrust paddles 1122 retracted to the position provided by FIG. 11C, and not providing a resistive force to forward gliding motion. The result is that the rider may, in effect, skate on the surface of the water, using a weight-shifting sliding technique similar to a Nordic snow skier.

Figure 12A:
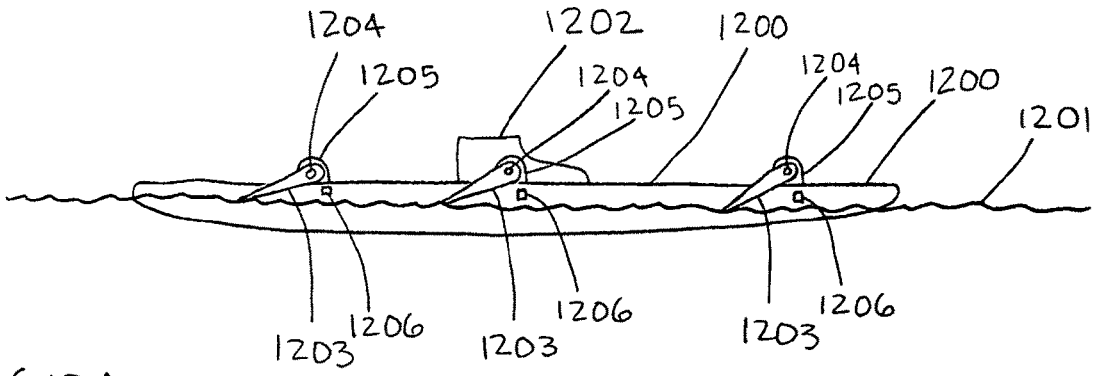
FIGS. 12A-12B are a side view of a useful embodiment of another thrust assembly.
Figure 12B:
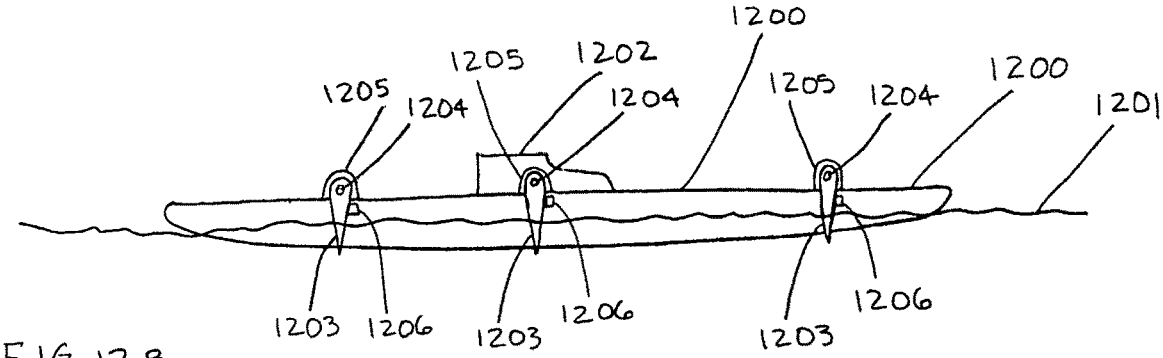

FIG. 12A is a side view of a useful embodiment of another thrust assembly. Such a thrust assembly may be substituted or combined with other thrust assemblies or actuators, such as the thrust actuators 902, 903, 904, 906, 907, and 908, of the SUPs 900 and 905 of FIG. 9A, or the thrust assemblies of FIGS. 10A-10D and 11A-11D. In the thrust assembly of FIG. 12A, the rider's foot 1202 is resting on the SUP 1200. Alternately, a foot holder 1202 is removably secured to the SUP 1200, and the rider's foot is held by the foot holder 1202. The foot holder 1202 may be attached to the SUP 1200 in a variety of ways. The SUP 1200 is floating in fluid 1201, such as fresh or salt water. There is at least one thrust paddle 1203 with a rotary joint 1204 capable of rotating relative to a mount 1205 which is firmly affixed to the SUP 1200. Positioned in functional relation to each thrust paddle 1203 is a limit-stop structure 1206 to prevent each thrust paddle 1203 from rotating past substantially extending straight down into the water during a forward-thrust phase. FIG. 12A shows the thrust paddles 1203 in their retracted position, which produces very little resistance to water flow past the SUP 1200, where the orientation of each thrust paddle 1203 is determined by the flow of water which rotates the thrust paddles 1203 clockwise in the figure when the SUP 1200 is traveling to the right. As shown in FIG. 12B, when the rider pushes the SUP 1200 rearward (i.e., to the left in the figure), the thrust paddles 1203 are forced by the water 1201 to rotate counter clockwise to an extended position against the limit-stop structures 1206, extending downward deeper into the water. In the extended position, a thrust paddle 1203 is capable of applying a force against the water supporting the SUP 1200 to direct the SUP 1200 forward. Typically, two SUPs are used by a rider: one SUP for each foot of the rider, where each SUP is configured according to FIG. 12A. When the rider applies a forward thrust force to a first SUP, the thrust paddles 1203 will rotate into the extended position and apply a rearward force against the water. The second SUP that is gliding forward will have its thrust paddles 1203 retracted by the force of the water to the retracted position as provided by FIG. 12A, and not provide a material resistive force to forward motion. The rider then applies a forward thrust force to the second SUP while the first SUP is gliding forward. The result is that the rider may, in effect, skate on the surface of the water, using an alternating-foot sliding technique, similar to a Nordic snow skier.

Figure 12C:
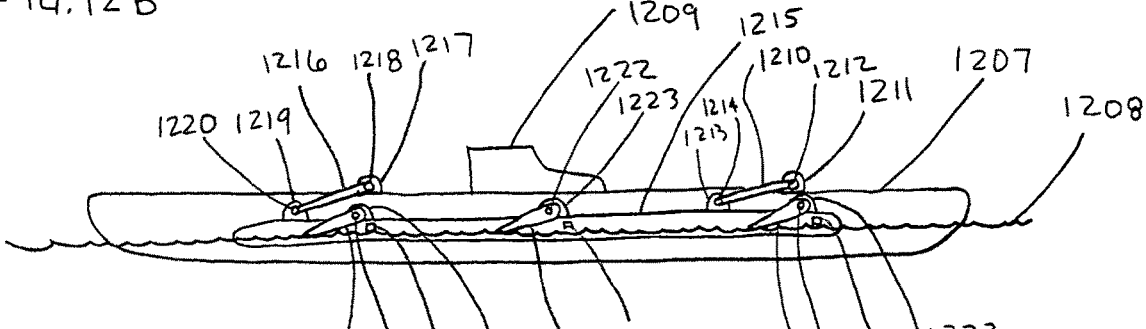
FIGS. 12C-12D are a side view of a useful embodiment of another thrust assembly.
Figure 12D:
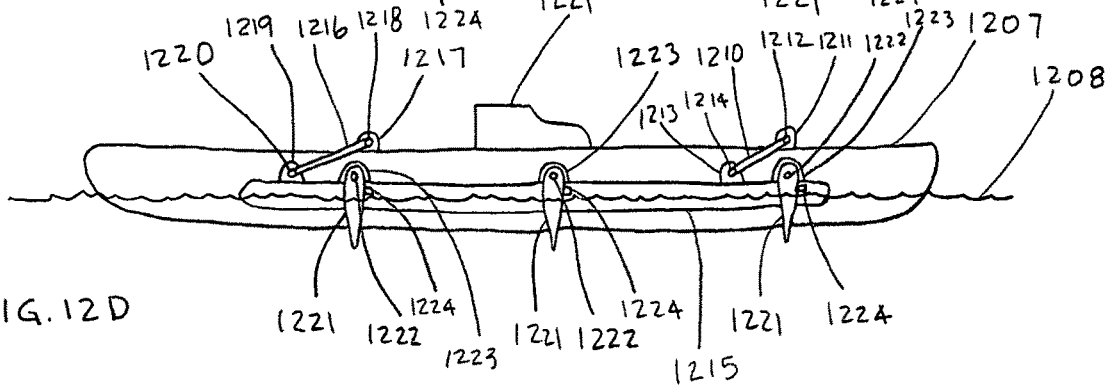

FIG. 12C is a side view of a useful embodiment of another thrust assembly. Such a thrust assembly may be substituted or combined with other thrust assemblies or actuators, such as the thrust actuators 902, 903, 904, 906, 907, and 908, of the SUPs 900 and 905 of FIG. 9A, or the thrust assemblies of FIGS. 10A-10D, 11A-11D, and 12A-12B. In the thrust assembly of FIG. 12C, the rider's foot 1209 is resting on the SUP 1207. Alternately, a foot holder 1209 is removably secured to the SUP 1207, and the rider's foot is held by the foot holder 1209. The foot holder 1209 may be attached to the SUP 1207 in a variety of ways. The SUP 1207 is floating in fluid 1208, such as fresh or salt water. The SUP 1207 is attached to a paddle float 1215 which keeps the thrust paddles 1221 attached to it at a desired depth, regardless of the weight of the rider. The paddle float 1215 may be attached to the SUP 1207 in a variety of ways. In FIGS. 12C and 12D, the paddle float 1215 is connected to the SUP 1207 in an articulated manner by a front tie rod 1210. The front tie rod 1210 has a rotary joint 1214 at the paddle-float end that rotates relative to the mount 1213 which is firmly affixed to the paddle float 1215. The front tie rod 1210 also has a rotary joint 1212 at the SUP end that rotates relative to the mount 1211 which is firmly affixed to the SUP 1207. Although optional, as shown in FIGS. 12C and 12D the paddle float 1215 is also connected to the SUP 1207 by a rear tie rod 1216. The rear tie rod 1216 has a rotary joint 1220 at the paddle-float end that rotates relative to the mount 1219 which is firmly affixed to the paddle float 1215. The rear tie rod 1216 also has a rotary joint 1218 at the SUP end that rotates relative to the mount 1217 which is firmly affixed to the SUP 1207. Based on the articulated relationship between the SUP 1207 and the paddle float 1215, the paddle float 1215 may float at a depth desired for the thrust paddles 1221, independently from the depth that the SUP 1207 floats at, which depends on the weight of the rider. There is at least one thrust paddle 1221 with a rotary joint 1222 capable of rotating relative to a mount 1223 which is firmly affixed to the paddle float 1215. Positioned in functional relation to each thrust paddle 1221 is a limit-stop structure 1224 to prevent each thrust paddle 1221 from rotating past substantially extending straight down into the water during a forward-thrust phase. FIG. 12C shows the thrust paddles 1221 in their retracted position, which produces very little resistance to water flow past the paddle float 1215 and the connected SUP 1207, where the orientation of each thrust paddle 1221 is determined by the flow of water which rotates the thrust paddles 1221 clockwise in the figure when the paddle float 1215 and the connected SUP 1207 is traveling to the right. As shown in FIG. 12D, when the rider pushes the SUP 1207 rearward (i.e., to the left in the figure), the paddle float 1215 also is pushed rearward by the tie rods 1210 and 1216, and the thrust paddles 1221 are forced by the water 1208 to rotate counter clockwise to an extended position against the limit-stop structures 1224, extending the thrust paddles 1221 downward deeper into the water. In the extended position, a thrust paddle 1221 is capable of applying a force against the water supporting the paddle float 1215, which directs the paddle float 1215 and SUP 1207 forward. Typically, two SUPs are used by a rider: one SUP for each foot of the rider, where each SUP is configured according to FIG. 12C. When the rider applies a forward thrust force to a first SUP, the thrust paddles 1221 will rotate into the extended position and apply a rearward force against the water. The second SUP that is gliding forward will have its thrust paddles 1221 retracted by the force of the water to the retracted position as provided by FIG. 12C, and not provide a material resistive force to forward motion. The rider then applies a forward thrust force to the second SUP while the first SUP is gliding forward. The result is that the rider may, in effect, skate on the surface of the water, using an alternating-foot sliding technique, similar to a Nordic snow skier.

Note that in place of, or in addition to, thrust paddles 1221 affixed to the paddle float 1215, other thrust actuators may be affixed to the paddle float 1215, such as the thrust actuators 902, 903, 904, 906, 907, and 908, of the SUPs 900 and 905 of FIG. 9A. In general, a thrust actuator that is capable of applying more force to the water in one direction than the opposite direction may be used.

For any of the illustrative embodiments, a thrust actuator may be located to the side of the SUP, under the SUP, partially to the side and partially under the SUP, partially to the side and partially above the SUP, or a portion inset into cavity in the SUP.

Figure 13A:
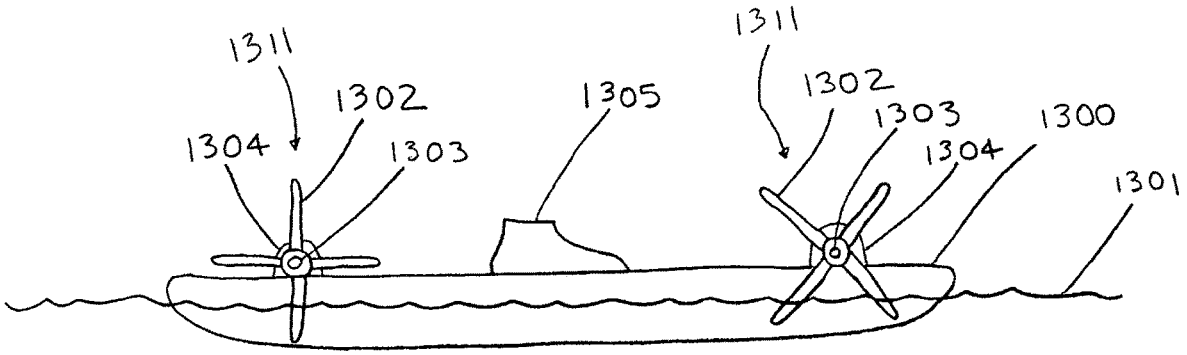
FIG. 13A is a side view of a useful embodiment of another thrust assembly.

FIG. 13A is a side view of a useful embodiment of another thrust assembly. Such a thrust assembly may be substituted or combined with other thrust assemblies or actuators, such as the thrust actuators 902, 903, 904, 906, 907, and 908, of the SUPs 900 and 905 of FIG. 9A, or the thrust assemblies of FIGS. 10A-10D, 11A-11D, and 12A-12D. In the thrust assembly of FIG. 13A, the rider's foot 1305 is resting on the SUP 1300. Alternately, a foot holder 1305 is removably secured to the SUP 1300, and the rider's foot is held by the foot holder 1305. The foot holder 1305 may be attached to the SUP 1300 in a variety of ways. The SUP 1300 is floating in fluid 1301, such as fresh or salt water. There is at least one thrust paddle wheel 1311 with a rotary joint 1303 capable of rotating relative to a mount 1304 which is firmly affixed to the SUP 1300. There are a plurality of thrust paddles 1302 affixed to each thrust paddle wheel 1311, where the number of thrust paddles 1302 per thrust paddle wheel 1311 is typically at least four so that at least one thrust paddle 1302 will be in the water at all times.

Figure 13B:
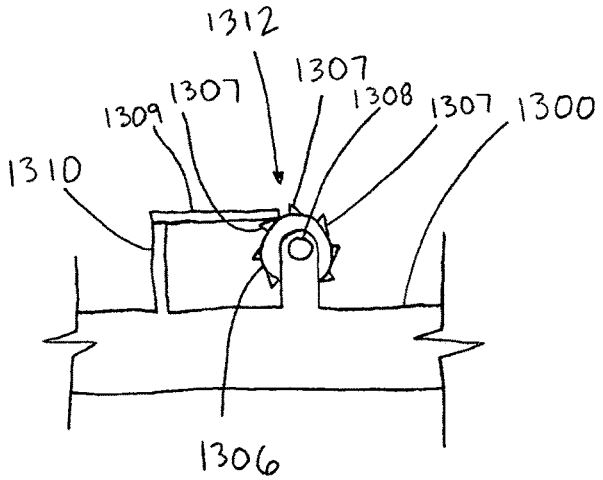
FIG. 13B provides one exemplary embodiment of a rotation-direction-limiting structure that is positioned in functional relation to each thrust paddle wheel.

A rotation-direction-limiting structure associated with each thrust paddle wheel 1311 prevents each thrust paddle wheel 1311 from rotating counter clockwise in the figure during a forward-thrust phase, but allows each thrust paddle wheel 1311 to rotate clockwise in the figure with little resistance. FIG. 13B provides one exemplary embodiment of a rotation-direction-limiting structure 1312 that is positioned in functional relation to each thrust paddle wheel 1311. The exemplary rotation-direction-limiting structure 1312 comprises a ratchet mechanism. The ratchet mechanism includes a ratchet wheel 1306 rotationally connected to the SUP 1300 by a rotary bearing 1308 which is typically co-axial with the thrust paddle wheel rotary joint 1303. The ratchet wheel 1306 comprises teeth 1307 that allow the ratchet wheel 1306 to rotate in the clockwise direction (in the figure) past the locking member 1309, but not to rotate counter clockwise. The teeth 1307 may articulate to retract into the ratchet wheel 1306 when the ratchet wheel 1306 is rotating in the clockwise direction, or the locking member 1309 may comprise a cantilever spring that flexes upward in the figure to allow the teeth 1307 to pass under it when the ratchet wheel 1306 is rotating clockwise, but where the locking member 1309 does not buckle, but instead blocks the teeth 1307 from rotating past the locking member 1309 when the ratchet wheel 1306 is attempting to rotate in the counter-clockwise direction.

When the rider pushes the SUP 1300 rearward (i.e., to the left in the figure), the rotation-direction-limiting structure 1312 of FIG. 13B prevents counter-clockwise rotation of the thrust paddle wheels 1311, which propels the SUP 1300 forward. Typically, two SUPs are used by a rider: one SUP for each foot of the rider, where each SUP is configured according to FIGS. 13A and 13B, or functional equivalent. When the rider applies a forward thrust force to a first SUP, the thrust paddle wheels 1311 will not rotate, and thus the thrust paddles 1302 will not rotate, thereby applying a rearward force against the water. The second SUP that is gliding forward will have its thrust paddle wheels 1311 capable of rotating clockwise in the figure, and so the thrust paddles 1302 on its thrust paddle wheels 1311 will also rotate, and thereby not providing a material resistive force to forward motion. The rider then applies a forward thrust force to the second SUP while the first SUP is gliding forward. The result is that the rider may, in effect, skate on the surface of the water, using an alternating-foot sliding technique, similar to a Nordic snow skier.

Figures 14A, 14B, 15A, 15B, 16:
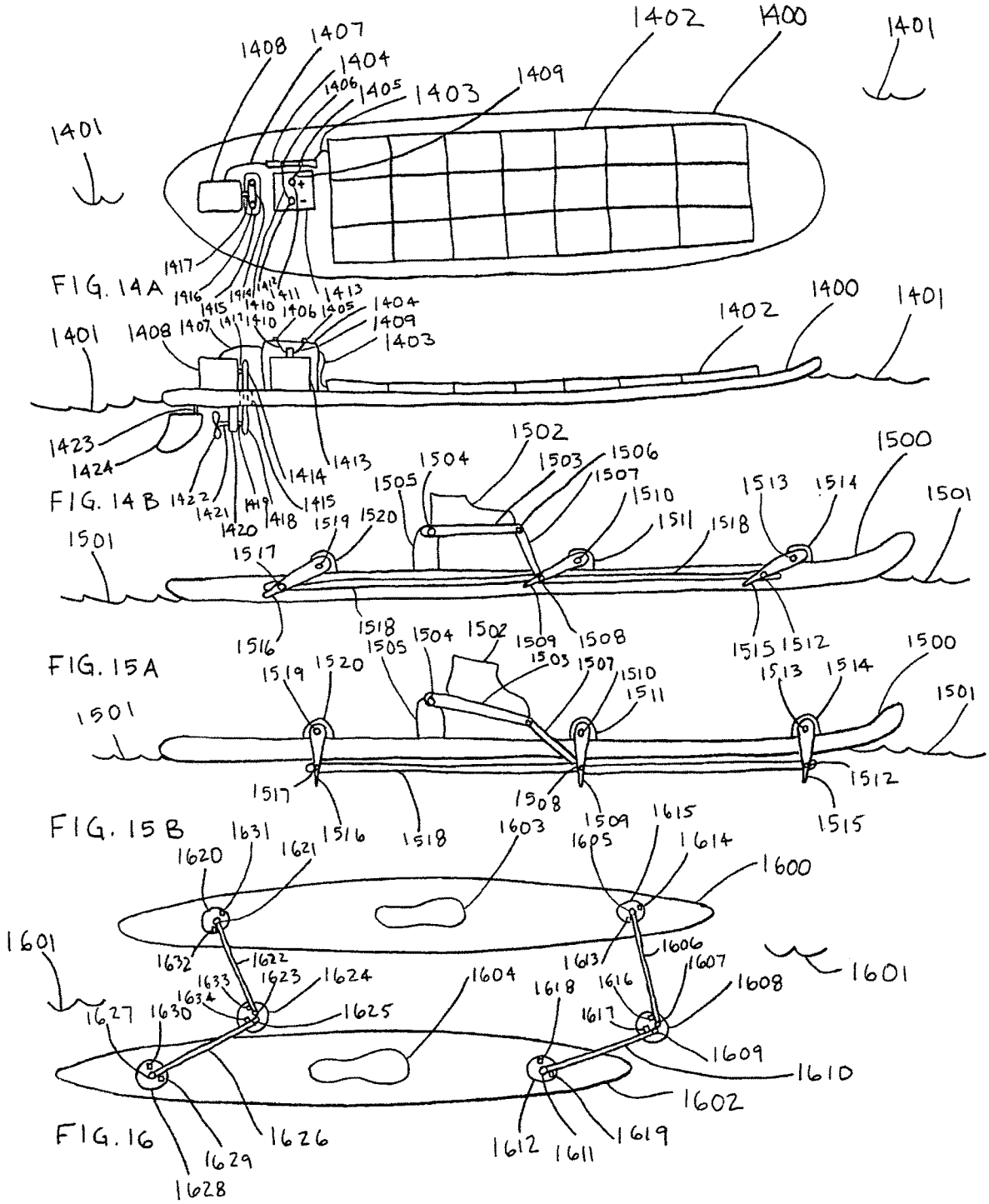
FIG. 14A is a top view of a solar-powered SUP in water.
FIG. 14B is a side view of the solar-powered SUP of FIG. 14A.
FIG. 15A is a side view of a useful embodiment of another thrust assembly.
FIG. 15B provides thrust paddles in a retracted position.
FIG. 16 is a top view of an exemplary apparatus that prevents a plurality of SUPs from coming into contact with each other, and allows the SUPs to move uninhibited in a substantially parallel direction relative to each other along a desired direction of travel.

FIG. 14A is a top view of a solar-powered SUP 1400 in water 1401. Sunshine provides solar energy that is stored by a battery 1413 and is also used to power a motor 1408 to propel the SUP 1400 in a desired direction at a desired speed. Solar cells 1402 are on the SUP 1400 visible to sunlight. The solar cells may be photovoltaic. The solar cells may comprise cadmium sulfide. The solar cells may be made of any convenient solar-power technology, and may be arranged in any convenient pattern. The solar cells 1402 communicate a control signal with the control circuitry 1404, where the control signal may include control information to the solar cells 1402 and/or electrical power from the solar cells 1402. The control signal may be communicated using electrical wires 1403. The control circuitry 1402 communicates a battery signal with the battery 1413. The battery signal may be communicated using electrical wires 1409 and 1410 to the battery terminals 1411 and 1412, respectively. The control circuitry 1404 communicates a motor signal to a motor 1408. The motor signal may be communicated using electrical wires 1407, and the motor 1408 may be an electrical motor. The motor 1408 has an output shaft 1417 to which a pulley wheel 1414 is attached. Around the pulley wheel 1414 is a pulley belt 1416. The pulley belt may pass by the side of the SUP 1400; however, shown in FIG. 14A, the pulley belt 1416 may alternatively pass through an opening 1415 in the SUP 1400 to reach a mating pulley wheel.

FIG. 14B is a side view of the solar-powered SUP 1400 of FIG. 14A. FIG. 14B provides that the pulley belt 1416 passes through the opening 1415 and around a mating pulley wheel 1418. The mating pulley wheel 1418 is capable of turning the pulley shaft 1419 that is supported by a bearing in the shaft support 1420 that is firmly affixed to the SUP 1400. The pulley shaft 1419 is capable of turning the propeller shaft 1421 that turns the propeller 1422. Any of a variety of convenient steering and breaking assemblies may be used with the SUP 1400. In FIG. 14B, a rear rudder 1424 is provided that is capable of rotating around a rudder shaft 1423.

Speed and direction of the motor 1408 may also be controlled by a suitable controller. The controller may be wired or wireless. The controller may be a mobile device, such as an iPhone, iPad, Android mobile device, and the like. The controller may be hand held or mounted to the SUP 1400. The controller may have buttons, rotary controls, squeeze controls, push controls, and the like.

FIG. 15A is a side view of a useful embodiment of another thrust assembly. Such a thrust assembly may be substituted or combined with other thrust assemblies or actuators, such as the thrust actuators 902, 903, 904, 906, 907, and 908, of the SUPs 900 and 905 of FIG. 9A, or the thrust assemblies of FIGS. 10A-10D, 11A-11D, 12A-12D, and 13A-13B. In the thrust assembly of FIG. 15A, the rider's foot 1502 is resting on the foot support 1503. Alternately, a foot holder 1502 is removably secured to the foot support 1503, and the rider's foot is held by the foot holder 1502. The foot support 1503 may be attached to the SUP 1500 in a variety of ways. In FIG. 15A, the foot support 1503 is supported relative to the surface of the SUP 1500 by a rotary joint 1504 connected to mount 1505 that is firmly affixed to the SUP 1500. The SUP 1500 is floating in fluid 1501, such as fresh or salt water. There is at least one thrust paddle 1509 with a rotary joint 1510 at one end capable of rotating relative to a mount 1511 which is firmly affixed to the SUP 1500. In FIG. 15A, there are additional thrust paddles 1515 and 1516, with rotary joints 1513 and 1519, respectively, and mounts 1514 and 1520, respectively. A tie rod 1518 connects each of the thrust paddles 1509, 1515, and 1516 by rotary joints 1508, 1512, and 1517, respectively. The foot support 1503 is also connected by a rotary joint 1506 to a connecting rod 1507 that is also connected to the rotary joint 1508. FIG. 15A provides the rider's foot in a first position, and where the thrust paddles 1509, 1515, and 1516 are in a retracted position, which produces very little resistance to water flow past the SUP 1500. As shown in FIG. 15B, when the rider presses down with the front part of their foot onto the foot support 1503, the foot support 1503 rotates down, pushing on the connecting rod 1507, and causing the thrust paddles 1509, 1515, and 1516 to rotate counter clockwise to an extended position, extending downward deeper into the water. In the extended position, a thrust paddle is capable of applying a force against the water supporting the SUP 1500. Note that rotating the front part of the foot support 1503 down places the rider's foot and leg in a convenient orientation to press rearward. Typically, two SUPs are used by a rider: one SUP for each foot of the rider, where each SUP is configured according to FIG. 15A. When the rider shifts their weight from the front of the foot on a first SUP that is pressing rearward, to the front of the foot on the second SUP that is gliding forward, the thrust paddles of the second SUP will be rotate into the extended position capable of applying a rearward force against the water. When the rider applies a rearward force with the second SUP, the first SUP that is not supporting the rider's weight will have thrust paddles in the retracted position provided by FIG. 15B, and will not provide a resistive force to forward gliding motion. The result is that the rider may, in effect, skate on the surface of the water, using a weight-shifting sliding technique similar to a Nordic snow skier.

FIG. 16 is a top view of an exemplary apparatus that prevents a plurality of SUPs from coming into contact with each other, and allows the SUPs to move uninhibited in a substantially parallel direction relative to each other along a desired direction of travel. Such an apparatus, or functionally equivalent thereto, finds particular use when a rider uses a dual-SUP apparatus, including but not limited to one of the apparatuses provided by FIGS. 9A, 10A-10D, 11A-11D, 12A-12D, and 13A-13B to, in effect, skate on the surface of the water, using a dual-SUP sliding technique similar to a Nordic snow skier. This list of figures above is intended only to exemplify use cases for the apparatus of FIG. 16, and the list is not intended to be complete or to limit the use cases. When the rider slides each foot forward and rearward, the exemplary apparatus comprises limit-stop structures that limit the rotation of articulated links between the two SUPs in order to prevent one SUP from undesirably contacting the other SUP. The exemplary apparatus of FIG. 16 permits two SUPs to slide freely parallel to each other, and the two SUPs may move toward and away from each other, but only in distance amounts limited by the placement of the limit-stop structures. Wheels along the sides between the two SUPs, as well as protective bumpers along the sides and between the two SUPs may also be used.

SUP 1600 is an SUP supporting a left foot 1603 of a rider on water 1601. Similarly, SUP 1602 is an SUP supporting a right foot 1604 of the rider on water 1601. A first articulated linkage comprises a left link 1606 with a left rotary joint 1605 connected to a left mount 1615 that is affixed to the left SUP 1600. The left link 1606 also has a right rotary joint 1607 connected to a floating mount 1608 that is not affixed to an SUP. The first articulated linkage comprises a right link 1610 with a left rotary joint 1609 connected to the floating mount 1608. The right link 1610 also has a right rotary joint 1611 connected to a right mount 1612 that is affixed to the right SUP 1602. Each of the mounts 1615, 1608, and 1612 comprises a limit-stop structure to prevent each link from rotating past a desired point. The limit-stop structures may comprise a pin, protrusion, or other convenient structure to prevent rotation of a rotating member beyond a desired angle. The left link 1606 is prevented from rotating in the counter-clockwise direction relative to the left mount 1615 by a limit-stop structure 1614. Similarly, the left link 1606 is prevented from rotating in the clockwise direction relative to the left mount 1615 by a limit-stop structure 1613. The left link 1606 is prevented from rotating in the counter-clockwise direction relative to the floating mount 1608 by a limit-stop structure 1616. The right link 1610 is prevented from rotating in the counter-clockwise direction relative to the right mount 1612 by a limit-stop structure 1618. Similarly, the right link 1610 is prevented from rotating in the clockwise direction relative to the right mount 1612 by a limit-stop structure 1619. The right link 1610 is prevented from rotating in the clockwise direction relative to the floating mount 1608 by a limit-stop structure 1617.

An optional second articulated linkage comprises a left link 1622 with a left rotary joint 1621 connected to a left mount 1620 that is affixed to the left SUP 1600. The left link 1622 also has a right rotary joint 1623 connected to a floating mount 1624 that is not affixed to an SUP. The optional second articulated linkage comprises a right link 1626 with a left rotary joint 1625 connected to the floating mount 1624. The right link 1626 also has a right rotary joint 1627 connected to a right mount 1628 that is affixed to the right SUP 1602. Each of the mounts 1620, 1624, and 1628 comprises a limit-stop structure to prevent each link from rotating past a desired point. The limit-stop structures may comprise a pin, protrusion, or other convenient structure to prevent rotation of a rotating member beyond a desired angle. The left link 1620 is prevented from rotating in the counter-clockwise direction relative to the left mount 1620 by a limit-stop structure 1631. Similarly, the left link 1622 is prevented from rotating in the clockwise direction relative to the left mount 1620 by a limit-stop structure 1632. The left link 1622 is prevented from rotating in the counter-clockwise direction relative to the floating mount 1624 by a limit-stop structure 1633. The right link 1626 is prevented from rotating in the counter-clockwise direction relative to the right mount 1628 by a limit-stop structure 1630. Similarly, the right link 1626 is prevented from rotating in the clockwise direction relative to the right mount 1628 by a limit-stop structure 1629. The right link 1626 is prevented from rotating in the clockwise direction relative to the floating mount 1624 by a limit-stop structure 1634.

Figure 17:
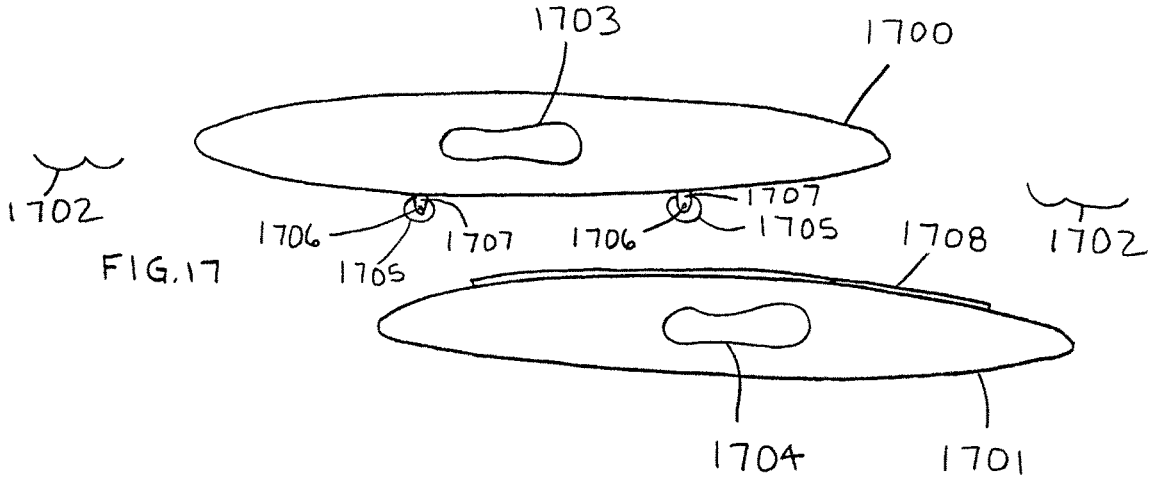
FIG. 17 is a top view of an exemplary apparatus that protects a plurality of SUPs when they contact each other.

FIG. 17 is a top view of an exemplary apparatus that protects a plurality of SUPs when they contact each other. Such an apparatus, or functionally equivalent thereto, finds particular use when a rider uses a dual-SUP apparatus, including but not limited to one of the apparatuses provided by FIGS. 9A, 10A-10D, 11A-11D, 12A-12D, and 13A-13B to, in effect, skate on the surface of the water, using a dual-SUP sliding technique similar to a Nordic snow skier. This list of figures above is intended only to exemplify use cases for the apparatus of FIG. 17, and the list is not intended to be complete or to limit the use cases.

In FIG. 17, wheels may be placed along the sides of the two SUPs 1700 and 1701 and between the two SUPs 1700 and 1701. Protective bumpers may also be placed along the sides of and between the two SUPs 1700 and 1701. SUP 1700 is an SUP supporting a left foot 1703 of a rider on water 1702. Similarly, SUP 1701 is an SUP supporting a right foot 1704 of the rider on water 1702. In this exemplary embodiment, the left SUP 1700 comprises a plurality of wheels on side facing the right SUP 1701. One or more wheels 1705 rotate around a rotary joint 1706 that is supported by a mount 1707 that is affixed to the SUP 1700. In FIG. 17, a front and rear wheel assembly are provided, although, any number of wheel assemblies may be used. A protective bumper 1708 is attached to the right SUP 1701; however, either SUP may comprise one or more wheel assemblies, and either SUP may comprise a protective bumper, or either SUP may comprise both one or more wheel assemblies as well as a bumper. The protective bumper 1708 may help prevent one SUP from damaging the other SUP if they come into contact, whether or not wheels 1705 are included. The protective bumper 1708 may also provide a useful surface to roll against by one or more wheels 1705 located on the side of the other SUP.

Figure 18A:
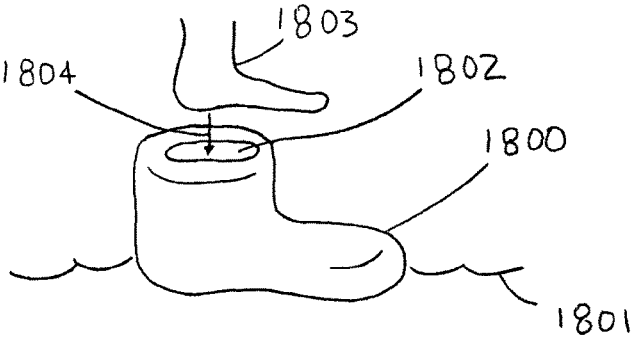
FIG. 18A is a prospective view of a floatation apparatus.

FIG. 18A is a prospective view of a floatation apparatus. A foot holder 1800 is capable of receiving a foot 1803. The foot may be inserted in the direction of the arrow 1804 into a cavity 1802 in the foot holder 1800. The foot holder 1800 is capable of floating on the water 1801. The foot holder 1800 may have a density below the density of water so a wearer will not fully submerge into the water 1801 when wearing one or more foot holders 1800. The foot holder 1800 may comprise low-density foam. The foot holder 1800 may be inflated with fluid with a density lower than water, where such fluid may comprise air or another gas, including but not limited to helium. When the foot holder 1800 is inflated, the foot holder 1800 may be made of plastic, vinyl, mylar, or any other convenient material capable of containing a gas. The type of plastic commonly used to manufacture kayaks may be used. The foot holder 1800 may be made from plastic and coated on the inside or outside with sealant further to reduce its permeability to a gas it's intended to contain, such as helium. The size of the foot holder 1800, the gas and pressure it is inflated with, as well as the weight of the wearer, determine whether the wearer will float or sink while wearing one or more foot holders 1800. The wearer may use balancing poles similar to those found in FIG. 9A, such as extension 931 with handle 930 and floating member 932. When a foot holder 1800 is worn on each foot, the result is that the wearer may, in effect, walk on the surface of the water.

Figure 18B:
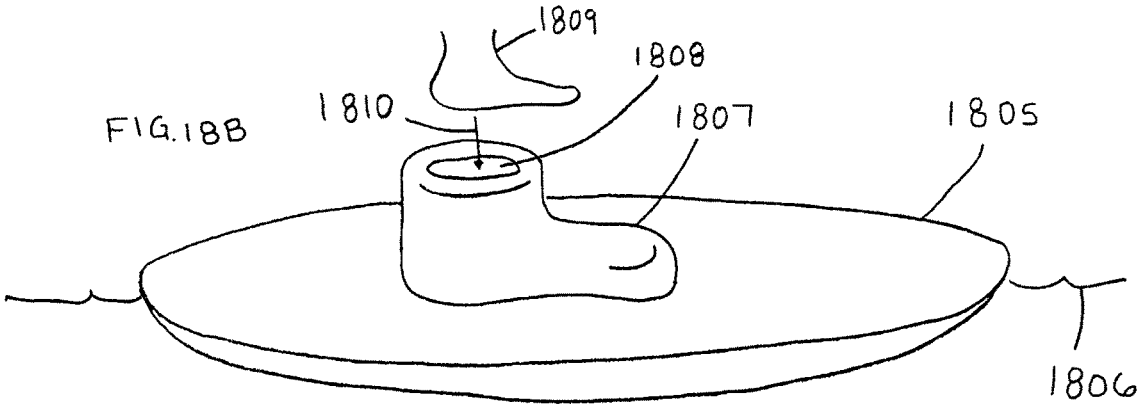
FIG. 18B is a perspective view of a foot holder.

FIG. 18B is a perspective view of a foot holder 1807. The foot holder 1807 may be removably secured to the floatation member 1805. The foot holder 1807 is capable of receiving a foot 1809. The foot may be inserted in the direction of the arrow 1810 into a cavity 1808 in the foot holder 1807. The floatation member 1805 may be an SUP, typically a smaller-than-usual SUP, typically one small SUP for each foot of wearer, where the small SUP includes but is not limited to a smaller-than-usual version of a stand-up paddle board, surf board, kayak, canoe, pontoon, or any of a variety of buoyant objects, boards, boats, inflatable devices, and the like, or any other functionally similar floatation or buoyant apparatus, where the apparatus may comprise a plurality of floatation or buoyant members, and where the apparatus is capable of providing buoyancy support for at least one user or rider in a fluid, which may be water. The floatation member 1805 may comprise low-density foam. The floatation member 1805 may be inflated with fluid with a density lower than water, where such fluid may comprise air or another gas, including but not limited to helium. When the floatation member 1805 is inflated, the floatation member 1805 may be made of plastic, vinyl, mylar, or any other convenient material capable of containing a gas. The type of plastic commonly used to manufacture kayaks may be used. The floatation member 1805 may be made from plastic and coated on the inside or outside with sealant further to reduce its permeability to a gas it's intended to contain, such as helium. When a foot holder 1807 with floatation member 1805 is worn on each foot, the result is that the wearer may, in effect, walk on the surface of the water.

FIG. 19A is a side view of a useful embodiment of another thrust assembly. Such a thrust assembly may be substituted or combined with other thrust assemblies or actuators, such as the thrust actuators 902, 903, 904, 906, 907, and 908, of the SUPs 900 and 905 of FIG. 9A, or the thrust assemblies of FIGS. 10A-10D, 11A-11D, 12A-12D, 13A-13B, and 15A-15B. In the thrust assembly of FIG. 19A, the rider's foot is resting on the foot support 1903. Alternately, a foot holder 1902 is removably secured to the foot support 1903, and the rider's foot is held by the foot holder 1902. The foot support 1903 may be attached to the SUP 1900 in a variety of ways. The SUP 1900 is floating in fluid 1901, such as fresh or salt water. There is at least one thrust paddle wheel 1918 capable of rotating about a rotary joint 1917 relative to the SUP 1900. There are a plurality of thrust paddles 1919 affixed to each thrust paddle wheel 1918, where the number of thrust paddles 1919 per thrust paddle wheel 1918 is typically at least four so that at least one thrust paddle 1919 will be in the water at all times.

Similar to a bicycle ratchet hub, each thrust paddle wheel may comprise a rotation-direction-limiting structure capable of preventing the associated thrust paddle wheel 1918 from rotating counter clockwise in the figure relative to the crank arm 1916 during a forward-thrust phase, but allows each thrust paddle wheel 1918 to rotate clockwise in the figure relative to the crank arm 1916 with little resistance when the crank arm 1916 is stationary, or rotating slowly.

The foot support 1903 is connected to the push rod 1914 by a rotary joint 1907. The rotary joint 1907 may also comprise a wheel 1906 on which the foot support 1903 may roll relative to the SUP 1900. The push rod 1914 is connected to the crank arm 1916 by a rotary joint 1915. When the crank arm 1916 is rotated clockwise, it causes the thrust paddle wheel 1918 to rotate clockwise. If the thrust paddle wheel 1918 comprises a hub that functions similarly to a bicycle ratchet hub, the thrust paddle wheel 1918 will prevent the crank arm 1916 from rotating counter clockwise. The foot support 1903 is also connected to the tie rod 1908 by a rotary joint 1905. The rotary joint 1905 may also comprise a wheel 1904 on which the foot support 1903 may roll relative to the SUP 1900. The tie rod 1908 is connected to a hand lever 1910 by a rotary joint 1909. With the rotary joint 1911, the hand lever 1910 can rotate relative to the lever mount 1912 which is affixed to the SUP 1900. Accordingly, when the rider pushes the foot support 1903 forward (i.e., to the right in the figure), the foot support 1903 pulls the connecting rod 1914 to the right, which causes the crank arm 1916 to rotate clockwise in the figure, causing the thrust paddle wheel 1918 also to rotate clockwise, which propels the SUP 1900 forward. Sliding the foot support 1903 forward may be aided by simultaneously pulling rearward (i.e., to the left in the figure) of the handle 1913. Pulling rearward of the handle 1913 causes the hand lever 1910 to rotate counter clockwise, thus pulling on the tie rod 1908, which assists in pulling the foot support 1903 to the right. The SUP 1900 may comprise a fender 1920 to prevent water from splashing from the paddle wheel 1918 onto the SUP 1900 or the rider.

FIG. 19B is a plan view of two SUPs according to FIG. 19A. Although the two SUPs 1921 and 1900 are provided in FIG. 19B linked together, they need not be connected. One SUP according to FIG. 19A may be used alone; however, typically, two SUPs are used by a rider: one SUP for each foot of the rider, where each SUP is configured according to FIG. 19A, or functional equivalent. In FIG. 19B, for clarity of the drawing, although the SUP 1921 includes all of the apparatus that is shown for the SUP 1900, the SUP 1921 does not show all of the apparatus that is shown for the SUP 1900. According to FIG. 19B, when the rider applies a forward thrust force to the foot support 1903 of SUP 1900, the thrust paddle wheel will rotate, and so the thrust paddles 1919 will rotate, thereby applying a force against the water causing the SUP 1900 to move forward (i.e., to the right in the figure). If the rider doesn't apply a forward thrust force to the foot support of SUP 1921, but SUP 1921 comprises a hub that functions similarly to a bicycle ratchet hub, the SUP 1921 will glide forward with its thrust paddles rotating clockwise in the figure due to water 1901 flowing by the moving SUP 1921, and so while gliding, the thrust paddles of SUP 1921 do not provide a material resistive force to forward motion. The rider then applies a forward thrust force to the SUP 1921 while the SUP 1900 is gliding forward. The result is that the rider may, in effect, skate on the surface of the water, using an alternating-foot sliding technique, similar to a Nordic snow skier.

FIG. 19C is a rear-end view of the SUPs shown as connected in FIG. 19B. The connection allows for one SUP to pull the other SUP in the forward direction, but also allows each SUP to rotate about an axis 1957 relative to the other SUP. The dashed line 1961 shows the outline of the SUP 1900 rotated clockwise, and the dashed line 1960 shows the outline of the SUP 1921 rotated counter clockwise. Such rotations may occur as water waves pass beneath each SUP at different times. The rider may also intentionally rotate an SUP to aid in steering. The rotations may include limit-stop apparatus to prevent the angle between the two SUPs from exceeding a maximum angle. The rider may decide to prevent the two SUPs from rotating relative to each other, and modify the articulated connections between the two SUPs to prevent or limit the rotation.

FIG. 19B comprises a forward connection joint with a left link 1948 connected to a right link 1949 by a rotary joint with an axis 1952. The axis 1952 is shown to be substantially in line with the forward direction of travel of the two SUPs. A pin may be used to connect the right link 1949 with the left link 1948, where the pin has a forward end 1950 and a rearward end 1951. The non-pinned end of the right link 1949 is affixed to the right SUP 1900, and the non-pinned end of the left link 1948 is affixed to the left SUP 1921.

FIG. 19B also comprises an optional rear connection joint with a left link 1953 connected to a right link 1954 by a rotary joint with an axis 1957. The axis 1957 is shown to be substantially in line with the forward direction of travel of the two SUPs, and also co-linear with the axis 1952. A pin may be used to connect the right link 1954 with the left link 1953, where the pin has a forward end 1955 and a rearward end 1956. The non-pinned end of the right link 1954 is affixed to the right SUP 1900, and the non-pinned end of the left link 1953 is affixed to the left SUP 1921.

Additional numbered elements of FIG. 19B include front 1928 and rear 1927 axles for the right-side front 1904 and rear 1906 wheels, respectively, of the right foot support 1903. The right foot support 1903 may comprise left-side front and rear wheels 1947. The right foot support 1903 is connected by the connector 1930 to the tie rod 1908, and connected by the connector 1940 to the push rod 1914. The hand lever 1910 is connected by the connector 1937 to the lever mount 1912, where the connector 1937 has a left end 1938. The crank arm 1916 is connected to the paddle wheel 1918 by a connector 1945. The SUP 1921 may comprise a fender 1958 to prevent water from splashing from the paddle wheel thrust paddles 1959 onto the SUP 1921 or the rider.

FIG. 19D is a side view of a useful embodiment of another thrust assembly. This thrust assembly comprises an elliptical-exercise-bike-style thrust assembly attached to a paddle wheel. When a paddle wheel is used, a water splash guard, such as a fender, may be used. The thrust assembly may also be mechanically connected to a propeller or other thrust actuator. The thrust assembly allows the rider of the SUP to use one or both arms, one or both legs, or any combination thereof to generate thrust. Steering and braking may comprise wired or wireless controls and actuators.

The elliptical-exercise-bike-style mechanism may be used on one or a pair of flotation devices. When a pair of floatation devices are used, they may be functionally connected. The floatation devices may be capable of rotating relative to each other. The floatation devices may be inflated. They may be filled will low-density fluid, such as a gas.

In FIG. 19D, the handle 1979 is connected to the hand lever 1977 which pivots relative to the lever mount 1983 that is attached to the SUP 1962 floating on the water 1963. A foot holder 1964 may be attached to a foot support 1965 on the end of a foot lever 1966 that is connected to the hand lever 1977 by a revolute joint 1976. The paddle wheel 1972 has paddle blades 1973, and the paddle wheel rotates about a rotary axis 1975 on a paddle-wheel mount 1974. The paddle wheel 1972 is connected by a revolute joint 1971 to a connecting rod 1968 that also connects to the foot lever 1966 by a revolute joint 1967. The connecting rod 1968 rolls relative to the SUP 1962 by a wheel 1969 with an axis 1970. A rudder 1981 may rotate about an axis 1982 to steer the SUP 1962.

Figures 20A, 20B, 20C:
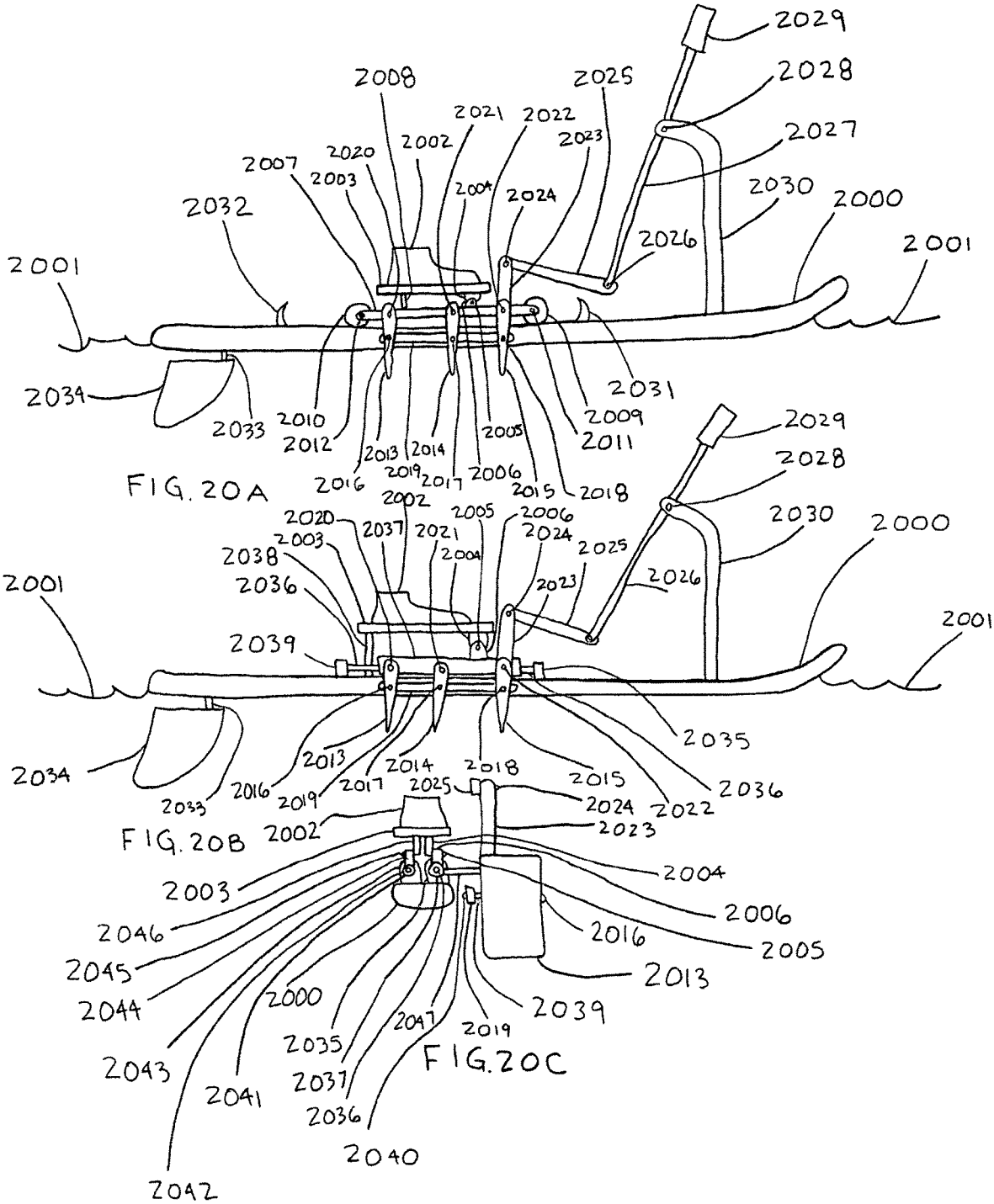
FIG. 20A is a side view of a useful embodiment of another thrust assembly.
FIG. 20B is a side view of a useful embodiment of another thrust assembly similar in structure to FIG. 20A, except the foot carriage includes a linear bearing.
FIG. 20C is a rear-end view of the thrust assembly of FIG. 20B.

FIG. 20A is a side view of a useful embodiment of another thrust assembly. The thrust assembly allows the rider of the SUP 2000 to use one or both arms, one or both legs, or any combination thereof to generate thrust. Shown is a thrust assembly for use by a right arm and leg. A foot may rest on the foot support 2003, or a foot holder 2002 may be attached to the foot support 2003. The foot holder 2002 may comprise a water sock or waterski boot. Steering and braking may comprise wired or wireless controls and actuators. When the rider pulls rearward on the handle 2029 of the hand lever 2027, the hand lever 2027 rotates about a revolute joint 2028 on a lever support 2030 connected to the SUP 2000. The hand lever 2027 then pulls the connecting rod 2025 that is connected to the hand lever 2027 by the revolute joint 2026. The connecting rod 2025 pulls the lever arm 2023 by the revolute joint 2024, which causes the thrust paddles 2015, 2014, and 2013 to rotate clockwise to a non-activated position, allowing the foot carriage 2007, to which the thrust paddles 2015, 2014, and 2013 are rotationally attached, to slide forward with only minimal water resistance. The thrust paddles 2015, 2014, and 2013 rotate relative to the carriage 2007 about the revolute joints 2022, 2021, and 2020, respectively. The lever arm 2023 is connected to the thrust paddle 2015, which when the lever arm 2023 is rotated, it rotates the thrust paddles 2015, 2014, and 2013 by the connecting rod 2019 pinned to each thrust paddle 2015, 2014, and 2013 by the revolute joints 2018, 2017, and 2016, respectively. Pulling rearward on the handle 2029 additionally assists in moving the foot carriage 2007 forward. Pushing forward on the handle 2029 causes the thrust paddles 2015, 2014, and 2013 to rotate counter clockwise, and assists in moving the foot carriage 2007 rearward to propel the SUP 2000 forward in the water 2001. The foot support 2003 may be rotatably connected to the foot carriage 2007, making it easier and more comfortable for the rider to lift their heel during a thrust phase where the rider pushes their foot rearward. As shown, a foot-supported hinge 2004 is connected to a carriage hinge 2006 by a hinge joint 2005. A rotational support structure 2008 acts as a limit stop and prevents the foot support 2003 from rotating counter clockwise too far. In FIG. 20A, the foot carriage 2007 may comprise one or more wheels 2009 and 2010 that rotate about axes 2011 and 2012, respectively, to move relative to the SUP 2000. There are limit stops on the front 2031 and rear 2032 of the SUP 2000 to prevent the foot carriage 2007 from moving too far forward or rearward. Steering and braking may use any convenient means. A rudder 2034 may rotate about an axis 2033 to steer the SUP 2000. The hand lever may be substituted by handle bars. Thrust paddles limit-stop structure may be added, such as to the foot carriage 2007, to prevent the thrust paddles 2015, 2014, and 2013 from rotating beyond a desired point.

FIG. 20B is a side view of a useful embodiment of another thrust assembly. FIG. 20B is similar in structure to FIG. 20A with corresponding elements and element numbering, except the foot carriage includes a linear bearing 2037, which may be in addition to, or in place of, the wheels 2009 and 2010 of FIG. 20A. The linear bearing 2037 is guided by the bearing shaft 2036 (with length that is not drawn to scale) with front 2035 and rear 2039 shaft supports connected to the SUP 2000. The rotational support structure that acts as a limit stop 2038 is shown to be longer to reach to the SUP 2000 in FIG. 20B; whereas the rotational support structure 2008 of FIG. 20A is shown shorter to rest on the foot carriage 2007.

FIG. 20C is a rear-end view of the thrust assembly of FIG. 20B, with corresponding elements and element numbering, and with some additional elements numbered that are visible in FIG. 20C. For clarity of FIG. 20C, the rotational support structure 2038 in FIG. 20B that prevents the foot support from rotating counter clockwise too far, is not shown in FIG. 20C. The connecting rod 2019 is connected to the thrust paddle 2013 by a connector 2039 with an end 2040. The thrust paddle 2013 is connected to the linear bearing 2037 by a connector 2047. The foot support 2003 further comprises a left linear bearing 2041 and left bearing shaft 2042 with the left shaft support 2043 connected to the SUP 2000. A left foot-supported hinge 2046 is connected to a left carriage hinge 2044 by a left hinge joint 2045.

FIG. 21A is a plan view of a useful embodiment of another thrust assembly. The SUP 2100 has one or a plurality of treadmill belts. FIG. 21A provides a right 2109 and left 2108 treadmill belt. As the rider walks or runs on the treadmill belts, thrust paddles (not shown in this view) in contact with the water 2101 apply force against the water 2101 to move the SUP 2100 forward. The rider places their right foot on the right treadmill belt 2109. The right treadmill belt 2109 may comprise a right foot holder 2110, similar to FIGS. 9E and 9F, connected to a right holder base 2111, typically at the toe end 2112. Alternately, the toe end 2112 may be hinged to the surface of the right treadmill belt 2109. The left treadmill belt 2108 may comprise a left foot holder 2105, similar to FIGS. 9E and 9F, connected to a left holder base 2106, typically at the toe end 2107. Alternately, the toe end 2107 may be hinged to the surface of the left treadmill belt 2108. The SUP 2100 may comprise a handlebar 2102 for steering, with handle 2103 and shaft 2104.

FIG. 21B is a side view of the thrust assembly of FIG. 21A. Similar to the foot holder 945 of FIGS. 9E and 9F, here the holder base 2111 is shown to comprise loop Velcro 2113 attached to hook Velcro 2114, which is attached to the treadmill belt 2109. The thrust paddles 2128, 2129, 2130, and 2131 may comprise rotation limit stops 2131, 2127, 2122, and 2123, such that the thrust paddles 2128 and 2129 are in an active extended position when applying force to the water, and the thrust paddles 2130 and 2131 are in an inactive retracted position when in a recovery phase. The thrust paddles 2128, 2129, 2130, and 2131 may collapse to the retracted position to permit gliding. The thrust paddles 2128, 2129, 2130, and 2131 may move with a circulatory belt 2115, as shown in FIG. 21B. Various mechanical or electrical means may be used to connect the treadmill belt control input to moving the thrust paddles 2128, 2129, 2130, and 2131. In FIG. 21B, the control treadmill 2109 uses pulley wheels 2116 and 2121 and figure-8 belts 2120 and 2125, respectively, to transfer rider-generated motion to the pulley wheels 2118 and 2123, respectively, of the circulatory belt 2115 moving the thrust paddles 2128, 2129, 2130, and 2131. The thrust paddles 2128, 2129, 2130, and 2131 rotate about axes 2132, 2135, 2138, and 2141, respectively, relative to the bases 2133, 2136, 2139, and 2142, respectively attached to the circulatory belt 2115. The pulleys 2116, 2121, 2118, and 2123 have rotary axes 2117, 2122, 2119, and 2124, respectively. The entire thrust assembly may reside in a cavity of the SUP 2100, with a front cavity boundary 2126 and a rear cavity boundary 2127. The handle 2103 of the handlebars may steer the direction of the rudder 2175. There is typically at least one thrust paddle 2128, 2129, 2130, and 2131 in the water 2101 on the bottom side of the circulatory belt 2115.

FIG. 21C is a side view, where the thrust paddles on the circulatory belt 2115 in FIG. 21B are substituted with collapsible thrust actuators or "scoop fins" 2155, 2158, 2152, and 2149 on the circulatory belt 2144 in FIG. 21C, such as were introduced in FIGS. 9A-9D. The two top thrust actuators 2155 and 2158 are shown with their respective ends 2156 and 2159 collapsed; whereas, the two bottom thrust actuators 2152 and 2149 are shown with their respective ends 2153 and 2150 open and capable of catching water to apply thrust. The thrust actuators 2155, 2158, 2152, and 2149 comprise sides 2157, 2160, 2154, and 2151, respectively. The circulatory belt 2144 comprises belt rollers 2145 and 2147 with axes 2146 and 2148, respectively.

FIG. 21D is a side view, where the pulleys and belt of FIG. 21A that mechanically connect the treadmill 2161 control input with the circulatory belt 2164 output is replaced by fixed gears 2162 and 2163 providing rearward transmission from the top treadmill 2161 to rearward transmission of the bottom circulatory belt 2164. The top gear 2162 may be a 1-way ratchet gear, like a bicycle sprocket or functional equivalent, where when the top treadmill 2161 is recovered forward, the top gear 2162 does not drive the bottom circulatory belt 2164 forward. A ratchet gear on the bottom gear 2163 allows fixed thrust actuators that don't rotate relative to the circulatory belt 2164 during gliding. Although not explicitly shown in FIG. 21D, the top treadmill 2161 is typically where the rider stands, and the top treadmill 2161 may comprise a foot holder similar to the foot holder 2110 in FIG. 21B.

FIG. 21E is an end view, where the fixed gears 2161 and 2163 of FIG. 21D are replaced by a gear box, which may also comprise an apparatus to provide a continuously changeable gear ratio. For example, the top gears 2166, 2162, and 2169 are coaxial with the top treadmill 2161 and can each rotate the top treadmill 2161. The axle 2165 of the top treadmill 2161 is attached to the gear 2166 having the axle 2167, which is attached to the gear 2162 having the axle 2168, which is attached to the gear 2169. The bottom gears 2171, 2163, and 2174 are coaxial with the bottom circulatory belt 2164 and can each rotate the bottom circulatory belt 2164. The axle of the bottom circulatory belt 2164 is capable of sliding to extend, where one of the sliding ends 2170 is attached to the gear 2171 having the axle 2172, which is attached to the gear 2163 having the axle 2173, which is attached to the gear 2174. As shown, the first gear 2166 of the top treadmill 2161 is meshed with the first gear 2171 of the bottom circulatory belt 2164, providing a first gear ratio. When the sliding axle of the bottom circulatory belt 2164 is extended by the rider, the second gear 2162 of the top treadmill 2161 is meshed with the second gear 2163 of the bottom circulatory belt 2164, providing a second gear ratio. When the sliding axle of the bottom circulatory belt 2164 is further extended, the third gear 2169 of the top treadmill 2161 is meshed with the third gear 2174 of the bottom circulatory belt 2164, providing a third gear ratio.

Figure 22A:
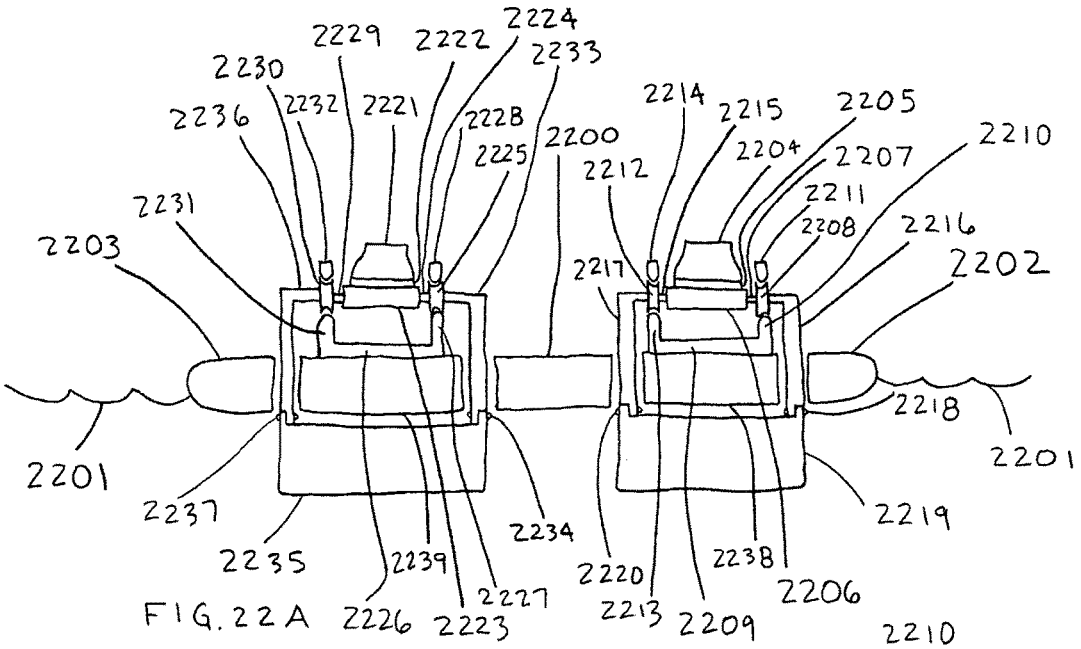
FIG. 22A is a rear-end view of the thrust assembly of FIG. 22B, where
Figure 22B:
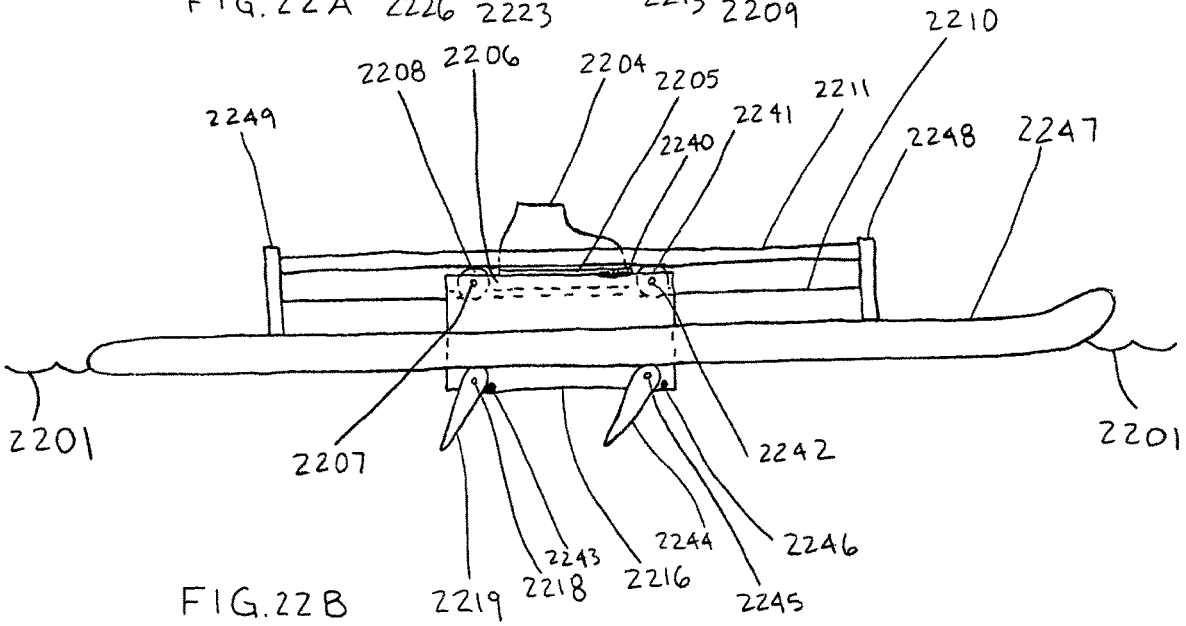
FIG. 22B is a side view of a useful embodiment of another thrust assembly.

FIG. 22A is a rear-end view of the thrust assembly of FIG. 22B, where FIG. 22B is a side view of a useful embodiment of another thrust assembly. Right 2206 and left 2223 foot carriages roll on wheels 2208, 2212, 2225, and 2230 along linear rails 2210, 2213, 2227, and 2231 having rail bases 2209 and 2226, much like freight train wheels roll along railroad tracks. The wheels 2208, 2212, 2225, and 2230 may have larger-diameter disks on either the inside surface of the wheels 2208, 2212, 2225, and 2230, the outside surface of the wheels, or both. In FIG. 22A, the wheels 2208, 2212, 2225, and 2230 are shown with larger-diameter disks on both the inside and outside surfaces of the wheels to better guide the food carriages 2206 and 2223 along the linear rails 2210, 2213, 2227, and 2231. FIG. 22A provides optional upper rails 2211, 2214, 2228, and 2232 to prevent the foot carriages 2206 and 2223 from coming off the lower rails 2210, 2213, 2227, and 2231. Thrust paddles 2219 and 2235 extend from the foot carriages 2206 and 2223 through openings, such as slots, along the SUP 2247, with sections 2202, 2238, 2200, 2239, and 2203. The thrust paddles 2219 and 2235 may rotate relative to the foot carriages 2206 and 2223, and the rotation may be impeded by limit stops 2243 and 2246 in FIG. 22B for the thrust paddles 2219 and 2244, respectively. The limit stops 2243 and 2246 in FIG. 22B are useful to help the thrust paddles 2219 and 2235 apply a forward thrust force to propel the SUP 2247, but where the thrust paddles 2219 and 2235 may rotate clockwise so as not to provide drag during a recovery phase. In this way, the thrust paddles 2219 and 2235 may be used to apply force against the water 2201 to propel the SUP 2247 forward (i.e., to the right in FIG. 22B). The thrust paddles 2219 and 2235 may be linked together by a tie rod (not shown), similar to the tie rod 1518 in FIGS. 15A-15B.

The rider typically places their feet on the carriages 2206 and 2223. The carriages 2206 and 2223 may comprise foot holders 2204 and 2221 with foot supports 2205 and 2222, respectively. The carriages 2206 and 2223 connect to the wheels 2208, 2212, 2225, and 2230 by axles 2207, 2215, 2224, and 2229, respectively. The axles of the wheels 2208, 2212, 2225, and 2230 connect to the paddle supports 2216, 2217, 2233, and 2236. The paddle supports 2216, 2217, 2233, and 2236 connect to paddles 2219 and 2235 by revolute joints 2218, 2220, 2234, and 2237.

FIG. 22B provides a front right thrust paddle 2244 with revolute joint 2245 and limit stop 2246, as well as a front right wheel 2241 with an axle 2242. The foot holder 2204 may comprise Velcro 2240 to attach to the carriage 2206. The upper 2211 and lower 2210 rails may comprise front 2248 and rear 2249 rail supports attached to the SUP 2247.

Figure 23A:
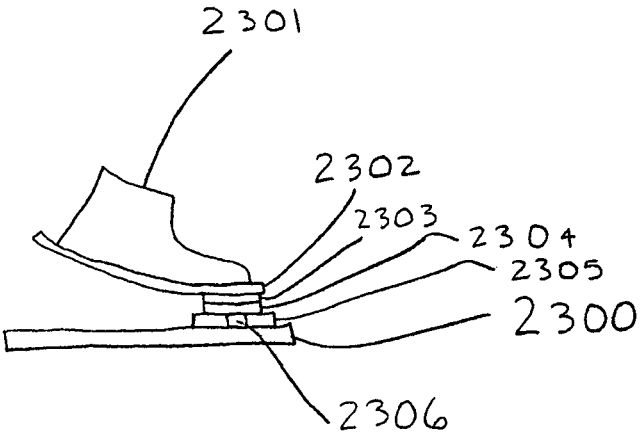
FIGS. 23A-23D provide a wireless steering apparatus.

FIGS. 23A-23D provide a wireless steering apparatus. FIG. 23A is a side view of a wireless steering control apparatus comprising a foot holder 2301 connected to a foot support 2302 comprising a first mating portion 2303 mated with a second mating portion 2304. The foot support 2302 may comprise hard, flexible rubber. The second mating portion 2304 is connected to a rotary member 2305 with a rotary joint 2306 for rotating relative to a base 2300. The base may be affixed to an SUP, or the base may be the SUP itself. The base 2300 may be functionally equivalent to the support member 2206 of the foot carriage in FIG. 22A.

Figure 23B:
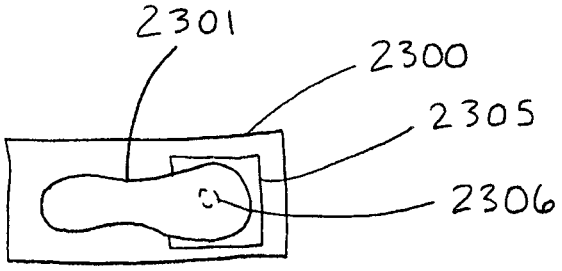

FIG. 23B is a plan view of the wireless steering control apparatus of FIG. 23A in a straight orientation.

Figure 23C:
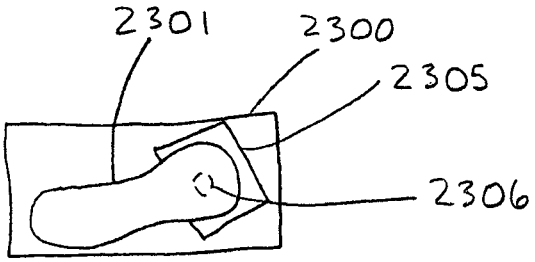

FIG. 23C is a plan view of the wireless steering apparatus of FIG. 23A in a left-turn orientation. Rotary joint 2306 comprises an angular sensor and wirelessly transmits an angle signal to a wireless steering actuator.

Figure 23D:
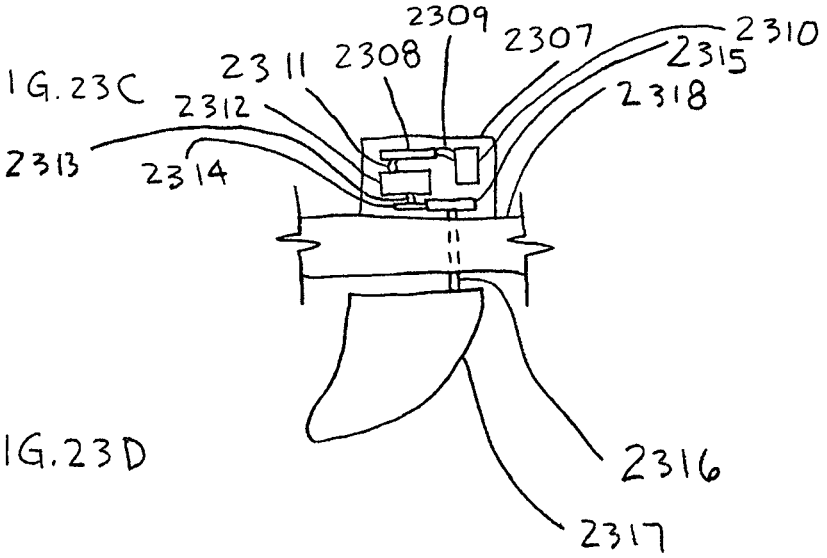

FIG. 23D is a side cutaway view of a wireless steering actuator. Located inside a water-resistant container 2307 is control circuitry 2308, a battery 2310, a rotation actuator 2312, transmission apparatus 2314 and 2315, and related electrical and mechanical connections. The transmission apparatus is connected to a steering rudder 2317. The control circuitry 2308 comprises a wireless receiver for receiving a wireless angle signal, and optionally a wireless transmitter. The control circuitry 2308 typically comprises a digital processor for processing data. The control circuitry 2308 may be connected by wires 2309 to the battery 2310. The control circuitry 2308 may also be connected by wires 2311 to the rotation actuator 2312. The rotation actuator 2312 may be an electric motor with an output shaft 2313. The output shaft 2313 may be connected to an input gear 2314 which meshes with, or is connected by a belt or cable to, an output gear 2315. The output gear 2315 is connected to the rudder shaft 2316 which controls the orientation of the rudder 2317. Accordingly, the rider of the SUP 2318 may control the rudder 2317 by rotating their foot. Alternatively, the rider or someone else may use a mobile communication device, such as a tablet or phone, to control the rudder 2317.

Figure 24A:
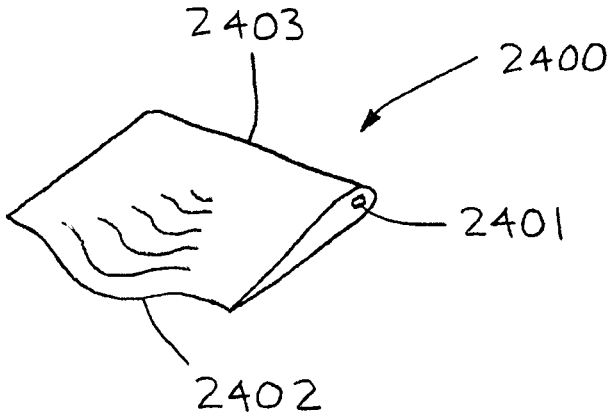
FIG. 24A is a perspective view of a thrust paddle with a curved paddle edge.

FIG. 24A is a perspective view of a thrust paddle 2400 with a curved paddle edge 2402. The thrust paddle 2400 may have a rotary joint 2401 about which it rotates. The thrust paddle 2400 typically has a straight edge 2403 on the edge nearest the rotary joint 2401. The curved paddle edge 2402 is typically the paddle edge most distal from the rotary joint 2401. The curved paddle edge 2402 is helpful to catch water when the thrust paddle 2400 is in a retracted orientation, and when the thrust paddle 2400 is moved in the direction from the straight edge 2403 toward the curved paddle edge 2402. When the thrust paddle 2400 is translated in this direction, the curved paddle edge 2402 acts like a scoop, and water fills a cavity formed by the curved paddle edge 2402, where the water applies a force against the thrust paddle 2400 and rotates the curved paddle edge 2402 downward into deeper water into a thrust-capable orientation.

Figure 24B:
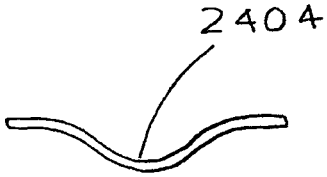
FIG. 24B is a cross section of the thrust paddle near the curved paddle edge.

FIG. 24B is a cross section 2404 of the thrust paddle 2400 near the curved paddle edge 2402.

Figure 24C:
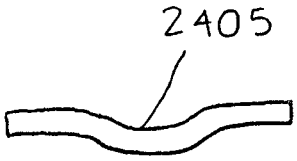
FIG. 24C is a cross section of the thrust paddle midway between the curved paddle edge and the straight edge.

FIG. 24C is a cross section 2405 of the thrust paddle 2400 midway between the curved paddle edge 2402 and the straight edge 2403.

Figure 24D:
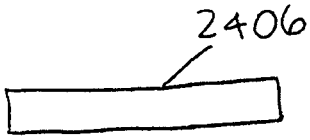
FIG. 24D is a cross section of the thrust paddle near the straight edge.

FIG. 24D is a cross section 2406 of the thrust paddle 2400 near the straight edge 2403.

Figure 25A:
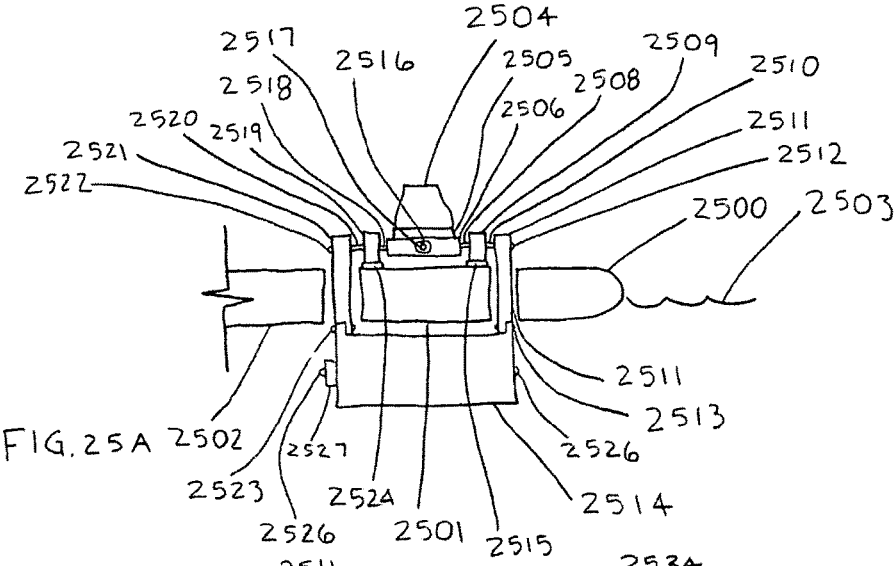
FIG. 25A is a rear-end view of the thrust assembly of FIG. 25B, where
Figure 25B:
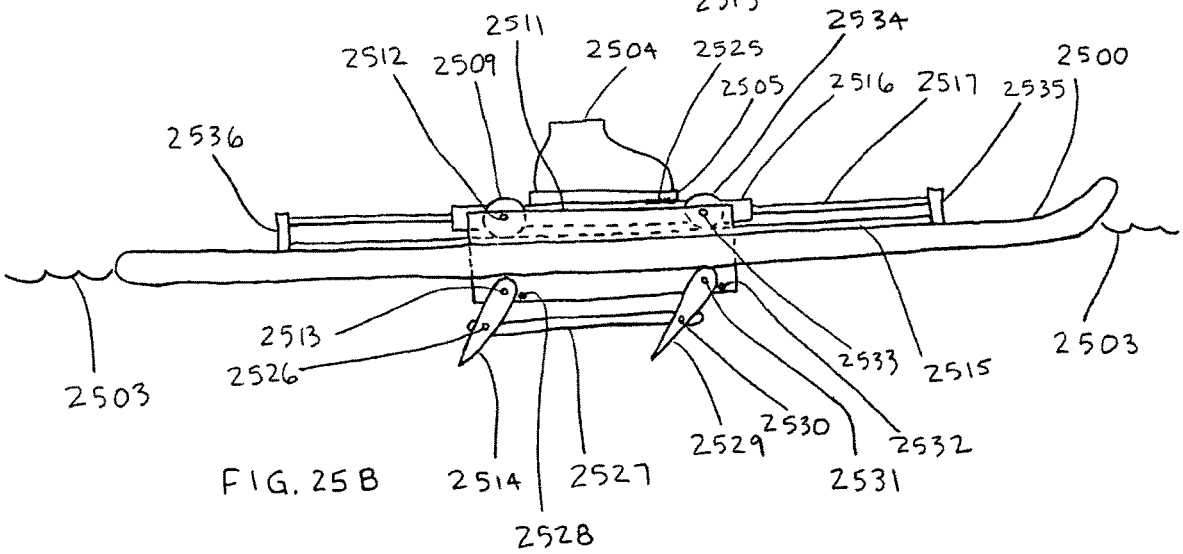
FIG. 25B is a side view of a useful embodiment of another thrust assembly.

FIG. 25A is a rear-end view of the thrust assembly of FIG. 25B, where FIG. 25B is a side view of a useful embodiment of another thrust assembly. A right-foot carriage 2506 rolls on wheels 2509 and 2519 along rolling surfaces 2515 and 2524. The wheels 2509 and 2519 may comprise rubber, and the rolling surfaces 2515 and 2524 may comprise strips of metal. Typically there is a similar left-foot carriage, but for clarity, it is not shown in FIGS. 25A-25B. FIG. 25A provides a linear bearing 2516 with bearing rail 2517 to guide the foot carriage 2506. A thrust paddle 2414 extends from the foot carriage 2506 through openings, such as slots, along the SUP 2500 having additional sections 2501 and 2502. The SUP 2500 may comprise a handlebar for turning a rudder, such as provided by FIG. 21B. The thrust paddle 2514 may rotate relative to the foot carriage 2506, and the rotation of the thrust paddle 2514 may be impeded by limit stops. In FIG. 25B, thrust paddles 2514 and 2529 have limit stops 2528 and 2532, respectively. In this way, the thrust paddles 2514 and 2529 may be used to apply force against the water 2503 to propel the SUP 2500 forward (i.e., to the right in FIG. 25B). The limit stops 2528 and 2512 may be adjustable to vary the depth the thrust paddles 2514 and 2529 (which may also be called "louvres") will extend, which accordingly varies the amount of effort the rider must exert based on the amount of water "grip." The limit stops 2528 and 2512 may be adjusted by a control in a handle, a grip, or handlebar (not shown), and where a Bowden cable may be used. One or more thrust paddles, such as thrust paddles 2514 and 2529, may be linked together by a tie rod 2527 by revolute joints 2526 and 2530, respectively. As the rider slides their feet alternately forward and rearward, similar to a Nordic snow skier, thrust paddles in contact with the water 2503 apply force against the water 2503 to move the SUP 2500 forward.

The rider typically places their feet on the carriage 2506. The carriage 2506 may comprise a foot holder 2504 with a foot support 2505. The foot holder 2504 may comprise a water sock or a boot. The carriage 2506 connects to the wheels 2509 and 2519 by axles 2508 and 2518, respectively. The axles 2510 and 2520 of the wheels 2509 and 2519 connect to the paddle supports 2511 and 2521, and may be seen from the sides as axles 2512 and 2522, respectively. The paddle supports 2511 and 2521 connect to the paddle 2514 by revolute joints 2513 and 2523.

FIG. 25B provides a front right thrust paddle 2529 with revolute joint 2531 and limit stop 2532, as well as a front right wheel 2534 with an axle 2533. The foot holder 2504 may comprise Velcro 2525 to attach to the carriage 2506. The bearing rail 2517 and the rolling surface 2515 may comprise front 2535 and rear 2536 supports attached to the SUP 2500. The axles of the wheels 2534 and 2509 may be seen from the side as 2533 and 2512, respectively.

Figure 26A:
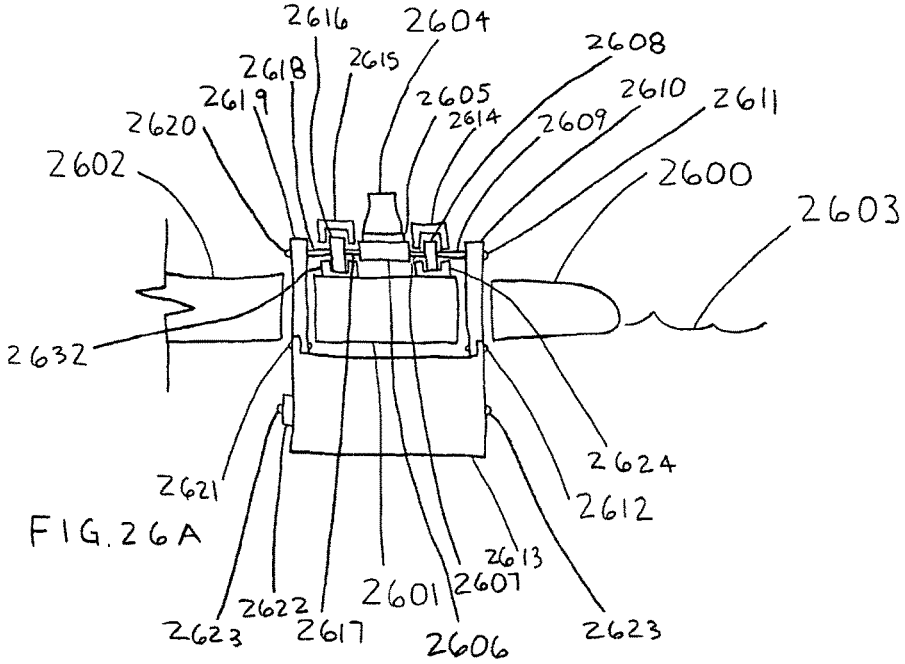
FIG. 26A is a rear-end view of the thrust assembly of FIG. 26B, where
Figure 26B:
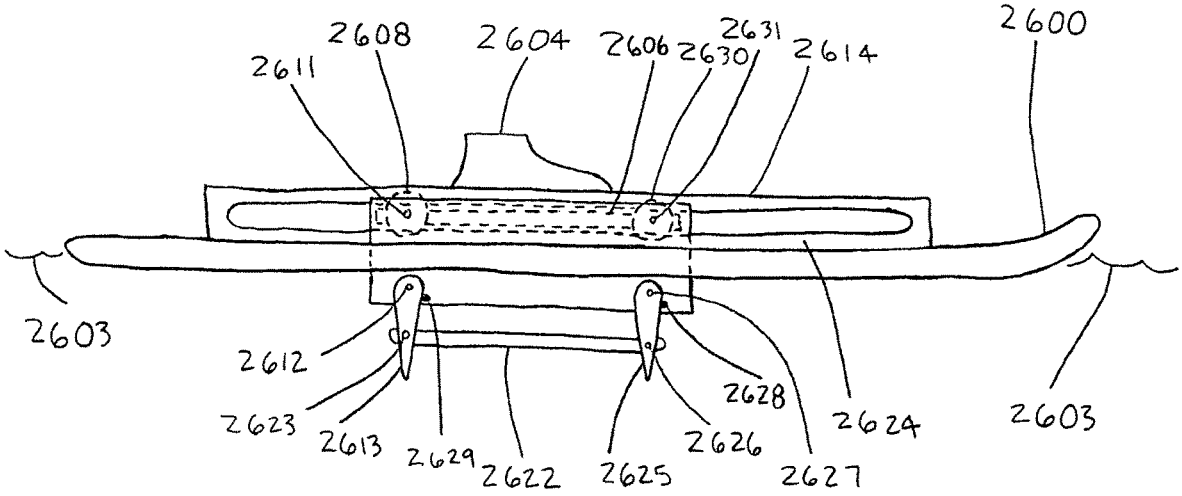
FIG. 26B is a side view of a useful embodiment of another thrust assembly.

FIG. 26A is a rear-end view of the thrust assembly of FIG. 26B, where FIG. 26B is a side view of a useful embodiment of another thrust assembly. A right-foot carriage 2606 rolls on wheels 2608, 2616, and 2630 contained by upper and lower linear rails, much like a garage door's wheels roll through a retaining channel. FIG. 26A provides optional upper rails 2614 and 2615 to prevent the foot carriage 2606 from coming off the lower rails 2624 and 2632. Typically there is a similar left-foot carriage, but for clarity, it is not shown in FIGS. 26A-26B. A thrust paddle 2613 extends from the foot carriage 2606 through openings, such as slots, along the SUP 2600 having additional sections 2601 and 2602. The thrust paddle 2613 may rotate relative to the foot carriage 2606, and the rotation of the thrust paddle 2613 may be impeded by limit stops. In FIG. 26B, thrust paddles 2613 and 2625 have limit stops 2629 and 2628, respectively. In this way, the thrust paddles 2613 and 2625 may be used to apply force against the water 2603 to propel the SUP 2600 forward (i.e., to the right in FIG. 26B). The thrust paddles 2613 and 2625 may be linked together by a tie rod 2622 by revolute joints 2623 and 2626, respectively. As the rider slides their feet alternately forward and rearward, similar to a Nordic snow skier, thrust paddles in contact with the water 2603 apply force against the water 2603 to move the SUP 2600 forward.

The rider typically places their feet on the carriage 2606. The carriage 2606 may comprise a foot holder 2604 with a foot support 2605. The foot holder 2604 may comprise a water sock or a boot. The carriage 2606 connects to the wheels 2608 and 2616 by axles 2607 and 2617, respectively. The axles 2609 and 2618 of the wheels 2608 and 2616 connect to the paddle supports 2610 and 2619, and may be seen from the sides as axles 2611 and 2620, respectively. The paddle supports 2610 and 2619 connect to the paddle 2613 by revolute joints 2612 and 2621.

FIG. 26B provides a front right thrust paddle 2625 with revolute joint 2627 and limit stop 2628, as well as a front right wheel 2630 with an axle 2631. The axles of the wheels 2630 and 2608 may be seen from the side as 2631 and 2611, respectively.

FIG. 27.1 is a side view of a useful embodiment of another thrust assembly where the rider may stand sideways on the SUP 2700, like a snowboarder stands on a snowboard, with one foot near the front of the SUP 2700 on the foot platform 2701 and one foot near the back of the SUP 2700 on the foot platform 2702. As the rider rocks 2703 between their front and back feet, the flipper 2704, which may be flexible, rotates up and down 2705 and provides forward thrust 2706 (i.e., to the left in the figure). The foot support is shown connected to the flipper 2704 by a pulley 2707 with pulley belt 2708; although, any convenient connection may be used.

FIG. 27.2 is a side view of a useful embodiment of another thrust assembly where the rider may stand sideways on the SUP 2709, like a snowboarder stands on a snowboard, with one foot near the front of the SUP 2709 on the foot platform 2710 and one foot near the back of the SUP 2709 on the foot platform 2711. As the rider rocks 2712 between their front and back feet, the pair of flippers 2713, which may be flexible, rotate side to side 2714 to provide forward thrust 2715 (i.e., to the left in the figure). The foot support may be connected to the flippers by a Mirage Drive 2716; although, any convenient connection may be used.

FIG. 27.3*a* is a plan view of the useful embodiment of another thrust assembly where the rider may stand sideways on the SUP 2717. The outlines of shoes 2718 and 2719 exemplify where the rider may place their feet on the foot platforms 2720 and 2721, but there need not be actual shoes or special foot holders.

FIG. 27.3*b* is a front-end view of the useful embodiment of another thrust assembly where the rider may stand sideways on the SUP 2722. In this figure, if the rider tilts 2723 from their heels 2724 to their toes 2725, the Bowden cable 2726, or any functionally similar apparatus, turns 2727 the steering rudder 2728.

FIG. 28A is a side view of a useful embodiment of another thrust assembly. In the thrust assembly of FIG. 28A, the rider's foot 2802 is resting on the foot support 2803. Alternately, a foot holder 2802 is removably secured to the foot support 2803, and the rider's foot is held by the foot holder 2802. Although, only a single foot support 2803 is shown, the embodiment typically comprises two foot supports, one for each foot. When the rider (not shown) applies their weight to press down on the foot support 2803, the thrust shaft 2804 moves downward, farther into the water 2801 though opening 2805 in the SUP 2800. The opening 2805 may comprise a linear bearing for guiding the thrust shaft 2804. The thrust shaft 2804 is connected at the connection point 2808 to thrust member 2807. The rear end of the thrust member 2807 is connected at the rear connection 2810 to the mount 2809, which is connected to the SUP 2800. The thrust member 2807 may be rigid, but typically it is flexible. If the thrust member 2807 is rigid, the rear connection 2810 typically comprises a rotary joint. If the thrust member 2807 is flexible, the rear connection 2810 may still comprise a rotary joint; however, a rotary joint is not required. The flexibility of thrust member 2807 is indicated in FIG. 28A by the dashed lines 2806 showing the initial position of the thrust member 2807 before the rider presses down on the foot support 2803. Typically there is mechanical or electromechanical apparatus that keeps the right and left foot supports 180 degrees out of phase, i.e., while one foot support is going down, the other foot support is forced up. The effect is that the rider feels like they are marching in place. Each foot support has its own thrust shaft and thrust member. As each thrust member is forced up and down by the rider alternatively transferring their weight from one foot support to the other, each thrust member directs water toward the rear of the SUP 2800, providing a forward thrust for the SUP 2800.

The rider may balance themselves using the handlebars 2811 connected to the SUP 2800 by handlebar neck 2812. The handlebars may be mechanically or electrically connected to the steering rudder 2813.

FIG. 28B is a side view of a useful embodiment of another thrust assembly. The thrust assembly of FIG. 28B has one or more thrust members similar to the thrust members of FIG. 28A; however, FIG. 28B also allows the rider to assist their foot-generated thrust with arm-generated thrust. If the rider pulls back on the handlebars 2819, the hand lever 2820 rotates clockwise about a rotary joint 2822 of a support 2821, and so the connected slide lever 2823 also rotates clockwise. The slide lever 2823 comprises a slide member 2824 that slides in the slide track 2825 when the slide lever 2823 rotates, such that when the slide lever 2823 rotates clockwise, the slide member 2824 forces the slide track 2825 down, and accordingly, forces the thrust shaft 2804 down. Conversely, if the rider pushes the handlebars 2819, the hand lever 2820 rotates counter clockwise about rotary joint 2822, ultimately causing the slide member 2824 to force the slide track 2825 up, which consequently forces the thrust shaft 2804 up. Coordinated hand and leg movement by the rider can lead to optimum performance, as well as a full-body exercise.

FIG. 28C is a side view of a useful embodiment of another thrust assembly. The apparatus of FIG. 28C is similar to the apparatus of FIG. 28A, except that the thrust member 2814 of FIG. 28C is different than the thrust member 2807 of FIG. 28A. The thrust member 2814 is not connected to the SUP 2800 at the trailing edge. The thrust member 2814 may be rigid, but typically it is flexible, like a SCUBA flipper. If the thrust member 2814 is rigid, typically the connection point 2808 comprises a return spring 2816. Such a return spring 2816 is shown schematically as a coil spring, with one end 2818 in functional relation to the thrust shaft 2804, and the other end 2817 in functional relation to the thrust member 2814; however, the return spring 2816 may comprise any convenient spring structure. Even if the thrust member 2814 is flexible, as indicated by the dashed lines 2815 in FIG. 28C, the flexible thrust member 2814 may still comprise a return spring 2816. In either case, the thrust member 2814 may automatically straighten to reduce drag when the rider is not pressing down on the foot support 2803. Typically there are two separate foot supports, where each foot support has its own thrust shaft and thrust member. As each thrust member is forced up and down by the rider alternatively transferring their weight from one foot support to the other, each thrust member directs water toward the rear of the SUP 2800, providing a forward thrust for the SUP 2800, much like a SCUBA diver propels themselves. The thrust member 2814 may be positioned beneath the SUP 2800, to the side of the SUP 2800, or partially beneath and partial to the side. The SUP 2800 may also comprise a cavity in the bottom surface of the SUP 2800 so the thrust member 2814 may completely retract into the cavity. Use of such a cavity is convenient if the SUP 2800 is to be used for surfing, since drag is minimized when a wave is caught. Use of a cavity also helps protect the thrust member 2814 when the SUP 2800 is placed on a hard surface.

FIG. 28D is a plan view, and FIG. 28E is a front-end view, of the useful embodiment of FIG. 28A. FIGS. 28D-28E provide the case where left and right foot supports 2803 and 2827 are used, with left and right thrust shafts 2804 and 2828 connected to left and right thrust members 2807 and 2830, respectively. Similarly to the foot holder 2802, a foot holder 2826 may be secured to the foot support 2827. To keep the left and right foot supports 2803 and 2827 180 degrees out of phase, a pulley 2834 with axle ends 2836 and 2837 is supported by a pulley mount 2835, and employing a pulley cable 2838, may be employed; however, any convenient mechanical or electromechanical means may be used. If programmable electromechanical means with position sensors and electromechanical position actuators are used, any desired phase between the left and right foot supports may be selected. The pulley apparatus provided by FIGS. 28D-28E, and functional equivalences, may be similarly applied to the thrust apparatus of FIG. 28C.

In FIG. 28D, the trailing edges of thrust members 2807 and 2830 are shown to be attached only by their corners to the SUP 2800 or to the mounts 2809 and 2833. With this design, water may flow thought the gaps 2831 and 2832 between the corners of the thrust members 2807 and 2830. As provided in FIG. 28D (but not similarly provided in FIG. 28E), the thrust shafts 2804 and 2828 may bow out to connect to the sides 2808 and 2829 of the thrust members 2807 and 2830. With proper support (not shown) of the foot supports to the SUP 2800, the thrust shafts 2804 and 2828 may extend out around the sides of the SUP 2800 so there do not need to be holes 2840 and 2839 through the SUP 2800.

FIG. 29.3*c* is a side view of a useful embodiment of another thrust assembly. The apparatus of this figure is similar to the apparatus of FIG. 28B, but where only arms 2900 are used to provide thrust. Additionally, a leash 2901 may be used to support the rider 2902 when they pull 2903 against the handles 2904. Velcro 2905 may be used to secure the leash to the rider 2902.

FIG. 29.3*d* is a plan view of a useful embodiment where a throttle grip 2906 comprises a Bowden cable 2907 to control the rudder 2908.

FIG. 29.4*a* is a side view of a useful embodiment of another thrust assembly, where a rigid curved rod 2909 is connected to the foot support 2910, goes around the SUP 2911 using a pivot 2912, and moves the thrust member 2913 up and down 2914 to provide thrust.

FIG. 29.4*b* is a front-end view of a useful embodiment where the two foot supports 2916 and 2917 are kept 180 degrees out of phase using a pulley 2918 and pulley cable 2919. The pulley 2918 is supported by the SUP 2915. The right foot support 2916 has a sliding member 2925 attached to one end of the pulley cable 2919. The sliding member 2925 is guided by a guiding member 2926. The pulley cable 2919 passes around the pulley 2918 and is connected to the left foot support 2917. The left foot support is connected to a flexible flipper 2921 with a connecting member 2927. When the left foot support 2917 is pressed down 2923 by the rider, the pulley cable 2919 rotates the pulley 2918 clockwise 2920, and causes the right foot support 2916 to elevate 2924. Also when the left foot support 2917 is pressed down 2923, the connecting member 2927 forces the flexible flipper 2921, producing thrust as the flexible flipper 2921 flexes. When the right foot support 2916 is pressed down, the pulley 2918 and pulley cable 2919 elevate the left foot support 2917, which also elevates the flexible flipper 2921, producing thrust.

FIG. 30.5*a* is a perspective view of a useful embodiment of another thrust assembly, where moving handles 3000 and 3001 forward 3002 and rearward 3003 makes a flexible flipper 3004 move side to side to provide forward thrust as well as turning. FIG. 30.5*b* shows an assembly comprising pulleys 3005 and 3006 and a pulley belt 3007 to keep the two handles 3008 and 3009 180 degrees out of phase, where when one handle 3008 is being pushed forward 3010, the other handle 3009 moves backward 3011.

FIG. 30.6*a* is a side view of a useful embodiment of another thrust assembly, where a rigid curved rod 3012 is connected to the foot support 3013 and to a hand lever 3014 with a sliding slot 3015, where the curved rod 3012 goes around the SUP 3016 using a pivot 3017, and moves the thrust member, shown here as a flexible flipper 3018, up 3019 and down 3020 to provide thrust. FIG. 30.6*b* is similar to 30.6*a*, except the hand lever 3021 is connected to the curved rod 3022 using a tie rod 3023 with rotary joints 3024 and 3025 on each end.

FIG. 30.7 is a plan view of a useful embodiment of another thrust assembly, where rocking handlebars 3026 back 3027 and forth makes a flexible rear flipper 3028 move side to side to provide forward thrust as well as turning. In this figure, an assembly comprising pulleys 3029 and 3030 and a pulley belts 3031 is used to mechanically connect the handlebar shaft 3032 with the flipper rotary joint 3033.

FIG. 31.8*a* is a side view of a useful embodiment of another thrust assembly, where the up and down 3110 motion of the foot support 3109 is constrained by a four-bar mechanism. The four-bar mechanism comprises members 3105, 3106, 3107, and 3108. The foot support 3109 is fastened to the member 3105, and the member 3107 is fastened to the SUP 3115. In this embodiment, a pulley 3111 is supported by the SUP 3115, and the pulley cable 3112 is connected at two points on the member 3108, whereby rocking of the member 3108 about the pivot 3138 causes the pulley 3111 to rotate 3114, which then also causes the flexible flipper 3113 to rotate up and down, providing thrust.

FIG. 31.8*b* is a front-end view of a useful embodiment, such as a portion of the embodiment of FIG. 31.8*a*, where the two foot supports 3116 and 3117 are kept 180 degrees out of phase using a pulley 3118 and pulley cable 3120. The pulley 3118 is supported by the SUP 3121. The right foot support 3116 is attached to one end of the pulley cable 3120. The pulley cable 3120 passes around the pulley 3118 and is connected to the left foot support 3117. When the left foot support 3117 is pressed down by the rider, the pulley cable 3120 rotates the pulley 3118 clockwise, and causes the right foot support 3116 to elevate. When the right foot support 3116 is pressed down, the pulley 3118 and pulley cable 3120 elevate the left foot support 3117.

FIG. 31.9 is a side view of a useful embodiment of another thrust assembly, where rocking handlebars 3100 back and forth 3101 makes a flexible flipper 3102 move side to side 3103, using a direct shaft connection 3104, to provide forward thrust as well as turning.

FIG. 31.10*a* is a front view of a useful embodiment for keeping the right 3122 and left 3123 foot supports moving 180 degrees out of phase using a pulley 3127 and pulley cable 3128, while simultaneously moving a flexible flipper 3124 up and down to provide forward thrust. In this figure, a rack 3125 and pinion 3126 is provided; however, any other functionally equivalent apparatus may be used.

FIG. 31.10*b* is a side view of the flexible flipper 3124 of FIG. 31.10*a*.

FIG. 31.10*c* is a front view of a useful embodiment for keeping the right 3139 and left 3140 foot supports moving 180 degrees out of phase using a four-bar mechanism, while simultaneously moving a flexible flipper 3141 up and down to provide forward thrust. The four-bar mechanism comprises members 3144, 3145, 3146, and 3147. In this figure, the four-bar mechanism is connected to a rack 3142 and pinion 3143; however, any other functionally equivalent apparatus may be used. The member 3147 is connected to the pinion 3143, and both rotate around the axis 3148 which is supported by the SUP 3149. The rack 3142 is connected to the flexible flipper 3141. When the rider presses down on the foot support 3140, the members 3147 and 3145 rotate counter clockwise, as does the pinion 3143, and the foot support 3139 elevates. The pinion 3143 is meshed with the rack 3142 and causes it and the flexible flipper 3141 to elevate, providing thrust. Similarly, when the rider presses down on the foot support 3139, the flexible flipper 3141 lowers, again providing thrust.

FIG. 31.11 is a side view of a useful embodiment of another thrust assembly where the rider 3129 may stand, and by rocking the handles 3130 and 3131 forward 3132 and backward 3133, the pair of flippers 3134 and 3135, which may be flexible, rotate side to side 3136 to provide forward thrust (i.e., to the left in the figure). The handle levers may be connected to the flippers 3134 and 3135 by a Mirage Drive 3137; although, and convenient connection may be used.

FIG. 32 is a side view of a useful embodiment of another thrust assembly, where pushing and pulling 3138 on the handlebars makes a flexible flipper 3139 move up 3140 and down 3141, to provide forward thrust as well as turning 3142.

FIG. 33.1 is a side view of a useful embodiment of another thrust assembly, where when the rider 3300 stomps down 3301 on the foot support 3302, fluid is compress and expelled 3304 from a pump 3303, providing forward thrust. The pump 3303 may comprise an impeller, and the impeller may be rotated by a pedaling motion and/or a stomping motion. The fluid may be water taken in through an intake 3305 below the waterline 3306, or the fluid may be air taken through an intake 3307 above the waterline 3306.

FIG. 33.2 is a side view of a useful embodiment of another thrust assembly, where the SUP 3308 comprises a battery 3309, where the battery 3309 may be located in a water tight compartment in the SUP 3308 (as shown), or on the SUP 3308, and the battery 3309 provides electrical power to a trolling motor 3310, providing forward thrust and steering. Although not shown, the trolling motor column 3311 may collapse down for transport and storage, like the steering column of a Razor scooter. The trolling motor and propeller 3312 may rotate up into a cavity (not shown) in the SUP 3308.

FIG. 33.3 is a side view of a useful embodiment of another thrust assembly, where right 3313 and left 3314 foot supports each comprise a plurality of retractable thrust fins 3315 and 3316, respectively, to help propel the SUP 3320. Each foot 3317 and 3318 of the rider 3319 is supported by a foot support 3313 or 3314, respectively, which the rider 3319 can move relative to the SUP 3320. When a foot support 3313 is moved rearward 3323, the thrust fins 3315 extend downward into the water; and when a foot support 3314 is moved forward 3324, the thrust fins 3316 retract to minimize water resistance. The SUP 3320 may comprise steering as shown where a steering handle 3321 steers a rudder 3322 to turn the SUP 3320.

Figure 34A:
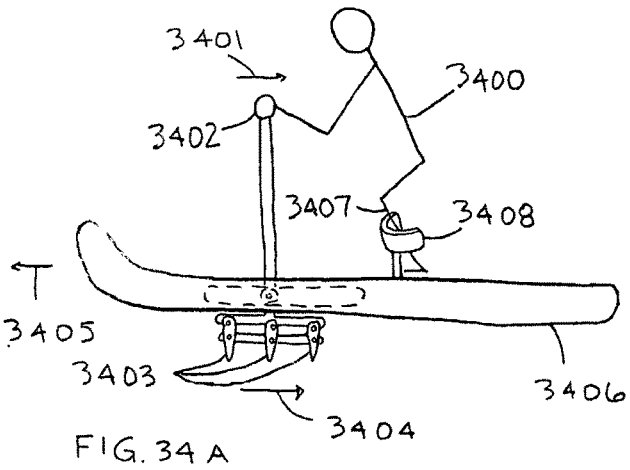
FIGS. 34A-34C are a side views of useful embodiments of other thrust assemblies.

FIG. 34A is a side view of a useful embodiment of another thrust assembly, where the rider 3400 pulls rearward 3401 against a handle 3402 to move thrust fins 3403 rearward 3404 to generate forward thrust 3405 for the SUP 3406. The rider 3400 may press their shin 3407 against a shin support 3408 to provide the reaction force to the rearward pulling 3401 against the handle 3402.

Figure 34B:
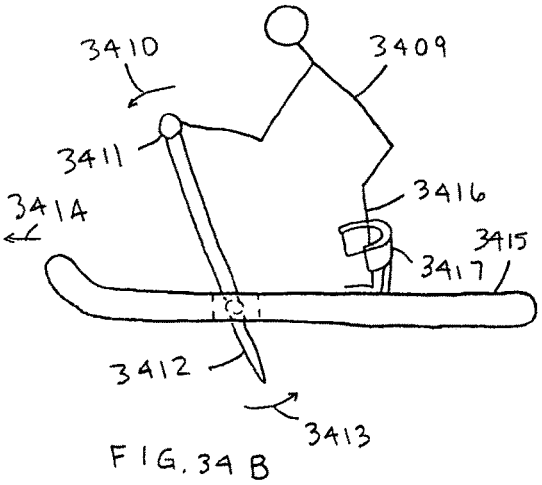

FIG. 34B is a side view of a useful embodiment of another thrust assembly, where the rider 3409 pushes forward 3410 against a handle 3411 to move thrust fin 3412 rearward 3413 to generate forward thrust 3414 for the SUP 3415. The rider 3409 may press their leg 3416 against a leg support 3417 to provide the reaction force to the forward pushing 3410 against the handle 3411.

Figure 34C:
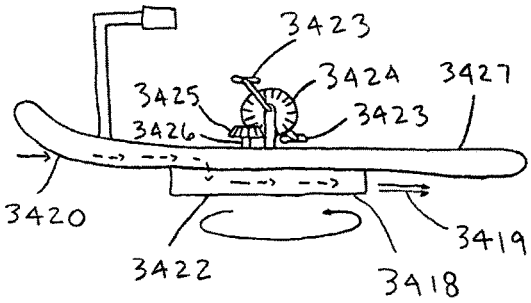

FIG. 34C is a side view of a useful embodiment of another thrust assembly, where fluid pump 3418 comprising an impeller/blower cage 2428 is powered by a rider to generate propulsion 3419 from the rear of the SUP 2427. Water may enter the pump 3418 from a water intake port on the front 3420, side 3421, or bottom 3422. In this figure, the rider uses pedals 3423 mechanically coupled using meshing gears 3424 and 3425 to rotate the pump 3418 about its rotary axis 3426.

Figure 34D:
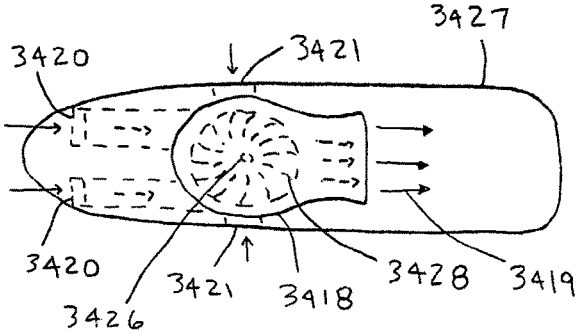
FIG. 34D is a plan view of the useful embodiment of FIG. 34C.

FIG. 34D is a plan view of the useful embodiment of FIG. 34C.

Figure 34E:
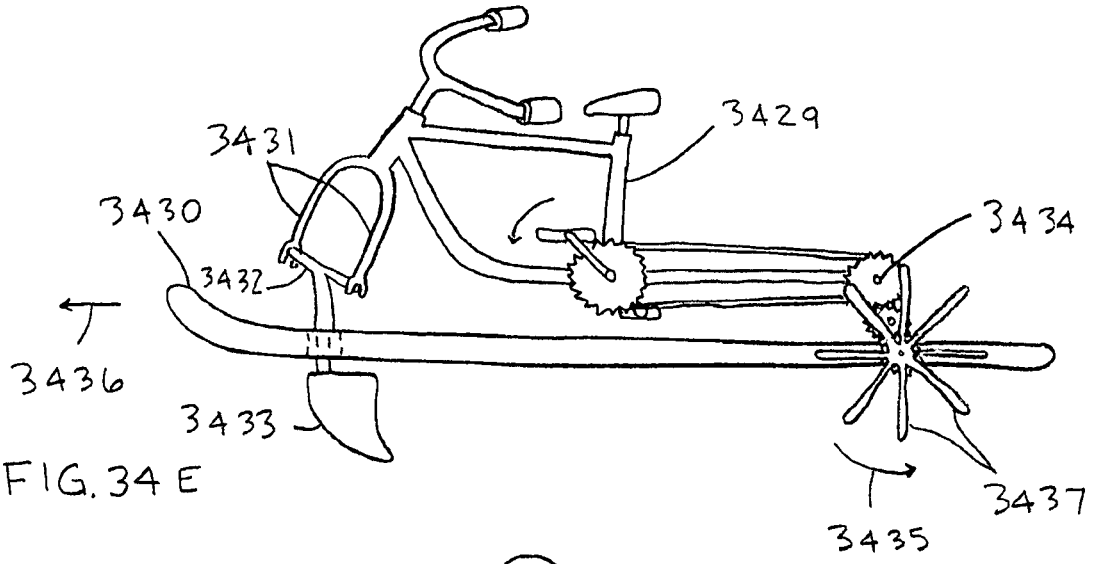
FIGS. 34E-34F are a side views of useful embodiments of other thrust assemblies.

FIG. 34E is a side view of a useful embodiment of another thrust assembly, where a bicycle frame 3429 is mounted to an SUP 3430 and used to steer and generate propulsion. The front forks 3431 of the bicycle frame 3429 may be set into a socket 3432 for the front steering rudder 3433. The rider-powered rear axle 3434 of the bicycle frame 3429 may be mechanically coupled to rotate 3435 a propulsion device to propel the SUP 3430 forward 3436, including paddles 3437, a propeller, impeller, Mirage Drive, and the like.

Figure 34F:
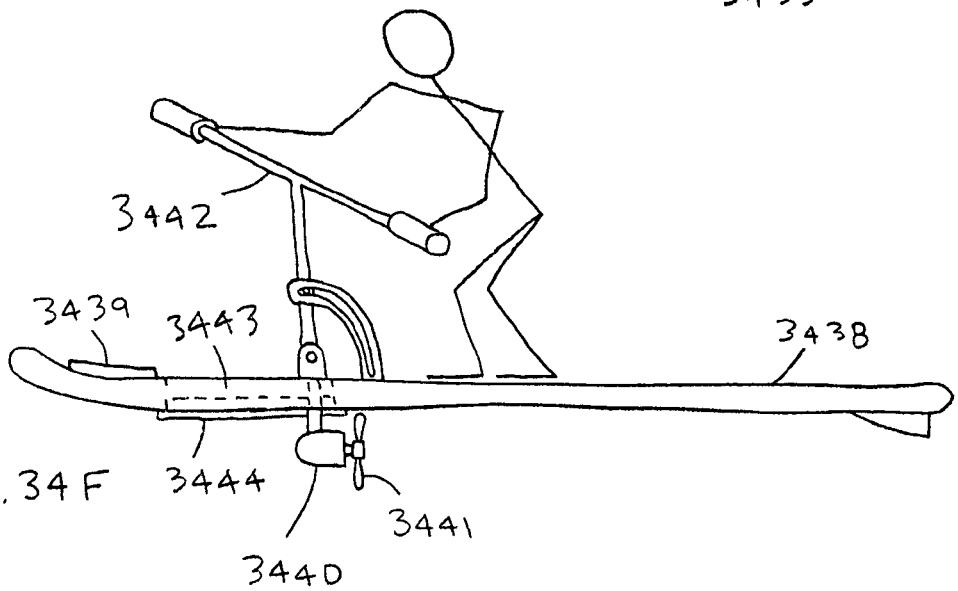
Figure 34G:
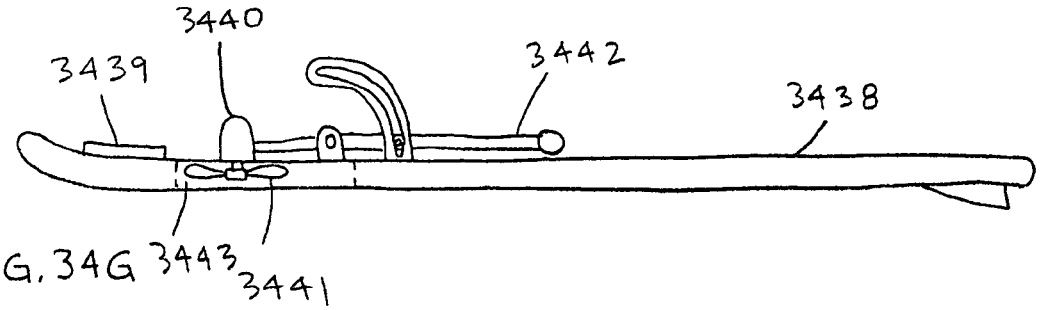
FIG. 34G is a side view of the useful embodiment of FIG. 34F where the handlebars are folded down against the SUP.

FIG. 34F is a side view of a useful embodiment of another thrust assembly, where an SUP 3438 is powered by an electric battery 3439 connected to an electric motor 3440 with propeller 3441 that is turned by handlebars 3442. FIG. 34G is a side view of the useful embodiment of FIG. 34F where the handlebars 3442 are folded down against the SUP 3438, and the electric motor 3440 with propeller 3441 is retracted up into a cavity 3443 in the SUP 3438. When the electric motor 3440 with propeller 3441 is not retracted up, the cavity 3443 in the SUP 3438 may be covered by a removable plug 3444. The electric battery 3449 may be placed on the SUP 3438 in a location as a counterweight to the rider.

Figure 35A:
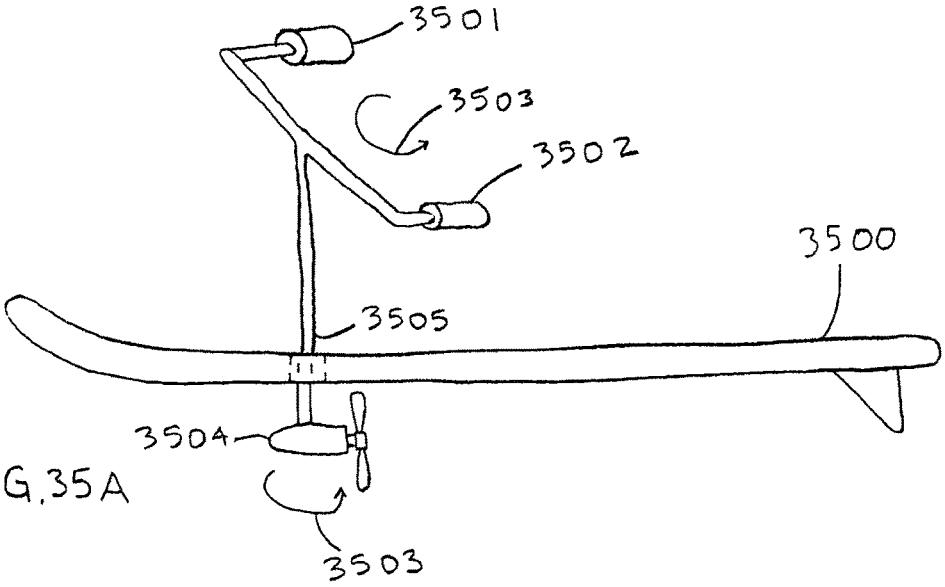
FIGS. 35A-35B are a side views of useful embodiments of other thrust assemblies.

FIG. 35A is a side view of a useful embodiment of another thrust assembly, where a rider of an SUP 3500 can stand, place each hand on handles 3501 and 3502, and steer by turning 3503 an electric motor 3504 axially connected 3505 to the handles 3501 and 3502.

Figure 35B:
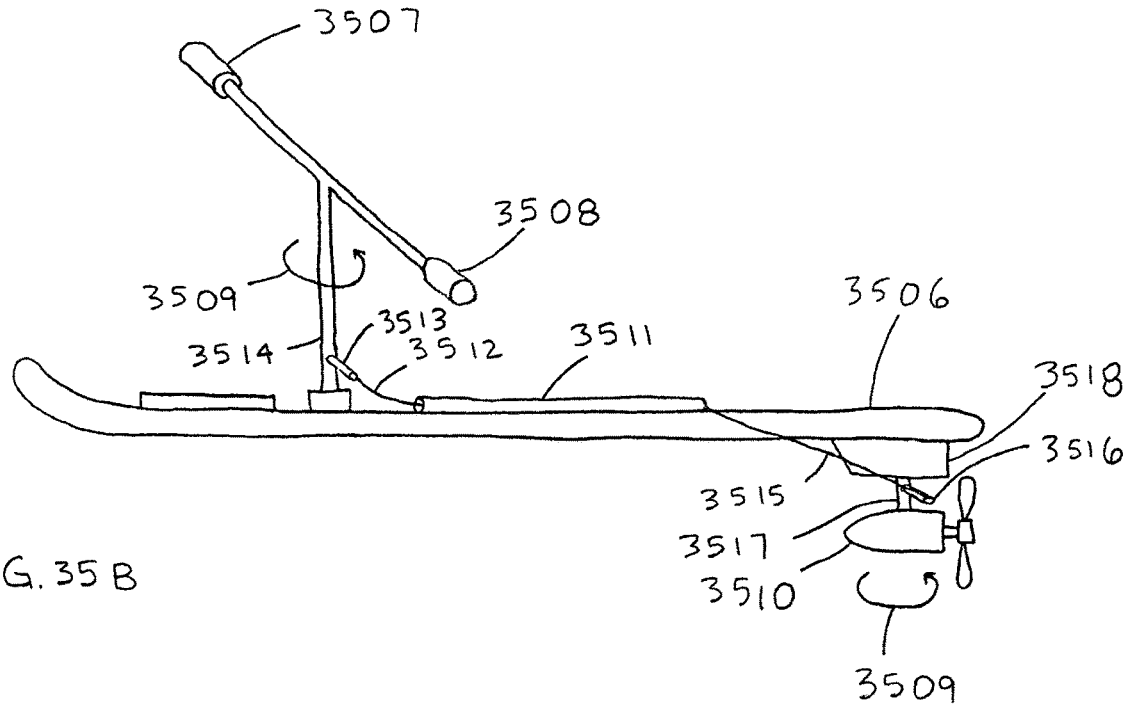

FIG. 35B is a side view of a useful embodiment of another thrust assembly, where a rider of an SUP 3506 can stand, place each hand on handles 3507 and 3508, and steer by turning 3509 an electric motor 3510 connected to the handles 3507 and 3508 using a Bowden cable 3511. One end of the Bowden cable tendon 3512 is attached to a moment arm 3513 on the handle shaft 3514, and the other end of the Bowden cable tendon 3515 is attached to a moment arm 3516 on the electric motor base axle 3517. The handle shaft 3514 may be mounted into the hand-carry slot in the SUP 3506 for easy retrofitting of a stock SUP, and the electric motor base 3518 may be mounted into the fin slot of the SUP 3506, again for easy retrofitting of a stock SUP.

Figure 35C:
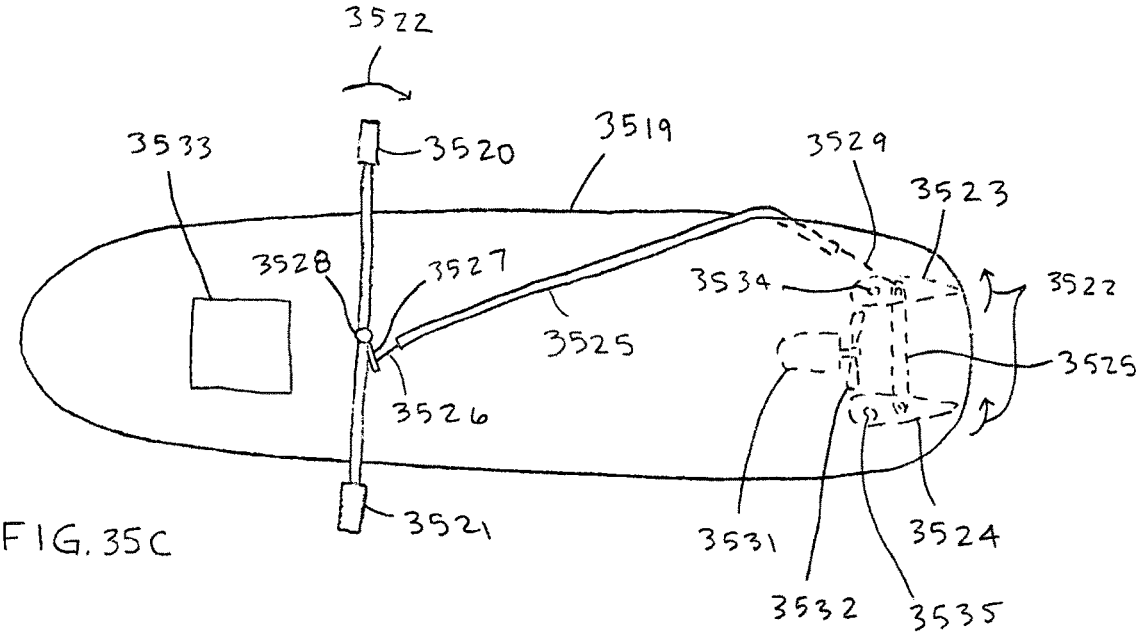
FIG. 35C is a plan view of a useful embodiment of another thrust assembly.

FIG. 35C is a plan view of a useful embodiment of another thrust assembly, where a rider of an SUP 3519 can stand, place each hand on handles 3520 and 3521, and steer by turning 3522 one or more rudders 3523 and 3524 connected to the handles 3520 and 3521 using a Bowden cable 3525. One end of the Bowden cable tendon 3526 is attached to a moment arm 3527 on the handle shaft 3528, and the other end of the Bowden cable tendon 3529 is attached to a first rudder 3523 with axis of rotation 3534. When a second rudder 3524 is used having an axis of rotation 3535, the first rudder 3523 may be mechanically connected to the second rudder 3524 by a tie rod 3530. In this figure, the electric motor 3531 with propeller 3532 is not turned by the handle shaft 3528, but the handles turn the rudders 3523 and 3524 behind the motor propeller 3532. The electric motor 3531 is electrically connected to an electrical battery 3533. The handle 3520 may comprise a throttle to adjust the electrical current to the electric motor 3531.

Figure 35D:
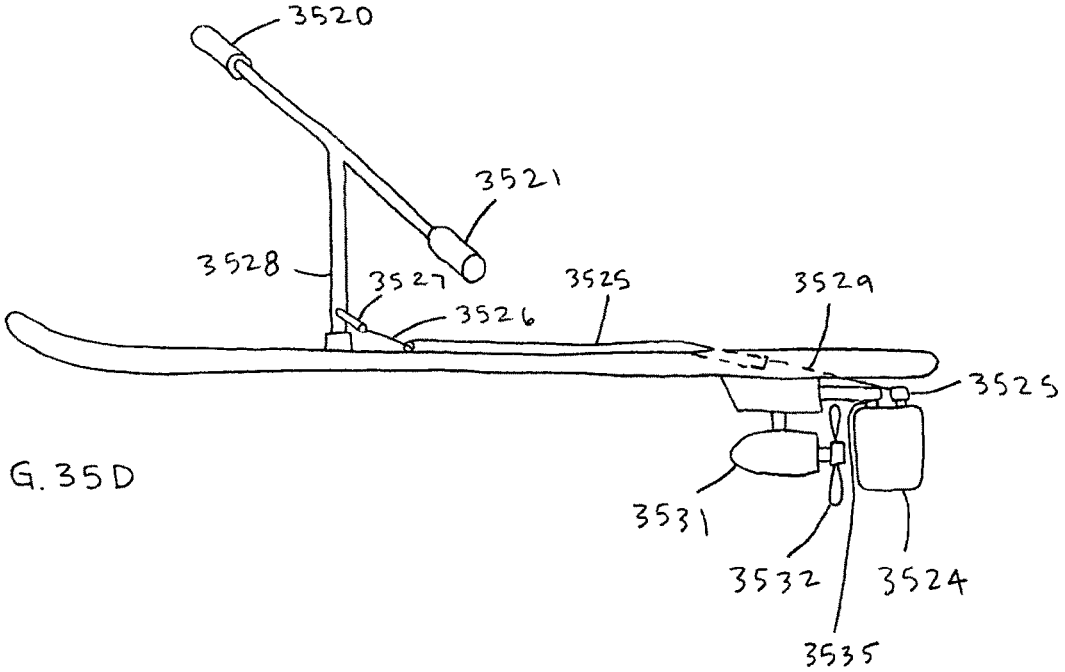
FIG. 35D is a side/perspective view of the useful embodiment of FIG. 35C.

FIG. 35D is a side/perspective view of the useful embodiment of FIG. 35C.

Figure 36A:
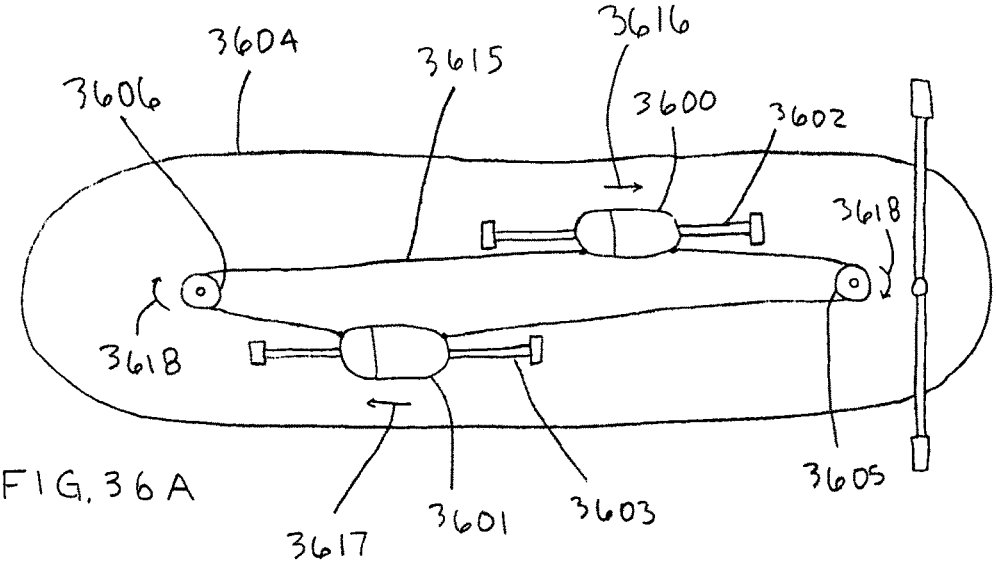
FIG. 36A is a plan view of a useful embodiment of another thrust assembly.

FIG. 36A is a plan view of a useful embodiment of another thrust assembly, where a left foot support 3600 and a right foot support 3601 are guided by linear bearings 3602 and 3603, respectively, on an SUP 3604. The foot supports 3600 and 3601 are connected by a pulley cable 3615 that passes around the pulleys 3605 and 3606 mounted on the SUP 3604 that rotate propellers. The pulley arrangement provides that when the foot support 3600 is moving forward 3616, the pulleys 3605 and 3606 each rotate clockwise 3618, and the foot support 3601 must move backward 3617, and vice versa.

Figure 36B:
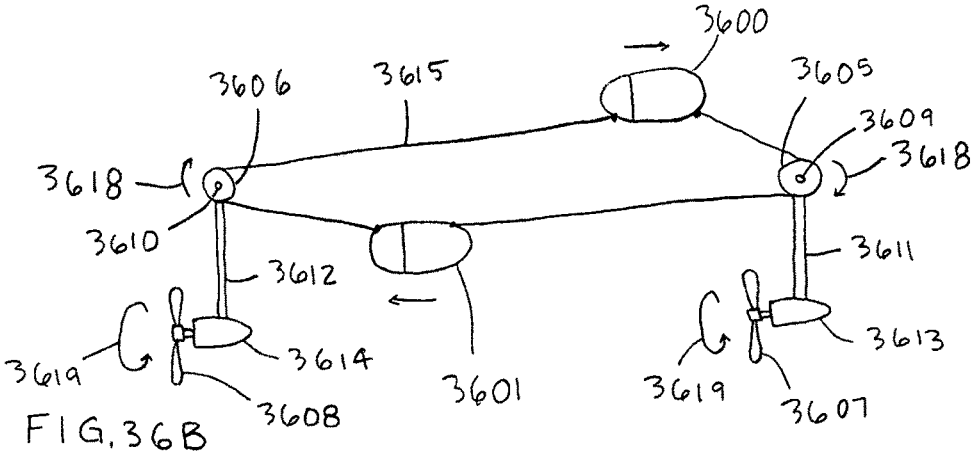
FIG. 36B is a plan/side view of the useful embodiment of FIG. 36A.

FIG. 36B is a plan/side view of the useful embodiment of FIG. 36A providing the pulleys 3605 and 3606 mechanically connected to the propellers 3607 and 3608, respectively. The plan view of the pulleys 3605 and 3606 is provided, and for illustrative purposes, the view of the propellers 3607 and 3608 is a side view, where the axes of rotation 3609 and 3610 of the pulleys 3605 and 3606, respectively, is coaxial with the rotary axles 3611 and 3612, respectively, extending to the motor housings 3613 and 3614, respectively, where the rotary axles 3611 and 3612 cause the propellers 3607 and 3608, respectively, to rotate 3619. Whereas two propellers 3607 and 3608 are shown in these figures, only one propeller is necessary to provide propulsion.

Figure 36C:
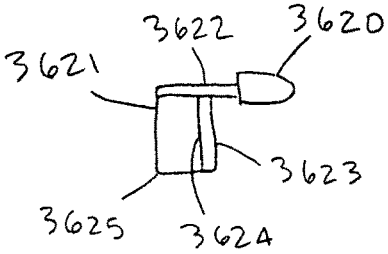
FIGS. 36C-36F are different views of a motor housing with a flexible fin for propulsion.

FIGS. 36C to 36F are different views of a motor housing 3620 with a flexible fin 3621 for propulsion. FIG. 36C is a side view of the motor housing 3620 with the flexible fin 3621. A torsionally stiff axle 3622 extends from the motor housing 3620, such that the flexible fin 3621 is attached to the axle 3622. The flexible fin 3621 comprises a relatively stiff spine 3623 along the edge 3624 nearest the motor housing 3620. Note that if the propellers 3607 and 3608 are rigid, then they must rotate in only one direction to provide forward propulsion, regardless of the direction of rotation of the pulleys 3605 and 3606. In contrast, the flexible fin 3621 of FIGS. 36C to 36F provides forward propulsion regardless of the direction of rotation of its axle 3622. As the axle 3622 rotates, the portion 3625 of the flexible fin 3621 that is farthest from the axle 3622 and from the spine 3623 will flex the most, creating a curved contour 3626 that always pushes water in such a way that provides propulsion with a propulsion vector component 3627 along the direction of the axle 3622.

Figure 36D:
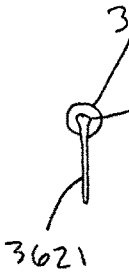
Figure 36E:
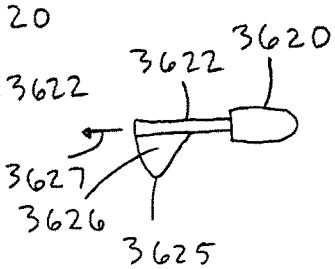
Figure 36F:
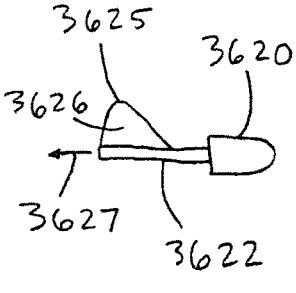

FIG. 36D is an end view of the flexible fin. FIG. 36E is a plan view of the flexible fin 3621 rotating clockwise in FIG. 36D, where the corner 3625 is flexing away from the axle 3622 and spine 3623. Similarly, FIG. 36F is a plan view of the flexible fin 3621 rotating counterclockwise in FIG. 36D.

Figure 37A:
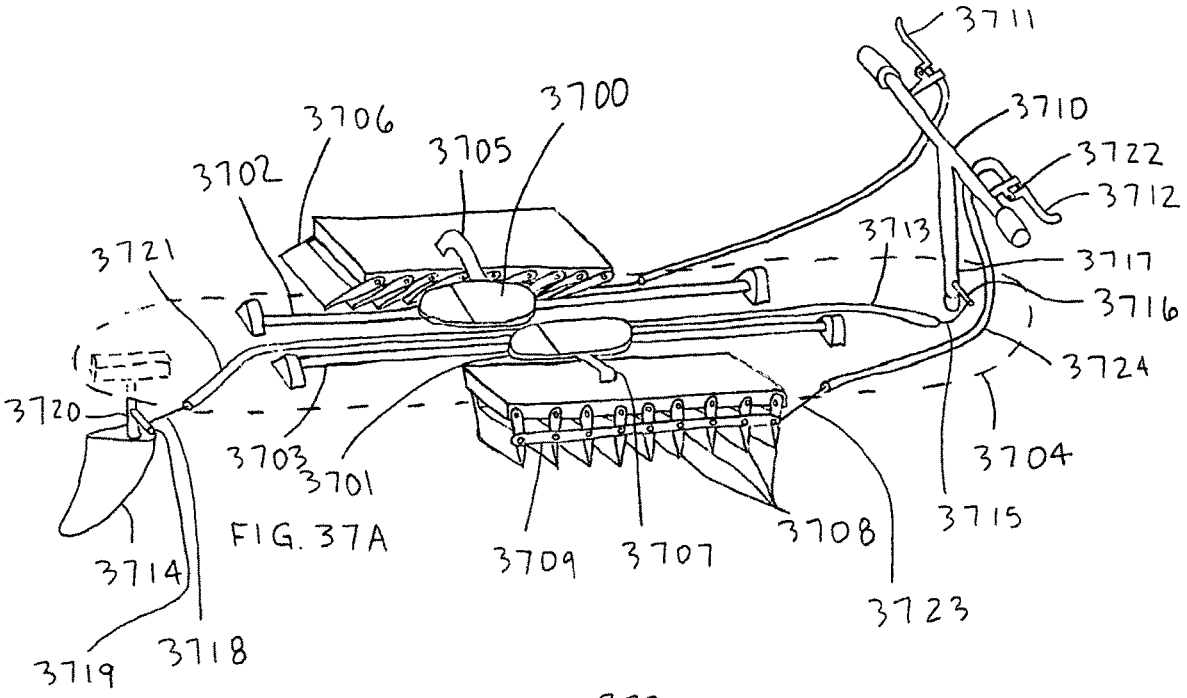
FIG. 37A is a perspective view of a useful embodiment of another thrust assembly, where a left foot support and a right foot support are guided by linear bearings on an SUP.

FIG. 37A is a perspective view of a useful embodiment of another thrust assembly, where a left foot support 3700 and a right foot support 3701 are guided by linear bearings 3702 and 3703, respectively, on an SUP 3704. Each foot support is connected to one or more propulsion fins. In FIG. 36A, the left foot support 3700 is connected 3705 to an array of retracted propulsion fins 3706; and the right foot support 3701 is connected 3707 to an array of extended propulsion fins 3708. When the left foot support 3700 is slid forward by the rider, the propulsion fins 3706 retract to minimize water drag; when the right foot support 3701 is slid rearward by the rider, the propulsion fins 3708 are extended to press against as much water as possible. When multiple propulsion fins are used for a single foot support, the propulsion fins may be connected by a connecting rod 3809 so they all move in unison.

FIG. 37A also shows handlebars 3710 with left 3711 and right 3712 control levers. As shown, the handlebars 3710 use a Bowden cable 3713 to turn the rear rudder 3714 for steering. The one end 3715 of the Bowden cable tendon is connected to a lever arm 3716 on the handlebar shaft 3717, and the other end 3718 of the Bowden cable tendon is connected to a lever arm 3719 on the rudder 3714 or rudder axle 3720. So, when the handlebars are turned, the Bowden cable tendon 3715 translates relative to the Bowden cable sheath 3721 that is attached to the SUP 3704, and transmits rotary motion from the handlebars 3710 to the rudder 3714.

In FIG. 37A, the control levers 3711 and 3712 may be used to control whether the propulsion fins are extended 3708 or retracted 3706. As shown, a Bowden cable 3724 is used, where one end 3722 of the Bowden cable tendon is connected to the right control lever 3712, and the other end 3723 of the Bowden cable tendon is connected to a propulsion fin 3708 or to the connecting rod 3709. So, the position of the control lever controls the position of the propulsion fins. In typical operation, the rider would activate the right control lever 3712 to extend the right propulsion fins 3708 and then slide the right foot support 3701 rearward to generate forward thrust. Simultaneously, the left control lever 3711 would be in the position to retract the left propulsion fins 3707 so the SUP 3704 may glide forward with minimum water resistance. The process is then alternated so the left foot platform provides the thrust. If both control levers 3711 and 3712 are simultaneously used to lower both sets of propulsion fins 3706 and 3708, braking of the SUP 3704 will occur. If only the right control lever 3711 is used to lower the propulsion fins 3708 on the right side, but the right foot support 3701 is not simultaneously slid rearward, braking will occur only on the right side, causing the SUP 3704 to turn to the right, similarly to how a bulldozer turns. The entire apparatus provided by FIG. 37A may be secured to the SUP 3704 using suction, adhesive, screws, etc.

Figure 37B:
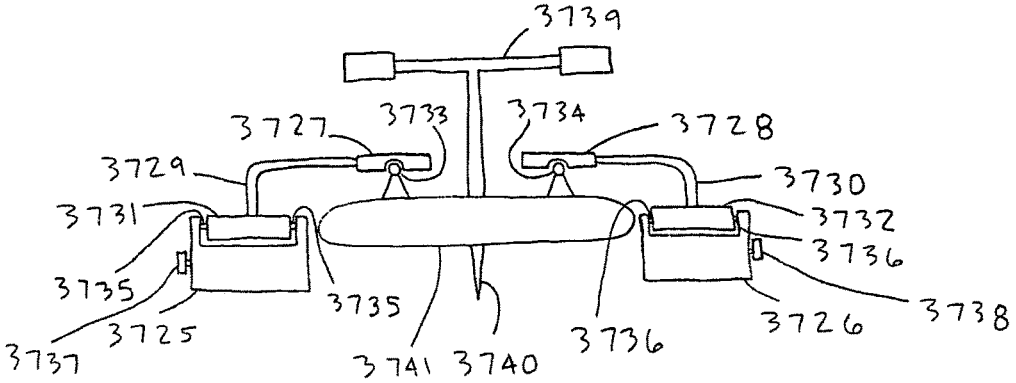
FIG. 37B is an end view of a useful embodiment of another thrust assembly, where the left and right propulsion fins are positioned to the side of the SUP.

FIG. 37B is an end view of a useful embodiment of another thrust assembly, where the left and right propulsion fins 3725 and 3726 are positioned to the side of the SUP 3741 and to the sides of the left and right foot supports 3727 and 3728, respectively. The left and right foot supports 3727 and 3728 are connected by left and right connectors 3729 and 3730 to the left and right propulsion fins structures 3731 and 3732 that comprise the left and right propulsion fins 3725 and 3726, respectively. The left and right foot supports 3727 and 3728 are shown in this figure to be supported by left and right linear guides 3733 and 3734, respectively. The propulsion fins 3725 and 3726 are rotationally connected by axles 3735 and 3736 to the propulsion fin structures 3731 and 3732, respectively. Left and right connecting rods 3737 and 3738 connect sets of left and right propulsion fins 3725 and 3726. Also shown are handlebars 3739 and a rudder 3740.

Figure 37C:
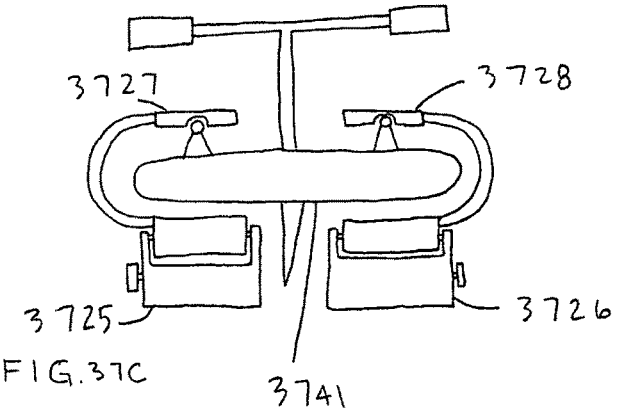
FIG. 37C is an end view of an alternate to the useful embodiment of FIG. 37B, where the left and right propulsion fins are positioned underneath the SUP.

FIG. 37C is an end view of an alternate to the useful embodiment of FIG. 37B, where the left and right propulsion fins 3725 and 3726 are positioned underneath the SUP 3741 and underneath the left and right foot supports 3727 and 3728, respectively.

Figure 37D:
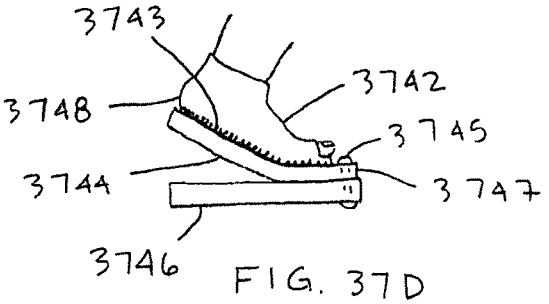
FIGS. 37D-37E are side views of useful embodiments of a foot support.

FIG. 37D is a side view of a useful embodiment of a foot support, where a flexible foot holder 3742, such as a neoprene boot, is fastened using Velcro 3743 to a flexible layer 3744 that is fastened by a snap 3745 to a rigid foot support 3746 that may be connected to a component of an SUP. The Velcro 3743 provides one manner to disconnect the foot holder 3742 from the rigid foot support 3746, and the snap 3745 provides another manner. The snap 3745 placed near the toe end 3747 of the flexible layer 3744 also insures that only the front portion of the flexible layer 3744 is attached to the rigid foot support 3746. This allows the rider to lift their heel 3748 as desired, such as occurs with a Nordic snow ski binding, yet still provides a secure tangential connection.

Figure 37E:
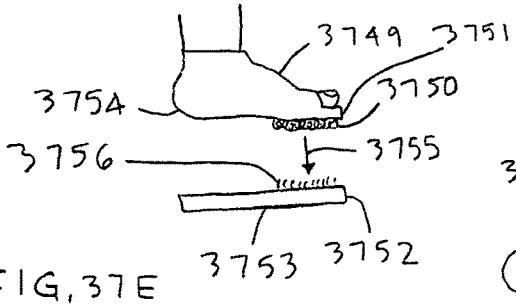

FIG. 37E is a side view of a useful embodiment of a foot support, where a flexible foot holder 3749, such as a neoprene boot, is fastened 3755 using cotton Velcro 3750 near the toe portion 3751 of the foot holder 3749, and hook Velcro 3756 also near the front portion 3752 of a rigid foot support 3753 that may be connected to a component of an SUP. The cotton Velcro 3750 placed near the toe end 3751 of the flexible foot holder 3749 allows the rider to lift their heel 3754 as desired, such as occurs with a Nordic snow ski binding, yet still provides a secure tangential connection, but with removable with a quick release.

Figure 37F:
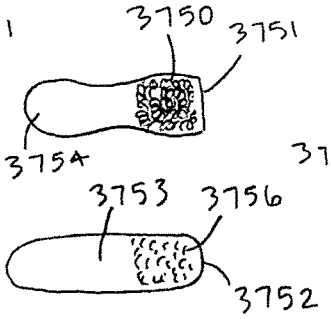
FIG. 37F is a plan view of the useful embodiment of the foot support of FIG. 37E.

FIG. 37F is a plan view of the useful embodiment of the foot support of FIG. 37E.

Figure 37G:
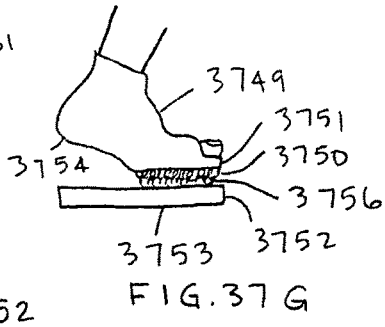
FIG. 37G is a side view of the useful embodiment of the foot support of FIG. 37E.

FIG. 37G is a side view of the useful embodiment of the foot support of FIG. 37E where the cotton Velcro 3750 is fastened to the hook Velcro 3756 while still allowing the heel 3754 to be lifted.

Figure 37H:
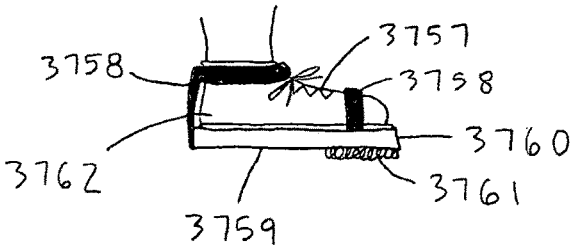
FIG. 37H is a side view of a useful embodiment of a foot support.

FIG. 37H is a side view of a useful embodiment of a foot support, where a shoe 3757, such as a workout shoe, is strapped using straps 3758 to a foot support flexible layer 3759 comprising Velcro near the toe region 3760, such as cotton Velcro 3761. The cotton Velcro 3761 is for fastening to hook Velcro also near the front portion of a rigid foot support that may be connected to a component of an SUP. The cotton Velcro 3761 placed near the toe end 3760 of the flexible foot support flexible layer 3759 allows the rider to lift their heel 3762 as desired, such as occurs with a Nordic snow ski binding, yet still provides a secure tangential connection, but with removable with a quick release.

Figure 38A:
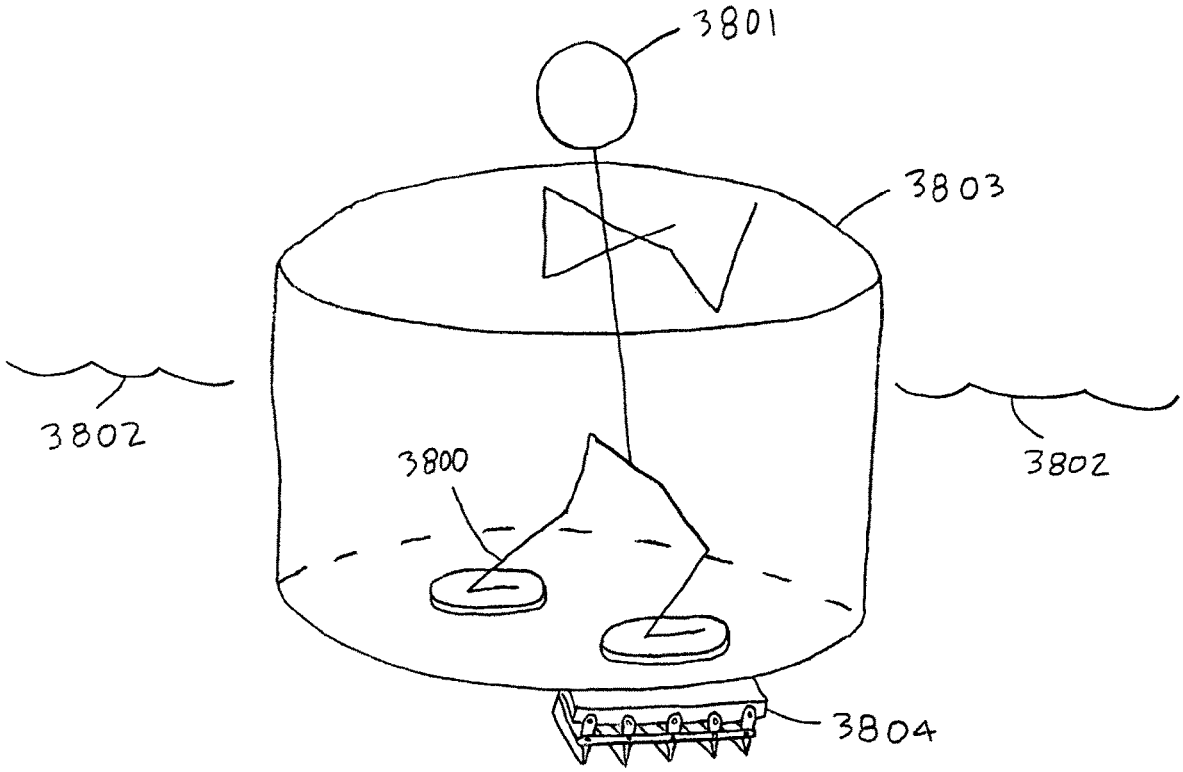
FIG. 38A is a perspective view of a useful embodiment of another thrust assembly, where a portion of the rider is positioned below the water level.

FIG. 38A is a perspective view of a useful embodiment of another thrust assembly, where a portion 3800 of the rider 3801 is positioned below the water level 3802, but the rider 3801 remains substantially dry inside a container 3803, where the container is largely below the water surface 3802. The embodiment provides a submarine-ish vehicle that is largely submerged, but keeps the rider's head above the waterline. The rider may stand on a surface to propel. The rider 3801 may use any of the thrust assemblies disclosed, such as the thrust assembly 3804, or an alternate thrust assembly.

Figure 38B:
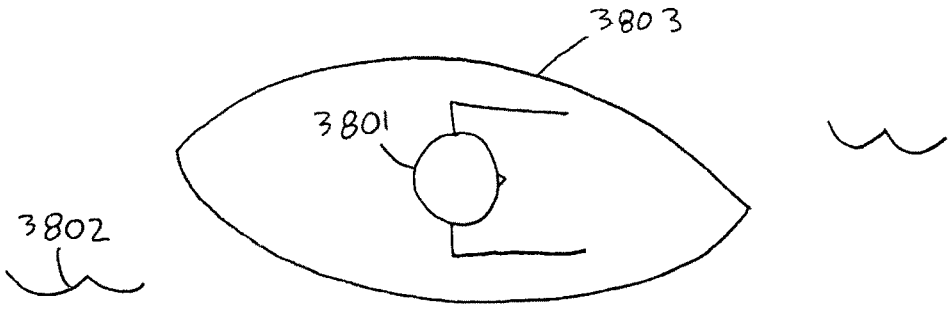
FIG. 38B is a plan view of the useful embodiment of FIG. 38A.

FIG. 38B is a plan view of the useful embodiment of FIG. 38A.

Figure 39A:
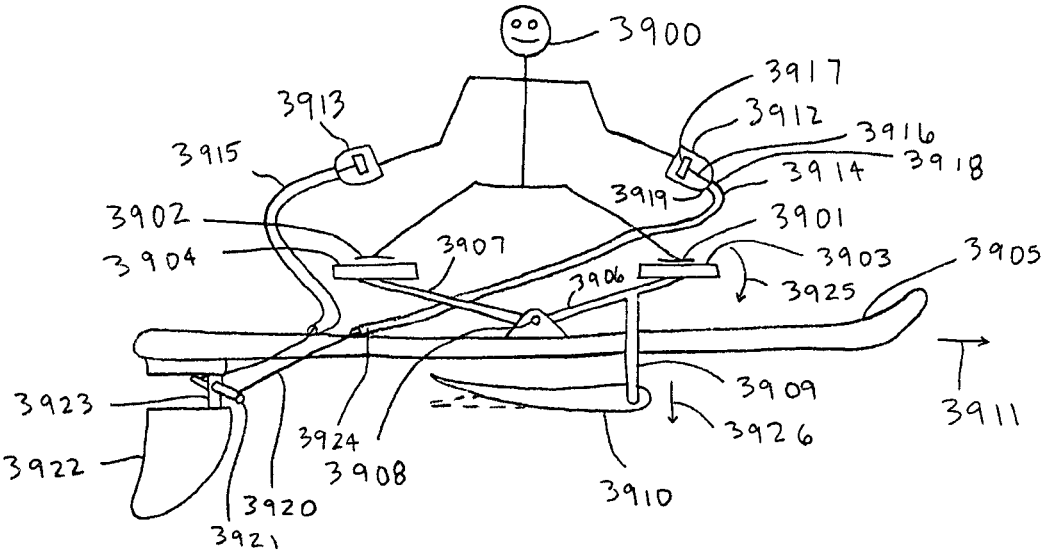
FIGS. 39A-39B are side views of useful embodiments of other thrust assemblies, where the rider faces to the side of the SUP.

FIG. 39A is a side view of a useful embodiment of another thrust assembly, where the rider 3900 places their left 3901 and right feet 3902 on the left 3903 and right 3904 foot supports and faces to the side of the SUP 3905, like a snowboarder stands on a snowboard. The left 3903 and right 3904 foot supports are connected together by left 3906 and right 3907 rocker arms that rotate together around a rotary bearing 3908. One of the rocker arms, such as the left rocker arm 3906 is connected by a push rod 3909 to a flexible flipper 3910. The flexible flipper 3910 typically does not rotate relative to the push rod 3909, but the flexible flipper 3910 flexes. When the rider 3900 pushes down 3925 with their left foot 3901 on the left foot support 3903, the push rod 3909 lowers 3926 the flexible flipper 3910 and generates thrust to propel the SUP 3905 to the right 3911. Similarly, when the rider 3900 pushes down with their right foot 3902 on the right foot support 3904, the push rod 3909 raises the flexible flipper 3910, and again generates thrust to propel the SUP 3905 to the right 3911. Accordingly, thrust is achieved through by the rider rocking from one foot to the other. Typically, when the left foot support 3903 is all the way up (i.e., the right foot support 3904 is all the way down), the flexible flipper 3910 can lie flush with the bottom of the SUP 3905. The rocker arms 3906 and 3907 may also be connected to a Mirage Drive.

Steering may be accomplished using hand-held controllers. In FIG. 39A, the left 3912 and right 3913 hand-held controllers comprise left 3914 and right 3915 Bowden cables, respectively. For the left hand-held controller 3912, one end 3916 of the tendon is attached to a movable gripper 3917, and the associated end of the sheath 3918 is attached to a stationary gripper 3919. When the rider closes their grip, the movable gripper 3917 is pulled away from the sheath 3918 and translates the tendon 3916. The other end 3920 of the tendon is attached to a lever arm 3921 attached to a rudder 3922 or rudder axle 3923, and the associated end of the sheath 3924 is attached to the SUP 3905. Accordingly, when the rider closes their grip, the rudder 3922 is turned. The right hand-held controller 3913 operates similarly to turn the rudder 3922 the other way. If either of the hand-held controllers turns the rudder 90 degrees, the SUP 3905 will brake.

Figure 39B:
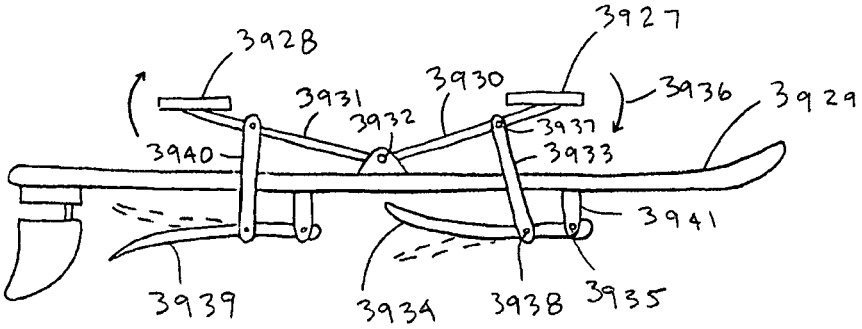

FIG. 39B is a side view of a useful embodiment of another thrust assembly, where the rider places their left and right feet on the left 3927 and right 3928 foot supports and faces to the side of the SUP 3929, like a snowboarder stands on a snowboard. The left 3927 and right 3928 foot supports are connected together by left 3930 and right 3931 rocker arms that rotate together around a rotary bearing 3932. The left rocker arm 3930 is connected by a push rod 3933 to a flexible flipper 3934. The flexible flipper 3934 may rotate relative to the SUP 3929 via a rotary pinned joint 3935 connected to a flipper support structure 3941 attached to the SUP 3929. The push rod 3933 has a pinned end 3937 to the left rocker arm 3930, and a pinned end 3938 to the flexible flipper 3934. When the rider pushes down 3936 with their left foot on the left foot support 3927, the push rod 3933 rotates the flexible flipper 3934 downward and generates thrust to propel the SUP 3929 to the right. Similarly, when the rider pushes down with their right foot on the right foot support 3928, the push rod 3933 rotates the flexible flipper 3934 upward, and again generates thrust to propel the SUP 3929 to the right. There may be a second flexible flipper 3939 that is connected to the right foot support 3928 by a right push rod 3940, where this second flexible flipper 3939 rotates upward when the first flexible flipper 3934 rotates downward, and vice versa. Accordingly, thrust is achieved through by the rider rocking from one foot to the other. The rocker arms 3930 and 3931 may also be connected to a Mirage Drive.

Figure 39C:
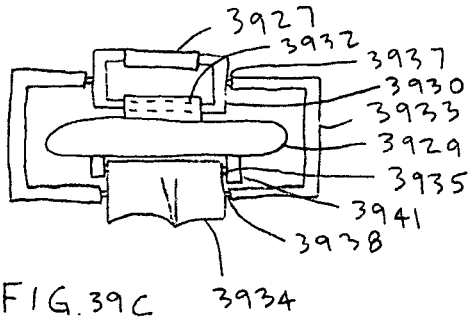
FIG. 39C is an end view of the useful embodiment of FIG. 39B.

FIG. 39C is an end view of the useful embodiment of FIG. 39B, where the push rods, such as the push rod 3933, extend around to the side of the SUP 3929 to reach the flexible flippers, such as flexible flipper 3934, which is beneath the SUP 3929.

Figure 39D:
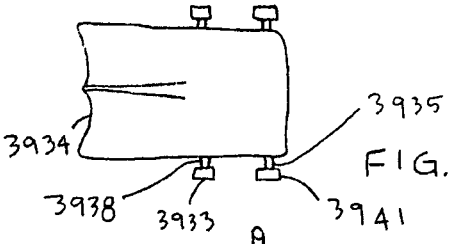
FIG. 39D is a plan view of the flexible flipper of the useful embodiment of FIG. 39B.
Figure 39E:
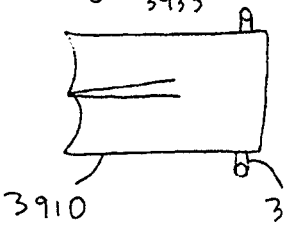
FIG. 39E is a plan view of the flexible flipper of the useful embodiment of FIG. 39A.

FIG. 39D is a plan view of the flexible flipper of the useful embodiment of FIG. 39B, and FIG. 39E is a plan view of the flexible flipper of the useful embodiment of FIG. 39A.

Figure 39F:
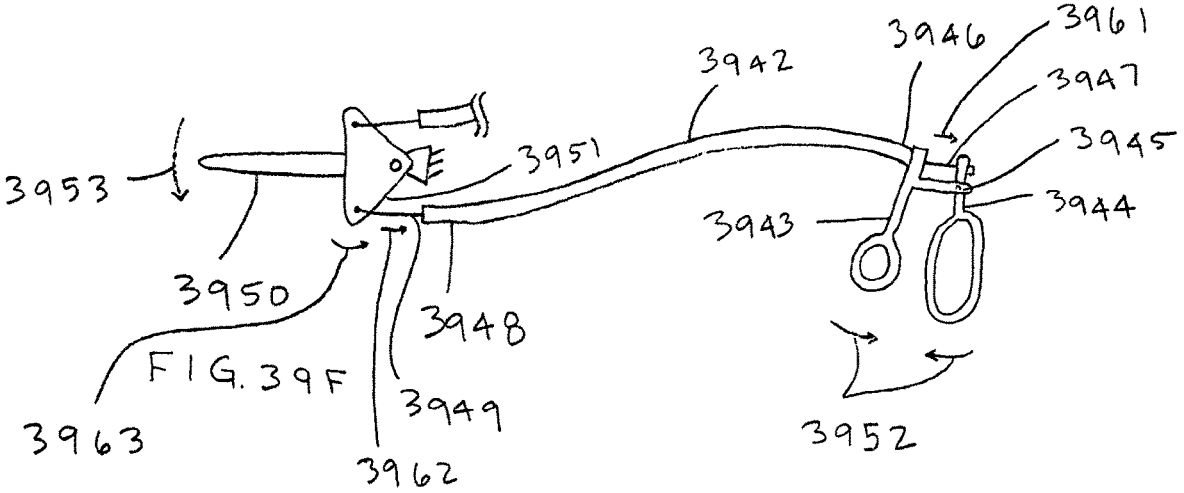
FIGS. 39F-39G are plan views of useful embodiments of the turning structure of FIG. 39A that use a Bowden cable.

FIG. 39F is a plan view of a useful embodiment of the turning structure of FIG. 39A that uses a Bowden cable 3942. A hand-held controller comprises a thumb lever 3943 and a finger lever 3944 that rotate relative to each other by a rotary joint 3945. The thumb lever 3943 supports one end of the sheath 3946 of the Bowden cable 3942, and the finger lever 3944 supports one end 3947 of the tendon of the Bowden cable 3942. Alternately, the sheath 3946 may be supported by the finger lever 3944, and tendon 3947 may be supported by the thumb lever 3943. When the rider squeezes 3952 the thumb lever 3943 toward the finger lever 3944, the tendon 3947 is translated 3961 relative to the sheath 3946. The other end 3948 of the sheath is connected to the SUP, and the associated end 3949 of the tendon is attached to the rudder 3950 or to a lever arm 3951 attached to the rudder. So, when the rider squeezes 3952 their thumb toward their fingers, the end 3949 of the tendon is translated 3962 which rotates 3963 the lever arm 3951 and the rudder 3950 to one side 3953, causing the SUP to turn.

Figure 39G:
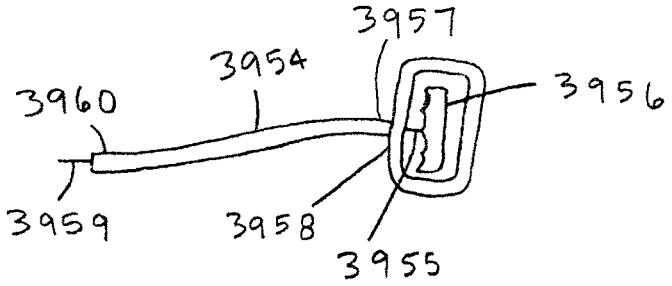

FIG. 39G is a plan view of a useful embodiment of the turning structure of FIG. 39A that uses a Bowden cable 3954. One end 3955 of the tendon is attached to a movable gripper 3956, and the associated end of the sheath 3957 is attached to a stationary gripper 3958. When the rider closes their grip, the movable gripper 3956 is pulled away from the sheath 3957 and translates the tendon 3955. The other end 3959 of the tendon is typically attached to a lever arm attached to a rudder or to the rudder axle, and the associated end of the sheath 3960 is attached to the SUP. Accordingly, when the rider closes their grip, the rudder is turned.

Figure 39H:
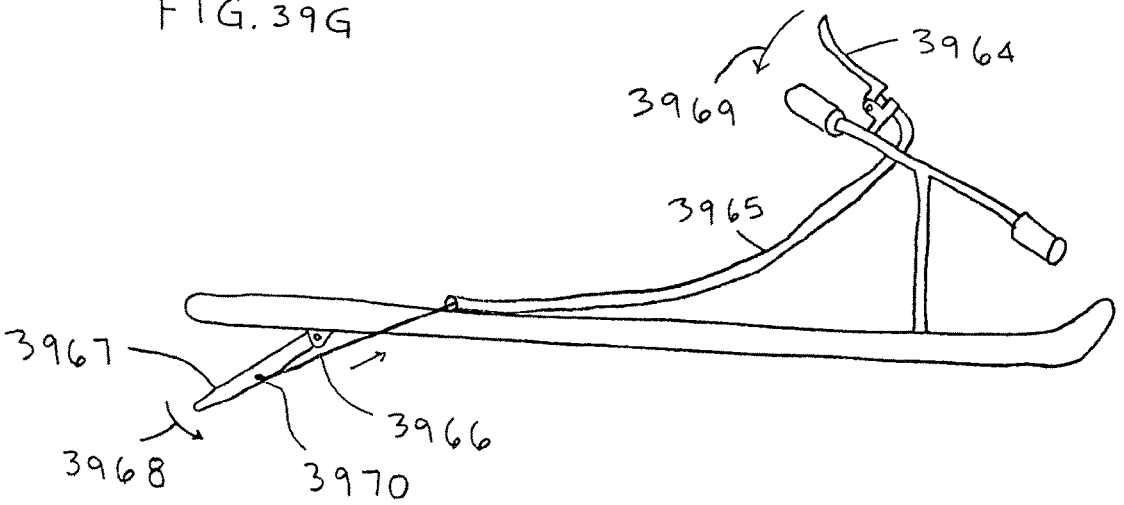
FIG. 39H is a combination side/perspective view of a useful braking embodiment comprising a brake lever and a Bowden cable.

FIG. 39H is a combination side/perspective view of a useful braking embodiment comprising a brake lever 3964 and a Bowden cable 3965. When the brake lever 3964 is squeezed 3969, the tendon 3966 that is attached 3970 to the braking fin 3967 causes the braking fin 3967 to rotate 3968 to an orientation presenting more surface area to the direction of travel, and hence providing more resistance to motion and producing braking.

Figure 39I:
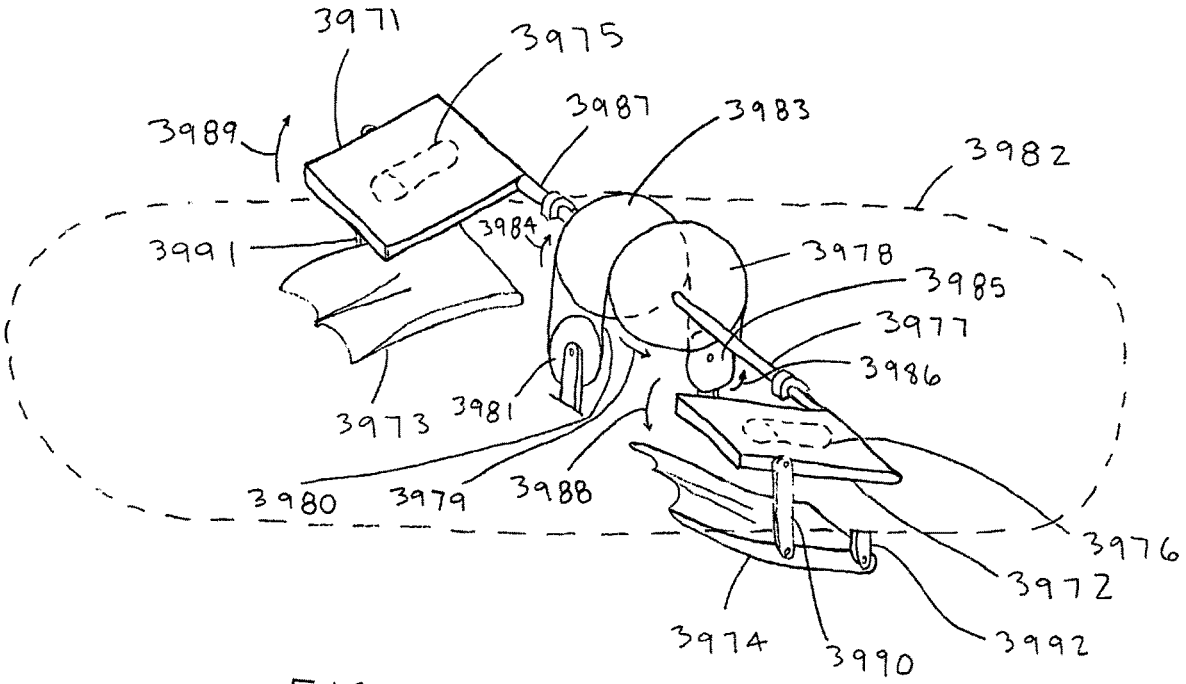
FIG. 39I is a perspective view of a useful embodiment of another thrust assembly, where the left and right foot supports are constrained by a constraint assembly to rotate in opposite directions.

FIG. 39I is a perspective view of a useful embodiment of another thrust assembly, where the left 3971 and right 3972 foot supports are constrained by a constraint assembly to rotate in opposite directions. Each foot support 3971 and 3972 is shown controlling the movement of a separate flexible flipper 3973 and 3974, respectively; although, only one flexible flipper is necessary. The left 3971 and right 3972 foot supports are positioned above the SUP 3982, and the flexible flippers 3973 and 3974 are positioned in the water. The dashed shoe outlines 3975 and 3976 are intended to indicate where the rider typically places their feet. When the rider presses down 3988 with their foot on the right foot support 3972, the right axle 3977 rotates the right pulley 3978 counterclockwise 3979. The pulley cable 3980 that passes around the right pulley 3978 rotates the rear pulley 3981 clockwise, and rotates the left pulley 3983 clockwise 3984, and rotates the front pulley 3985 counterclockwise 3986. Since the left foot support 3971 is connected to the left pulley 3983 by the left axle 3987, the right foot support 3972 can only be rotated down 3988 if the left foot support 3971 is rotated up 3989. The right push rod 3990 connects the right foot support 3972 to the right flexible flipper 3974. Accordingly, when the right foot support 3972 is rotated down 3988, the right flexible flipper 3974 is pushed down and provides thrust toward the right in the figure. Similarly, the left foot support 3971 may be connected to a left flexible flipper 3973 by a left push rod 3991. Note that although FIG. 39I shows a structure similar to FIG. 39B where the right flexible flipper 3974 pivots around the flipper support structure 3992 attached to the SUP 3982, the right push rod 3990 may operate similarly to the push rod 3909 of FIG. 39A and FIG. 39E, where the right flexible flipper 3974 does not rotate relative to the right push rod 3990, but the flexible flipper 3974 flexes to provide thrust.

In general, the thrust assemblies, steering, and braking apparatuses provided may be positioned on a standard SUP, such as to the hand-carry hole, and locked in place. Adhesive or suction may be used for mounting. Push rods may go around the side of a standard SUP, or can go through the SUP. A Bowden cable may use a Teflon sheath with a Dacron tendon.

Figure 40A:
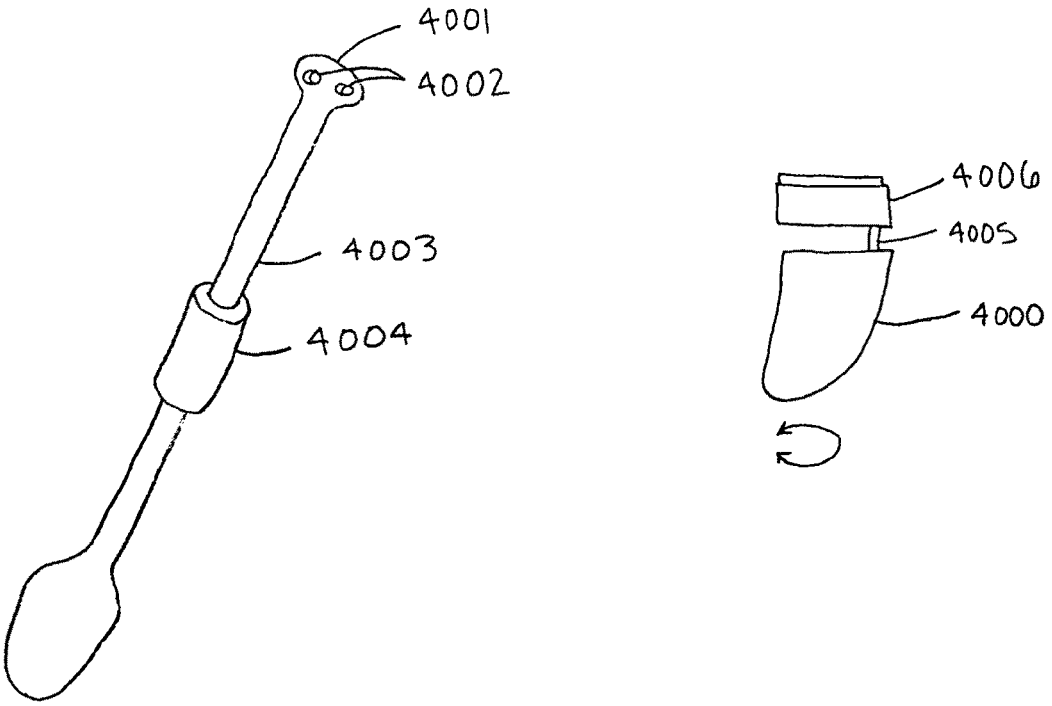
FIG. 40A is a side view of a useful embodiment for wirelessly controlling a rudder of an SUP.

FIG. 40A is a side view of a useful embodiment for wirelessly controlling a rudder 4000 of an SUP. One end of an SUP paddle 4001 may have control buttons 4002 and a wireless transmitter, and the shaft 4003 of the SUP paddle may have a handle 4004 that rotates around the SUP paddle, where the angle of rotation is detected and wirelessly transmitted to the rudder 4000. The rudder 4000 may rotate about an axis 4005 relative to an SUP mount 4006.

Figure 40B:
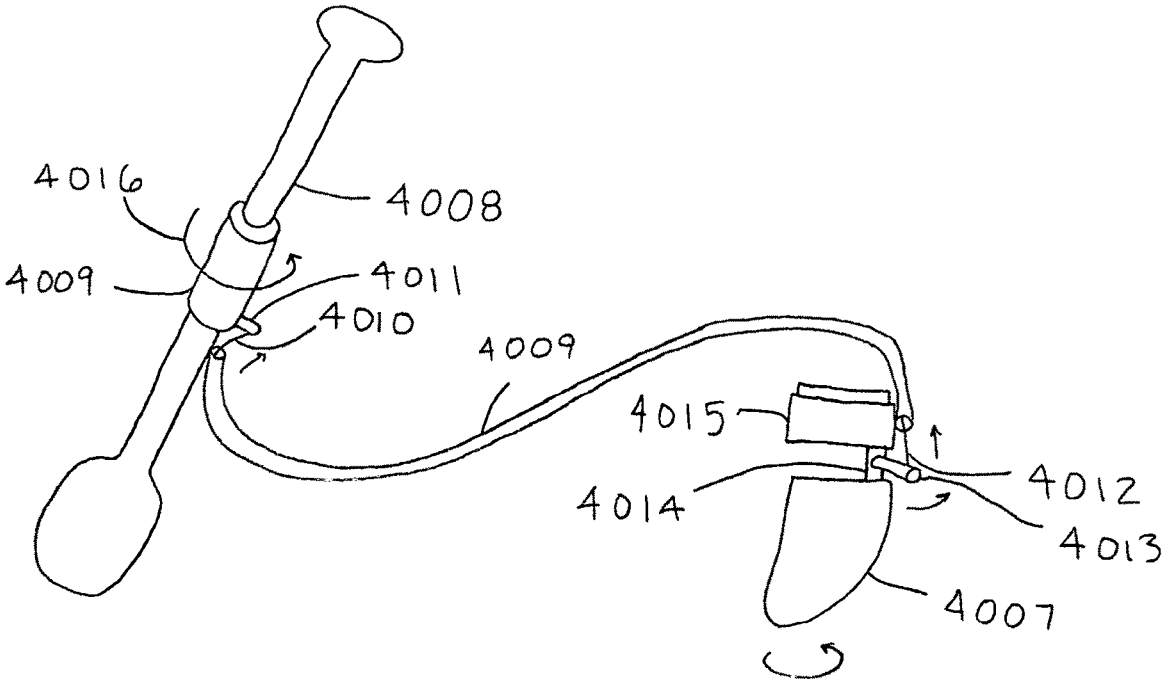
FIG. 40B is a side view of a useful embodiment for remotely mechanically controlling a rudder of an SUP.

FIG. 40B is a side view of a useful embodiment for remotely mechanically controlling a rudder 4007 of an SUP. The shaft 4008 of the SUP paddle has a handle 4009 that rotates 4016 around the SUP paddle, where the angle of rotation is mechanically transmitted to the rudder 4007 by a Bowden cable tendon-sheath assembly 4009. One end 4010 of the Bowden cable tendon is connected to the lever arm 4011 on the SUP paddle, and the other end 4012 of the tendon is connected to the lever arm 4013 attached to the axel 4014 of the rudder 4007. When the handle 4009 rotates 4016 relative to the SUP paddle shaft 4008, the rudder 4007 rotates about the axel 4014 relative to an SUP mount 4015 that may be inserted into the rudder slot in the SUP.

Figure 41A:
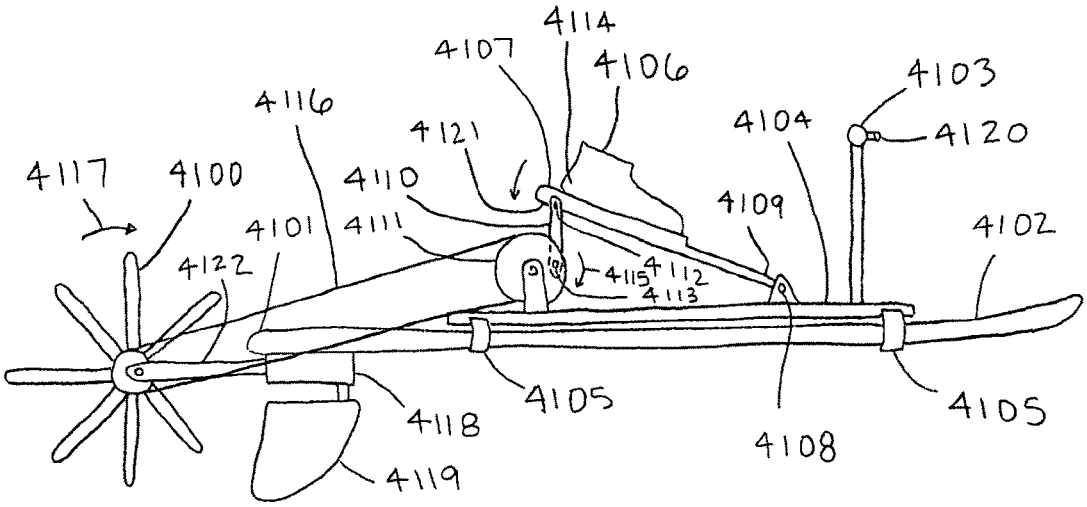
FIGS. 41A-41B are side views of useful embodiments of other thrust assemblies, where thrust is provided by a paddle wheel which may be located to the rear or side of an SUP.

FIG. 41A is a side view of a useful embodiment of another thrust assembly, where thrust is provided by a paddle wheel 4100 which may be located to the rear 4101 or side of an SUP 4102. Components for generating thrust, as well as handles 4103 for steering and brake levers 4120 for braking, may be fastened to a surface 4104 that is then fastened to an existing SUP 4102, such as by straps 4105 or screws. A boot 4106 is shown to illustrate where a rider's foot is typically placed on a foot support 4107. The foot support 4107 can pivot relative to the SUP 4102 around a pivot 4108 near the front portion 4109 of the foot support 4107. A push rod 4110 connects the rear portion 4121 of the foot support 4107 to a drive wheel 4111 with pinned pivot joints 4112 and 4113, such that when the rider presses down with their heel 4114, the drive wheel 4111 rotates clockwise 4115, like a piston rotates a crankshaft. Similar to a bicycle with pedals, typically there is one foot support for each foot, and each foot support with its own push rod, and the foot supports are connected to opposite ends of the drive wheel 4111, like pedals are connected to opposite ends of a drive sprocket on a bicycle. As the rider alternately applies their weight to one foot support 4107, and then to the other foot support, the drive wheel 4111 turns. Again, similar to a bicycle, the drive wheel 4111 is connected to the paddle wheel 4100 by a flexible loop 4116, such as a chain or pulley belt, such that when the drive wheel 4111 is turned, it causes the paddle wheel 4100 to turn 4117. The paddle wheel 4100 may be connected by a connecting member 4122 to the rudder housing 4118, that also holds the rudder 4119, and that is connected to the standard rudder slot on the bottom rear portion of the SUP 4102.

Figure 41B:
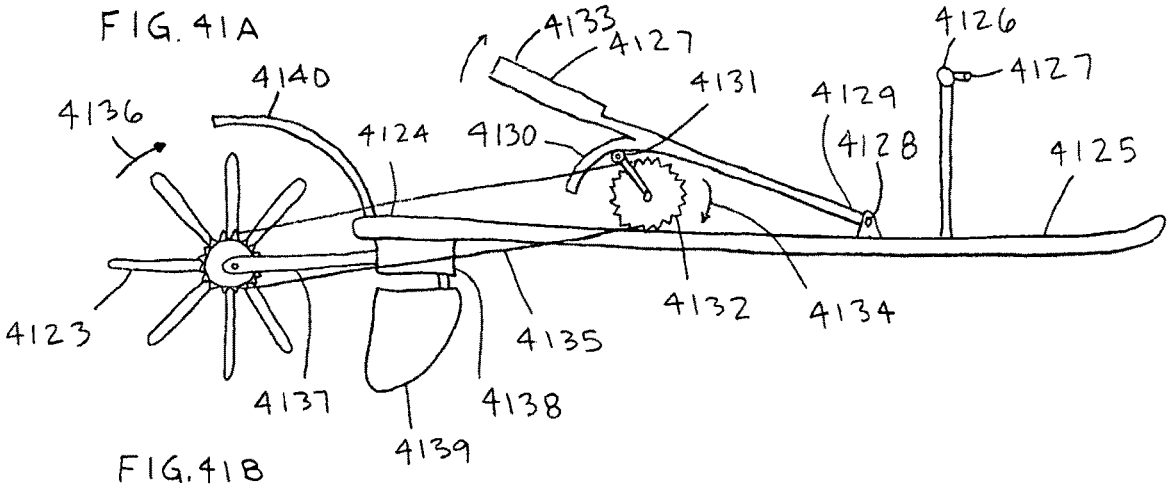

FIG. 41B is a side view of a useful embodiment of another thrust assembly, where thrust is provided by a paddle wheel 4123 which may be located to the rear 4124 or side of an SUP 4125. Also shown are components for generating thrust, as well as handles 4126 for steering and brake levers 4127 for braking, fastened to an existing SUP 4125. The foot support 4127 can pivot relative to the SUP 4125 around a pivot 4128 near the front portion 4129 of the foot support 4127. A curved member 4130 attached to the foot support 4127 guides a roller bearing 4131, which is attached to a drive wheel 4132, in a circular trajectory. When the rider presses down with their heel 4133, the drive wheel 4132 rotates clockwise 4134. Similar to a bicycle with pedals, typically there is one foot support for each foot, and each foot support with its own curved member guiding a roller bearing, and the roller bearings are connected to opposite ends of the drive wheel 4132, like pedals are connected to opposite ends of a drive sprocket on a bicycle. As the rider alternately applies their weight to one foot support 4127, and then to the other foot support, the guide members alternately apply downward force to the roller bearings on opposite ends of the drive wheel 4132, causing the drive wheel 4132 to turn 4134. Again, similar to a bicycle, the drive wheel 4132 is connected to the paddle wheel 4123 by a flexible loop 4135, such as a chain or pulley belt, such that when the drive wheel 4132 is turned, it causes the paddle wheel 4123 to turn 4136. The paddle wheel 4123 may be connected by a connecting member 4137 to the rudder housing 4138, that also holds the rudder 4139, and that is connected to the standard rudder slot on the bottom rear portion of the SUP 4125. The paddle wheel 4123 may be partially covered by a fender 4140 to prevent water from splashing onto the SUP 4125 or the rider.

Figure 41C:
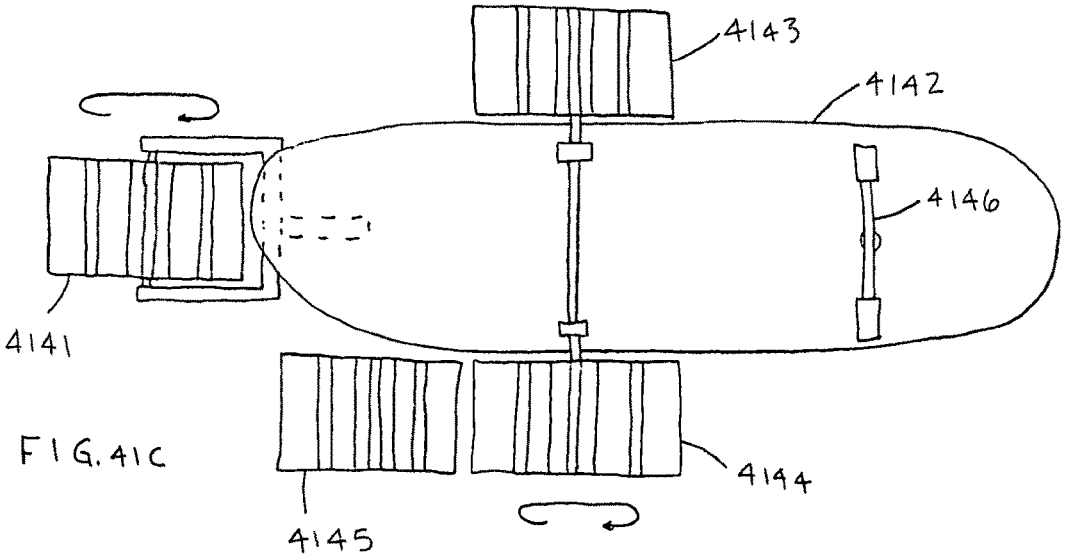
FIG. 41C is a plan view of a useful embodiment of a thrust assembly comprising one or more paddle wheels for providing thrust.

FIG. 41C is a plan view of a useful embodiment of a thrust assembly comprising one or more paddle wheels for providing thrust, where the paddle wheels may be located to the rear 4141 of an SUP 4142, to the left side 4143, to the right side 4144, or to the side and set back 4145. Various paddle wheel locations for generating thrust, as well as handles 4146 for steering, are provided.

Figure 42A:
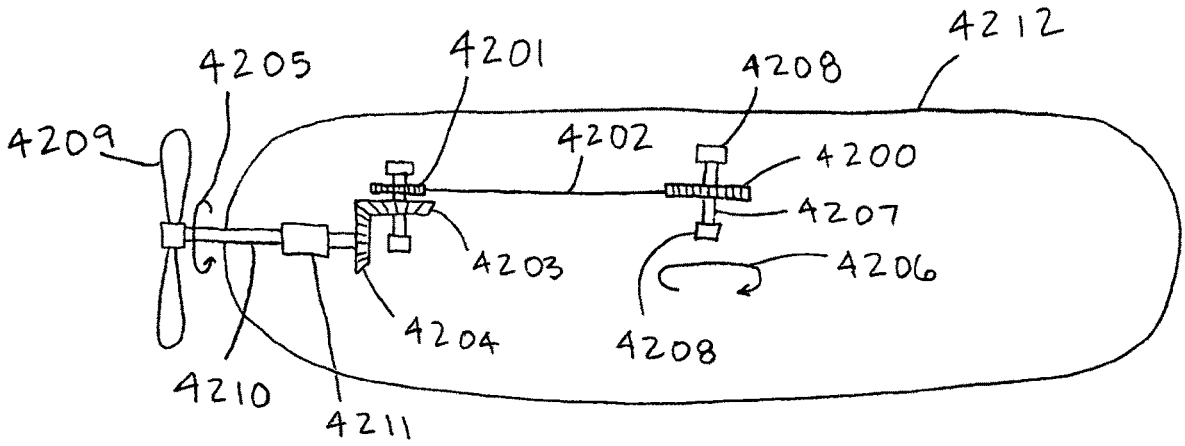
FIG. 42A is a side view of a useful embodiment of another thrust assembly, where a drive sprocket is connected to a rear sprocket.

FIG. 42A is a side view of a useful embodiment of another thrust assembly, where a drive sprocket 4200 is connected to a rear sprocket 4201 by a chain 4202 or cable, and the rear sprocket 4201 uses right-angle gears 4203 and 4204 to rotate 4205 a propeller 4209 to provide thrust. The drive sprocket 4200 may be rotated 4206 by the rider of an SUP 4212 using foot supports such as are described in detail in other figures. The drive sprocket 4200 may have an axle 4207 with bearings 4208, and the propeller 4209 may have a propeller shaft 4210 with a bearing 4211.

Figure 42B:
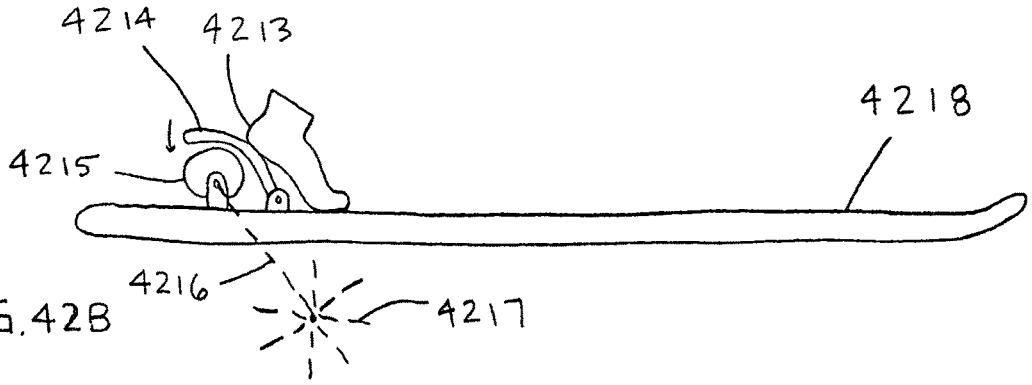
FIG. 42B is a side view of a useful embodiment of a braking assembly, where the heel of a rider pushes on a pad that rubs on a rotating element.

FIG. 42B is a side view of a useful embodiment of a braking assembly, where the heel 4213 of a rider pushes on a pad 4214 that rubs on a rotating element 4215 that is attached 4216 to one or more paddle wheels 4217. As the rider applies more of their weight to the pad 4214, the pad exerts more friction to the rotating element 4215 to restrict it from turning, and thus restricting the attached paddle wheels 4217 from turning, which provides braking for a moving SUP 4218.

Figure 42C:
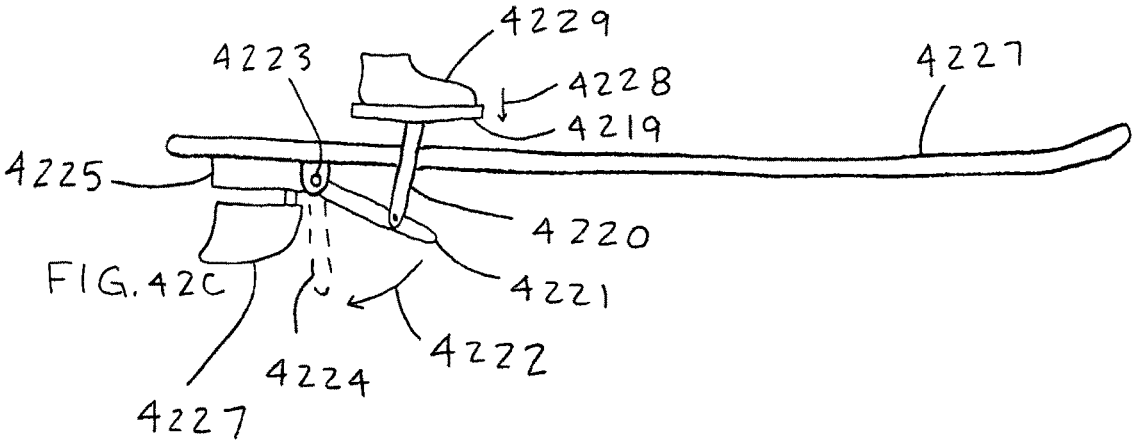
FIG. 42C is a side view of a useful embodiment of another braking assembly, where the rider presses down their foot on a foot support connected by a brake rod to a brake fin.

FIG. 42C is a side view of a useful embodiment of another braking assembly, where when the rider presses down 4228 their foot 4229 on a foot support 4219 connected by a brake rod 4220 to a brake fin 4221, causing the brake fin 4221 to rotate 4222 about a pivot 4223 to a lower position 4224 to increase drag force to provide braking. The brake fin 4221 may be attached to a rudder housing 4225 that is attached to the rudder slot on the SUP 4226, and that is also attached to the rudder 4227.

Figure 43A:
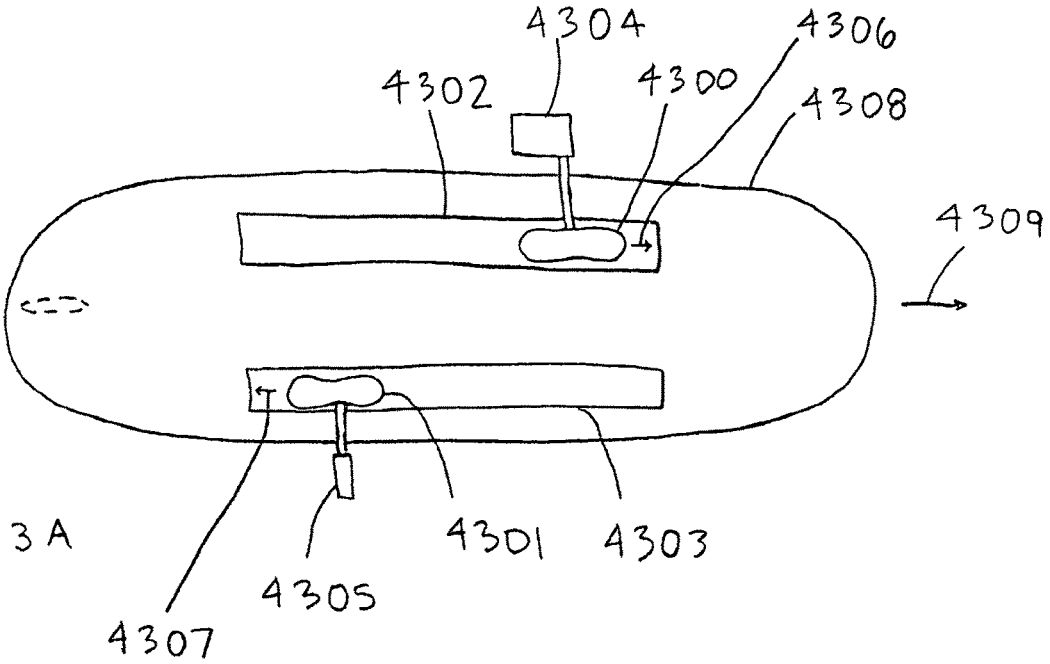
FIG. 43A is a plan view of a useful embodiment of another thrust assembly, where left and right foot supports slide along left and right slide paths.

FIG. 43A is a plan view of a useful embodiment of another thrust assembly, where left 4300 and right 4301 foot supports slide along left 4302 and right 4303 slide paths, respectively, on an SUP 4308. Foot supports 4300 and 4301 are connected to rotatable thrust paddles 4304 and 4305, respectively. When the left foot support 4300 is sliding forward 4306, the left paddle 4304 is rotated above the water level so there is no resistance to motion applied to the paddle 4304 from the water. When the right foot support 4301 is sliding rearward 4307, the right paddle 4305 is rotated down into the water, so the sliding creates a forward 4309 thrust force against the water.

Figure 43B:
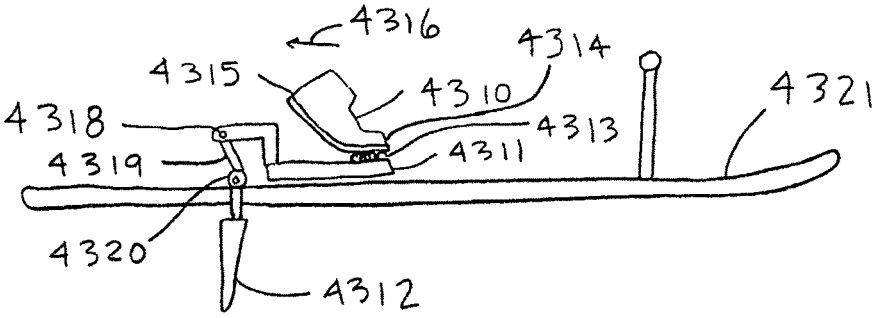
FIG. 43B is a side view of a useful embodiment of another thrust assembly, where a foot holder is attached to a foot support that is connected to a thrust fin.

FIG. 43B is a side view of a useful embodiment of another thrust assembly, where a foot holder 4310 is attached to a foot support 4311 that is connected to a thrust fin 4312. The foot holder 4310 may be attached to the foot support 4311 using Velcro 4313. Since the foot holder 4310 is attached near the toe portion 4314, the rider is able to lift their heel 4315, which is convenient when pushing the foot support rearward. In this thrust phase, when the foot holder 4310 slides the foot support 4311 rearward 4316, the thrust fin 4312 also moves rearward 4317, pushing against the water and generating forward thrust (i.e., to the right in the figure). The foot support 4311 is connected by a pinned rotary joint 4318 to a lever arm 4319 connected to the thrust fin 4312, where the lever arm 4319 also comprises a rotary wheel 4320 to roll on the SUP 4321.

Figure 43C:
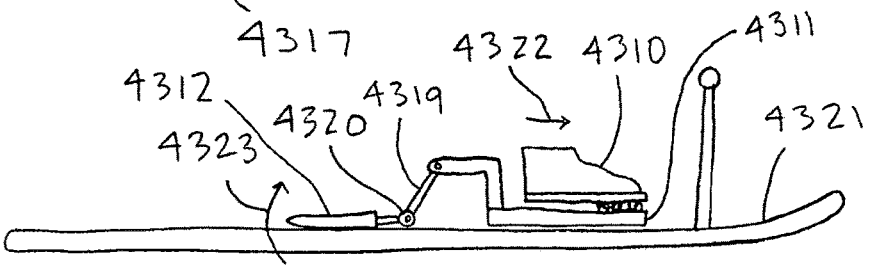
FIG. 43C is a side view of the useful embodiment of the thrust assembly of FIG. 43B, where in this figure, the foot holder is pushing the foot support forward.

FIG. 43C is a side view of the useful embodiment of the thrust assembly of FIG. 43B, where in this figure, the foot holder 4310 is pushing the foot support 4311 forward 4322. The forward motion of the foot support 4311 causes the lever arm 4319 to rotate clockwise 4323 and rotate around the wheel 4320 and rotate the thrust fin 4312 out of the water. In this recovery phase, there is no water resistance applied to the thrust fin.

Figure 43D:
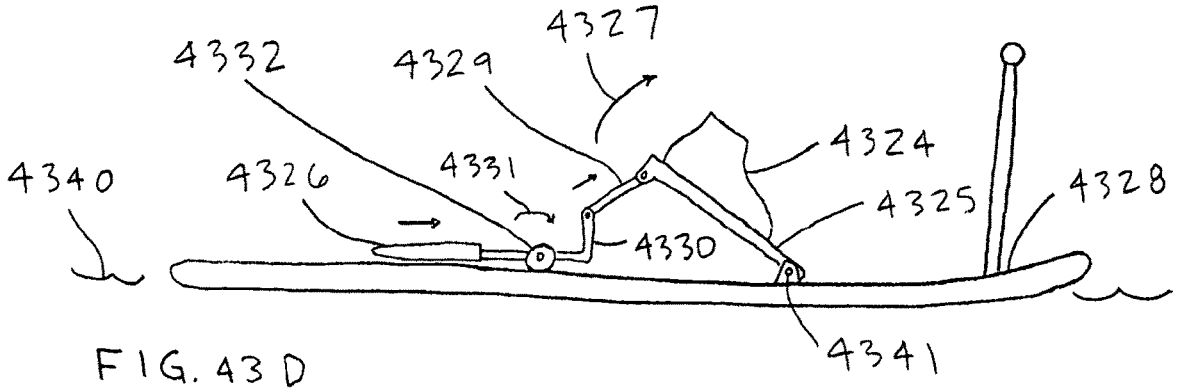
FIG. 43D is a side view of a useful embodiment of another thrust assembly, where a foot holder is attached to a rotary foot support that is connected to a thrust fin.

FIG. 43D is a side view of a useful embodiment of another thrust assembly, where a foot holder 4324 is attached to a rotary foot support 4325 that is connected to a thrust fin 4326. As shown, the foot holder 4324 is rotating the foot support 4325 clockwise 4327 about the rotary joint 4341 relative to the SUP 4328. The rotation of the foot support 4325 causes the connecting rod 4329 to rotate the lever arm 4330 clockwise 4331 and rotate around the wheel 4332 and rotate the thrust fin 4326 out of the water 4340. In this recovery phase, there is no water resistance applied to the thrust fin.

Figure 43E:
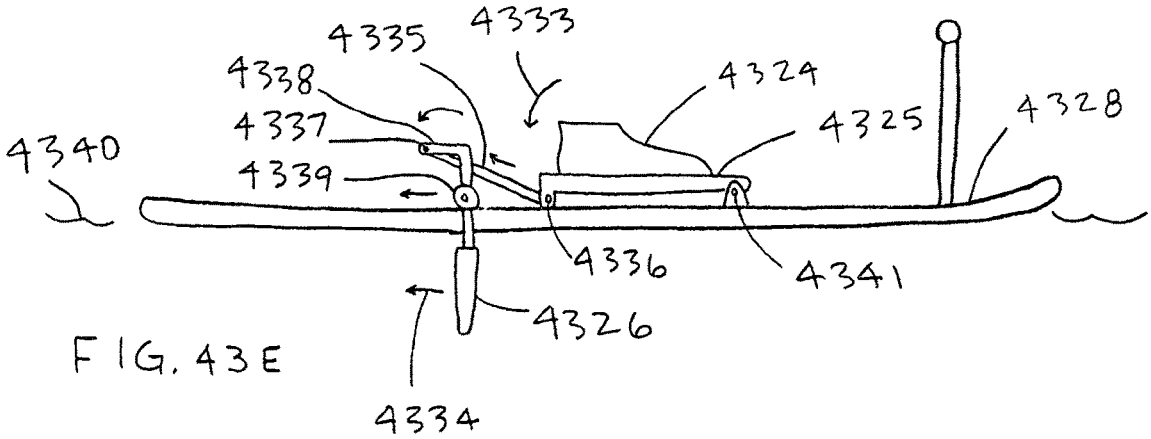
FIG. 43E is a side view of the useful embodiment of the thrust assembly of FIG. 43D.

FIG. 43E is a side view of the useful embodiment of the thrust assembly of FIG. 43D. In this thrust phase, when the foot holder 4324 rotates the foot support 4325 counterclockwise 4333 about the rotary joint 4341 relative to the SUP 4328, the thrust fin 4326 rotates into the water 4340 and moves rearward 4334, pushing against the water and generating forward thrust (i.e., to the right in the figure). The foot support 4325 is connected by a connecting rod 4335 with pinned rotary joints 4336 and 4337 to a lever arm 4338 connected to the thrust fin 4326, where the lever arm 4338 also comprises a rotary wheel 4339 to roll on the SUP 4328. There is typically one foot holder for each foot, each with an associated foot support. The foot supports may be rotatably attached to a single SUP, or to two separate SUPs that may be propelled with forward/backward sliding motion by the rider, like Nordic snow skis, but floating and sliding on water.

Figure 43F:
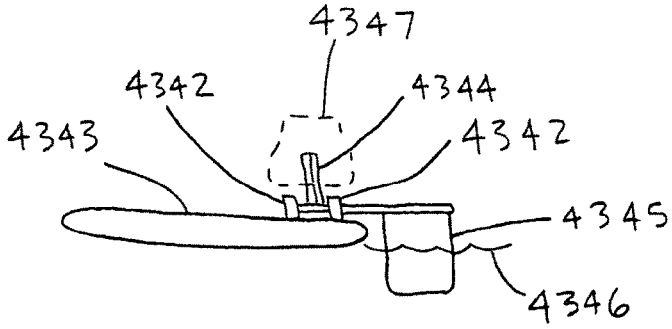
FIG. 43F is an end view of a useful embodiment of another thrust assembly.

FIG. 43F is an end view of a useful embodiment of another thrust assembly, where rotary wheels 4342 roll on an SUP 4343, the wheels 4342 are connected to a lever arm 4344 and to a thrust paddle 4345, and where the thrust paddle 4345 is in the water 4346. The outline for a foot holder 4347 provides where the rider's foot is typically positioned relative to the wheels 4342 and paddle 4345.

Figure 44:
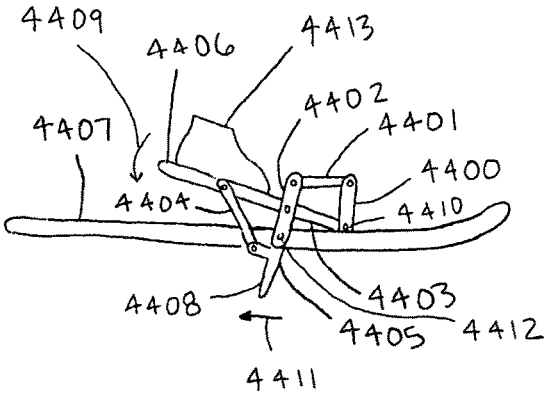
FIG. 44 is a side view of a useful embodiment of another thrust assembly, where two four-bar linkages are used.

FIG. 44 is a side view of a useful embodiment of another thrust assembly, where two four-bar linkages are used. The first four-bar linkage comprises links 4400, 4401, 4402, and 4403. The second four-bar linkage comprises links 4402, 4403, 4404, and 4405. The four-bar linkages are interconnected with rotary pinned joints. The first four-bar linkage positions the foot support 4406 relative to the SUP 4407. The foot support 4406 is attached to the link 4403. The second four-bar linkage positions the thrust fin 4408 relative to the position of the foot support 4406. The thrust fin 4408 is attached to the link 4405. As the foot support 4406 is rotated counterclockwise 4409 about the rotary pinned joint 4410, the thrust fin 4408 is rotated clockwise about the rotary pinned joint 4412. Accordingly, when the rider presses down with their foot 4413, the thrust fin 4408 simultaneously moves down into the water and rearward 4411, providing forward thrust. When the rider lifts their foot 4413, the thrust fin 4408 retracts up.

Figure 45A:
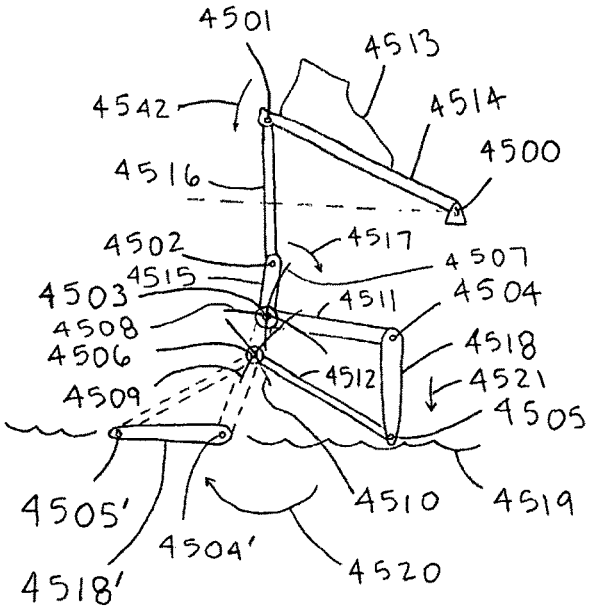
FIG. 45A is a side view of a useful embodiment of another thrust assembly, where two four-bar linkages are used.

FIG. 45A is a side view of a useful embodiment of another thrust assembly, where two four-bar linkages are used. The first four-bar linkage comprises four revolute joints 4500 (grounded), 4501, 4502, and 4503 (grounded). The second four-bar linkage comprises the four revolute joints 4503 (grounded), 4504, 4505, and 4506 (grounded). Grounded revolute joints are affixed to an SUP; whereas, non-grounded revolute joints may translate relative to the SUP. Construction arcs 4507, 4508, 4509, and 4510 are provided to indicate how the locations of the grounded revolute joints may be determined based on the desired starting and ending locations for the non-grounded revolute joints. From the starting location of the revolute joint 4504, the construction arc 4507 is drawn with a radius equal to the length of the link 4511; from the ending location of the revolute joint 4504', another construction arc 4508 is drawn using the same radius. The intersection of the two arcs 4507 and 4508 provides the location for the grounded revolute joint 4503. From the starting location of the revolute joint 4505, the construction arc 4509 is drawn with a radius equal to the length of the link 4512; from the ending location of the revolute joint 4505', another construction arc 4510 is drawn using the same radius. The intersection of the two arcs 4509 and 4510 provides the location for the grounded revolute joint 4506.

The rider places their foot 4513 on the foot support 4514 that is connected to the SUP by the grounded revolute joint 4500. The rear of the foot support is connected to the lever arm 4515 of the crank link 4511 by a coupler 4516. The foot support 4514 comprises a crank link, such that when the rider presses down on the foot support 4514 to rotate it counterclockwise 4542, the coupler 4516 causes the lever arm 4515 of the crank link 4511 of the second four-bar linkage to rotate clockwise 4517. The thrust fin 4518 comprises the coupling link of the second four-bar linkage between revolute joints 4504 and 4505, where the thrust fin 4518 translates down 4521 into the water 4519 as it also rotates clockwise 4520 to a second position 4518', and provides forward thrust to the SUP.

Figure 45B:
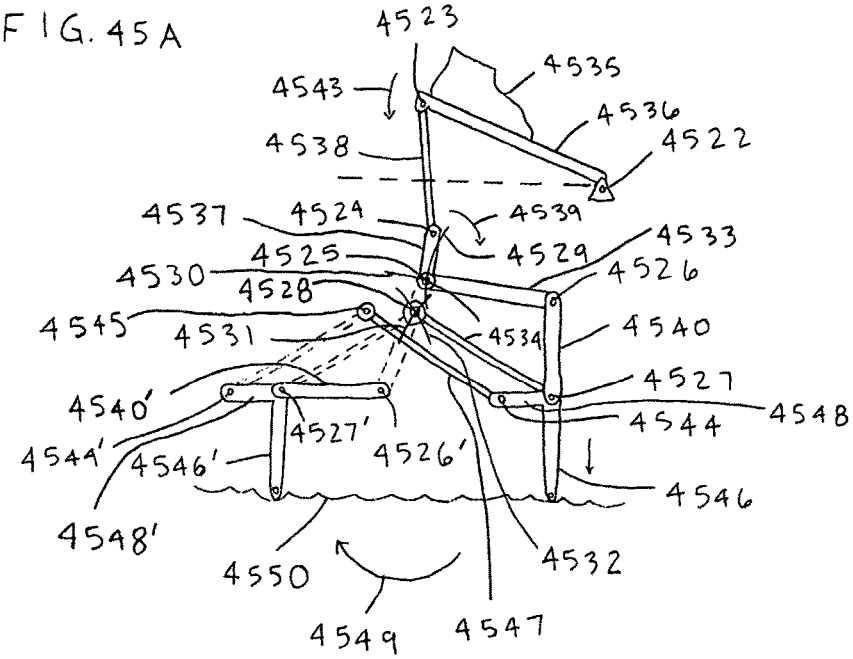
FIG. 45B is a side view of a useful embodiment of another thrust assembly, similar to FIG. 45A, but which adds a third four-bar linkage.

FIG. 45B is a side view of a useful embodiment of another thrust assembly, similar to FIG. 45A, but which adds a third four-bar linkage. The first four-bar linkage comprises four revolute joints 4522 (grounded), 4523, 4524, and 4525 (grounded). The second four-bar linkage comprises the four revolute joints 4525 (grounded), 4526, 4527, and 4528 (grounded). Grounded revolute joints are affixed to an SUP; whereas, non-grounded revolute joints may translate relative to the SUP. Construction arcs 4529, 4530, 4531, and 4532 are provided to indicate how the locations of the grounded revolute joints may be determined based on the desired starting and ending locations for the non-grounded revolute joints. From the starting location of the revolute joint 4526, the construction arc 4529 is drawn with a radius equal to the length of the link 4533; from the ending location of the revolute joint 4526', another construction arc 4530 is drawn using the same radius. The intersection of the two arcs 4529 and 4530 provides the location for the grounded revolute joint 4525. From the starting location of the revolute joint 4527, the construction arc 4531 is drawn with a radius equal to the length of the link 4534; from the ending location of the revolute joint 4527', another construction arc 4532 is drawn using the same radius. The intersection of the two arcs 4531 and 4532 provides the location for the grounded revolute joint 4528.

The rider places their foot 4535 on the foot support 4536 that is connected to the SUP by the grounded revolute joint 4522. The rear of the foot support is connected to the lever arm 4537 of the crank link 4533 by a coupler 4538. The foot support 4536 comprises a crank link, such that when the rider presses down on the foot support 4536 to rotate it counterclockwise 4543, the coupler 4538 causes the lever arm 4537 of the crank link 4533 of the second four-bar linkage to rotate clockwise 4539. The coupling link 4540 of the second four-bar linkage rotates clockwise to a second position 4540'.

A third four-bar linkage comprises the four revolute joints 4528 (grounded), 4527, 4544, and 4545 (grounded). A thrust fin 4546 is connected to the coupler 4548 between revolute joints 4527 and 4544. When the coupler 4540 rotates clockwise (as did the thrust fin 4518 in FIG. 45A), it forces the crank link 4534 also to rotate clockwise. Since the crank link 4547 of the third four-bar linkage is the same length as the crank link 4534, the coupler 4548 between the crank links 4534 and 4347 maintains its orientation relative to the SUP as it translates to its ending position 4548'. Likewise, the thrust fin 4546 which is connected to the coupler 4548 maintains its vertical orientation relative to the SUP as it translates 4549 through the water 4550 to its ending position 4546', while providing forward thrust to the SUP.

Figure 46A:
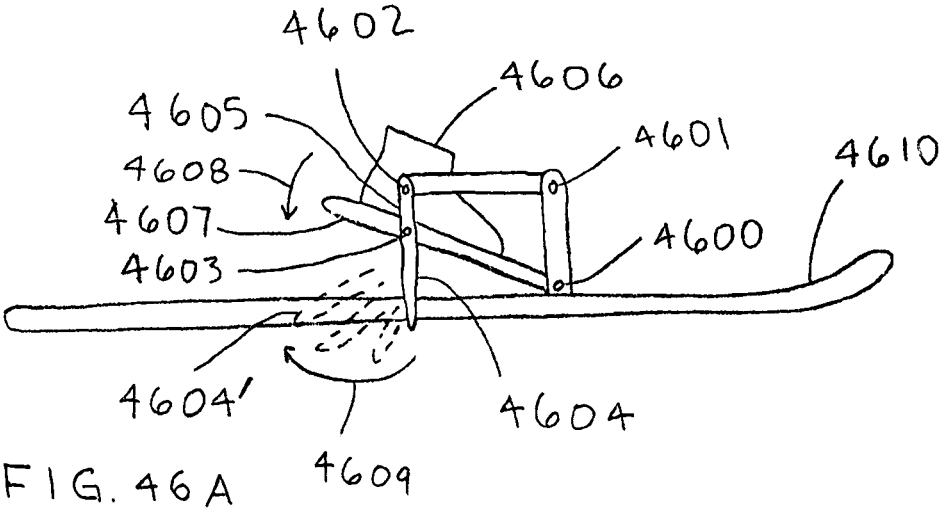
FIG. 46A is a side view of a useful embodiment of another thrust assembly, where a four-bar linkage is used.

FIG. 46A is a side view of a useful embodiment of another thrust assembly, where a four-bar linkage is used comprising the four revolute joints 4600 (grounded), 4601 (grounded), 4602, and 4603. A thrust fin 4604 extends from the coupler 4605 between revolute joints 4602 and 4603. The rider places their foot 4606 on the foot support 4607 that is connected to the SUP 4610 by the grounded revolute joint 4600. The rear of the foot support is connected to the coupler 4605 by the revolute joint 4603. The foot support 4607 comprises a crank link, where the rider presses down on the foot support 4607 to rotate it counterclockwise 4608. Since the length between the revolute joints 4602 and 4603 is less than between the revolute joints 4600 and 4601, downward movement of the coupler 4605 causes the thrust fin 4604 to rotate counterclockwise 4609 as it translates downward and to the left until it reaches its final position 4604', generating forward thrust to the right as it translates.

Figure 46B:
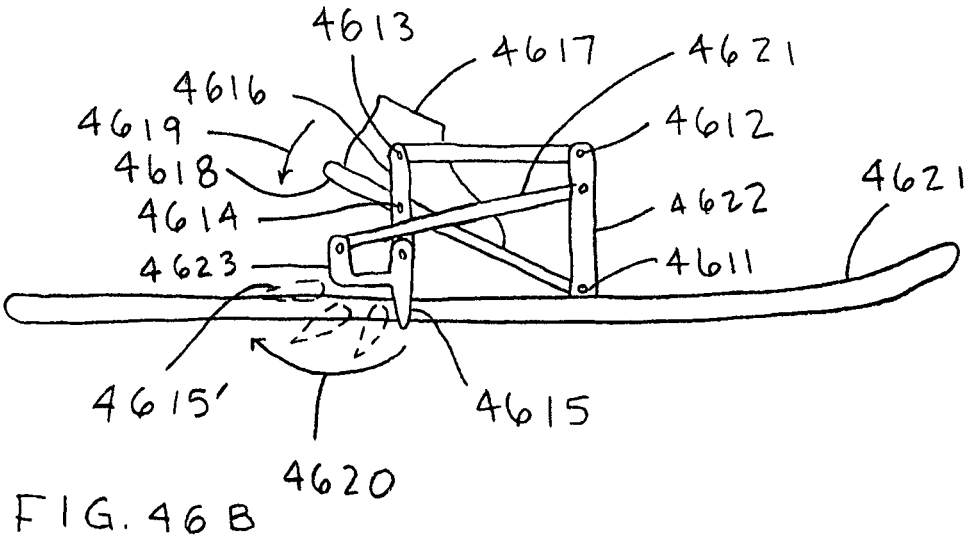
FIG. 46B is a side view of a useful embodiment of another thrust assembly, where a four-bar linkage is used similar to FIG. 46A, but with additional links added.

FIG. 46B is a side view of a useful embodiment of another thrust assembly, where a four-bar linkage is used similar to FIG. 46A, but with additional links added. A four-bar linkage is used comprising the four revolute joints 4611 (grounded), 4612 (grounded), 4613, and 4614. A thrust fin 4615 extends from the coupler 4616 between revolute joints 4613 and 4614. The rider places their foot 4617 on the foot support 4618 that is connected to the SUP 4621 by the grounded revolute joint 4611. The rear of the foot support is connected to the coupler 4616 by the revolute joint 4614. The foot support 4618 comprises a crank link, where the rider presses down on the foot support 4618 to rotate it counterclockwise 4619. Since the length between the revolute joints 4613 and 4614 is less than between the revolute joints 4611 and 4612, downward movement of the coupler 4616 causes it to rotate counterclockwise. The tie link 4621 connects the ground link 4622 to the lever arm 4623 extending from the thrust fin 4615, causing the thrust fin 4615 to rotate clockwise 4620 more rapidly as it rotates to its final position 4615' as the rider presses down on the foot support 4618.

Figure 47A:
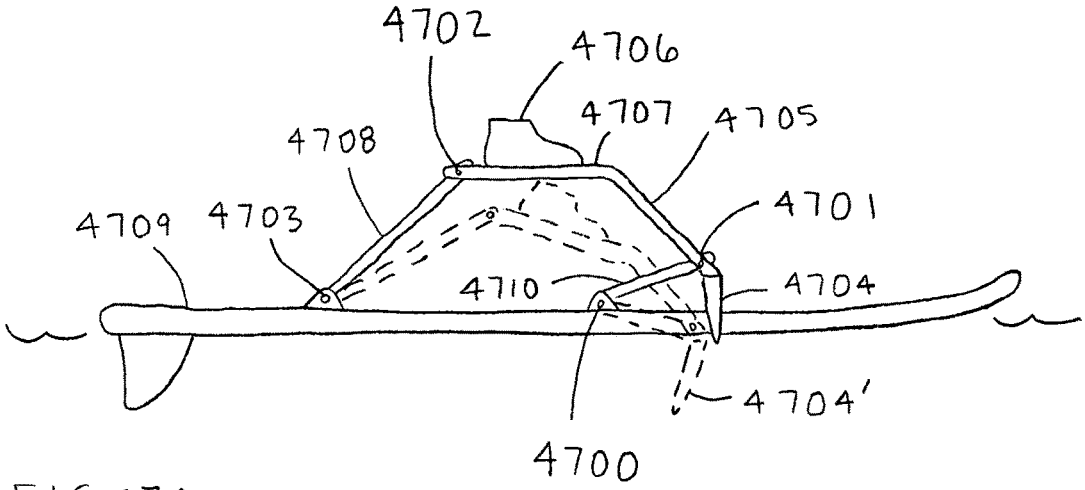
FIG. 47A is a side view of a useful embodiment of another thrust assembly, where a four-bar linkage is used.

FIG. 47A is a side view of a useful embodiment of another thrust assembly, where a four-bar linkage is used comprising the four revolute joints 4700 (grounded), 4701, 4702, and 4703 (grounded). A thrust fin 4704 extends from the coupler 4705 between revolute joints 4701 and 4702, and the rider places their foot 4706 on the foot support 4707 that is connected to the coupler 4705. A revolute joint 4702 connects the rear portion of the coupler 4705 to the rear crank 4708 that is connected to the SUP 4709 by the grounded revolute joint 4703. A revolute joint 4701 connects the front portion of the coupler 4705 to the front crank 4710 that is connected to the SUP 4709 by the grounded revolute joint 4700. When the rider presses down on the foot support 4707, it rotates clockwise. Since the length of the front crank 4710 is less than the length of the rear crank 4708, downward movement of the coupler 4705 causes it to rotate clockwise, and the thrust fin 4704 to move down into the water and rearward to a second position 4704', generating forward thrust.

Figure 47B:
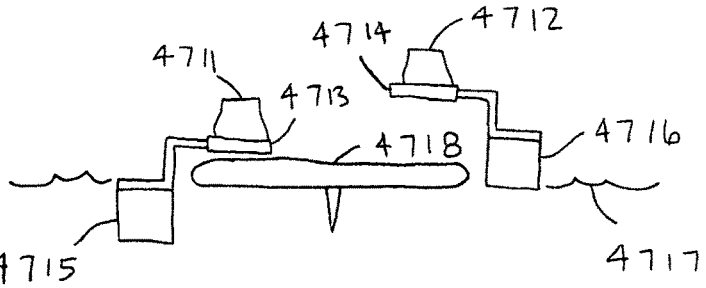
FIG. 47B is a rear end view of a useful embodiment of another thrust assembly.

FIG. 47B is a rear end view of a useful embodiment of another thrust assembly, where left and right feet 4711 and 4712, respectively are alternately pressing down on two foot supports 4713 and 4714, respectively, each connected to a thrust fin 4715 and 4716, respectively. The right foot support 4714 is elevated such that the connected thrust fin 4716 is above the water level 4717, and not producing any resistance to forward travel of the SUP 4718. The left foot support 4713 is pressed down such that the connected thrust fin 4715 is in the water and able to apply thrust.

Figure 47C:
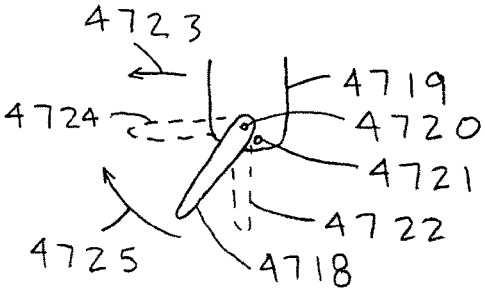
FIG. 47C is a side view of a useful embodiment of a thrust fin assembly.

FIG. 47C is a side view of a useful embodiment of a thrust fin assembly, where the thrust fin 4718 is connected to a member 4719 by a revolute joint 4720. The member comprises a detent 4721 to prevent the thrust fin 4718 from rotating counterclockwise (in the figure) past a limit orientation 4722 during the thrust phase 4723, but where the thrust fin 4718 can rotate clockwise (in the FIG. 4725 to a limit orientation 4724 when the member 4719 is not moving, or is moving against the water, so the thrust fin 4718 doesn't impede forward movement. This embodiment is useful when it is desired that a fin only generate forward thrust when moving in a rearward direction, but where the fin should minimize water drag when moving in a forward direction through the water.

Figure 47D:
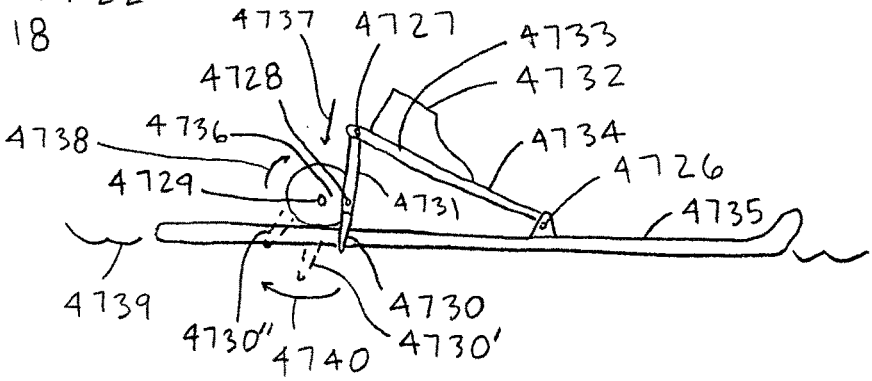
FIG. 47D is a side view of a useful embodiment of another thrust assembly, where a four-bar linkage is used.

FIG. 47D is a side view of a useful embodiment of another thrust assembly, where a four-bar linkage is used comprising the four revolute joints 4726 (grounded), 4727, 4728, and 4729 (grounded). A thrust fin 4730 extends from the coupler 4731 between revolute joints 4727 and 4728, and the rider places their foot 4732 on the foot support 4733 that is connected to the front crank 4734 which is connected to the SUP 4735 by the grounded revolute joint 4726. A revolute joint 4728 connects the coupler 4731 to the rear crank 4736 which is connected to the SUP 4735 by the grounded revolute joint 4729. When the rider presses down 4737 on the foot support 4733, it rotates counterclockwise, and the rear crank 4736 rotates clockwise 4738, and the thrust fin 4730 moves down into the water 4739 and rearward 4740 to a second position 4730', generating forward thrust. If the rider removes downward force from the foot support 4733 when the revolute joint 4728 is as far down as it can travel, momentum of the rear crank 4736 will move the thrust fin 4730 to a third position 4730" out of the water, while simultaneously lifting the foot support 4733. As the rider continues pumps the foot support 4733 up and down, the thrust fin 4730 will repeatedly enter the water 4739, move rearward 4730' to generate forward thrust, and then lift out of the water 4730".

Figure 47E:
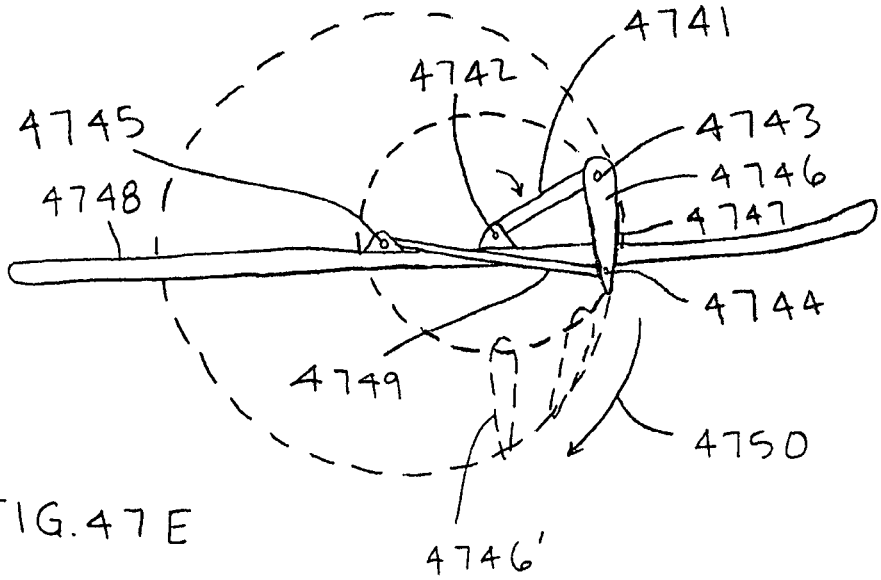
FIGS. 47E-47F are side views of useful embodiments of crank assemblies for providing thrust.

FIG. 47E is a side view of a useful embodiment of a crank assembly for providing thrust. The crank assembly comprises a front crank 4741, which may be substituted for the rear crank 4736 of FIG. 47D. The present crank assembly comprises a four-bar linkage with four revolute joints 4742 (grounded), 4743, 4744, and 4745 (grounded). The front crank 4741 comprises the link between the revolute joints 4742 and 4743. A thrust fin 4746 is connected to a coupler 4747 between the revolute joints 4743 and 4744. As provided in FIG. 47D, typically a rider places their foot on a foot support (not shown in FIG. 47E) that is connected to the front crank 4741 (i.e., the rear crank 4736 in FIG. 47D) which is connected to the SUP 4748 by the grounded revolute joint 4742. A revolute joint 4744 connects the coupler 4747 to the rear crank 4749 which is connected to the SUP 4748 by the grounded revolute joint 4745. As shown in FIG. 47D, when the rider presses down on the foot support, it rotates the front crank 4741 clockwise (i.e., the rear crank 4736 in FIG. 47D), and accordingly the thrust fin 4746 moves down into the water and rearward 4750 to a second position 4746', generating forward thrust. The rear crank 4749 adjusts the angle of the thrust fin as it moves down into the water and rearward.

Figure 47F:
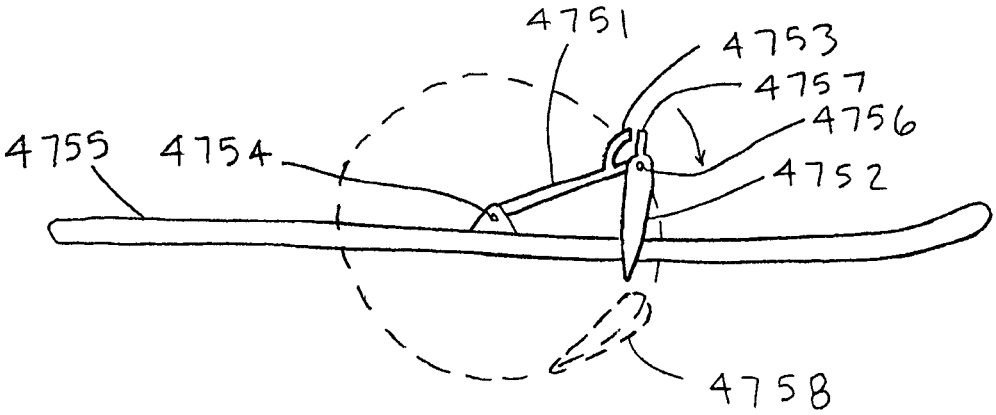

FIG. 47F is a side view of a useful embodiment of a crank assembly for providing thrust. The crank assembly comprises a crank 4751, which may be substituted for the rear crank 4736 of FIG. 47D. The crank 4751 also functions like the member 4719 of FIG. 47C, where the crank 4751 is connected to a thrust fin 4752, and where the crank 4751 comprises a detent 4753. The other end of the crank 4751 is connected by a grounded revolute joint 4754 to the SUP 4755. The detent 4753 prevents the thrust fin 4752 from rotating counterclockwise around the revolute joint 4756 past a limit position, but where the thrust fin 4752 may rotate freely in a clockwise direction. The detent comprises a structure that limits a portion 4757 of the thrust fin 4752 from rotating past it. In this way, the thrust fin 4752 can apply forward thrust to the SUP 4755 while the crank 4751 is rotating clockwise and the thrust fin is moving to a second position 4758, but the thrust fin 4752 applies minimal water drag when the crank 4751 stops rotating, or rotates counterclockwise.

Figure 48A:
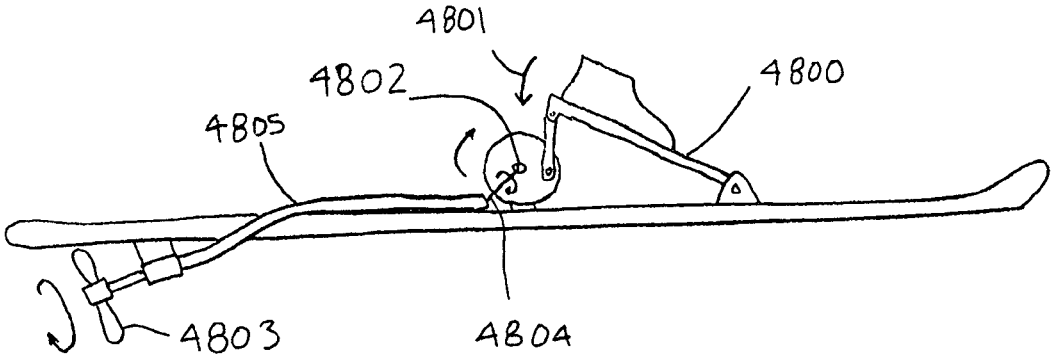
FIG. 48A is a side view of a useful embodiment of another thrust assembly, where a foot support may be pumped up and down to rotate a shaft.

FIG. 48A is a side view of a useful embodiment of another thrust assembly, where a foot support 4800 may be pumped up and down 4801 to rotate a shaft 4802, where the shaft 4802 may turn a propeller 4803, or a paddle wheel, or other propulsion apparatus. In this figure, the shaft 4802 is mechanically connected to the shaft of the propeller 4803 using a torsion cable 4804 in a sheath 4805 that transmits rotary motion like a dentist drill cable.

Figure 48B:
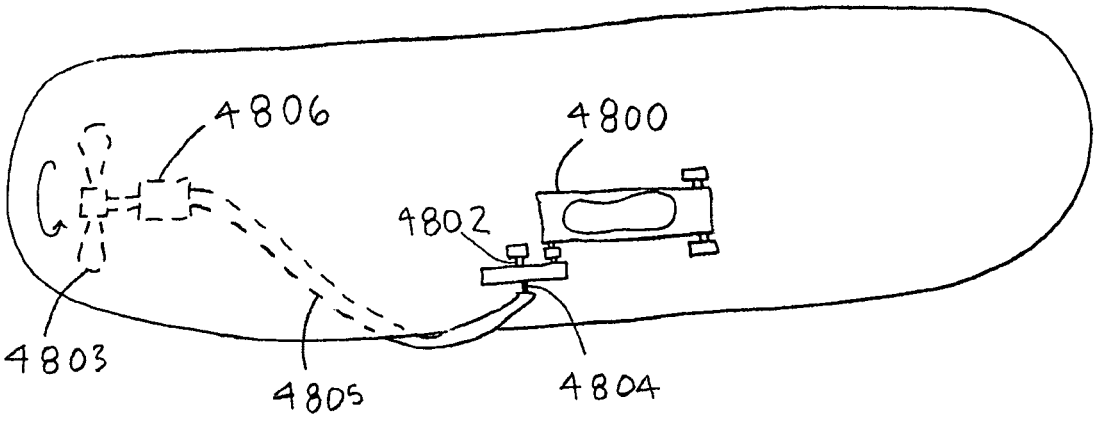
FIG. 48B is a plan view of the useful embodiment of FIG. 48A.

FIG. 48B is a plan view of the useful embodiment of FIG. 48A. The torsion cable 4804 is connected 4806 to the shaft of the propeller 4803.

Figure 49A:
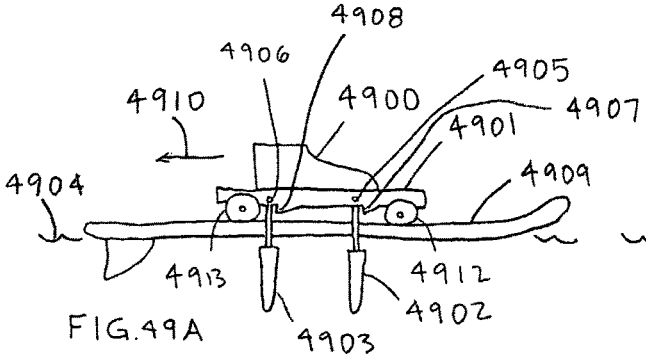
FIG. 49A is a side view of a useful embodiment of another thrust assembly, where one or more thrust fins rotate relative to foot supports.

FIG. 49A is a side view of a useful embodiment of another thrust assembly, where one or more thrust fins rotate relative to foot supports. During a thrust phase where the rider uses their foot 4900 to press a foot support 4901 rearward 4910, the thrust fins 4902 and 4903 rotate counterclockwise down into the water 4904 about revolute joints 4905 and 4906, respectively, on the foot support 4901, and press against detent/limit stops 4907 and 4908, respectively, to resist the thrust fins 4902 and 4903 from rotating further counterclockwise. While pressing against the detent/limit stops 4907 and 4908, the thrust fins may apply a thrust force against the water 4904 to move the SUP 4909 forward. The foot supports may use wheels 4912 and 4913 to slide along the surface of the SUP 4909.

Figure 49B:
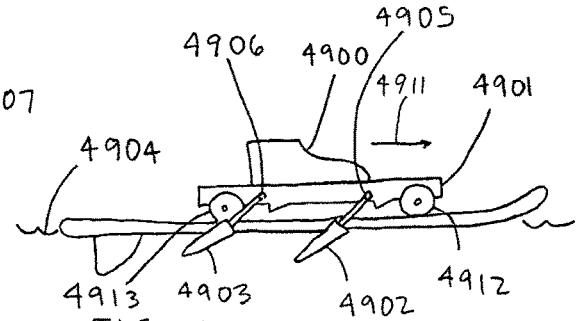
FIG. 49B is a side view of the useful embodiment of FIG. 49A during a recovery phase.

FIG. 49B is a side view of the useful embodiment of FIG. 49A during a recovery phase, where the rider uses their foot 4900 to press the foot support 4901 forward 4911. During the recovery phase, the thrust fins 4902 and 4903 rotate clockwise about revolute joints 4905 and 4906, respectively, on the foot support 4901, to slide along the top of the water 4904, or out of the water, to minimize water resistance.

Figure 49C:
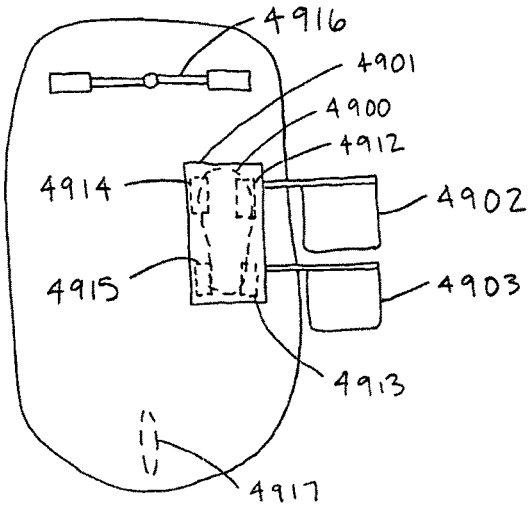
FIG. 49C is a plan view of the useful embodiment of FIGS. 49A and 49B, where the rider uses their foot to move the foot support.

FIG. 49C is a plan view of the useful embodiment of FIGS. 49A and 49B, where the rider uses their foot 4900 to move the foot support 4901. Thrust fins 4902 and 4903 are shown rotated relative to the foot support 4901, to slide along the top of the water 4904, or out of the water, to minimize water resistance. The foot support is shown with wheels 4912, 4913, 4914, and 4915, to slide along the surface of the SUP 4909. Handlebars 4916 may be used to press against, and to steer the rudder 4917.

Figure 49D:
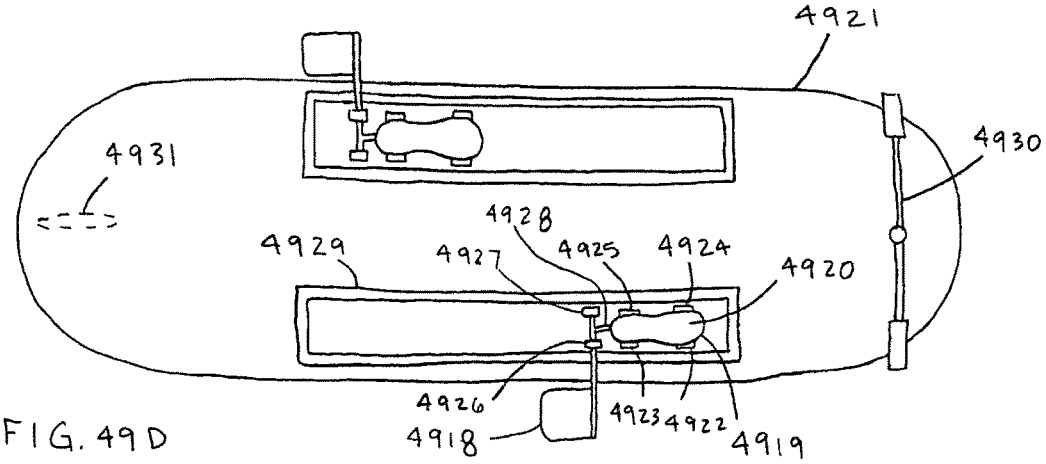
FIG. 49D is a plan view of a useful embodiment of another thrust assembly, where a thrust fin rotates relative to a foot support.

FIG. 49D is a plan view of a useful embodiment of another thrust assembly, where a thrust fin 4918 rotates relative to a foot support 4919. During a thrust phase where the rider uses their foot 4920 to press the foot support 4919 rearward, the thrust fin 4918 rotates down into the water about a revolute joint on the foot support 4919 and applies a thrust force against the water to move the SUP 4921 forward. The foot support 4919 may use wheels 4922, 4923, 4924, and 4925 to slide along the top of the SUP 4921. The foot support 4919 may comprise a roller skates with wheels. The thrust fin 4918 may have roller wheels 4926 and 4927 to help slide along the top of the SUP 4921, and may be connected by a connector 4928 to the foot support 4919. The thrust fin 4918 may extend from the wheels 4926 and 4927 into the water to the side of the SUP 4921. The SUP 4921 may have guard rails or a wall 4929 to help guide movement of the foot support 4919. Movement of the foot support 4919 may be constrained with a linear bearing. Handlebars 4930 may be used to press against, and to steer the rudder 4931.

Figure 50A:
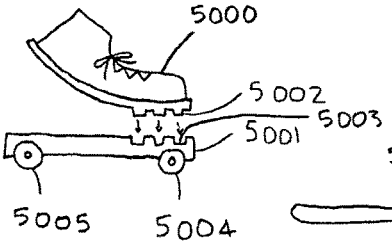
FIG. 50A is a side view of a useful embodiment of a foot holder and a foot support, where the foot holder comprises protrusions that mate with sockets on the foot support.

FIG. 50A is a side view of a useful embodiment of a foot holder 5000 and a foot support 5001, where the foot holder 5000 comprises protrusions 5002 that mate with sockets 5003 on the foot support 5001. The mating protrusions 5002 and sockets 5003 can transmit tangential force from the foot holder 5000 to the foot support 5001, but yet the foot holder 5000 and foot support 5001 may be easily separated. The mating protrusions 5002 and sockets 5003 may lightly snap together or use Velcro. The foot support 5001 may comprise roller wheels 5004 and 5005.

Figure 50B:
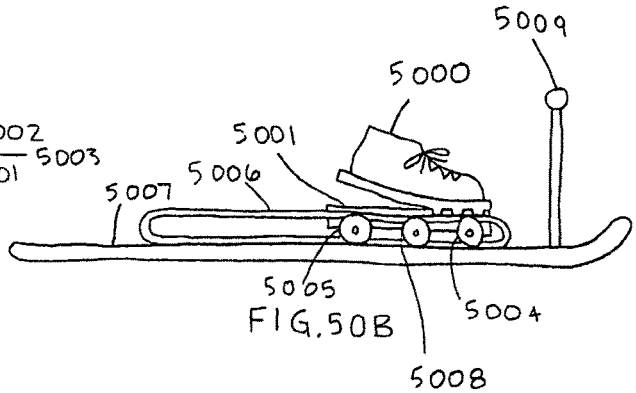
FIG. 50B is a side view of a useful embodiment of the foot holder and a foot support of FIG. 50A.

FIG. 50B is a side view of a useful embodiment of the foot holder 5000 and a foot support 5001 of FIG. 50A, where the wheels 5004 and 5005 are guide wheels constrained within a guide 5006, which may operate like a garage-door wheel guide. The guide 5006 may be on top of the SUP 5007, as provided in FIG. 50B, or inset inside the SUP, as provided in FIG. 50C. One guide wheel 5008 may support a thrust fin. Handlebars 5009 may be used to press against, to steer a rudder, to brake, or for balance.

Figure 50C:
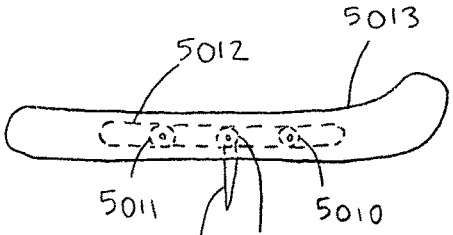
FIG. 50C is a side view of a useful embodiment of guide wheels and constrained within a guide.

FIG. 50C is a side view of a useful embodiment of guide wheels 5010 and 5011 constrained within a guide 5012, which may operate like a garage-door wheel guide. The guide 5012 may be inset inside the SUP 5013. One guide wheel 5014 may support a thrust fin 5015.

Figure 50D:
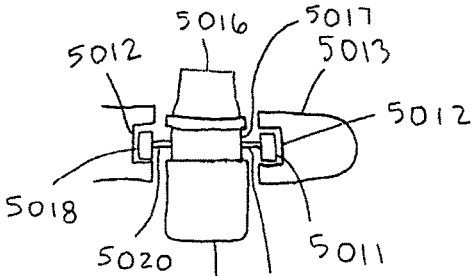
FIG. 50D is a rear end view of a useful embodiment of guide wheels of FIG. 50C.

FIG. 50D is a rear end view of a useful embodiment of guide wheels of FIG. 50C, where the guide wheels are constrained within a guide 5012 inset inside the SUP 5013. A foot holder 5016 is mated with a foot support 5017. The guide wheels 5011 and 5018 are connected to the foot support 5017 with revolute joints 5019 and 5020, respectively. When the guide 5012 is inset inside the SUP 5013, the thrust fin 5015 is typically positioned beneath the foot support 5017.

Figure 50E:
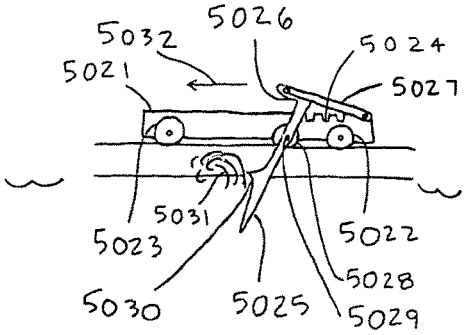
FIGS. 50E, 50F, and 50G are a side views of a useful embodiment of a foot support, where a thrust fin is connected to the foot support by a connector.
Figure 50F:
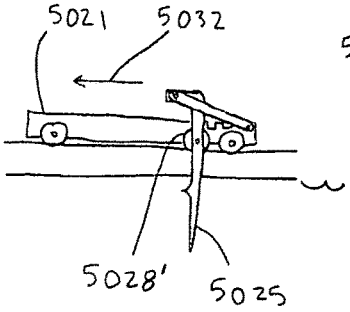
Figure 50G:
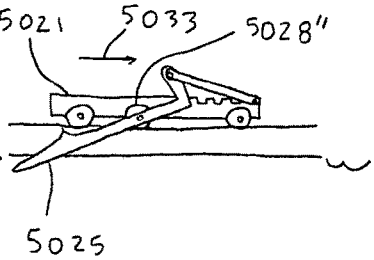

FIGS. 50E, 50F, and 50G are a side views of a useful embodiment of a foot support, where a thrust fin is connected to the foot support by a connector. In operation, a typical thrust progression is from FIG. 50G to 50E to 50F, but FIG. 50E will be described first here. In FIG. 50E, a foot support 5021 comprises load-bearing wheels 5022 and 5023, which may be guided by guides. The foot support 5021 may also comprise sockets 5024 for mating with protrusions of a foot support (such as shown in FIG. 50A). A thrust fin 5025 with a lever arm 5026, which may be an "L" shaped lever arm, is connected by the lever arm 5026 to the foot support 5021 by a connector 5027. The thrust fin 5025 is also connected to a roller wheel 5028 by a revolute joint 5029, where the roller wheel 5028 is not directly connected to the foot support 5021. The thrust fin 5025 may comprise a scoop 5030 for re-directing water 5031 when the thrust fin 5025 moves rearward 5032. The scoop 5030 may also help apply a force from re-directed water 5031 to rotate the thrust fin counterclockwise to vertical, as well as translate the thrust fin 5025 forward relative to the foot support 5021, since the scoop 5030 is positioned below the revolute joint 5029 of the roller wheel 5028.

FIG. 50F is a side view of a useful embodiment of the foot support of FIG. 50E, where due to pressure from the water, the thrust fin 5025 has been rotated to vertical and translated forward relative to the foot support 5021 when the foot support is pushed rearward 5032 during the thrust phase by the rider. In this view, the roller wheel 5028' is positioned farther to the right than the roller wheel 5028 shown in FIG. 50E.

FIG. 50G is a side view of a useful embodiment of the foot support of FIG. 50E, where due to pressure from the water, the thrust fin 5025 has been rotated to nearly horizontal and translated rearward relative to the foot support 5021 when the foot support is pushed forward 5033 during the recovery phase by the rider. In this view, the roller wheel 5028" is positioned farther to the left than the roller wheel 5028 shown in FIG. 50E.

Figure 50H:
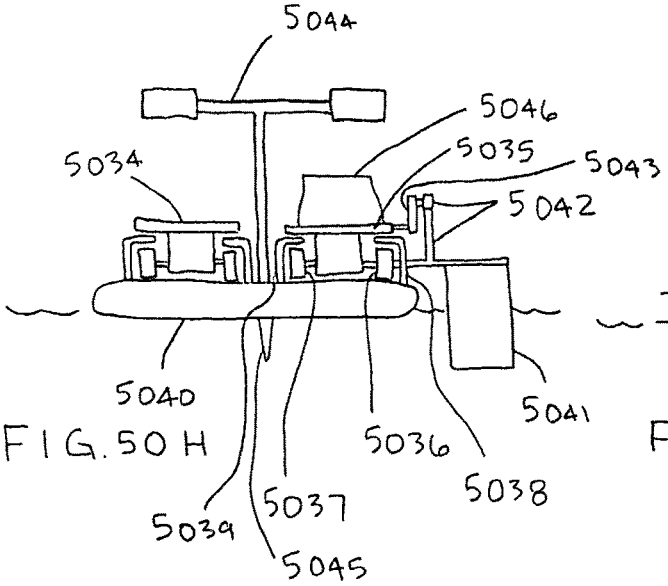
FIG. 50H is a rear end view of a useful embodiment of the foot support of FIGS. 50E, 50F, and 50G.

FIG. 50H is a rear end view of a useful embodiment of the foot support of FIGS. 50E, 50F, and 50G. A foot holder 5046 is mated with a foot support 5035. There are typically a left 5034 and a right 5035 foot support which operate similarly, so only the right foot support 5035 will be describe here in detail. The foot support 5035 comprises load-bearing wheels 5036 and 5037, which may be guided by guides 5038 and 5039, respectively, connected to an SUP 5040. A thrust fin 5041 with a lever arm 5042, which may be an "L" shaped lever arm, is connected by the lever arm 5042 to the foot support 5035 by a connector 5043. The thrust fin 5041 is also connected to a roller wheel by a revolute joint, where the roller wheel is not directly connected to the foot support 5035. Handlebars 5044 may be used by the rider to press against, and to steer the rudder 5045.

Figure 50I:
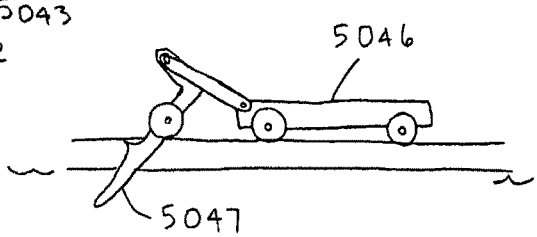
FIG. 50I is a side view of a useful embodiment of a foot support similar to FIG. 50E, but where the thrust fin is positioned to the rear of the foot support.

FIG. 50I is a side view of a useful embodiment of a foot support 5046 similar to FIG. 50E, but where the thrust fin 5047 is positioned to the rear of the foot support 5046, rather than under or to the side of the foot support 5046.

Figure 50J:
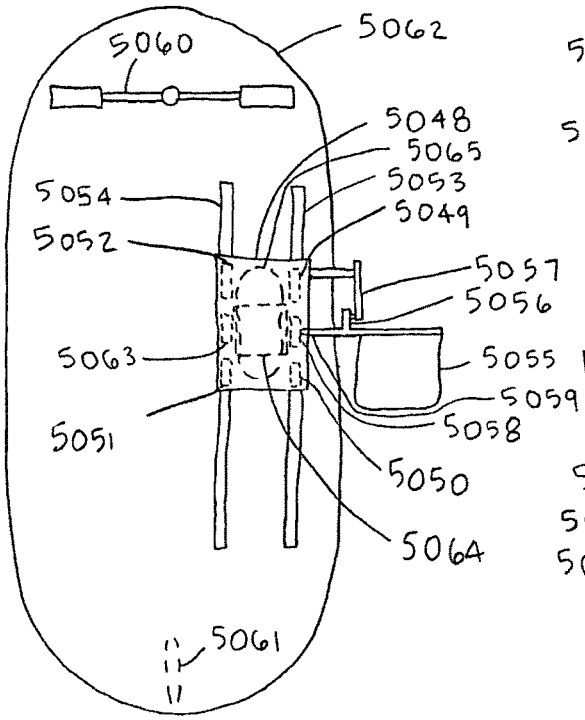
FIG. 50J is a plan view of a useful embodiment of the foot support of FIGS. 50E, 50F, 50G, and 50H.

FIG. 50J is a plan view of a useful embodiment of the foot support of FIGS. 50E, 50F, 50G, and 50H. In FIG. 50J, a foot support 5048 comprises load-bearing wheels 5049, 5050, 5051, and 5052, which may be guided by guides 5053 and 5054 connected to the SUP 5062. The guides 5053 and 5054 may operate like garage-door guides for the garage-door wheels. The foot outline 5065 indicates where a rider typically stands on the foot support 5048. A thrust fin 5055 with a lever arm 5056, which may be an "L" shaped lever arm, is connected by the lever arm 5056 to the foot support 5048 by a connector 5057. The thrust fin 5055 is also connected to a roller wheels 5058 and 5063 by a revolute joint 5059 to prevent the thrust fin 5055 from twisting (e.g., clockwise or counterclockwise in the plan view), where the roller wheels 5058 and 5063 are not directly connected to the foot support 5048. There may be an axle support 5064 for the roller wheels 5058 and 5063. Handlebars 5060 may be used by the rider to press against, and to steer the rudder 5061.

Figure 50K:
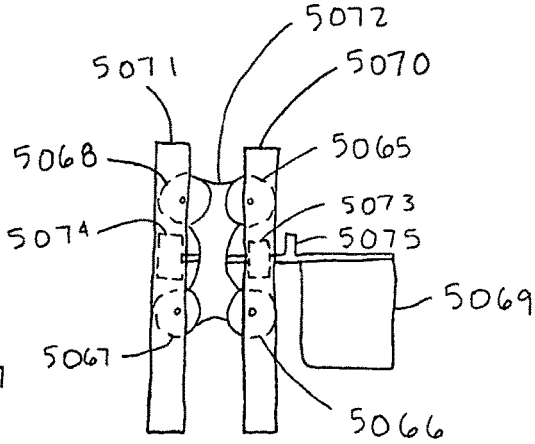
FIG. 50K is a plan view of a useful embodiment of the foot support of FIG. 50J, where wheels with vertical axes (i.e., out of the paper) support torsional force.

FIG. 50K is a plan view of a useful embodiment of the foot support of FIG. 50J, where wheels 5065, 5066, 5067, and 5068 with vertical axes (i.e., out of the paper) support torsional force (i.e., counterclockwise) from water pressure against the thrust fin 5069 during the thrust phase. The vertical-axis wheels 5065, 5066, 5067, and 5068 are guided by wheel guides 5070 and 5071. The vertical-axis wheels 5065, 5066, 5067, and 5068 are connected by revolute joints to an axle support 5072. The thrust fin 5069 may have roller wheels 5073 and 5074 that are also guided by the wheel guides 5070 and 5071, respectively. The roller wheels 5073 and 5074 of the thrust fin 5069 may also be connected to the axle support 5072. The thrust fin 5069 is shown with a lever arm 5075, such as the lever arm described in detail in preceding figures, however additional features are omitted in this figure for clarity.

Figure 50L:
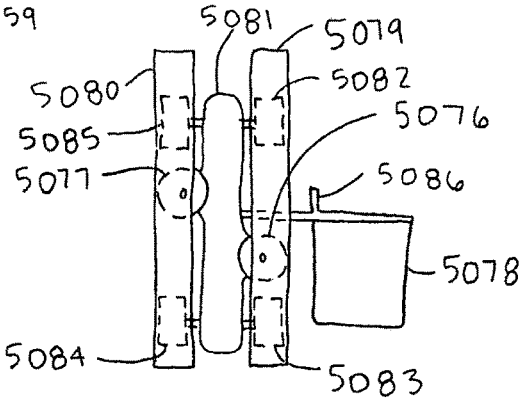
FIG. 50L is a plan view of a useful embodiment of the foot support of FIG. 50J, where wheels with vertical axes (i.e., out of the paper) support torsional force.

FIG. 50L is a plan view of a useful embodiment of the foot support of FIG. 50J, where wheels 5076 and 5077 with vertical axes (i.e., out of the paper) support torsional force (i.e., counterclockwise) from water pressure against the thrust fin 5078 during the thrust phase. While four vertical-axis wheels may be used as provided by FIG. 50K, only two vertical-axis wheels are needed to resist the torsional force against the thrust fin 5078 during the thrust phase. The vertical-axis wheels 5076 and 5077 are guided by wheel guides 5079 and 5080. The vertical-axis wheels 5076 and 5077 are connected by revolute joints to an axle support 5081. Rider load-bearing wheels 5082, 5083, 5084, and 5085 may also be connected to the axle support 5081, and they are guided by the wheel guides 5079 and 5080. The thrust fin 5078 may also be connected to the axle support 5081. The thrust fin 5078 is shown with a lever arm 5086, such as the lever arm described in detail in preceding figures, however additional features are omitted in this figure for clarity.

Figure 51A:
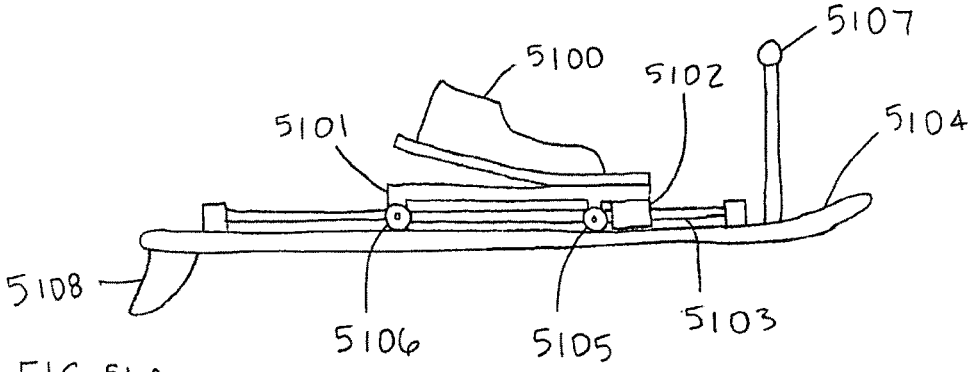
FIG. 51A is a side view of a useful embodiment of a foot holder and a foot support guided by a linear bearing.

FIG. 51A is a side view of a useful embodiment of a foot holder 5100 and a foot support 5101 guided by a linear bearing 5102 and a bearing rod 5103 on an SUP 5104. The foot support 5101 may comprise support wheels 5105 and 5106. Handlebars 5107 may be used to press against, to steer a rudder 5108, to brake, or for balance.

Figure 51B:
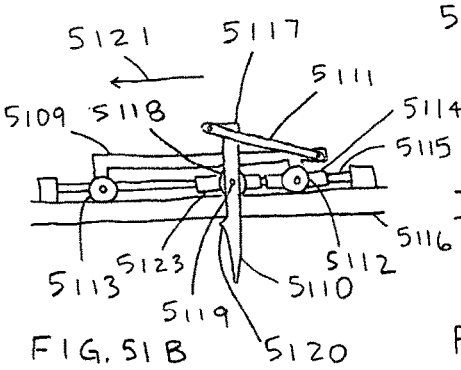
FIGS. 51B, 51C, and 51D are a side views of a useful embodiment of a foot support.
Figure 51C:
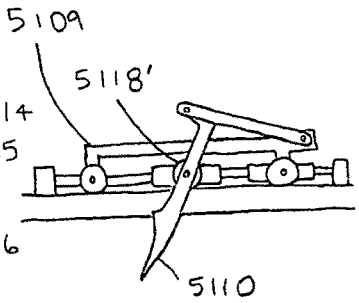
Figure 51D:
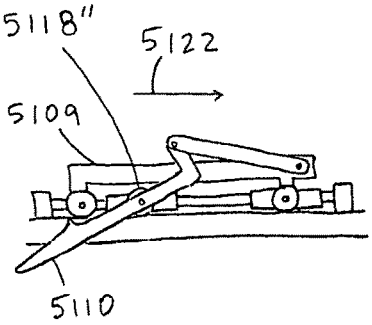

FIGS. 51B, 51C, and 51D are a side views of a useful embodiment of a foot support 5109, where a thrust fin 5110 is connected to the foot support 5109 by a connector 5111. In operation, a typical thrust progression is from FIG. 51D (the recovery phase) to 51C to 51B, but FIG. 51B will be described first here. In FIG. 51B, a foot support 5109 comprises load-bearing wheels 5112 and 5113, which may be guided by a linear bearing 5114 and bearing rod 5115 on an SUP 5116. In FIG. 51B, the linear bearing is associated with the front wheel 5112. The thrust fin 5110 with a lever arm 5117, which may be an "L" shaped lever arm, is connected by the lever arm 5117 to the foot support 5109 by the connector 5111. The thrust fin 5110 is also connected to a roller wheel 5118 by a revolute joint 5119, where the roller wheel 5118 is guided by a linear bearing 5123 and the bearing rod 5115, and it is not directly connected to the foot support 5109. The thrust fin 5110 may comprise a scoop 5120 for re-directing water when the thrust fin 5110 moves rearward 5121. The scoop 5120 may also help apply a force from re-directed water to rotate the thrust fin counterclockwise to vertical, as well as translate the thrust fin 5110 forward relative to the foot support 5109, since the scoop 5120 is positioned below the revolute joint 5119 of the roller wheel 5118.

FIG. 51C is a side view of a useful embodiment of the foot support of FIG. 51B, where due to pressure from the water, the thrust fin 5110 has been rotated to nearly vertical and translated forward relative to the foot support 5109 when the foot support is pushed rearward during the thrust phase by the rider. In this view, the roller wheel 5118' is positioned farther to the left than the roller wheel 5118 shown in FIG. 51B.

FIG. 51D is a side view of a useful embodiment of the foot support of FIG. 51B, where due to pressure from the water, the thrust fin 5110 has been rotated to nearly horizontal and out of the water and translated rearward relative to the foot support 5109 when the foot support is pushed forward 5122 during the recovery phase by the rider. In this view, the roller wheel 5118" is positioned farther to the left than the roller wheel 5118 shown in FIG. 51B and the roller wheel 5118' in FIG. 51C.

Figure 51E:
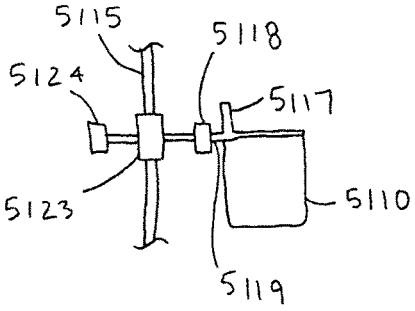
FIG. 51E is a plan view of a useful embodiment of the foot support of FIG. 51B, where the roller wheels are guided by a linear bearing.

FIG. 51E is a plan view of a useful embodiment of the foot support of FIG. 51B, where the roller wheels 5118 and 5124 are guided by the linear bearing 5123 and the bearing rod 5115. The thrust fin 5110 is connected to the revolute joint 5119 of the roller wheel 5118. The thrust fin 5110 is shown with a lever arm 5117, such as the lever arm described in detail in preceding figures, however additional features are omitted in this figure for clarity.

Figure 51F:
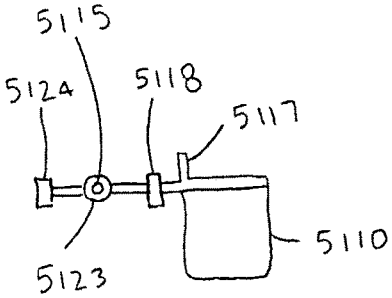
FIG. 51F is a rear end view of a useful embodiment of the foot support of FIG. 51B.

FIG. 51F is a rear end view of a useful embodiment of the foot support of FIG. 51B, where the roller wheels 5118 and 5124 are guided by the linear bearing 5123 and the bearing rod 5115. The thrust fin 5110 is connected to the revolute joint 5119 of the roller wheel 5118. The thrust fin 5110 is shown with a lever arm 5117, such as the lever arm described in detail in preceding figures, however additional features are omitted in this figure for clarity.

Figure 51G:
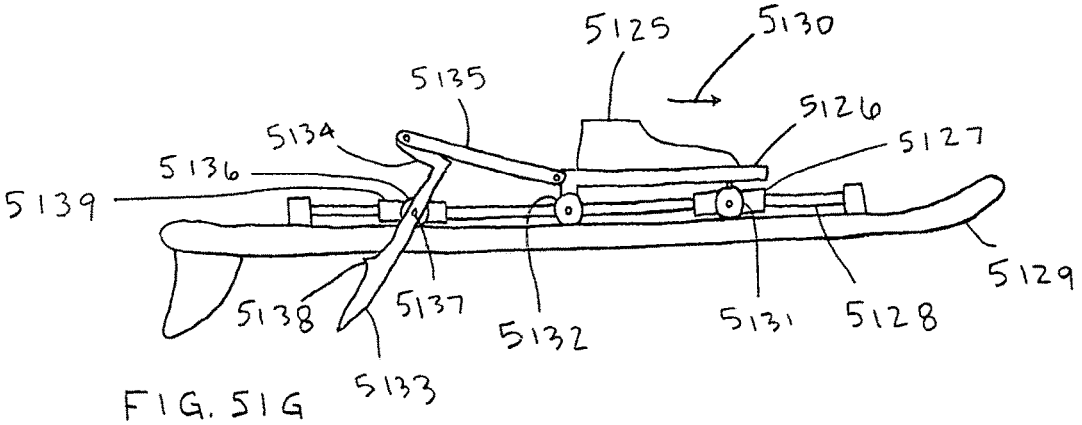
FIG. 51G is a side view of a useful embodiment of a foot holder and a foot support guided by a linear bearing.

FIG. 51G is a side view of a useful embodiment of a foot holder 5125 and a foot support 5126 guided by a linear bearing 5127 and a bearing rod 5128 on an SUP 5129. During the recovery phase, the rider is moving the foot support forward 5130. The foot support 5126 may comprise support wheels 5131 and 5132. The linear bearing 5127 may be associated with the front wheel 5131. The thrust fin 5133 with a lever arm 5134, which may be an "L" shaped lever arm, is connected by the lever arm 5134 to the foot support 5126 by the connector 5135. The thrust fin 5133 is also connected to a roller wheel 5136 by a revolute joint 5137, where the roller wheel 5136 is guided by the linear bearing 5139 and the bearing rod 5128, and it is not directly connected to the foot support 5126. During the recovery phase, the thrust fin 5133 is rotated clockwise from vertical by the connector 5135 pulling on the lever arm 5134. The thrust fin 5133 may comprise a scoop 5138 for re-directing water when the thrust fin 5133 moves rearward during the thrust phase. The scoop 5138 may also help apply a force from re-directed water to rotate the thrust fin 5133 counter-clockwise to vertical during the thrust phase, as well as translate the thrust fin 5133 forward relative to the foot support 5126, since the scoop 5138 is positioned below the revolute joint 5137 of the roller wheel 5136.

Figure 51H:
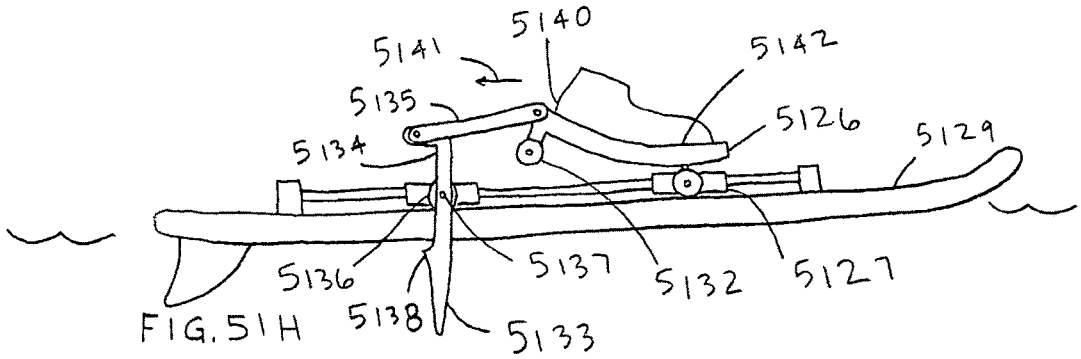
FIG. 51H is a side view of the useful embodiment of FIG. 51G during the thrust phase.

FIG. 51H is a side view of the useful embodiment of FIG. 51G during the thrust phase. During the thrust phase, the rider typically lifts their heel 5140 and applies rearward 5141 force from the front portion 5142 of their foot, similar to how a Nordic snow skier propels themselves on Nordic snow skis. During the thrust phase, the rear wheel 5132 may lift off the SUP 5129. During the thrust phase, the rider is moving the foot support rearward 5141, and the thrust fin 5133 is rotated counterclockwise to vertical by the connector 5135 pushing on the lever arm 5134. The scoop 5138 may also help apply a force from re-directed water to rotate the thrust fin 5133 counterclockwise to vertical during the thrust phase, as well as translate the thrust fin 5133 to the right relative to the foot support 5126, since the scoop 5138 is positioned below the revolute joint 5137 of the roller wheel 5136.

Figure 51I:
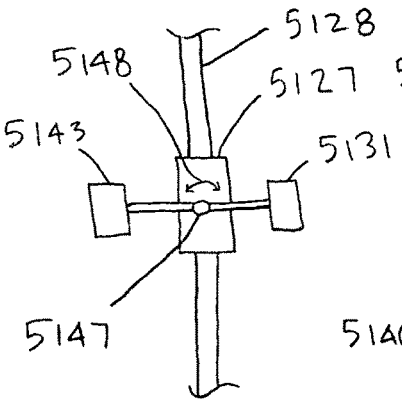
FIGS. 51I-51J are plan views of useful embodiments of the foot support of FIGS. 51G and 51H.

FIG. 51I is a plan view of a useful embodiment of the foot support 5126 of FIGS. 51G and 51H. The foot support is guided by the linear bearing 5127 and the bearing rod 5128 on an SUP. The linear bearing 5127 may be associated with the front support wheels 5131 and 5143. The front support wheels 5131 and 5143 may swivel 5148 around the linear bearing 5127 by the revolute joint 5147.

Figure 51J:
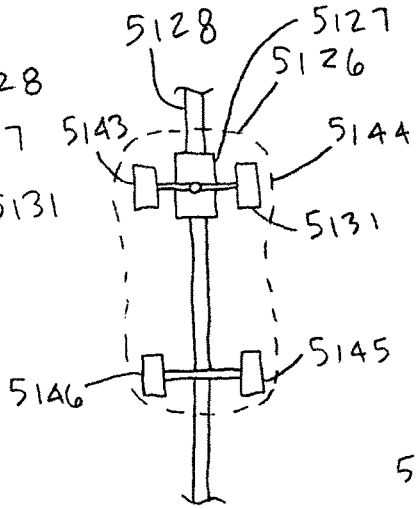

FIG. 51J is a plan view of a useful embodiment of the foot support 5126 of FIGS. 51G and 51H, where the foot support 5126 may comprise a roller skate shoe comprising the front support wheels 5131 and 5143 of FIG. 51I. The foot support 5126 is outlined by a dashed line 5144. The foot support 5126 is guided by the linear bearing 5127 and the bearing rod 5128 on an SUP. The foot support 5126 may also comprise the rear support wheels 5145 and 5146.

Figure 51K:
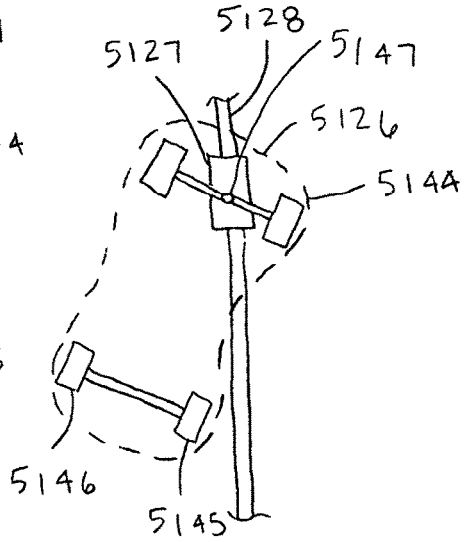
FIG. 51K is a plan view of a useful embodiment of the foot support of FIG. 51J.

FIG. 51K is a plan view of a useful embodiment of the foot support 5126 of FIG. 51J, where the foot support 5126 is swiveled clockwise about the revolute joint 5147. The foot support 5126 is outlined by a dashed line 5144. The foot support 5126 is guided by the linear bearing 5127 and the bearing rod 5128 on an SUP. The foot support 5126 may also comprise the rear support wheels 5145 and 5146.

Figure 52A:
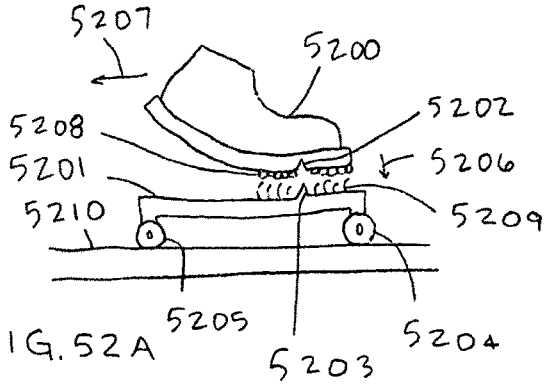
FIGS. 52A-52B and 52D are side views of useful embodiments of foot holders and foot supports.

FIG. 52A is a side view of a useful embodiment of a foot holder 5200 and a foot support 5201, where the foot holder 5200 comprises a socket 5202 that mates 5206 with a protrusion 5203 on the foot support 5201. The mating socket 5202 and protrusion 5203 can transmit tangential force 5207 from the foot holder 5200 to the foot support 5201, but yet the foot holder 5200 and foot support 5201 may be easily separated. The mating socket 5202 and protrusion 5203 may lightly snap together or use cotton Velcro 5208 and hook Velcro 5209. The foot support 5201 may comprise roller wheels 5204 and 5205 that roll on an SUP 5210.

Figure 52B:
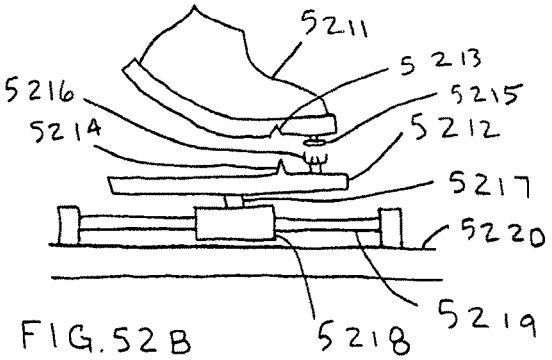

FIG. 52B is a side view of a useful embodiment of a foot holder 5211 and a foot support 5212, where the foot holder 5211 comprises a socket 5213 that mates with a protrusion 5214 on the foot support 5212. The mating socket 5213 and protrusion 5214 can transmit tangential force from the foot holder 5211 to the foot support 5212, but yet the foot holder 5211 and foot support 5212 may be easily separated. The mating socket 5213 and protrusion 5214 may lightly snap together or use additional mating snap components 5215 and 5216, which may operate like blue jeans snaps, and are more secure than Velcro. The foot support 5212 may be connected by a connector 5217 to a linear bearing 5218 that rides on a bearing rod 5219 connected to an SUP 5220.

Figure 52C:
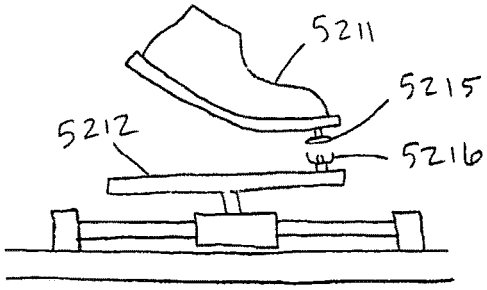
FIG. 52C is a side view of a useful embodiment of the foot holder and the foot support of FIG. 52B.

FIG. 52C is a side view of a useful embodiment of the foot holder 5211 and the foot support 5212 of FIG. 52B, where the mating snap components 5215 and 5216 provide sufficient tangential support so that the socket 5213 and protrusion 5214 of FIG. 52B aren't needed.

Figure 52D:
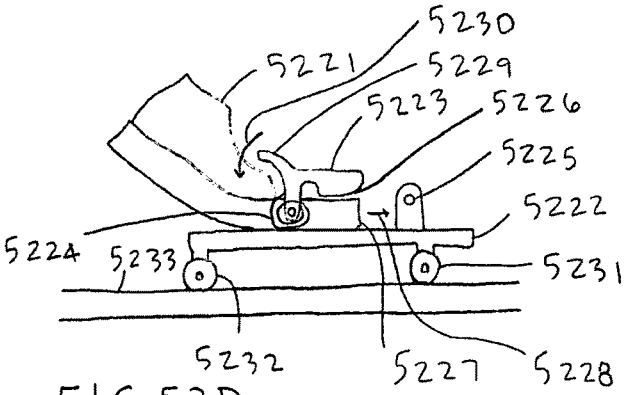

FIG. 52D is a side view of a useful embodiment of a foot holder 5221 and a foot support 5222, where the foot holder 5221 comprises a clasp 5223 with a return spring 5224 that mates with a pin 5225 on the foot support 5222. The front of the clasp 5223 may be curved 5226 to slide over the pin 5225 on the foot support 5222 when the front end 5227 of the foot holder 5221 slides forward 5228 under the pin 5225. The clasp 5223 and pin 5225 can transmit tangential force from the foot holder 5221 to the foot support 5222, but yet the foot holder 5221 and foot support 5222 may be easily separated by pressing down on the clasp lever 5229 to rotate it counterclockwise 5230 against the return force of the return spring 5224. The foot support 5222 may comprise roller wheels 5231 and 5232 that roll on an SUP 5233.

Figure 52E:
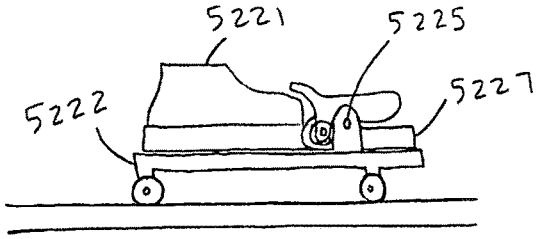
FIG. 52E is a side view of a useful embodiment of the foot holder and the foot support of FIG. 52D.

FIG. 52E is a side view of a useful embodiment of the foot holder 5221 and the foot support 5222 of FIG. 52D, where the front end 5227 of the foot holder 5221 has slid forward under the pin 5225 of the foot support 5222, securing the foot holder 5221 to the foot support 5222.

FIGS. 52F-52O provide useful embodiments of various thrust assemblies and components where a thrust fin automatically rotates into the water to provide thrust against the water during the thrust phase where the rider translates their foot rearward relative to an SUP, and the thrust fin automatically rotates out of the water to minimize drag during the recovery phase where the rider translates their foot forward relative to the SUP.

Figure 52F:
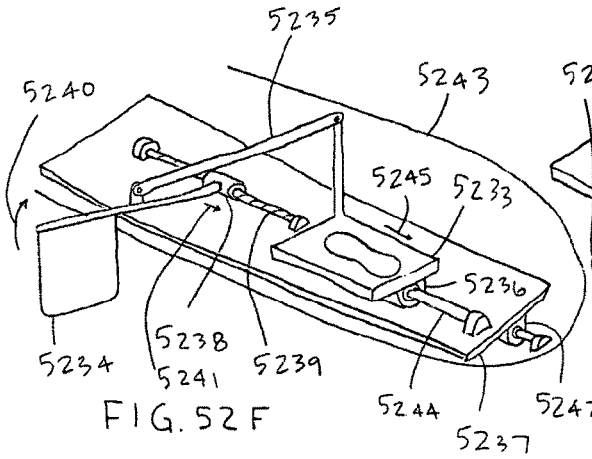
FIGS. 52F-52O provide useful embodiments of various thrust assemblies and components where a thrust fin automatically rotates into the water.

FIG. 52F is a perspective view of a useful embodiment of another thrust assembly, where a foot support 5233 is connected to a thrust fin 5234 by a connector 5235. The foot support may be guided by a linear bearing 5236 with bearing rod 5244 attached to a moveable support 5237. The thrust fin 5234 is connected by a lead-screw bearing 5238 to a lead screw 5239 (or a worm screw, or a cork screw threaded rod) that is also attached to the moveable support 5237. When the foot support 5233 moves forward 5245 relative to the moveable support 5237, the connector 5235 pulls the thrust fin 5234 forward 5241, causing the thrust fin 5234 to rotate clockwise 5240 about the lead screw 5239 and rise out of the water as it translates forward 5241 relative to the moveable support 5237. The entire moveable support may move on a linear bearing 5242 and may translate relative to the SUP 5243.

Figure 52G:
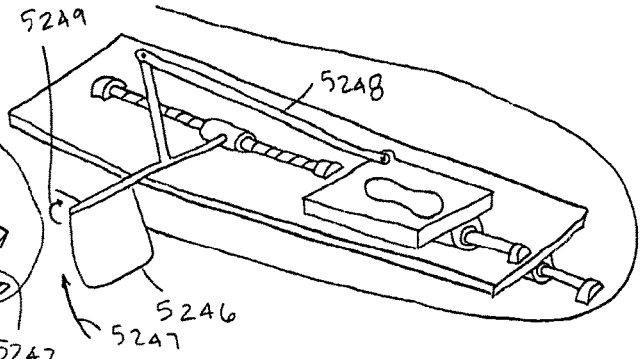

FIG. 52G is a perspective view of a useful embodiment of another thrust assembly similar to FIG. 52F, but where the thrust fin 5246 not only rises up 5247 as it is pulled forward by a connector 5248, but it also rotates clockwise 5249 about its own axis to quickly remove drag of the thrust fin 5246 during the recovery phase.

Figure 52H:
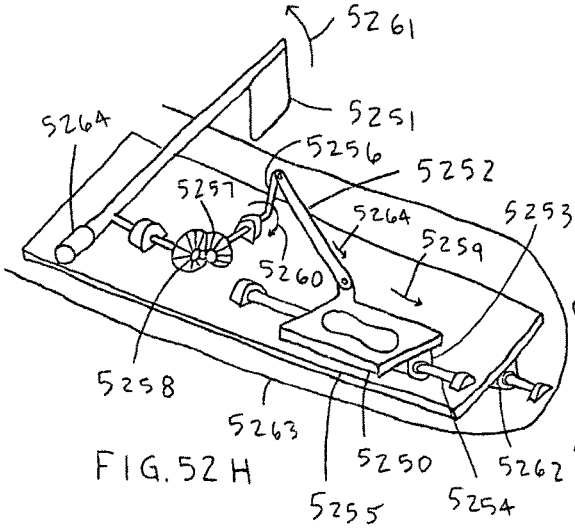

FIG. 52H is a perspective view of a useful embodiment of another thrust assembly, where a foot support 5250 is connected to a thrust fin 5251 by a connector 5252 and a set of beveled gears, which may be right-angled gears or spiraled gears. The foot support 5250 may be guided by a linear bearing 5253 with bearing rod 5254 attached to a moveable support 5255. The connector 5252 connects the foot support 5250 to a lever arm 5256 that turns a first bevel gear 5257. The first bevel gear 5257 meshes with a second bevel gear 5258 that is connected to the thrust fin 5251. When the foot support 5250 moves forward 5259 relative to the moveable support 5255, the connector 5252 pulls 5264 the lever arm 5256 forward 5260, causing the bevel gears 5257 and 5258 to rotate 5261 the thrust fin 5251 out of the water. The entire moveable support 5255 may move on a linear bearing 5262 and may translate relative to the SUP 5263. The shaft of the thrust fin may comprise a counterweight 5264.

Figure 52I:
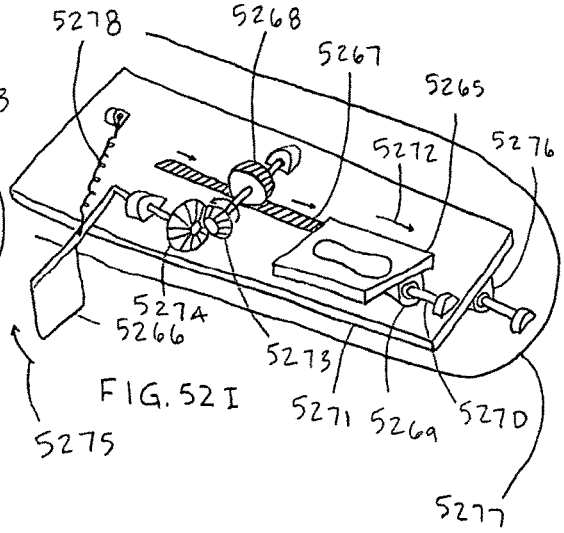

FIG. 52I is a perspective view of a useful embodiment of another thrust assembly, where a foot support 5265 is connected to a thrust fin 5266 by a rack 5267 and pinion gear 5268 connected to a set of beveled gears, which may be right-angled gears or spiraled gears. The foot support 5265 may be guided by a linear bearing 5269 with bearing rod 5270 attached to a moveable support 5271. When the foot support 5265 translates forward 5272 relative to the moveable support 5265, it translates the rack 5267 past the pinion gear 5268 which turns a first bevel gear 5273. The first bevel gear 5273 meshes with a second bevel gear 5274 that is connected to the thrust fin 5266, where the bevel gears 5273 and 5274 rotate 5275 the thrust fin 5266 out of the water. The entire moveable support 5271 may move on a linear bearing 5276 and may translate relative to the SUP 5277. The shaft of the thrust fin 5266 may comprise a spring 5278 to offset weight of the thrust fin 5266.

Figure 52J:
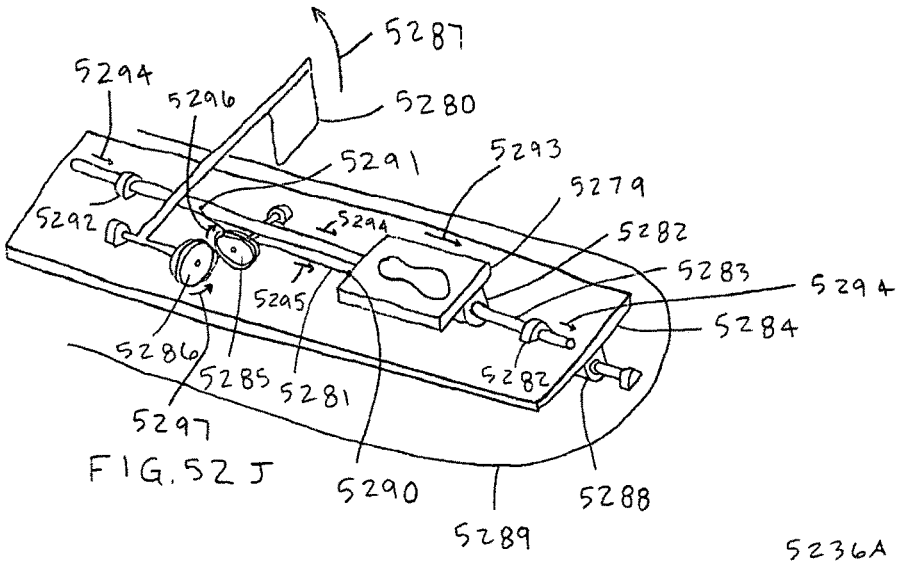

FIG. 52J is a perspective view of a useful embodiment of another thrust assembly, where a foot support 5279 is connected to a thrust fin 5280 by a tendon 5281, which may be wire rope, which passes around and rotates a pair of pulleys that may be at an angle to each other. The foot support 5279 may be attached to a bearing rod 5283 that is guided by linear bearings 5282 and 5292 that are attached to a moveable support 5284. When the foot support 5279 translates forward 5293 relative to the moveable support 5284, it translates 5294 the bearing rod 5283, which translates 5295 the tendon 5281 past the first pulley 5285 which turns 5296 the first pulley 5285. The tendon then passes over a second pulley 5286 that is connected to the thrust fin 5280, where rotation 5297 of the second pulley 5286 rotates 5287 the thrust fin 5280 out of the water. The entire moveable support 5284 may translate on a linear bearing 5288 relative to the SUP 5289. In the figure, the tendon 5281 is shown to start from a point 5290 on the foot support 5279, then pass over the top of the first pulley 5285, then pass under the second pulley 5286 and wrap around to the top, and then pass under the first pulley 5285, and exit over the top of the first pulley 5285 where it connects to the bearing rod 5283 at a point 5291. However, any suitable path around the pulleys 5285 and 5286 for the tendon 5281 will suffice.

Figure 52K:
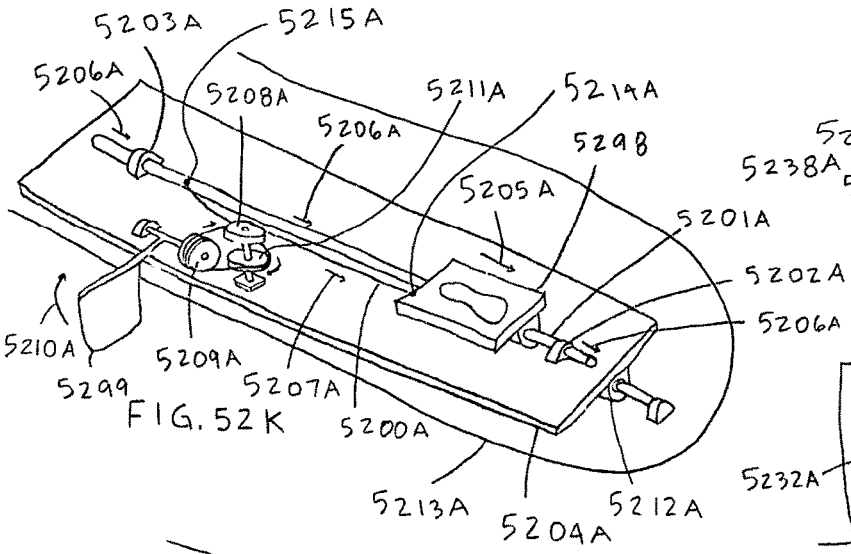

FIG. 52K is a perspective view of a useful embodiment of another thrust assembly that is similar to the thrust assembly of FIG. 52J, but which uses three tendon pulleys to route the tendon and raise/lower a thrust fin. A foot support 5298 is connected to a thrust fin 5299 by a tendon 5200A, which may be wire rope, which passes around and rotates a set of pulleys. The foot support 5298 may be attached to a bearing rod 5201A that is guided by linear bearings 5202A and 5203A that are attached to a moveable support 5204A. When the foot support 5298 translates forward 5205A relative to the moveable support 5204A, it translates 5206A the bearing rod 5201A, which translates 5207A the tendon 5200A past the first pulley 5208A which turns the first pulley 5208A. The tendon 5200A then passes around a second pulley 5209A that is connected to the thrust fin 5299, where rotation of the second pulley 5209A rotates 5210A the thrust fin 5299 out of the water. The tendon then passes around a third pulley 5211A and is attached to the bearing rod 5201A. The entire moveable support 5204A may translate on a linear bearing 5212A relative to the SUP 5213A. In the figure, the tendon 5200A is shown to start from a point 5214A on the foot support 5298, then pass behind the first pulley 5208A, then pass 1.5 times around the second pulley 5209A exiting from the bottom, and then pass around the right of the third pulley 5211A, and exit from the rear left of the third pulley 5211A where it then connects to the bearing rod 5201A at a point 5215A. However, any suitable path around the pulleys 5208A, 5209A, and 5211A for the tendon 5200A will suffice.

Figure 52O:
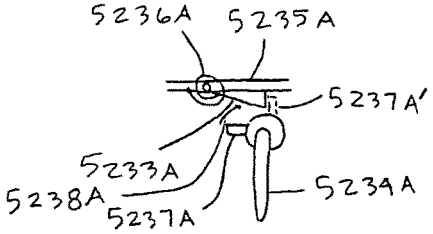
Figure 52N:
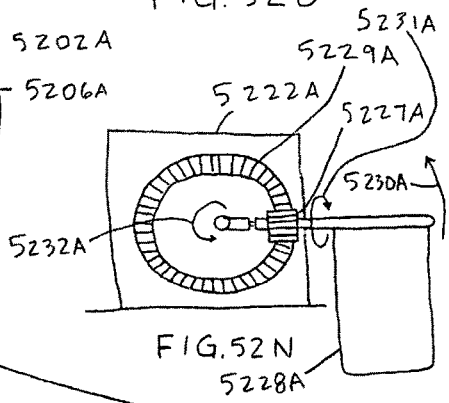
Figure 52L:
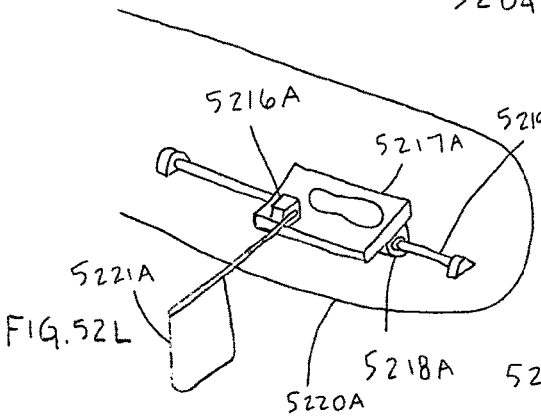

FIG. 52L is a perspective view of a useful embodiment of another thrust assembly which comprises a microprocessor, an accelerometer, a battery, computer memory, a computer program, and a motor 5216A. A foot support 5217A may be guided by a linear bearing 5218A with bearing rod 5219A attached to an SUP 5220A. When forward acceleration of the foot support 5217A is sensed, the motor lifts the thrust fin 5221A from the water and rotates it, and when rearward acceleration of the foot support is sensed, the motor rotates the thrust fin and lowers it into the water.

Figure 52M:
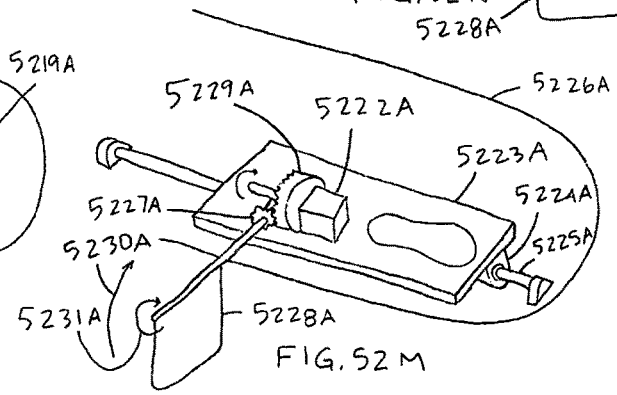

FIG. 52M is a perspective view of a useful embodiment of another thrust assembly which comprises a module 5222A comprising a microprocessor, an accelerometer, a battery, computer memory, a computer program, and a motor. A foot support 5223A may be guided by a linear bearing 5224A with bearing rod 5225A attached to an SUP 5226A. A moveable gear 5227A is attached to the thrust fin 5228A and meshes with a stationary gear 5229A which may be attached to the module 5222A. When forward acceleration of the foot support 5223A is sensed, the motor moves the moveable gear 5227A relative to the stationary gear 5229A, and the thrust fin 5228A simultaneously rises 5230A from the water and rotates 5231A about its own axis. When rearward acceleration of the foot support 5223A is sensed, the motor moves the moveable gear 5227A in the opposite direction relative to the stationary gear 5229A, and the thrust fin 5228A simultaneously lowers into the water and rotates about its own axis.

FIG. 52N is an end view of the useful embodiment of FIG. 52M which comprises a module 5222A comprising a microprocessor, an accelerometer, a battery, computer memory, a computer program, and a motor. The moveable gear 5227A is attached to the thrust fin 5228A and meshes with a stationary gear 5229A which may be attached to the module 5222A. When forward acceleration of the foot support is sensed, the motor moves the moveable gear 5227A counterclockwise 5232A relative to the stationary gear 5229A, and the thrust fin 5228A simultaneously rises 5230A from the water and rotates 5231A about its own axis. When rearward acceleration of the foot support is sensed, the motor moves the moveable gear 5227A in the opposite direction relative to the stationary gear 5229A, and the thrust fin 5228A simultaneously lowers into the water and rotates about its own axis.

FIG. 52O is a side view of a useful embodiment of a thrust fin assembly comprising a detent 5233A for holding a thrust fin 5234A in a desired orientation. A detent support 5235A comprises the detent 5233A with return spring 5236A. The thrust fin 5234A comprises a catch 5237A that when the thrust fin 5234A is rotated 5238A, the catch 5237A depresses the detent 5233A. When the catch 5237A passes past the detent 5233A and moves to a second position 5237A', the return spring 5236A un-depresses the detent 5233A. The catch 5237A then rests against the detent 5233A, and prevents the thrust fin 5234A from rotating back to its original orientation until the catch 5237A is released by depressing the detent 5233A.

Figure 53A:
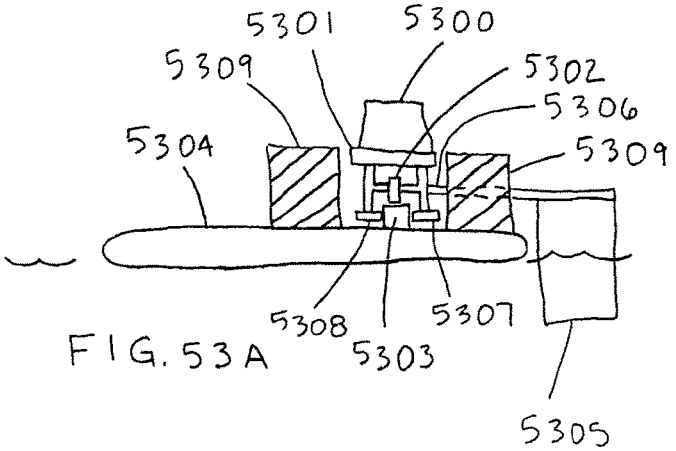
FIG. 53A is a rear end view of a useful embodiment of another thrust assembly, where a foot holder is mated with a foot support.

FIG. 53A is a rear end view of a useful embodiment of another thrust assembly, where a foot holder 5300 is mated with a foot support 5301. There are typically a left and a right foot support which operate similarly, so only the right foot support 5301 will be describe here. The foot support 5301 comprises at least a load-bearing wheel 5302, which may be guided by the guide 5303 connected to an SUP 5304. The guide 5303 may be a track or rail. A thrust fin 5305 is connected to a roller wheel or the foot support 5301 by a revolute joint 5306. The foot support 5301 also comprises guide wheels 5307 and 5308 with vertical axes, which may be guided by the guide 5303. Foam 5309, such as neoprene, may be placed around the guide 5303 and other apparatus to protect the rider in the case they fall.

Figure 53B:
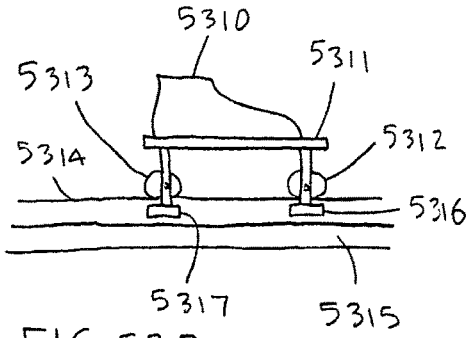
FIG. 53B is a side view of a useful embodiment of another thrust assembly, where a foot holder is mated with a foot support.

FIG. 53B is a side view of a useful embodiment of another thrust assembly, where a foot holder 5310 is mated with a foot support 5311. The foot support 5311 comprises the load-bearing wheels 5312 and 5313, which may be guided by the guide 5314 connected to an SUP 5315. The guide 5314 may comprise a track or rail. The foot support 5311 also comprises guide wheels 5316 and 5317 with vertical axes, which may be guided by the guide 5314.

Figure 53C:
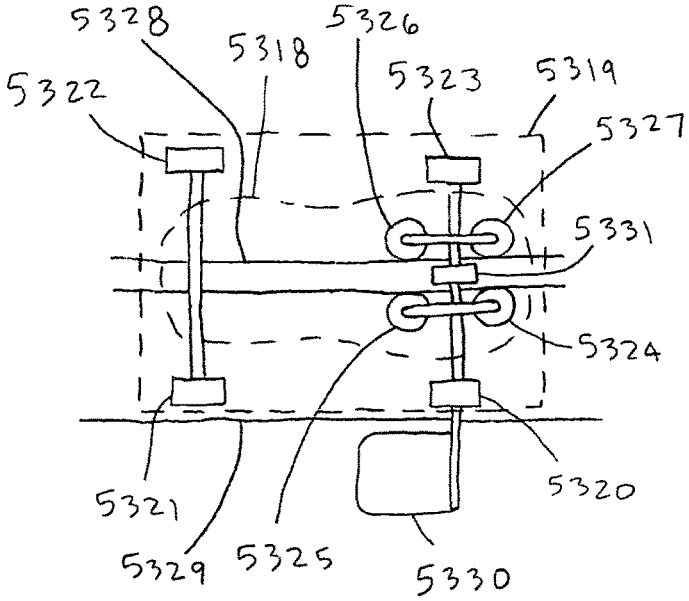
FIG. 53C is a plan view of a useful embodiment of another thrust assembly, where a foot rests on a foot support.

FIG. 53C is a plan view of a useful embodiment of another thrust assembly, where a foot 5318 rests on a foot support 5319, each indicated with dashed outlines. The foot support 5319 comprises the load-bearing wheels 5320, 5321, 5322, and 5323. The foot support 5319 also comprises the guide wheels 5324, 5325, 5326, and 5327 with vertical axes, which may be guided by the guide 5328 connected to an SUP 5329. The guide 5328 may comprise a track or rail. A thrust fin 5330 may be connected to a roller wheel 5331, a load-bearing wheel 5320, or the foot support 5319.

Figure 53D:
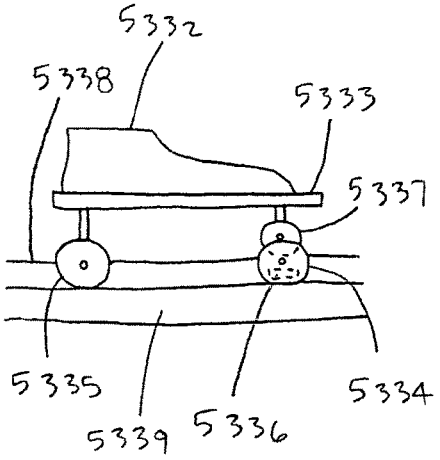
FIG. 53D is a side view of a useful embodiment of another thrust assembly, where a foot holder rests on a foot support.

FIG. 53D is a side view of a useful embodiment of another thrust assembly, where a foot holder 5332 rests on a foot support 5333. The foot support 5333 comprises the load-bearing wheels 5334 and 5335. The foot support 5333 also comprises the guide wheels 5336 and 5337, where guide wheel 5336 comprises a vertical axis. The guide wheels 5336 and 5337 may be guided by the guide 5338 connected to an SUP 5339. The guide 5338 may comprise a track or rail.

Figure 53E:
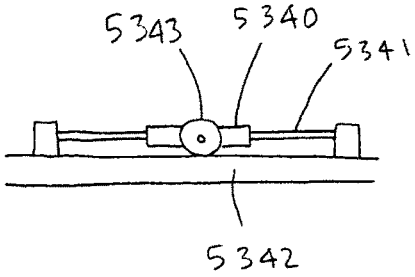

FIG. 53E is a side view of a useful embodiment of a portion of a thrust assembly guided by a linear bearing 5340 and a bearing rod 5341 connected to an SUP 5342. The linear bearing 5340 may be connected to a wheel 5343.

Figure 53F:
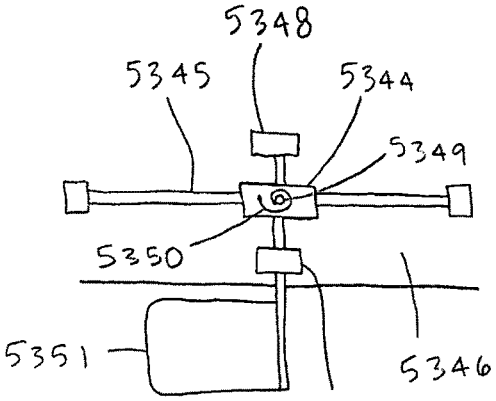

FIG. 53F is a plan view of a useful embodiment of a portion of a thrust assembly guided by a linear bearing 5344 and a bearing rod 5345 on an SUP 5346. The linear bearing 5344 may be connected to the wheels 5347 and 5348. The wheels 5347 and 5348 may swivel around the linear bearing 5344 by the revolute joint 5349, and may comprise a return spring 5350. The return sprint 5350 encourages the wheels 5347 and 5348 to remain centered, but allows them to rotate about the revolute joint 5349 if twisted by the rider to assist with turning the SUP 5346. A thrust fin 5351 may be connected to the axle of a wheel, such as the wheel 5347, or to the linear bearing 5344.

Figure 53G:
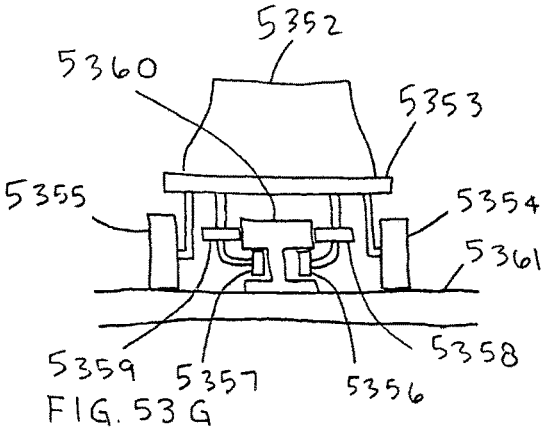
FIGS. 53G-53H are rear end views of useful embodiments of other thrust assemblies, where foot holders are mated with foot supports.

FIG. 53G is a rear end view of a useful embodiment of another thrust assembly, where a foot holder 5352 is mated with a foot support 5353. The foot support 5353 comprises the load-bearing wheels 5354 and 5355. The foot support 5353 also comprises the guide wheels 5356 and 5357 with horizontal axes, and comprises the guide wheels 5358 and 5359 with vertical axes. The guide wheels 5356, 5357, 5378, and 5359 may be guided by the guide 5360 connected to an SUP 5361. The guide 5360 may comprise a track or rail.

Figure 53H:
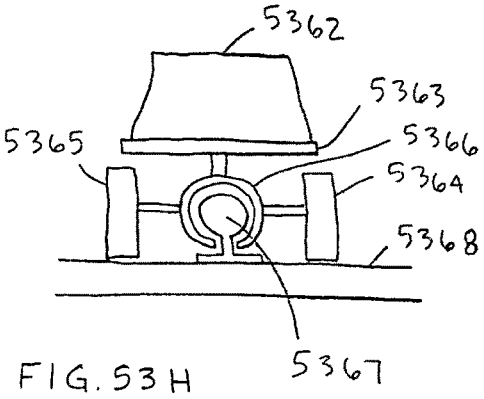

FIG. 53H is a rear end view of a useful embodiment of another thrust assembly, where a foot holder 5362 is mated with a foot support 5363. The foot support 5363 comprises the load-bearing wheels 5364 and 5365. The foot support 5363 also comprises the linear bearing 5366. The load bearing 5366 may be guided by the bearing rod 5367 connected to an SUP 5368.

Figure 53I:
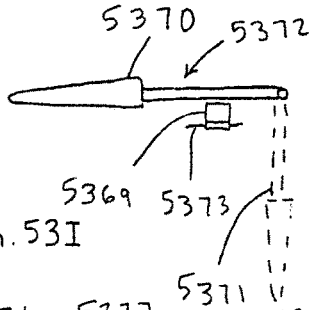
FIG. 53I is a side view of a useful embodiment of a thrust fin assembly comprising a detent.

FIG. 53I is a side view of a useful embodiment of a thrust fin assembly comprising a detent 5369 for holding a thrust fin 5370 in a desired orientation, such as rotated up out of the water. When the thrust fin 5370 is rotated from a first position 5371 to a second position 5372, it depresses the detent 5369 which rotates (into the page as shown) about the detent axis 5373. The thrust fin 5370 then passes past the detent 5369 and moves to the second position 5372 and is supported there by the detent 5369 that has un-depressed. The detent 5369 prevents the thrust fin 5370 from rotating back to its original first position 5371 until the thrust fin 5370 is released from the detent 5369 by depressing the detent 5369.

Figure 53J:
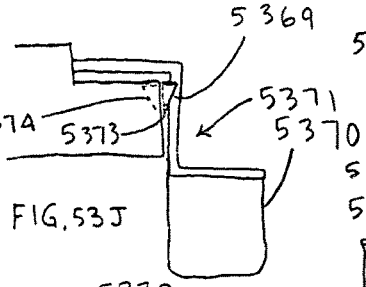
FIG. 53J is a side view of a useful embodiment of the thrust fin assembly of FIG. 53I.

FIG. 53J is a side view of a useful embodiment of the thrust fin assembly of FIG. 53I comprising the detent 5369 for holding the thrust fin 5370 in a desired orientation, such as rotated up out of the water. When the thrust fin 5370 is rotated from a first position 5371 to a second position, it depresses the detent 5369 which rotates (counterclockwise as shown to the dashed position 5374) about the detent axis 5373. The thrust fin 5370 then passes past the detent 5369 and moves to the second position and is supported there by the detent 5369 that has un-depressed. The detent 5369 prevents the thrust fin 5370 from rotating back to its original first position 5371 until the thrust fin 5370 is released from the detent 5369 by depressing the detent 5369.

Figure 53M:
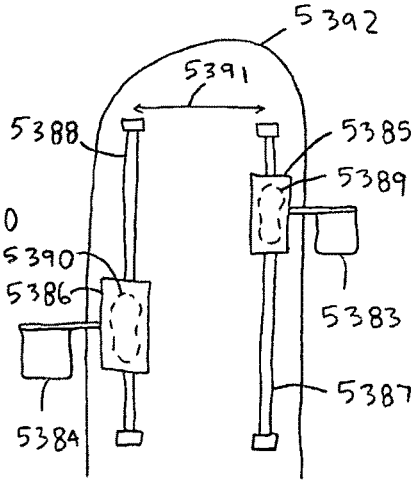
FIG. 53M is a plan view of a useful embodiment of another thrust assembly which may comprise any of the useful embodiments of FIGS. 53A-53L.
Figure 53K:
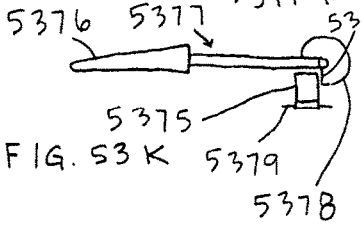
FIG. 53K is a side view of a useful embodiment of a thrust fin assembly comprising a detent.

FIG. 53K is a side view of a useful embodiment of a thrust fin assembly comprising a detent 5375 for holding a thrust fin 5376 in a desired orientation, such as rotated up out of the water. When the thrust fin 5376 is rotated from a first position to a second position 5377, the cam 5378 that is attached to the thrust fin 5376 depresses the detent 5375 which rotates (into the page as shown) about the detent axis 5379. The thrust fin 5376 then passes past the detent 5375 and moves to the second position 5377 and is supported there by a flat 5380 on the cam 5378 resting against the detent 5375 that has un-depressed. The detent 5375 prevents the thrust fin 5376 from rotating back to its original first position until the thrust fin 5376 is released from the detent 5375 by depressing the detent 5375.

Figure 53L:
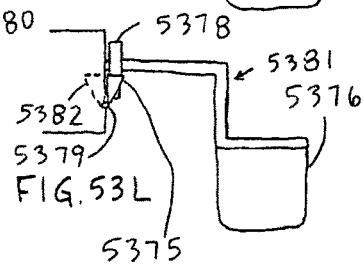
FIG. 53L is a side view of a useful embodiment of the thrust fin assembly of FIG. 53K.

FIG. 53L is a side view of a useful embodiment of the thrust fin assembly of FIG. 53K comprising the detent 5375 for holding the thrust fin 5376 in a desired orientation, such as rotated up out of the water. When the thrust fin 5376 is rotated from a first position 5381 to a second position, the cam 5378 that is attached to the thrust fin 5376 depresses the detent 5375 which rotates (counterclockwise as shown to the dashed position 5382) about the detent axis 5379. The thrust fin 5376 then passes past the detent 5375 and moves to the second position and is supported there by a flat on the cam 5378 resting against the detent 5375 that has un-depressed. The detent 5375 prevents the thrust fin 5376 from rotating back to its original first position until the thrust fin 5376 is released from the detent 5375 by depressing the detent 5375.

FIG. 53M is a plan view of a useful embodiment of another thrust assembly which may comprise any of the useful embodiments of FIGS. 53A-53L, where thrust fins 5383 and 5384 rotate relative to foot supports 5385 and 5386 guided by linear bearings with bearing rods 5387 and 5388. Outlines 5389 and 5390 show where a rider typically places their feet on the foot supports 5385 and 5386. The width 5391 of the placement of the bearing rods 5387 and 5388 on the SUP 5392 may be adjusted by the rider. The foot supports 5385 and 5386 may be compatible with Nordic (a.k.a. cross-country) snow ski bindings and shoes.

Figure 54A:
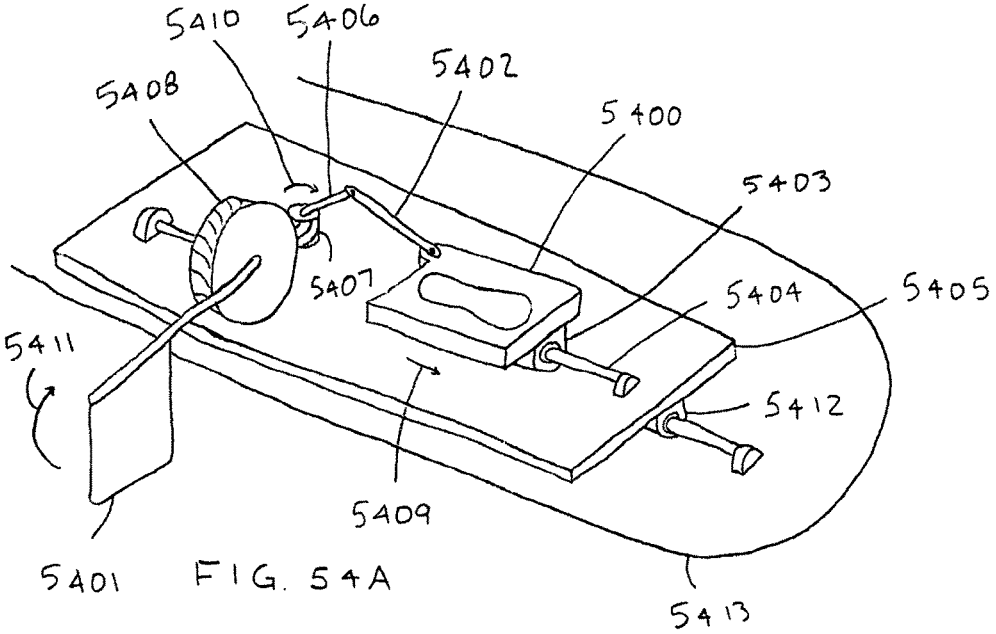
FIG. 54A is a perspective view of a useful embodiment of another thrust assembly, where a foot support is connected to a thrust fin.

FIG. 54A is a perspective view of a useful embodiment of another thrust assembly, where a foot support 5400 is connected to a thrust fin 5401 by a connector 5402 and a set of meshing gears, which may be spiraled gears. The foot support 5400 may be guided by a linear bearing 5403 with bearing rod 5404 attached to a moveable support 5405. The connector 5402 connects the foot support 5400 to a lever arm 5406 that turns a first gear 5407. The first gear 5407 meshes with a second gear 5408 that is connected to the thrust fin 5401. When the foot support 5400 moves forward 5409 relative to the moveable support 5405, the connector 5402 pulls the lever arm 5406 clockwise 5410, causing the meshing gears 5407 and 5408 to rotate 5411 the thrust fin 5401 out of the water. The entire moveable support 5405 may move on a linear bearing 5412 and may translate relative to the SUP 5413. In operation, when the first gear 5047 rotates 90 degrees, the thrust fin 5401 may rotate up 45 degrees.

Figure 54B:
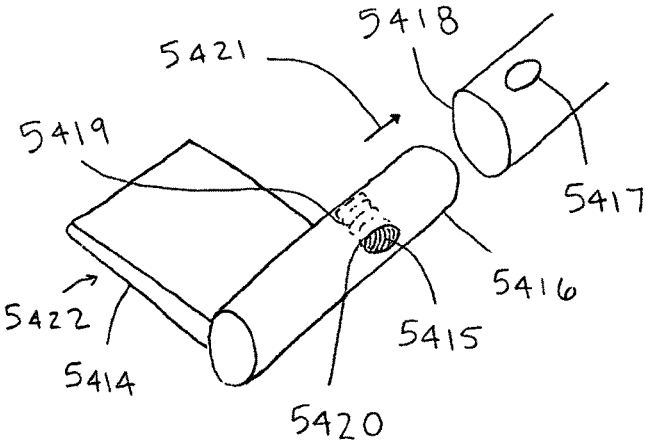
FIG. 54B is a perspective view of a useful embodiment of a thrust fin assembly comprising a detent.

FIG. 54B is a perspective view of a useful embodiment of a thrust fin assembly comprising a detent for holding a thrust fin 5414 in a desired orientation, such as rotated out of the water. The detent comprises a plunger 5415 in the fin arm 5416, which may include a cylinder or ball, and comprises an opening 5417 in a retaining sleeve 5418 into which the plunger may extend and lodge. The fin arm 5416 comprises a cavity comprising the plunger 5415 that is pressed by a spring 5419 to extend outward from an opening 5420 in the fin arm 5416. The fin arm 5416 is inserted 5421 into the retaining sleeve 5418. The retaining sleeve 5418 may be attached to a foot support, such as the foot support 5400 in FIG. 54A, or may be attached to an apparatus connected to the foot support 5400, such as the second gear 5408 in FIG. 54A. When the thrust fin 5414 is rotated from a first position 5422 to a second position, the plunger 5415 is pressed against the inside of the retaining sleeve 5418 by the spring 5419 as it slides along the inside of the retainer sleeve 5418 until the plunger 5415 extends and lodges into the opening 5417 in the receiver sleeve 5418, and holds the fin arm 5416 in an orientation relative to the retainer sleeve 5418. The detent prevents the thrust fin 5414 from rotating back to its original first position 5422 until the fin arm 5416 is released from the detent by depressing the plunger 5415.

Figure 54C:
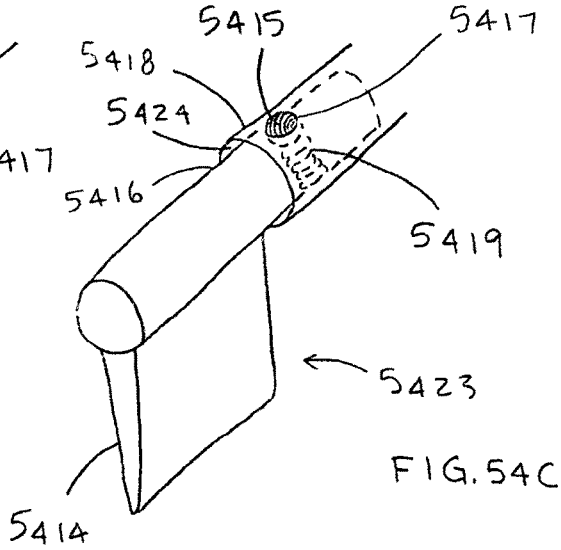
FIG. 54C is a perspective view of the useful embodiment of the thrust fin assembly of FIG. 54B.

FIG. 54C is a perspective view of the useful embodiment of the thrust fin assembly of FIG. 54B comprising a detent for holding the thrust fin 5414 in a desired orientation. When the thrust fin 5414 is rotated from a first position to a second position 5423, the plunger 5415 is pressed against the inside wall 5424 of the retaining sleeve 5418 by the spring 5419 as it slides along the inside wall 5424 of the retainer sleeve 5418 until the plunger 5415 extends and lodges into the opening 5417 in the receiver sleeve 5418, and holds the fin arm 5416 in an orientation relative to the retainer sleeve 5418. The detent prevents the thrust fin 5414 from rotating back to its original first position until the fin arm 5416 is released from the detent by depressing the plunger 5415.

Figure 54D:
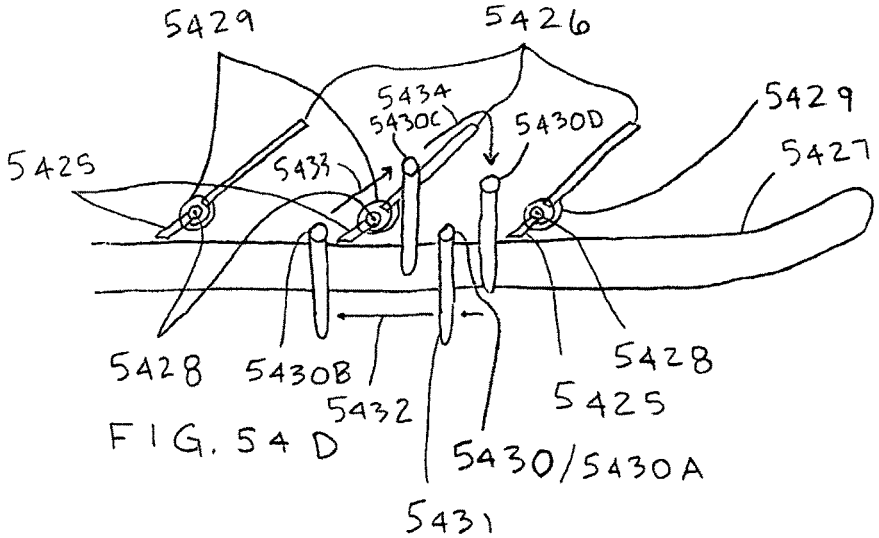
FIG. 54D is a side view of a useful embodiment of another thrust assembly comprising spring-loaded one-way flaps.

FIG. 54D is a side view of a useful embodiment of another thrust assembly comprising spring-loaded one-way flaps 5425 and associated stationary inclined surfaces 5426. The inclined surfaces 5426 are attached to an SUP 5427, and the flaps 5425 are rotationally attached to the inclined surfaces by revolute joints 5428 and comprise return springs 5429. A thrust paddle arm 5430 of a thrust paddle 5431 is typically connected directly or by other apparatus to a foot support (not shown) such that movement of the foot support by the SUP rider translates the thrust paddle 5431. Below, postfixes A, B, C, and D are used to represent the thrust paddle arm 5430 at different locations. The flaps only allow the thrust paddle arm 5430 of the thrust paddle 5431 to translate rearward (i.e., to the left in the FIG. 5432 through the flaps 5425, and they don't permit the thrust paddle arm 5430 to return forward (i.e., to the right in the figure) through the flaps 5425. That is, the flaps 5425 will rotate clockwise (in the figure) about their revolute joints 5428 against the force of the springs 5429 when the thrust paddle arm 5430A presses against them from the right side in the figure. When a thrust paddle arm 5430B is translated forward relative to the SUP 5427, the flaps 5425 remain pressed down against the SUP 5427, and they redirect the thrust paddle arm 5430C up along 5433 one of the inclined surfaces 5426 in order to raise the thrust paddle 5431 out of the water. After passing over the peak edge 5434 of an inclined surface 5426, the thrust paddle arm 5430D will then drop back down to the surface of the SUP 5427. Multiple flaps 5425 with inclined surfaces 5426 may be used simultaneously, so when the thrust paddle 5431 is at almost any location along the SUP 5427, if it is translated forward, there is a flap 5425 and inclined surface 5426 nearby to direct the thrust paddle arm 5430 up.

Figure 54E:
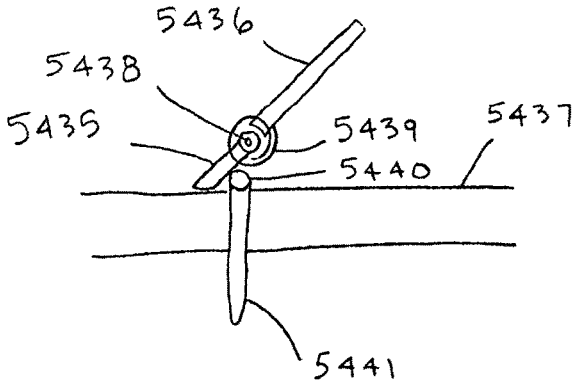
FIG. 54E is a side view of a useful embodiment of the thrust assembly of FIG. 54D comprising a spring-loaded one-way flap.

FIG. 54E is a side view of a useful embodiment of the thrust assembly of FIG. 54D comprising a spring-loaded one-way flap 5435 and associated stationary inclined surface 5436. The inclined surface 5436 is attached to an SUP 5437, and the flap 5435 is rotationally attached to the inclined surface by a revolute joint 5438 and comprises a return spring 5439. A thrust paddle arm 5440 of a thrust paddle 5441 is typically connected directly or by other apparatus to a foot support (not shown) such that movement of the foot support by the SUP rider translates the thrust paddle 5441. The flap only allow the thrust paddle arm 5440 of the thrust paddle 5441 to translate rearward (i.e., to the left in the figure) through the flap 5435, and the flap 5435 doesn't permit the thrust paddle arm 5440 to return forward (i.e., to the right in the figure) through the flap 5435. That is, the flap 5435 will rotate clockwise (in the figure) about its revolute joint 5438 against the force of the spring 5439 when the thrust paddle arm 5440 presses against it from the right side in the figure.

Figure 54F:
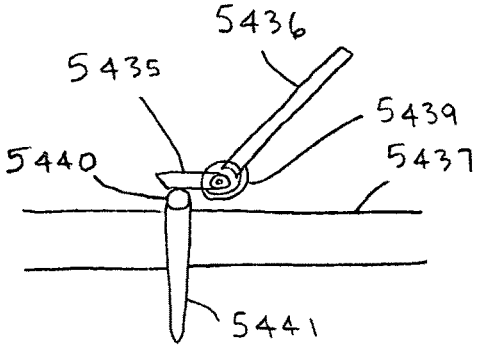
FIG. 54F is a side view of the useful embodiment of the thrust assembly of FIG. 54E comprising a spring-loaded one-way flap.

FIG. 54F is a side view of the useful embodiment of the thrust assembly of FIG. 54E comprising a spring-loaded one-way flap 5435 and associated stationary inclined surface 5436. In this figure, the thrust paddle arm 5440 with thrust paddle 5441 is shown passing rearward (i.e., to the left in the figure) underneath the flap 5435 while compressing the spring 5439 as the flap 5435 is rotated counterclockwise by the thrust paddle arm 5440.

Figure 54G:
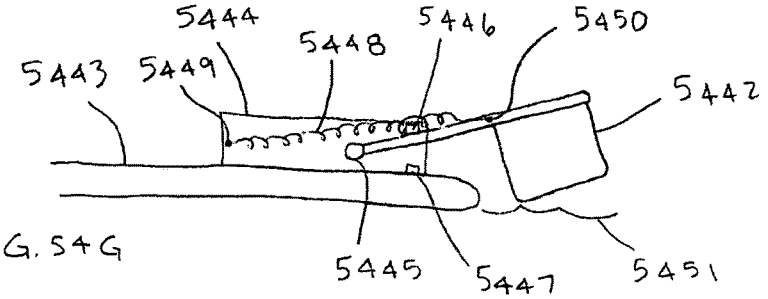
FIG. 54G is a side view of a useful embodiment of another thrust assembly, where a thrust paddle for an SUP is stable in either of two positions.

FIG. 54G is a side view of a useful embodiment of another thrust assembly, where a thrust paddle 5442 for an SUP 5443 is stable in either of two positions. The thrust paddle 5442 is attached to a foot support 5444 by a revolute joint 5445. The foot support 5444 comprises a first 5446 and a second 5447 limit stop. The foot support 5444 also comprises a spring 5448, where the spring 5448 is attached to the foot support 5444 at a first location 5449, and is attached to the thrust paddle 5442 at a second location 5450. Due to the tension in the spring 5448, the thrust paddle 5442 will only be stable when resting against the first 5446 or the second 5447 limit stop. In this figure, the thrust paddle 5442 is provided resting stably against the first 5446 limit stop, where the thrust paddle 5442 is out of the water 5451.

Figure 54H:
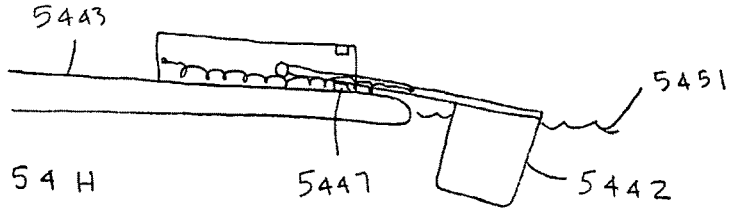
FIG. 54H is a side view of the useful embodiment of the thrust assembly of FIG. 54G.

FIG. 54H is a side view of the useful embodiment of the thrust assembly of FIG. 54G, where the thrust paddle 5442 for the SUP 5443 is stable in either of two positions. In this figure, the thrust paddle 5442 is provided resting stably against the second 5447 limit stop, where the thrust paddle 5442 is in the water 5451.

Figure 54I:
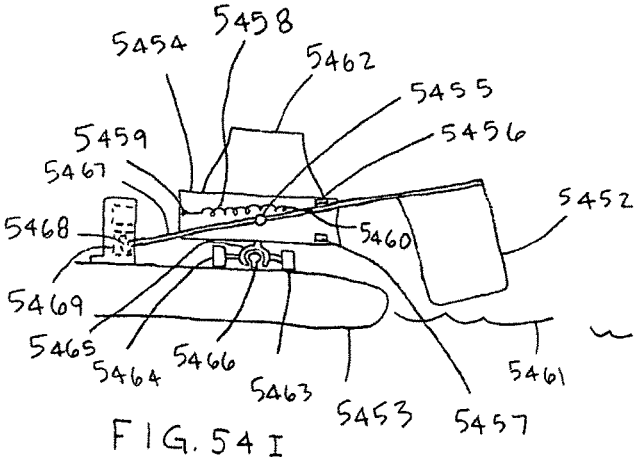
FIG. 54I is a side view of a useful embodiment of another thrust assembly, where a thrust paddle for an SUP is stable in either of two positions.

FIG. 54I is a side view of a useful embodiment of another thrust assembly, where a thrust paddle 5452 for an SUP 5453 is stable in either of two positions. The thrust paddle 5452 is attached to a foot support 5454 by a paddle revolute joint 5455. The foot support 5454 comprises a first 5456 and a second 5457 limit stop. The foot support 5454 also comprises a spring 5458, where the spring 5458 is attached to the foot support 5454 at a first location 5459, and is attached to the thrust paddle 5452 at a second location 5460. Due to the tension in the spring 5458, the thrust paddle 5452 will only be stable when resting against the first 5456 or the second 5457 limit stop. In this figure, the thrust paddle 5452 is provided resting stably against the first 5456 limit stop, where the thrust paddle 5452 is out of the water 5461. An optional foot holder 5462 is shown mated with the foot support 5454. The foot support 5454 is shown to be supported on the SUP 5453 by a linear bearing assembly similar to FIG. 53H. Here, the foot support 5454 comprises the load-bearing wheels 5463 and 5464. The foot support 5454 also comprises the linear bearing 5465. The linear bearing 5465 may be guided by the bearing rod 5466 connected to the SUP 5453. The arm of the thrust paddle 5452 extends 5467 and comprises a roller 5468 on the end opposite to the thrust paddle 5452. The roller 5468 rolls through paths in a guide 5469 that comprises a set of constraints to move the roller up and down and, in effect, to determine whether the thrust paddle 5452 is in the water 5461 or out of the water 5461.

Figure 54J:
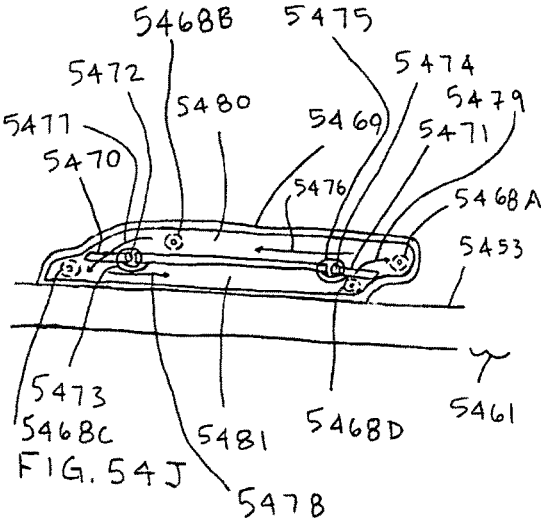
FIG. 54J is a side view of the useful embodiment the constraint guide of FIG. 54I.

FIG. 54J is a side view of the useful embodiment the constraint guide 5469 of FIG. 54I. The constraint guide 5469 comprises an upper path 5480 and a lower path 5481, where the two paths are separated by one-way spring-loaded flaps 5470 and 5471. The first flap 5470 can rotate counterclockwise around a revolute joint 5472 while pushing against a return spring 5473. The first flap 5470 cannot rotate clockwise from the shown position. Similarly, the second flap 5471 can rotate counterclockwise around a revolute joint 5474 while pushing against a return spring 5475. The second flap 5471 cannot rotate clockwise from the shown position. The arm of the thrust paddle 5452 comprises a roller 5468 (shown with a dashed circle in locations indicated by 5468A, B, C, and D) on the end opposite to the thrust paddle 5452 (in FIG. 54I). The roller 5468 passes through paths in a guide 5469 that comprises a set of constraints to move the roller up and down and, in effect, to determine whether the thrust paddle 5452 (in FIG. 54I) is in the water 5461 or out of the water 5461. When the foot support 5454 (in FIG. 54I) is forward relative to the SUP 5453, the roller 5468A is positioned in the upper right of the constraint guide 5469, where the thrust paddle 5452 is in the water 5461. As the rider pushes the foot support 5454 rearward the roller also moves rearward 5476 to the roller location 5468B, and forward thrust is provided to the SUP 5453. As the rider continues to push the foot support 5454 rearward, the roller also moves rearward 5477, and the roller passes past the first one-way spring-loaded flap 5470 to reach the roller location 5468C in the lower left of the constraint guide 5469, where the thrust paddle 5452 is raised above the water 5461 as the roller reaches the roller location 5468C. As the rider pushes the foot support 5454 forward, the roller also moves forward 5478 to the roller location 5468D, and there is no resistance from the water since the thrust paddle 5452 is still out of the water 5461. As the rider continues to push the foot support 5454 forward, the roller also moves forward 5479, and the roller passes past the second one-way spring-loaded flap 5471 to reach the roller location 5468A in the upper right of the constraint guide 5469 where the cycle started, and where the thrust paddle 5452 is lowered into the water 5461 as the roller reaches the roller location 5468D. The thrust paddle 5452 also may rotate rearward (i.e., clockwise) to prevent drag while the SUP 5453 is gliding or while the thrust paddle 5452 is being pushed forward, and may use the thrust fin assembly of FIGS. 54B and 54C comprising a detent.

Figure 55A:
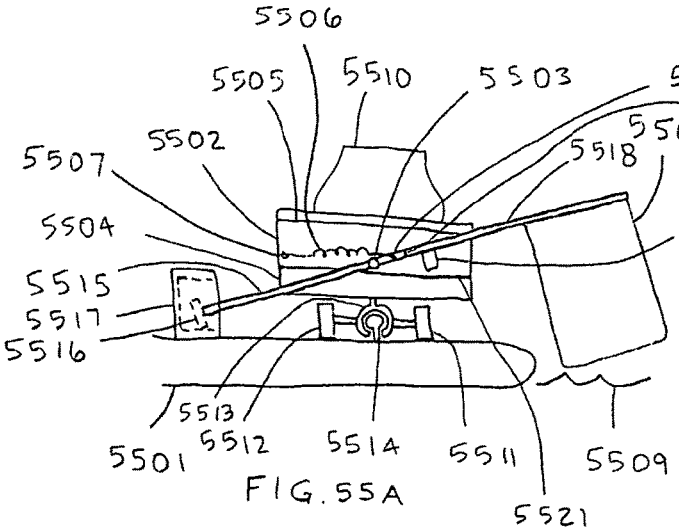
FIG. 55A is a rear end view of a useful embodiment of another thrust assembly, where a thrust paddle for an SUP is stable in either of two positions.

FIG. 55A is a rear end view of a useful embodiment of another thrust assembly, where a thrust paddle 5500 for an SUP 5501 is stable in either of two positions. The thrust paddle 5500 is attached to a foot support 5502 by a paddle revolute joint 5503. The foot support 5502 comprises a first 5504 and a second 5505 limit stop. The foot support 5502 also comprises a spring 5506, where the spring 5506 is attached to the foot support 5502 at a first location 5507, and is attached to the thrust paddle 5500 at a second location 5508. Due to the tension in the spring 5506, the thrust paddle 5500 will only be stable when resting against the first 5504 or the second 5505 limit stop. In this figure, the thrust paddle 5500 is provided resting stably against the first 5504 limit stop, where the thrust paddle 5500 is out of the water 5509. An optional foot holder 5510 is shown mated with the foot support 5502. The foot support 5502 is shown to be supported on the SUP 5501 by a linear bearing assembly similar to FIG. 53H. Here, the foot support 5502 comprises the load-bearing wheels 5511 and 5512. The foot support 5502 also comprises the linear bearing 5513. The linear bearing 5513 may be guided by the bearing rod 5514 connected to the SUP 5501. The arm of the thrust paddle 5500 extends 5515 and comprises a roller 5516 on the end opposite to the thrust paddle 5500. The roller 5516 rolls through paths in a guide 5517 that comprises a set of constraints to move the roller 5516 up and down and, in effect, to determine whether the thrust paddle 5500 is in the water 5509 or out of the water 5509.

The thrust paddle arm 5518 of the thrust paddle 5500 comprises a lever arm 5519 and an axial revolute joint 5520. When the foot support 5502 is moved forward on the SUP 5501, the roller 5516 rotates the thrust paddle arm 5518 clockwise (in the figure) about the paddle revolute joint 5503, and the thrust paddle 5500 is lowered into the water 5509 in an orientation about its axial revolute joint 5520 to apply forward thrust to the SUP 5501. While providing forward thrust, the thrust paddle 5500 is prevented from rotating forward about the axial revolute joint 5520 by a thrust limit stop, but the thrust paddle 5500 may freely rotate rearward about the axial revolute joint 5520 to prevent water drag when the SUP 5501 is gliding and the thrust paddle 5500 is in the water 5509. If the SUP 5501 is gliding, the thrust paddle 5500 rotates rearward about the axial revolute joint 5520 due to water 5509 pressing against it. When the thrust paddle 5500 is in this rearward rotated position, if the foot support 5502 is moved forward such that the roller 5516 causes the thrust paddle arm 5518 to rise, the lever arm 5519 contacts the upper portion 5521 of the first limit stop 5504, causing the thrust paddle 5500 to rotate about its axial revolute joint 5520 to a vertical orientation, which positions the thrust paddle 5500 to apply forward thrust to the SUP 5501 when it is next lowered into the water 5509.

Figure 55B:
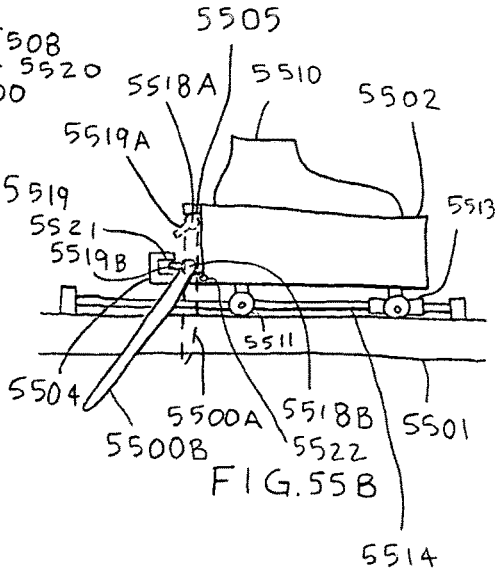
FIG. 55B is a side view of the useful embodiment of the thrust assembly of FIG. 55A.

FIG. 55B is a side view of the useful embodiment of the thrust assembly of FIG. 55A. The thrust paddle arm 5518 in a first position 5518A of the thrust paddle 5500 in a first position 5500A comprises a lever arm 5519 in a first position 5519A and an axial revolute joint. When the foot support 5502 is moved forward (i.e., to the right in the figure) on the SUP 5501, the roller rotates the thrust paddle arm 5518A about the paddle revolute joint, and the thrust paddle 5500A is lowered into the water 5509 in a vertical orientation about its axial revolute joint 5520 to apply forward thrust to the SUP 5501. While providing forward thrust, the thrust paddle 5500 is prevented from rotating forward (counterclockwise in the figure) about the axial revolute joint 5520 by a thrust limit stop 5522, but the thrust paddle 5500 may freely rotate rearward (clockwise in the figure) about the axial revolute joint to prevent water drag when the SUP 5501 is gliding and the thrust paddle 5500 is in the water 5509. If the SUP 5501 is gliding, the thrust paddle 5500 rotates rearward (clockwise in the figure) to position 5500B about the axial revolute joint due to water 5509 pressing against it. When the thrust paddle 5500B is in this rearward rotated position, if the foot support 5502 is moved forward such that the roller 5516 causes the thrust paddle arm 5518B to rise, the lever arm 5519B contacts the upper portion 5521 of the first limit stop 5504, causing the thrust paddle 5500B to rotate (counterclockwise in the figure) about its axial revolute joint 5520 to a vertical orientation, which positions the thrust paddle 5500A to apply forward thrust to the SUP 5501 when it is next lowered into the water 5509.

Figure 55C:
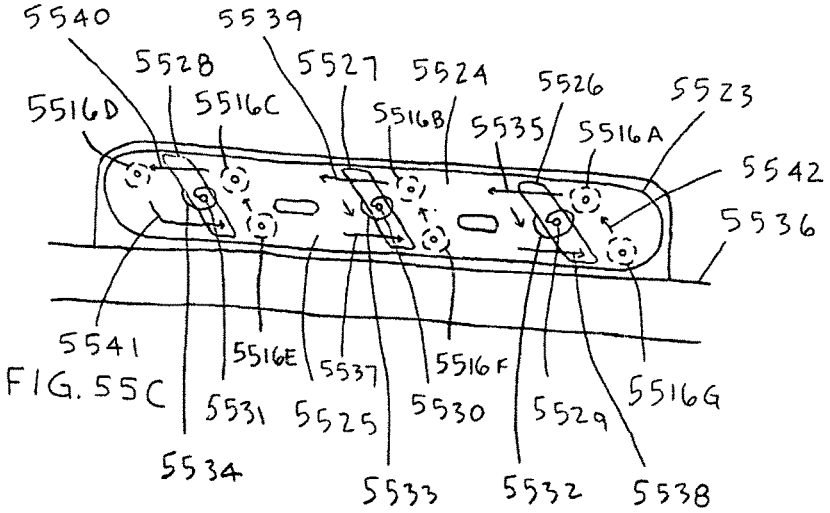
FIGS. 55C-55D are side views of useful embodiments of the constraint guide of FIG. 55A.

FIG. 55C is a side view of a useful embodiment of the constraint guide 5517 of FIG. 55A. In the current figure, FIG. 55C, the constraint guide 5523 comprises an upper path 5524 and a lower path 5525, where the two paths are separated by one-way spring-loaded flaps 5526, 5527, and 5528. Three flaps are shown, however, there may by any number of flaps depending on the length of the constraint guide 5523. The flaps 5526, 5527, and 5528 can rotate counterclockwise around the revolute joints 5529, 5530, and 5531, respectively, while pushing against the return springs 5532, 5533, and 5534, respectively. The flaps 5526, 5527, and 5528 cannot rotate clockwise from the shown positions; however, the flaps 5526, 5527, and 5528 can rotate counterclockwise around their respective revolute joints 5529, 5530, and 5531 while pushing against their respective return springs 5532, 5533, and 5534.

In FIG. 55A, the extension of the thrust paddle 5515 comprises the roller 5516 on the end opposite to the thrust paddle 5500. In the current figure, FIG. 55C, the roller 5516 is shown with a dashed circle in locations indicated by 5516A, B, C, D, E, F, and G. The roller 5516 passes through the paths 5524 and 5525 in the guide 5523, that comprises a set of constraints, to move the roller 5516 up and down and, in effect, to determine whether the thrust paddle 5500 (in FIG. 55A) is in the water or out of the water. When the foot support 5502 (in FIG. 55A) is forward relative to the SUP and the foot support 5502 is just starting to be pushed rearward by the rider, the roller 5516 in this figure, FIG. 55C, is positioned at 5516A in the upper right of the constraint guide 5523, where the thrust paddle 5500 is in the water. As the rider pushes the foot support 5502 rearward, the roller 5516A also moves rearward 5535, and the roller 5516A passes past the first one-way spring-loaded flap 5526 to reach the roller location 5516B, while forward thrust is provided to the SUP 5536. As the rider continues to push the foot support 5502 rearward 5539, the roller 5516B passes past the second one-way spring-loaded flap 5527 to reach the roller location 5516C. As the rider continues to push the foot support 5502 as far rearward as possible, the roller 5516C passes past 5540 the third one-way spring-loaded flap 5528 to reach the roller location 5516D in the left of the constraint guide 5523, where the thrust paddle 5500 is still in the water.

As the rider pushes the foot support 5502 forward, the roller 5516D rolls down 5541 along the left side of the third flap 5528 which raises the thrust paddle 5500 out of the water, and the roller 5516D also moves forward to the roller location 5516E. There is no resistance from the water while the thrust paddle 5500 is out of the water. As the rider continues to push the foot support 5502 forward, the roller also moves forward 5537, and the roller 5516E passes past the second one-way spring-loaded flap 5527 to reach the roller location 5516F. As the rider continues to push the foot support 5502 forward, the roller 5516F also moves forward 5538, and the roller 5516F passes past the first one-way spring-loaded flap 5526 to reach the farthest-right roller location 5516G in the lower right of the constraint guide 5523. When the rider starts to push the foot support 5502 rearward to initiate the thrust phase again, the roller 5516G rolls up 5542 the right side of the first flap 5526 to reach roller location 5516A, where the cycle started, and where the thrust paddle 5500 is again lowered into the water.

While the foot support 5502 is moving rearward (to the left) in the upper path 5524 during the thrust phase, where the thrust paddle is in the water, at any time the foot support 5502 may be moved forward to initiate a recovery phase, and the roller 5516 will roll down the left side of the nearest flap to its right, and the thrust paddle 5500 will be raised from the water. While the foot support 5502 is moving forward (to the right) in the lower path 5525 during the recovery phase where the thrust paddle 5500 is out of the water, at any time the foot support 5502 may be moved rearward to initiate a thrust phase, and the roller 5516 will roll up the right side of the nearest flap to its left, and the thrust paddle 5500 will be lowered into the water.

Figure 55D:
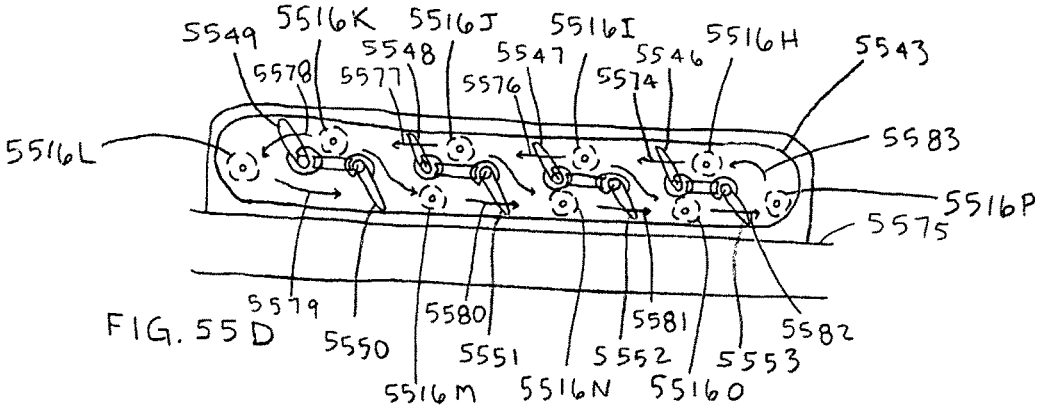

FIG. 55D is a side view of a useful embodiment of the constraint guide 5517 of FIG. 55A. In the current figure, FIG. 55D, the constraint guide 5543 comprises an upper path 5544 and a lower path 5545, where the two paths are separated by one-way spring-loaded flaps 5546, 5547, 5548, 5549, 5550, 5551, 5552, and 5553. Four upper flaps and four lower flaps are shown, however, there may by any number of flaps depending on the length of the constraint guide 5543. Each upper flap 5546, 5547, 5548, and 5549 is paired with a lower flap 5550, 5551, 5552, and 5553, where the upper 5546, 5547, 5548, and 5549 and lower 5550, 5551, 5552, and 5553 flaps are separated by the stationary horizontal guides 5554, 5555, 5556, and 5557, respectively. The flaps 5546, 5547, 5548, 5549, 5550, 5551, 5552, and 5553 can rotate counterclockwise around the revolute joints 5558, 5559, 5560, 5561, 5562, 5563, 5564 and 5565, respectively, while pushing against the return springs 5566, 5567, 5568, 5569, 5570, 5571, 5572 and 5573, respectively. The flaps 5546, 5547, 5548, 5549, 5550, 5551, 5552, and 5553 cannot rotate clockwise from the shown positions; however, they can rotate counterclockwise around their respective revolute joints 5558, 5559, 5560, 5561, 5562, 5563, 5564 and 5565 while pushing against their respective return springs 5566, 5567, 5568, 5569, 5570, 5571, 5572 and 5573.

In FIG. 55A, the extension of the thrust paddle 5515 comprises the roller 5516 on the end opposite to the thrust paddle 5500. In the current figure, FIG. 55D, the roller 5516 is shown with a dashed circle in locations indicated by 5516H, I, J, K, L, M, N, O, and P. The roller 5516 passes through the paths 5544 and 5545 in the guide 5543, that comprises a set of constraints, to move the roller 5516 up and down and, in effect, to determine whether the thrust paddle 5500 (in FIG. 55A) is in the water or out of the water. When the foot support 5502 (in FIG. 55A) is forward relative to the SUP and the foot support 5502 is just starting to be pushed rearward by the rider, the roller 5516 in this figure, FIG. 55D, is positioned at 5516H in the upper right of the constraint guide 5543, where the thrust paddle 5500 is in the water. As the rider pushes the foot support 5502 rearward (to the left), the roller 5516H also moves rearward 5574, and the roller 5516H passes past the first one-way spring-loaded flap 5546 to reach the roller location 5516I, while forward thrust is provided to the SUP 5575. As the rider continues to push the foot support 5502 rearward 5576, the roller 5516I passes past the second one-way spring-loaded flap 5547 to reach the roller location 5516I As the rider continues to push the foot support 5502 rearward 5577, the roller 5516J passes past the third one-way spring-loaded flap 5548 to reach the roller location 5516K. As the rider continues to push the foot support 5502 as far rearward as possible, the roller 5516K passes past 5578 the fourth one-way spring-loaded flap 5549 to reach the roller location 5516L in the left of the constraint guide 5543, where the thrust paddle 5500 (in FIG. 55A) is still in the water, but starting to rise up.

As the rider pushes the foot support 5502 forward, the roller 5516L rolls down 5579 along the left side of the fourth flap 5549 to the left side of the fifth flap 5550, which raises the thrust paddle 5500 out of the water, and the roller 5516L also moves forward to the roller location 5516M. There is no resistance from the water while the thrust paddle 5500 is out of the water. As the rider continues to push the foot support 5502 forward, the roller 5516M also moves forward 5580, and the roller 5516M passes past the sixth one-way spring-loaded flap 5551 to reach the roller location 5516N. As the rider continues to push the foot support 5502 forward, the roller 5516N also moves forward 5581, and the roller 5516N passes past the seventh one-way spring-loaded flap 5552 to reach the roller location 5516O. As the rider continues to push the foot support 5502 forward, the roller 5516O also moves forward 5582, and the roller 5516O passes past the eight one-way spring-loaded flap 5553 to reach the farthest-right roller location 5516P in the right of the constraint guide 5543, where the thrust paddle 5500 (in FIG. 55A) starts to lower. When the rider starts to push the foot support 5502 rearward to initiate the thrust phase again, the roller 5516P rolls up 5583 the right side of the seventh flap 5553 to the right side of the first flap 5546 to reach roller location 5516H, where the cycle started, and where the thrust paddle 5500 is again lowered into the water.

While the foot support 5502 is moving rearward (to the left) in the upper path 5544 during the thrust phase, where the thrust paddle is in the water, at any time the foot support 5502 may be moved forward to initiate a recovery phase, and the roller 5516 will roll down the left side of the nearest flap to its right, and the thrust paddle 5500 (in FIG. 55A) will be raised from the water. While the foot support 5502 is moving forward (to the right) in the lower path 5545 during the recovery phase where the thrust paddle 5500 (in FIG. 55A) is out of the water, at any time the foot support 5502 may be moved rearward to initiate a thrust phase, and the roller 5516 will roll up the right side of the nearest flap to its left, and the thrust paddle 5500 will be lowered into the water.

Figure 56A:
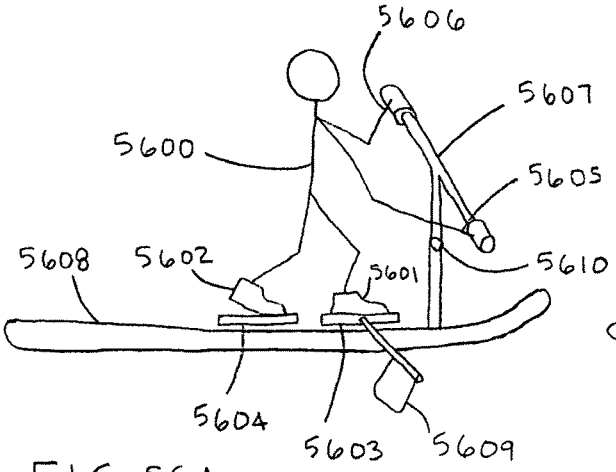
FIG. 56A is a combined side/perspective view of a useful embodiment of another thrust assembly, where a rider is standing with their feet on translatable foot supports, and with their hands on handlebars.

FIG. 56A is a combined side/perspective view of a useful embodiment of another thrust assembly, where a rider 5600 is standing with their feet 5601 and 5602 on translatable foot supports 5603 and 5604, and with their hands 5605 and 5606 on handlebars 5607 (shown using a perspective view) of an SUP 5608. The foot support 5603 comprises a thrust paddle 5609 (shown using a perspective view) for applying thrust to the SUP 5608. The handlebars 5607 comprise a joint 5610 for adjusting the handlebar position.

Figure 56B:
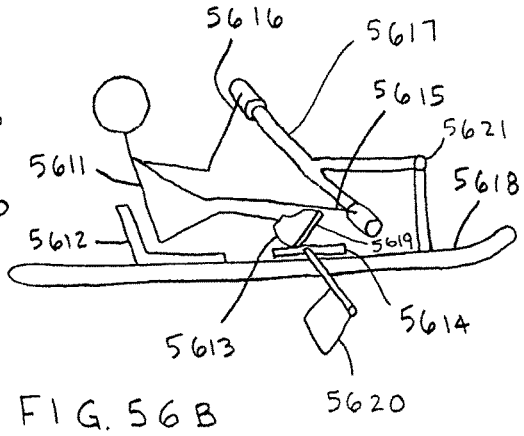
FIG. 56B is a combined side/perspective view of a useful embodiment of another thrust assembly, where a rider is seated on a seat with a foot contacting a translatable foot support, and their hands on handlebars.

FIG. 56B is a combined side/perspective view of a useful embodiment of another thrust assembly, where a rider 5611 is seated on a seat 5612 with a foot 5613 contacting a translatable foot support 5614, and their hands 5615 and 5616 on handlebars 5617 (shown using a perspective view) of an SUP 5618. The foot support 5614 comprises an inclined portion 5619 convenient for a seated position, where the inclined portion 5619 may tilt up, and the foot support 5614 further comprises a thrust paddle 5620 (shown using a perspective view) for applying thrust to the SUP 5618. The handlebars 5617 comprise a joint 5621, which may comprise a hinge, for adjusting the handlebar position to accommodate the seated position. The embodiment of FIG. 56A may easily convert into the embodiment of FIG. 56B, and vice versa.

Figure 57A:
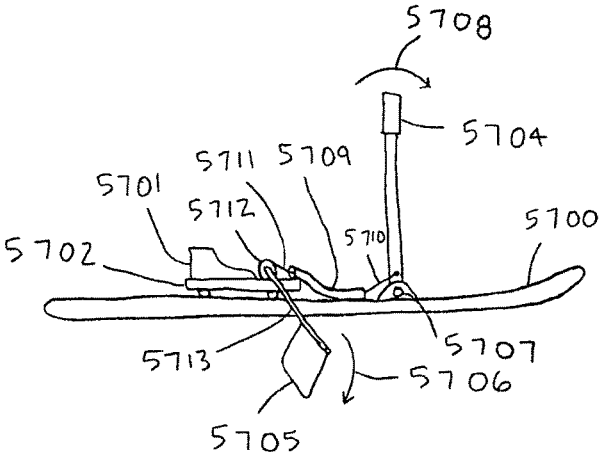
FIG. 57A is a combined side/perspective view of a useful embodiment of another thrust assembly of an SUP, where a rider may stand with a foot on a translatable foot support, and place their hand on a hand lever.

FIG. 57A is a combined side/perspective view of a useful embodiment of another thrust assembly of an SUP 5700, where a rider may stand with a foot 5701 on a translatable foot support 5702, and place their hand on a hand lever 5704. The foot support 5702 may slide relative to the SUP 5700. The foot support 5702 comprises a thrust paddle 5705 (shown using a perspective view) that can rotate out of the water or into 5706 the water for applying thrust to the SUP 5700. The hand lever 5704 comprises a revolute joint 5707 for rotating the hand lever forward 5708 and rearward. The hand lever 5704 controls the thrust paddle 5705, and may comprise a linkage or a Bowden cable. In this figure, the hand lever 5704 is connected to the thrust paddle 5705 by a Bowden cable 5709, with a first end 5710 of the tendon attached to the hand lever 5704, and a second end 5711 attached to a rotary cam 5712 attached to the shaft 5713 of the thrust paddle 5705. During the thrust phase, when the rider pushes rearward with their foot 5701 on the foot support 5702, they simultaneously push their hand forward against the hand lever 5704. When the hand lever 5704 moves forward 5708, the tendon of the Bowden cable 5709 rotates the cam 5712 and causes the thrust paddle 5705 to rotate into 5706 the water. During the recovery phase, when the rider pushes forward with their foot 5701 on the foot support 5702, they simultaneously pull their hand rearward against the hand lever 5704. When the hand lever 5704 moves rearward, the tendon of the Bowden cable 5709 rotates the cam 5712 and causes the thrust paddle 5705 to rotate out of the water so it does not provide any resistance against the water.

Figure 57B:
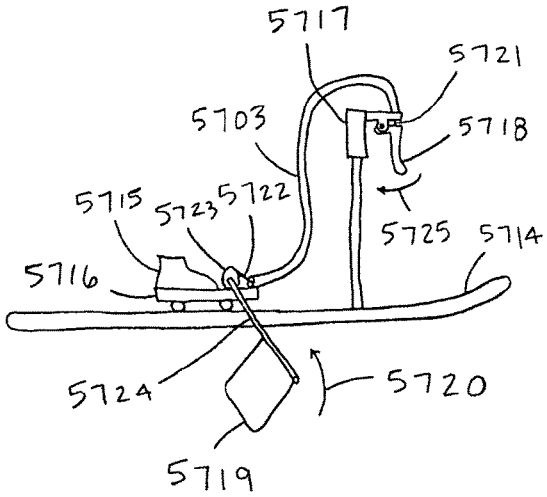
FIG. 57B is a combined side/perspective view of a useful embodiment of another thrust assembly for an SUP, where a rider may stand with a foot on a translatable foot support, and place their hand on a handle comprising a lever.

FIG. 57B is a combined side/perspective view of a useful embodiment of another thrust assembly for an SUP 5714, where a rider may stand with a foot 5715 on a translatable foot support 5716, and place their hand on a handle 5717 comprising a lever 5718, similar to a bicycle brake lever. The foot support 5716 may slide relative to the SUP 5714. The foot support 5716 comprises a thrust paddle 5719

(shown using a perspective view) that can rotate out 5720 of the water or into the water for applying thrust to the SUP 5714. The lever 5718 controls the thrust paddle 5719, and may comprise a linkage or a Bowden cable. In this figure, the lever 5718 is connected to the thrust paddle 5719 by a Bowden cable 5703, with the first end 5721 of the tendon attached to the lever 5718, and the second end 5722 attached to a rotary cam 5723 attached to the shaft 5724 of the thrust paddle 5719. During the recovery phase, when the rider pushes forward with their foot on the foot support 5716, they simultaneously squeeze their hand and pull their fingers rearward 5725 against the lever 5718. When the lever 5718 is squeezed, the tendon of the Bowden cable 5703 rotates the cam 5723 and causes the thrust paddle 5719 to rotate out 5720 of the water so it does not provide any resistance against the water. During the thrust phase, when the rider pushes rearward with their foot on the foot support 5716, they simultaneously open their hand and release their fingers from the lever 5718. When the lever 5718 is released, the tendon of the Bowden cable 5703 rotates the cam 5723 and causes the thrust paddle 5719 to rotate into the water.

Figure 58:
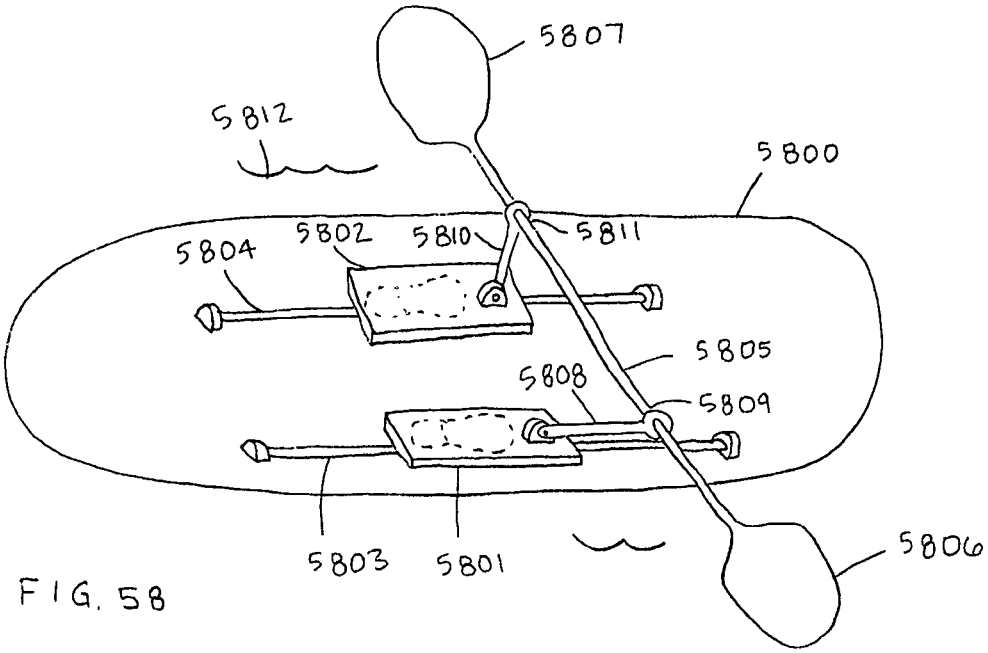
FIG. 58 is a perspective view of a useful embodiment of another thrust assembly for an SUP comprising translatable foot supports.

FIG. 58 is a perspective view of a useful embodiment of another thrust assembly for an SUP 5800 comprising translatable foot supports 5801 and 5802. The foot supports 5801 and 5802 are shown in FIG. 58 to slide on bearing rods 5803 and 5804. Each foot support is connected to a paddle by a connector, and is capable of raising a paddle blade out of the water 5812, or lowering the paddle blade into the water 5812. The paddle may comprise a single handle 5805 with paddle blades 5806 and 5807 on opposite ends. The right foot support 5801 is connected by the right connector 5808 to the right portion 5809 of the paddle handle 5805; the left foot support 5802 is connected by the left connector 5810 to the left portion 5811 of the paddle handle 5805. When a foot support moves forward, such as the right foot support 5801, the right connector 5808 of the right foot support 5801 lifts the paddle blade 5806 over the water 5812 so there is no water resistance from the right paddle blade 5806. When a foot support moves rearward, such as the left foot support 5802, the left connector 5810 of the left foot support 5802 lowers the paddle blade 5807 into the water 5812 so the left paddle blade 5807 may apply thrust to the SUP 5800.

Figure 59A:
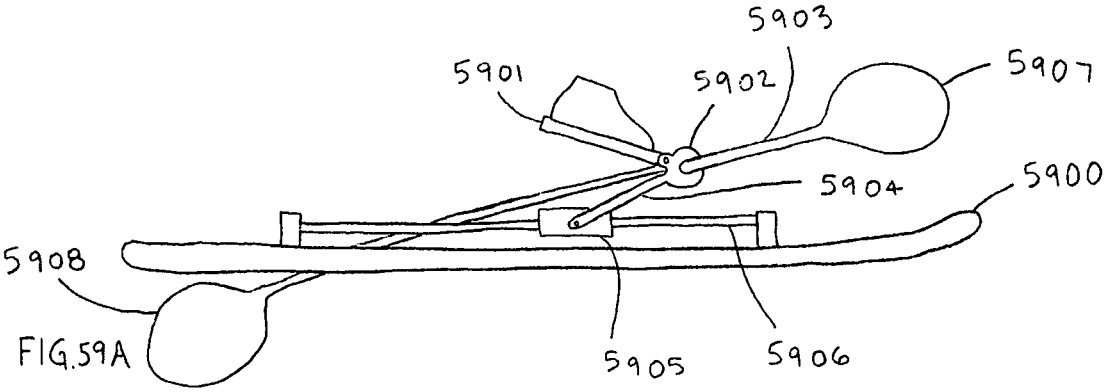
FIG. 59A is a side view of a useful embodiment of another thrust assembly for an SUP comprising a translatable foot support.

FIG. 59A is a side view of a useful embodiment of another thrust assembly for an SUP 5900 comprising a translatable foot support 5901. The foot support 5901 is connected to a connecting joint 5902 which is connected to a paddle handle 5903. The connecting joint 5902 is also connected by a connector 5904 to a linear bearing 5905 that slides on a bearing rod 5906. The foot support 5901 is able to raise a paddle blade 5907 of the paddle handle 5903 out of the water, or lower the paddle blade 5907 into the water. The paddle handle 5903 may comprise paddle blades 5907 and 5908 on opposite ends. When the foot support 5901 lifts, the connecting joint 5902 lifts the right paddle blade 5908 over the water so there is no water resistance from the right paddle blade 5908. When the foot support 5901 moves forward, the connecting joint 5902 pulls the linear bearing 5905 forward along the bearing rod 5906. When the foot support 5901 moves rearward, the connecting joint 5902 lowers the paddle blade 5908 into the water so the paddle blade 5908 may apply thrust to the SUP 5900. When the foot support 5901 moves rearward with the paddle blade 5908 in the water, the connecting joint 5902 pushes the linear bearing 5905 rearward along the bearing rod 5906 to propel the SUP 5900 forward.

Figure 59B:
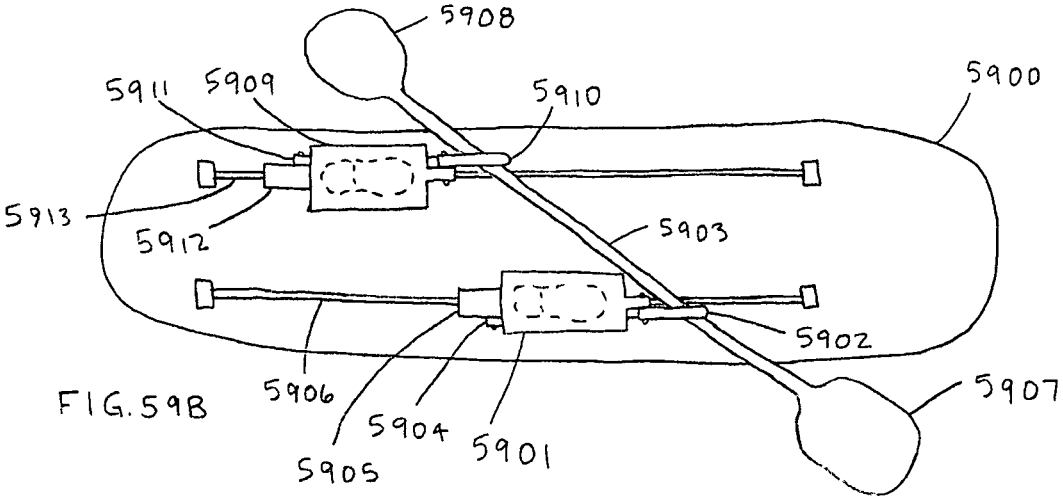
FIG. 59B is a plan view of the useful embodiment of the thrust assembly of FIG. 59A.

FIG. 59B is a plan view of the useful embodiment of the thrust assembly of FIG. 59A for the SUP 5900 comprising right and left translatable foot supports 5901 and 5909 connected to connecting joints 5902 and 5910, respectively, which are each connected to the paddle handle 5903. The connecting joints 5902 and 5910 are also connected by connectors 5904 and 5911 to linear bearings 5905 and 5912, respectively, which slide on bearing rods 5906 and 5913, respectively. The foot supports 5901 and 5909 are able to raise paddle blades 5907 and 5908 of the paddle handle 5903 out of the water, or lower the paddle blades 5907 and 5908 into the water.

When the right foot support 5901 lifts, the connecting joint 5902 lifts the right paddle blade 5907 over the water so there is no water resistance from the right paddle blade 5907. When the foot support 5901 moves forward, the connecting joint 5902 pulls the connector 5904 to pull the linear bearing 5905 forward along the bearing rod 5906. When the foot support 5901 moves rearward, the connecting joint 5902 lowers the paddle blade 5907 into the water so the paddle blade 5907 may apply thrust to the SUP 5900. When the foot support 5901 moves rearward with the paddle blade 5907 in the water, the connecting joint 5902 pushes the connector 5904 to push the linear bearing 5905 rearward along the bearing rod 5906 to propel the SUP 5900 forward.

Similarly, when the left foot support 5909 lifts, the connecting joint 5910 lifts the left paddle blade 5908 over the water so there is no water resistance from the left paddle blade 5908. When the foot support 5909 moves forward, the connecting joint 5910 pulls the connector 5911 to pull the linear bearing 5912 forward along the bearing rod 5913. When the foot support 5909 moves rearward, the connecting joint 5910 lowers the paddle blade 5908 into the water so the paddle blade 5908 may apply thrust to the SUP 5900. When the foot support 5909 moves rearward with the paddle blade 5908 in the water, the connecting joint 5910 pushes the connector 5911 to push the linear bearing 5912 rearward along the bearing rod 5913 to propel the SUP 5900 forward.

Figure 60:
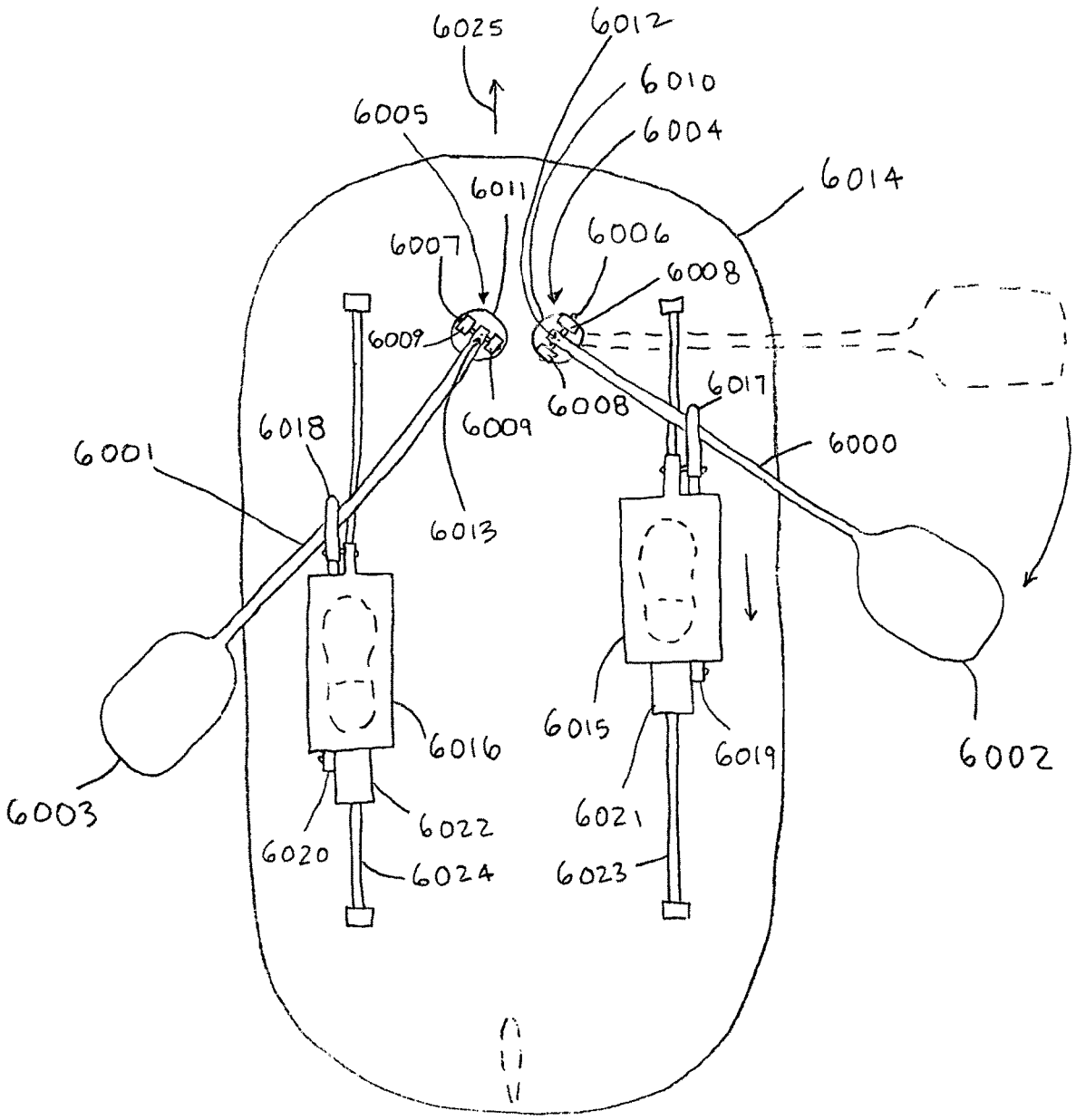
FIG. 60 is a plan view of another useful embodiment of a thrust assembly similar to FIG. 59B, but where there are two separate paddle handles.

FIG. 60 is a plan view of another useful embodiment of a thrust assembly similar to FIG. 59B, but where there are two separate paddle handles 6000 and 6001, instead of one paddle handle with a paddle blade on each end. Each paddle handle 6000 and 6001 has a paddle blade 6002 and 6003 at one end, and an elevation/rotary joint 6004 and 6005 at the other end, respectively. Each of the elevation/rotary joints 6004 and 6005 comprises and elevation axis 6006 and 6007 about which the paddle handles 6000 and 6001 may elevate, respectively. The elevation axes 6006 and 6007 may have supports 6008 and 6009 for the axes 6006 and 6007 connected to rotary bases 6010 and 6011 that rotate about vertical (out of the page) axes 6012 and 6013, respectively. The SUP 6014 comprises right and left translatable foot supports 6015 and 6016 connected to connecting joints 6017 and 6018, respectively, which are connected to paddle handles 6000 and 6001, respectively. The connecting joints 6017 and 6018 are also connected by connectors 6019 and 6020 to linear bearings 6021 and 6022, respectively, which slide on bearing rods 6023 and 6024, respectively. The foot supports 6015 and 6016 are able to raise the paddle blades 6002 and 6003 out of the water, or lower the paddle blades 6002 and 6003 into the water.

When a foot support, such as the right foot support 6015 lifts, the connecting joint 6017 lifts the right paddle blade 6002 over the water so there is no water resistance from the right paddle blade 6002. When the foot support 6015 moves forward, the connecting joint 6017 pulls the connector 6019 to pull the linear bearing 6021 forward along the bearing rod 6023. When the foot support 6015 moves rearward, the connecting joint 6017 lowers the paddle blade 6002 into the water so the paddle blade 6002 may apply thrust to the SUP 6014. When the foot support 6015 moves rearward with the paddle blade 6002 in the water, the connecting joint 6017 pushes the connector 6019 to push the linear bearing 6021 rearward along the bearing rod 6023 to propel the SUP 6014 forward 6025. Unlike the embodiment of FIG. 59B, since the connecting joints 6017 and 6018 are connected to the paddle handles 6000 and 6001 away from their vertical axes of rotation 6012 and 6013, respectively, when foot supports 6015 and 6016 move, the amounts of their movements are amplified to provide greater amounts of movement at the end of their respective paddle blades 6002 and 6003.

Figure 61A:
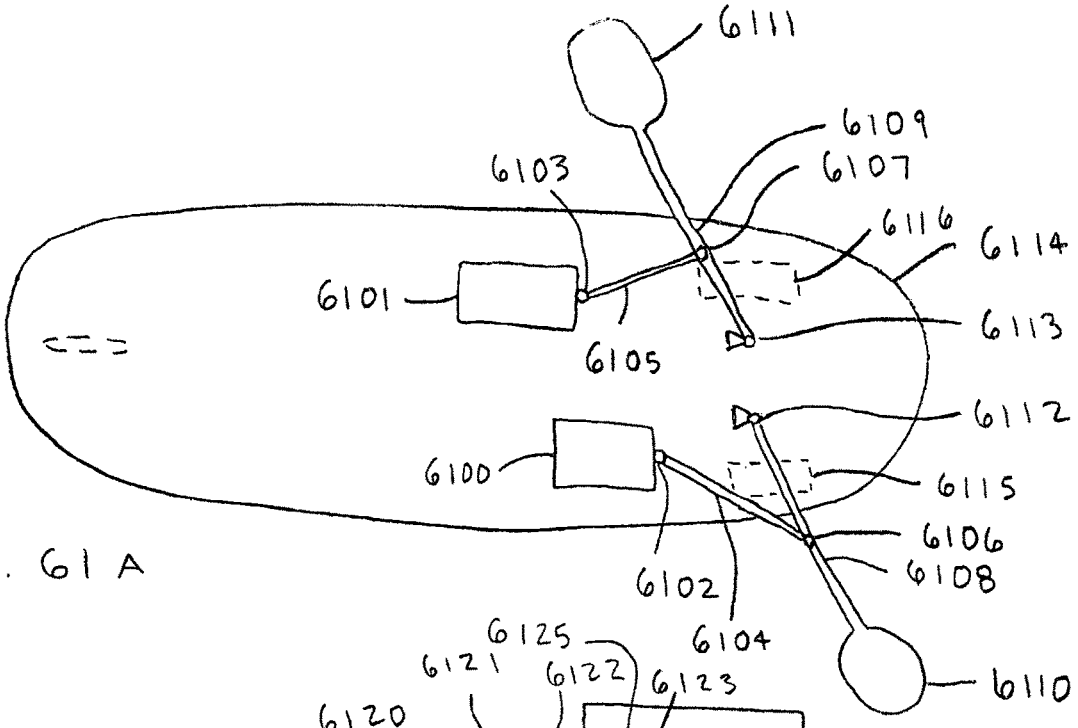
FIG. 61A is a plan view of another useful embodiment of a thrust assembly, where right and left foot supports are connected by joints to right and left connectors which are connected by joints to right and left paddle handles, where the paddle handles have paddle blades.

FIG. 61A is a plan view of another useful embodiment of a thrust assembly, where right and left foot supports 6100 and 6101 are connected by joints 6102 and 6103 to right and left connectors 6104 and 6105, respectively, which are connected by joints 6106 and 6107 to right and left paddle handles 6108 and 6109, respectively, where the paddle handles 6108 and 6109 have paddle blades 6110 and 6111 on one end and elevation/rotary joints 6112 and 6113, respectively, connected to the SUP 6114 at the other end. Located on the SUP 6114 between the elevation/rotary joints 6112 and 6113 and the paddle blades 6110 and 6111 are handle guides 6115 and 6116 similar to the handle guide assembly provided by FIG. 61B (see FIG. 61B for details). As the foot supports 6100 and 6101 move forward and rearward relative to the SUP 6114, the handle guides 6115 and 6116 lift the paddle blades 6110 and 6111 out of the water during the forward recovery phase, and guide the paddle blades 6110 and 6111 into the water during the rearward thrust phase.

Figure 61B:
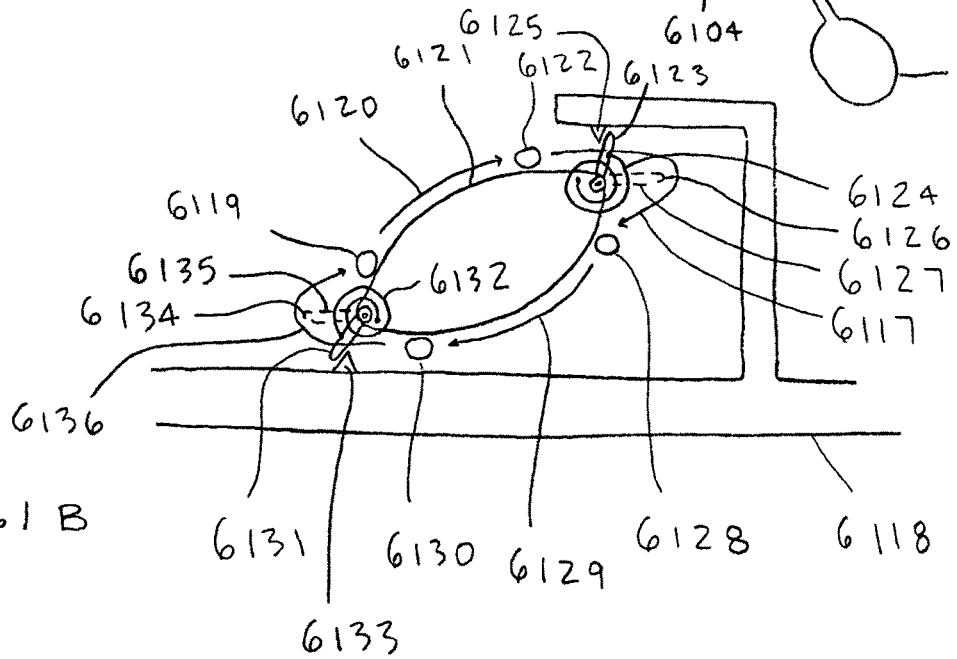
FIG. 61B is a side view of the embodiment of a handle guide assembly.

FIG. 61B is a side view of the embodiment of a handle guide assembly. A foot support is connected by joints to a paddle handle with a paddle blade, such as provided by FIG. 61A. At the beginning of a paddle recovery phase, the foot support is in a rearward location relative to an SUP 6118, where the paddle handle is in a first position 6119, and the corresponding paddle blade is in the water. As rider moves their foot forward, the foot support starts moving forward, and the paddle handle is guided up 6120 to the top of a guide structure 6121 to a second position 6122, where the paddle blade is guided out of the water. As the foot support continues forward, the paddle handle passes a top flap. The top flap is shown in a first top flap position 6123, where the top flap has a top return spring 6124 pressing it against a top limit stop 6125. As the paddle handle reaches the tip 6126 of the top flap, the top flap rotates temporarily to a second top flap position 6127. Once the paddle handle passes the tip 6126 of the top flap, the rider of the SUP pulls their foot rearward to pull the foot support rearward. Once the foot support moves rearward, the attached paddle handle that is past the tip 6126 of the top flap moves 6117 to a third position 6128, and the top return spring 6124 rotates the top flap back to the first top flap position 6123. Once the paddle handle passes the tip 6126 of the top flap, when the foot support moves rearward, it can only move to the third position 6128, since the top flap has returned to the first top flap position 6123, preventing the paddle handle from returning to the second position 6122.

As rider continues to pull the foot support rearward, the paddle arm moves along the bottom 6129 of the guide structure 6121 to a fourth position 6130, where the paddle blade is guided into the water. As the rider continues to pull the foot support rearward, the paddle handle passes a bottom flap. The bottom flap is shown in a first bottom flap position 6131, where the bottom flap has a bottom return spring 6132 pressing it against a bottom limit stop 6133. As the paddle handle reaches the tip 6134 of the bottom flap 6131, the bottom flap rotates temporarily to a second bottom flap position 6135. Once the paddle handle passes the tip 6134 of the bottom flap, the rider of the SUP 6118 pushes their foot forward to push the foot support forward. Once the foot support moves forward, the attached paddle handle that is past the tip 6134 of the bottom flap and moves 6136 to the first position 6119, and the bottom return spring 6132 rotates the bottom flap back to the first bottom flap position 6131. Once the paddle handle passes the tip 6134 of the bottom flap, when the foot support moves forward, it can only move to the first position 6119, since the bottom flap has returned to the first bottom flap position 6131, preventing the paddle handle from returning to the fourth position 6130. The cycle of the paddle handle being guided around the guide structure 6121 may repeat.

Figure 61C:
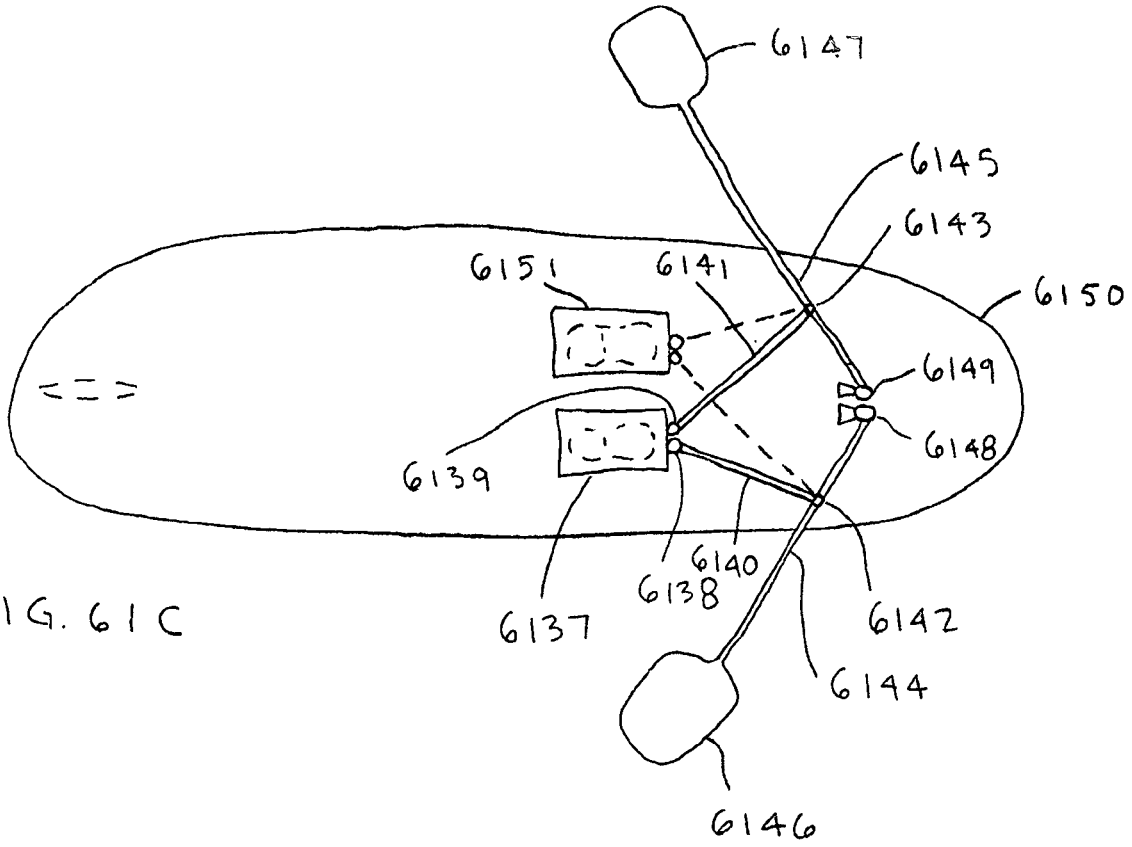
FIG. 61C is a plan view of another useful embodiment of a thrust assembly, where a foot support is connected by joints to right and left connectors which are connected by joints to right and left paddle handles, where the paddle handles have paddle blades.

FIG. 61C is a plan view of another useful embodiment of a thrust assembly, where a foot support 6137 is connected by joints 6138 and 6139 to right and left connectors 6140 and 6141, respectively, which are connected by joints 6142 and 6143 to right and left paddle handles 6144 and 6145, respectively, where the paddle handles 6144 and 6145 have paddle blades 6146 and 6147 on one end and elevation/rotary joints 6148 and 6149, respectively, connected to the SUP 6150 at the other end. Accordingly, the single foot support 6137 may move both paddle blades 6146 and 6147. The foot support connected to both paddle handles may be a right 6137 or a left 6151 foot support, or both.

Figure 61D:
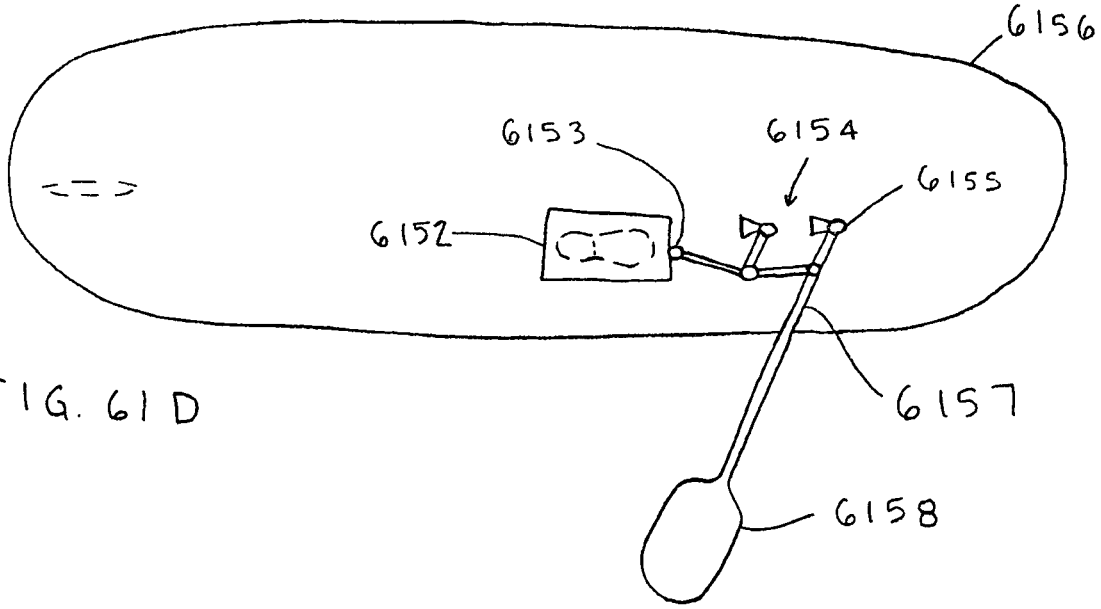
FIG. 61D is a plan view of another useful embodiment of a thrust assembly, where a foot support is connected by a joint to a multi-bar linkage.

FIG. 61D is a plan view of another useful embodiment of a thrust assembly, where a foot support 6152 is connected by a joint 6153 to a multi-bar linkage 6154 (such as provided by FIGS. 45-47) grounded 6155 to the SUP 6156 and connected to a paddle handle 6157, where the paddle handle 6157 has a paddle blade 6158. The linkage 6154 determines the position of the paddle blade 6158 based on the position of the foot support 6152.

Figure 62A:
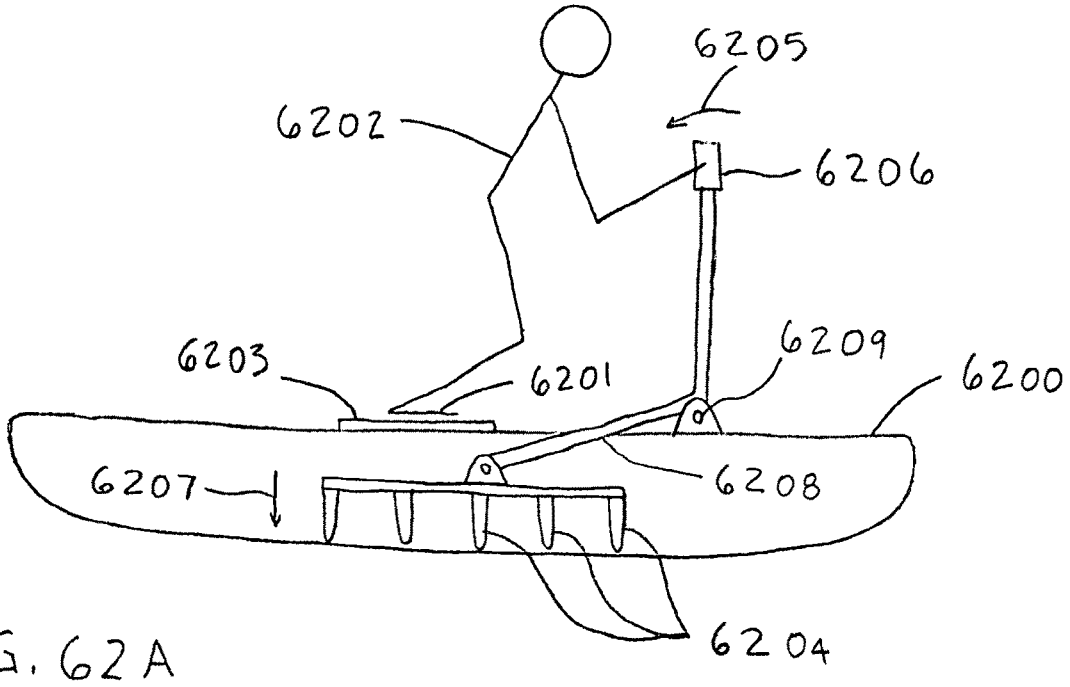
FIG. 62A is a side view of another useful embodiment of a thrust assembly comprising a right and left flotation device for the right and left feet of a rider.

FIG. 62A is a side view of another useful embodiment of a thrust assembly comprising a right 6200 and left flotation device for the right 6201 and left feet, respectively, of a rider 6202. Only the right flotation device 6200 is provided in this figure. The rider 6202 may stand on a foot support 6203 on the flotation device 6200. Each flotation device, such as the right flotation device 6200, comprises one or more fins 6204 which may be extended into the water by the rider 6202 to provide "traction" during a thrust phase, or retracted during a recovery phase. During the recovery phase, the rider 6202 retracts the fins 6204 so the associated flotation device 6200 may glide along the surface of the water. In typical operation, the rider may pull rearward 6205 on a right handle 6206 that controls the fins 6204 of the right flotation device 6200 to extend 6207 them into the water to hold the right flotation device relatively stationary at that location in the water (see also FIG. 62B). The rider simultaneously pushes forward on the left handle that retracts the fins of the left flotation device from the water. While the rider pushes the left handle forward, they also push their left foot forward relative to their right foot 6201, causing the left flotation device to glide forward on the water, since the left flotation device has its fins retracted, while the right flotation device 6200 doesn't move much since its fins are extended. The handle 6206 may be connected to the fins 6204 by a lever 6208 that rotates about a revolute joint 6209, where counterclockwise rotation of the lever extends the fins 6204 into the water, and clockwise rotation of the lever 6204 retracts the fins from the water.

Figure 62B:
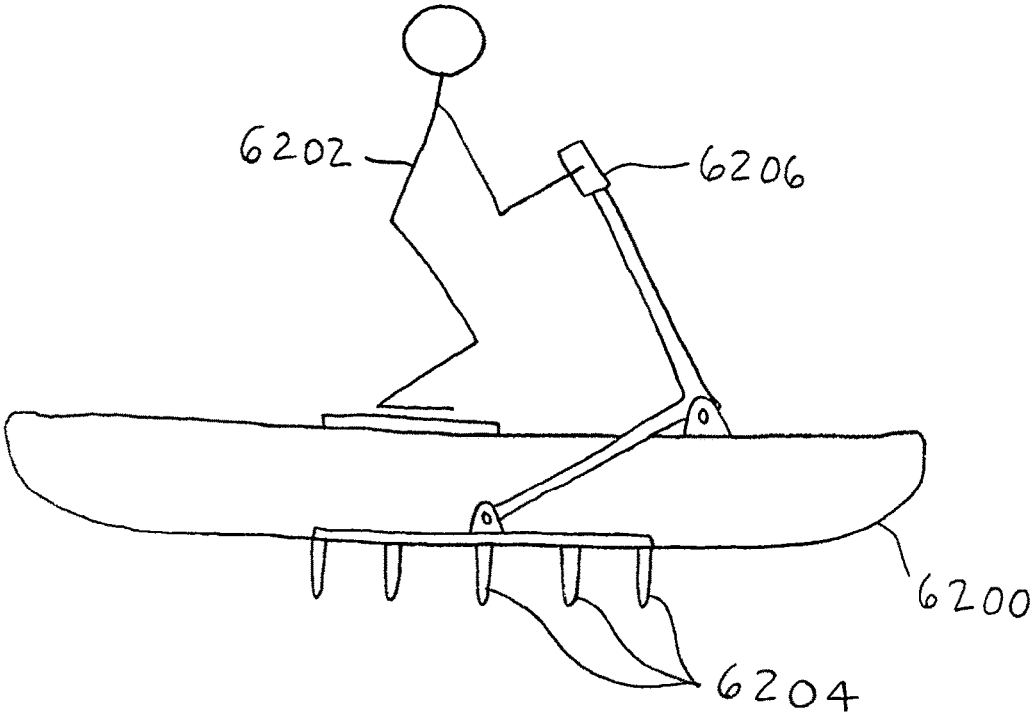
FIG. 62B is a side view of the useful embodiment of the thrust assembly of FIG. 62A.

FIG. 62B is a side view of the useful embodiment of the thrust assembly of FIG. 62A, where the rider 6202 already pulled rearward on the right handle 6206 that controls the fins 6204 of the right flotation device 6200 to extend them into the water to hold the right flotation device 6200 relatively stationary at that location in the water.

The drawings and descriptions provided are intended to illustrate a variety of important elements of the invention, including components, assemblies, sub-assemblies, features, and the like. The elements provided are not intended to be limited only to the drawing in which they are shown. For clarity of the drawings, and so only a finite set of drawings are needed to exemplify the various elements of the invention, elements are included in some drawings and not in others to illustrate the different elements; however, the invention includes that elements in the drawings may be interchanged and or combined with elements in other drawings. For instance, the steering assembly in one drawing may be combined with the rudder assembly of another drawing, which may be combined with a braking assembly of another drawing, which may be combined with a paddle assembly from another drawing, which may be combined with the mechanical or electrical control from another drawing, and the like. Input controls may mechanically or electrically control output movement. Furthermore, the assemblies may be for attaching to an SUP at the factory, or the assemblies may be for attachment to a generic SUP already owned by the rider, i.e., retrofit. When paddle blades are used to provide thrust, a paddle blade may provide thrust by moving along the side of the SUP, moving under the SUP, moving through one or more openings in the SUP, or a combination.

All publications and patent applications cited in this specification are herein incorporated by reference as if each individual publication or patent application were specifically and individually indicated to be incorporated by reference.

Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

What is claimed is:

1. A thrust assembly comprising:

a mounting structure for removable attachment to a standard standup paddle board (SUP) and configured for removable attachment to a hand carrying structure of said SUP;

a support supported by said mounting structure for supporting a foot; and a thrust member for applying force against water and propelling said SUP when said support is moved.

2. The thrust assembly according to claim 1, wherein said support is for supporting a right foot, and said support is configured for positioning on the right side of said mounting structure;

said thrust assembly further comprising a left support supported by said mounting structure for supporting a left foot, and a left thrust member for applying force against said water and propelling said SUP when said left support is moved;

wherein said left support is configured for positioning on the left side of said mounting structure; and wherein said mounting structure includes a protruding member for extending into a cavity of said hand carrying structure.

3. The thrust assembly according to claim 1, wherein said thrust member comprises at least one from the group consisting of a propeller, a bellows, an impeller, and a pump.

4. The thrust assembly according to claim 2, wherein each of said thrust members includes at least one from the group consisting of a fin, a flipper, and a paddle not a paddle wheel; and wherein said thrust assembly is for constraining said supports to move down and up in opposite directions to each other, where moving one of said supports down moves the corresponding said thrust member down to propel said SUP and moves the other said support and corresponding thrust member up.

5. The thrust assembly according to claim 4, wherein said thrust assembly includes a pulley for said constraining.

6. The thrust assembly according to claim 1, wherein said mounting structure includes a linear guide beneath said support and for guiding said support; and wherein said thrust assembly is for controlling the position, orientation, or movement of said thrust member.

7. The thrust assembly according to claim 1, wherein said mounting structure includes a linear guide including a linear bearing for guiding said support forward and rearward; and wherein said thrust member includes at least one from the group consisting of a paddle, a fin, a flipper, a paddle wheel, a propeller, a bellows, an impeller, and a pump.

8. The thrust assembly according to claim 1, wherein said mounting structure includes a handle for braking said SUP or for controlling said thrust member.

9. The thrust assembly according to claim 1, wherein said removable attachment does not require modifying said SUP.

10. The thrust assembly according to claim 1, wherein said mounting structure includes a handle for steering or braking said SUP, for controlling said thrust member, for balance, or for pressing against; and wherein said handle includes a Bowden cable, a linkage, or a wireless control for controlling an electric actuator.

11. The thrust assembly according to claim 1 further comprising a rudder assembly configured for removable attachment to the rear-fin slot of said SUP, wherein said mounting structure includes a handle for steering; and wherein said rudder assembly includes a rudder steerable by said handle.

12. The thrust assembly according to claim 11, wherein said rudder assembly further includes a brake fin controlled by said handle for braking said SUP.

13. The thrust assembly according to claim 4, wherein a first said thrust member is for attaching to a first said support, said attaching including attachment structure extending over a side edge of a right or left side of said SUP for positioning said first said thrust member in at least one position from the group consisting of (a) over water and to said side of said SUP;

(b) in water and to said side of said SUP;

(c) in water and partially under said side edge of said SUP; and (d) in water and entirely under said SUP.

14. The thrust assembly according to claim 1, wherein said mounting structure includes a seat with backrest.

15. A personal watercraft comprising:

a right buoyant member comprising a right thrust assembly including a right support for supporting a right foot, said right thrust assembly further including a right thrust member for applying force against water;

a left buoyant member comprising a left thrust assembly including a left support for supporting a left foot, said left thrust assembly further including a left thrust member for applying force against said water;

wherein said right and left buoyant members are moveable relative to each other; and wherein when said right and left supports are moved forward and rearward said right and left thrust members propel said personal watercraft in said water.

16. The personal watercraft according to claim 15 further comprising a handle for braking said personal watercraft or for controlling said right or said left thrust member.

17. A personal watercraft comprising:

a single buoyant member;

a support for supporting a foot;

a guide for guiding said support to move only forward and rearward; and a thrust member for propelling said buoyant member in water when said support is moved forward or rearward;

wherein said guide is positioned in an opening in said single buoyant member, said opening completely surrounded by said single buoyant member.

18. The personal watercraft according to claim 17 further comprising:

a second support for supporting a second foot;

a second guide for guiding said second support to move only forward and rearward; and a second thrust member for propelling said buoyant member in said water when said second support is moved forward or rearward;

wherein each of said guides includes a linear guide including a linear bearing; and wherein each of said supports includes an attachment for releasably securing one of said feet.

19. The personal watercraft according to claim 18 further comprising a handle for braking said personal watercraft or for controlling a said thrust member.

20. The personal watercraft according to claim 17 further comprising a handle for steering or braking said personal watercraft, for controlling a said thrust member, for balance, or for pressing against, wherein said handle includes a Bowden cable, a linkage, or a wireless control for controlling an electric actuator.

* * * * *